United States Patent [19]

Amada et al.

[11] Patent Number: 4,954,397

[45] Date of Patent: Sep. 4, 1990

[54] LIGHT RECEIVING MEMBER HAVING A DIVIDED-FUNCTIONALLY STRUCTURED LIGHT RECEIVING LAYER HAVING CGL AND CTL FOR USE IN ELECTROPHOTOGRAPHY

[75] Inventors: Hiroshi Amada; Tatsuyuki Aoike; Takehito Yoshino, all of Nagahama; Ryuji Okamura, Shiga, all of Japan

[73] Assignee: Canon Kabushiki Kaisha, Tokyo, Japan

[21] Appl. No.: 423,680

[22] Filed: Oct. 18, 1989

Related U.S. Application Data

[63] Continuation of Ser. No. 111,768, Oct. 23, 1987, abandoned.

[30] Foreign Application Priority Data

| | | | |
|---|---|---|---|
| Oct. 27, 1986 | [JP] | Japan | 61-255114 |
| Oct. 29, 1986 | [JP] | Japan | 61-258946 |
| Oct. 31, 1986 | [JP] | Japan | 61-261153 |
| Nov. 1, 1986 | [JP] | Japan | 61-261129 |
| Nov. 4, 1986 | [JP] | Japan | 61-262451 |
| Nov. 5, 1986 | [JP] | Japan | 61-264351 |
| Nov. 6, 1986 | [JP] | Japan | 61-264293 |
| Nov. 7, 1986 | [JP] | Japan | 61-266315 |

[51] Int. Cl.[5] ..... G03G 5/085

[52] U.S. Cl. ..... 430/58; 430/63; 430/65; 430/84; 430/95

[58] Field of Search ..... 430/57, 58, 63, 65, 430/67, 84, 85, 95

[56] References Cited

U.S. PATENT DOCUMENTS

| | | | |
|---|---|---|---|
| 4,418,132 | 11/1983 | Yamazaki | 430/57 |
| 4,732,834 | 3/1988 | Honda et al. | 430/57 |
| 4,738,913 | 4/1988 | Shirai et al. | 430/63 |
| 4,751,192 | 6/1988 | Hirooka et al. | 437/4 |

*Primary Examiner*—John L. Goodrow

*Attorney, Agent, or Firm*—Fitzpatrick, Cella, Harper & Scinto

[57] ABSTRACT

An improved light receiving member for use in electrophotography having a light receiving layer provided with a charge carrier generation layer (hereinafter referred to as "CGL") and a charge carrier transport layer (hereinafter referred to as "CTL"), the CGL being formed of a non-single-crystal material composed substantially of silicon atom as the main constituent atom and at least one kind selected from hydrogen atom and halogen atom and the CTL being formed of a Non-Si(H,X) material containing carbon atom and a conductivity controlling element selected from the group consisting of boron, aluminum, gallium, indium and thallium belonging to group III of the Periodic Table or from the group consisting of phosphorus, arsenic, antimony and bismuth belonging to group V of the Periodic Table in an uneven state in the thicknesswise direction, and optionally at least one kind selected from oxygen atom and nitrogen atom in this order from the side of a substrate.

The above light receiving member is that electrical, optical and photoconductive properties are always substantially stable scarcely depending on the working circumstances, that is excellent against optical fatigue, causes no degreadation upon repeating use and that is excellent in durability and moisture-proofness and exhibits no or scarce residual potential.

44 Claims, 37 Drawing Sheets

(C)

(D)

(E)

(F)

(G)

(H)

(A)

(B)

(C)

Diversification patterns of gas flow rates in forming the CTL

Diversification patterns of gas flow rates in forming the CTL

Diversification patterns of gas flow rates in forming the CTL

Diversification patterns of gas flow rates in forming the CTL

Diversification patterns of gas flow rates in forming the CTL

Diversification patterns of gas flow rates in forming the CTL

Diversification patterns of gas flow rates in forming the CTL

Diversification patterns of gas flow rates in forming the CTL

Diversification patterns of gas flow rates in forming the CTL

Diversification patterns of gas flow rates in forming the CTL

LIGHT RECEIVING MEMBER HAVING A DIVIDED-FUNCTIONALLY STRUCTURED LIGHT RECEIVING LAYER HAVING CGL AND CTL FOR USE IN ELECTROPHOTOGRAPHY

This application is a continuation of application Ser. No. 111,768 filed Oct. 23, 1987, now abandoned.

FIELD OF THE INVENTION

This invention relates to an improved light receiving member for use in electrophotography which is sensitive to electromagnetic waves such as light (which herein means in a broader sense those lights such as ultra-violet rays, visible rays, infrared rays, X-rays and γ-rays).

BACKGROUND OF THE INVENTION

For the photoconductive material to consitute a light receiving layer in a light receiving member for use in electrophotography, it is required to be highly sensitive, to have a high SN ratio [photocurrent (Ip)/dark current (Id)], to have absorption spectrum characteristics suited for the spectrum characteristics of an electromagnetic wave to be irradiated, to be quickly responsive and to have a desired dark resistance. It is also required to be not harmful to living things as well as man upon use.

Especially, in the case where it is the light receiving member to be applied in an electrophotographic machine for use in office, causing no pollution is indeed important.

From these standpoints, the public attention has been focused on light receiving members having a light receiving layer comprised of an amorphous material containing silicon atoms (hereinafter referred to as "A-Si"), for example, as disclosed in Offenlegungsschriftes Nos. 2746967 and 2855718 which disclose use of such light receiving member as an image-forming member in electrophotography.

For the conventional light receiving members having a light receiving layer comprised of A-Si material, there have been made improvements in their optical, electric and photoconductive characteristics such as dark resistance, photosensitivity, and photoresponsiveness, use-environmental characteristics, economic stability and durability.

However, there are still left subjects to make further improvements in their characteristics in the synthesis situation in order to make such light receiving member practically usable.

For example, in the case where such conventional light receiving member is employed as a light receiving member for use in electrophotography with aiming at heightening the photosensitivity and dark resistance, there are often observed a residual potential on the conventional light receiving member upon the use, and when it is repeatedly used for a long period of time, fatigue due to the repeated use will be accumulated to cause the so-called ghost phenomena inviting residual images.

Further, in the preparation of the light receiving layer of the conventional light receiving member for use in electrophotography using an A-Si material, hydrogen atoms, halogen atoms such as fluorine atoms or chlorine atoms, elements for controlling the electrical conduction type such as boron atoms or phosphorus atoms, or other kinds of atoms for improving the characteristics are selectively incorporated in the light receiving layer.

However, the resulting light receiving layer sometimes is accompanied with defects on electrical characteristics, photoconductive characteristics and/or breakdown voltage resistance depending upon the way the constituents to are employed.

That is, in the case of using the light receiving member having such light receiving layer, there often occur problems that the life of a photocarrier generated in the layer upon irradiation of light is not sufficient, inhibition of a charge injection from the side of the substrate in a dark layer region is not sufficiently carried out, and image defects likely due to a local breakdown phenomenon which is so-called "white oval marks on half-tone copies" or other image defects likely due to abrasion upon using a blade for the cleaning which is so-called "white line" are apt to appear on the transferred images on a paper sheet.

Further, in the case where the above light receiving member is used in a very moist atmosphere, or in the case where after being placed in that atmosphere it is used, the so-called "image flow" sometimes appears on the transferred images on a paper sheet.

In consequence, it is necessary to make further improvements not only in an A-Si material itself but also in the layer constitution, chemical composition for each constituent layer and preparation method in order to overcome the foregoing problems.

SUMMARY OF THE INVENTION

The object of this invention is to provide a light receiving member for use in electrophotography which has a light receiving layer mainly composed of A-Si, free from the foregoing problems and capable of satisfying various kinds of requirements in electrophotography.

That is, the main object of this invention is to provide a light receiving member for use in electrophotography which has a light receiving layer formed of a silicon containing amorphous material, that electrical, optical and photoconductive properties are always substantially stable generally independent of the working circumstances, that is excellent against optical fatigue, causes no degradation upon repeating use and that is excellent in durability and moisture-proofness and exhibits no or scarce residual potential.

Another object of this invention is to provide a light receiving member for use in electrophotography which has a light receiving layer formed of a silicon containing amorphous material which is excellent in the adhesion with a substrate on which the layer is disposed or between the layers laminated, dense and stable in view of the structural arrangement and is of high quality.

A further object of this invention is to provide a light receiving member for use in electrophotography which has a light receiving layer formed of a silicon containing amorphous material which exhibits a sufficient chargemaintaining function in the charging process of forming electrostatic latent images and excellent electrophotographic characteristics when it is used in electrophotographic method.

A still further object of this invention is to provide a light receiving member for use in electrophotography which has a light receiving layer formed of a silicon containing amorphous material which invites neither an image defect nor an image flow on the resulting visible images on a paper sheet upon repeated use in a long period of time and which gives highly resolved visible images with clearer half-tone which are highly dense and quality.

Other object of this invention is to provide a light receiving member for use in electrophotography which has a light receiving layer formed of a silicon containing amorphous material which has a high photosensitivity, high S/N ratio and high electrical voltage withstanding property.

The present inventors have made earnest studies for overcoming the foregoing problems on the conventional light receiving members for use in electrophotography and attaining the objects as described above and, as a result, has accomplished this invention based on the finding as described below. That is, the present inventors have found that the above objects of this invention can be desirably attained by the provision of a light receiving layer constituted with a charge carrier generation layer (hereinafter referred to as "CGL") and a charge carrier transport layer (hereinafter referred to as "CTL"), the CGL being formed of a non-single-crystal material composed substantially of silicon atoms as the main constituent atoms and at least one kind selected from hydrogen atoms and halogen atoms [hereinafter referred to as "Non-Si(H,X)"] and the CTL being formed of a Non-Si(H,X) material containing carbon atoms and a conductivity controlling element selected from the group consisting of boron, aluminum, gallium, indium and thallium belonging to group III of the Periodic Table (hereinafter referred to as "the group III atom") or from the group consisting of phosphorus, arsenic, antimony and bismuth belonging to group V of the Periodic Table (hereinafter referred to as "the group V atom") in an uneven state in the thicknesswise direction, and optionally at least one kind selected from oxygen atoms and nitrogen atoms hereinafter, the non-single-crystal material to constitute the CTL being referred to as "Non-SiMC(O,N)(H,X)", wherein M stands for the above-mentioned selected group III atom or the group V atom) in this order from the side of a substrate.

Therefore, in one specific embodiment of this invention there is provided an improved light receiving member for use in electrophotography comprised of a substrate, and thereover a light receiving layer constituted the CGL and the CTL in this order from the side of the substrate. In second specific embodiment of this invention there is provided an improved light receiving member for use in electrophotography comprised of a substrate, and thereover a light receiving layer constituted by a charge injection inhibition layer formed of a non-single-crystal silicon containing material (hereinafter referred to as "Non-Si material") containing a conductivity controlling element (hereinafter referred to as "MO") and at least one kind selected from hydrogen atoms and halogen atoms (hereinafter referred to as "Non-SiMo(H,X) material"), a Non-Si material containing at least one kind selected from carbon atoms, oxygen atoms and nitrogen atoms (hereinafter referred to as "Non-Si(C,O,N) material") or a Non-Si(C,O,N) material containing at least one kind selected from the group consisting of hydrogen atoms and halogen atoms and a conductivity controlling element (Mo) (hereinafter referred to as Non-Si(C,O,N)(H,X,Mo), the CGL and the CTL in this order from the side of the substrate. In third specific embodiment of this invention there is provided an improved light receiving member for use in electrophotography comprised of a substrate, and thereover a light receiving layer constituted by one or more kinds selected from the above-mentioned charge injection inhibition layer and an infrared absorption layer (hereinafter referred to as "IR absorption layer") formed of a non-single-crystal material containing germanium atoms and/or tin atoms, optionally silicon atoms, and at least one kind selected from hydrogen atoms and halogen atoms (hereinafter referred to as "Non-(Ge,Sn)-(Si)(H,X) material"), the CGL and the CTL in this order from the side of the substrate. In fourth specific embodiment of this invention there is provided an improved light receiving layer for use in electrophotography that has a surface layer formed of a Non-Si (C,O,N)(H,X) material being placed on the CTL in any of the above-mentioned light receiving member.

The light receiving member for use in electrophotography having the above-mentioned light receiving layer according to this invention is free from the foregoing problems on the conventional light receiving members for use in electrophotography, has a wealth of practically applicable excellent electric, optical and photoconductive characteristics and is accompanied with an excellent durability and satisfactory use environmental characteristics.

In addition, the light receiving member for use in electrophotography of this invention has a high photosensitivity against light in the visible region and an improved photoresponse property.

Further, the light receiving member for use in electrophotography according to this invention has substantially stable electric characteristics without depending on the working circumstances, maintains a high photosensitivity and a high S/N ratio and does not invite any undesirable influence due to residual potential even when it is repeatedly used for along period of time. In addition, it has sufficient moisture resistance and optical fatigue resistance, and causes neither degradation upon repeating use nor any defect of breakdown voltage. Because of this, according to the light receiving member for use in electrophotography of this invention, even upon repeated use for a long period of time, a highly resolved visible image with a clear half tone which is in a highly dense and quality can be stably obtained.

In view of the above, the light receiving member for use in electrophotography is suited for use in the image-making based on a digital signal and makes it possible to repeatedly and stably obtain a highly resolved desired image of high quality at high speed.

Furthermore, since the light receiving layer of the light receiving member for use in electrophotography according to this invention is of a divided-functional structure comprised of the specific CGL to serve for generation of a charge carrier and the specific CTL to serve for transport of said photocarrier, the freedom in designing the layer composition becomes large and the resultant becomes accompanied with desired many practically applicable characteristics. It is possible for the CTL to reduce a relative dielectric constant because it contains at least one kind selected from carbon atoms, oxygen atoms and nitrogen atoms. In addition to this, it becomes possible not only to reduce the capacity per the thickness of a constituent layer but also to improve the charge-retentivity and photosensitivity.

There are further advantages that the breakdown voltage resistance and durability are improved. Further in addition, because the CTL contains the foregoing selected conductivity controlling element in an uneven state in the thicknesswise direction, the CTL may be so designed as to have a desired charge carrier transporting ability depending upon the requirements therefor.

Other than the above, for the light receiving member for use in electrophotography according to this invention, the state of a charge to be injected at the interface between the CGL and the CTL is remarkably improved so that the problems relative to charge-retentivity, photosensitivity, residual potential, ghost, uneven density caused by sensitivity shift, durability and resolution power which are found on the conventional light receiving member for use in electrophotography are desirably eliminated.

In the case where the light receiving layer of the light receiving member for use in electrophotography according to this invention has the foregoing IR absorption layer the foregoing charge injection inhibition layer either between the substrate and the CGL or between the substrate and the foregoing charge injection inhibition layer, part of long wavelength light remained unabsorbed during from the incident surface side through the substrate is efficiently absorbed by the IR absorption layer to thereby sufficiently prevent the occurrence of undesirable interference phenomena caused by reflection of such long wavelength light at the surface of the substrate which is found on the conventional light receiving member for use in electrophotography. Because of this, the quality of an image obtained is highly improved.

In the case where the light receiving layer of the light receiving member for use in electrophotography according to this invention has the foregoing surface layer, there are various advantages that the mechanical strength and breakdown voltage resistance are further improved, injection of a charge from the free surface of the light receiving layer at the time of being engaged in charging process is effectively prevented, and the charge retentivity, use-environmental characteristic, durability and breakdown voltage resistance are remarkably improved.

BRIEF DESCRIPTION OF THE DRAWINGS

For a better understanding of this invention and further features thereof, reference is made to the following detailed description of various preferred embodiments wherein.

DETAILED DESCRIPTION OF THE INVENTION

Figure 1:
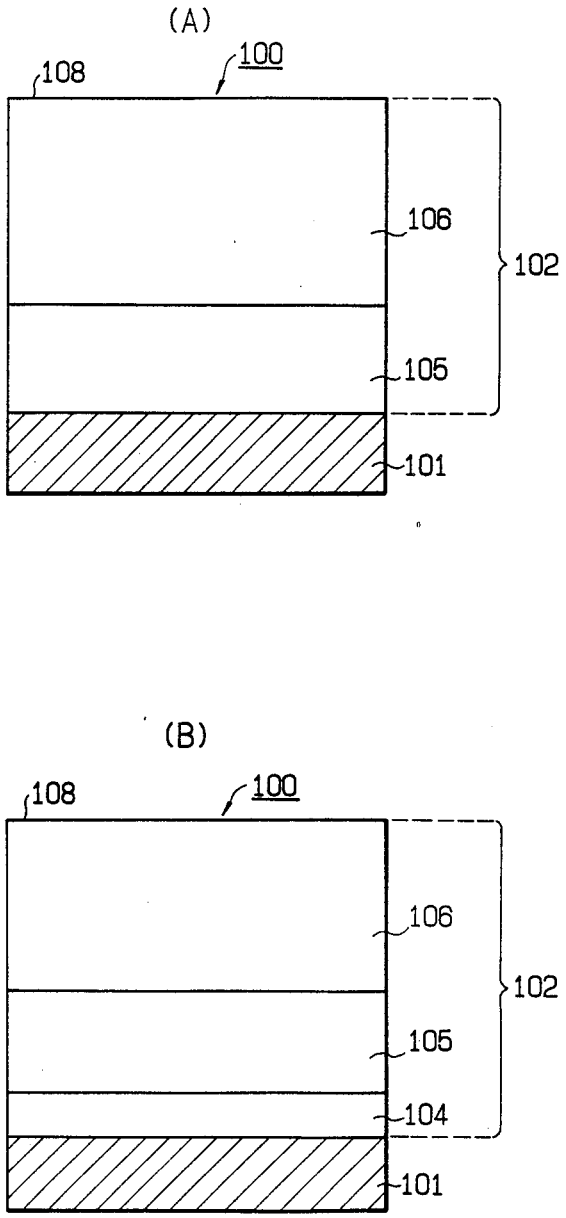
FIG. 1(A) through FIG. 1(H) are partially schematic cross-sectional views illustrating the typical layer constitution of a representative light receiving member for use in electrophotography according to this invention.
Figure 1:
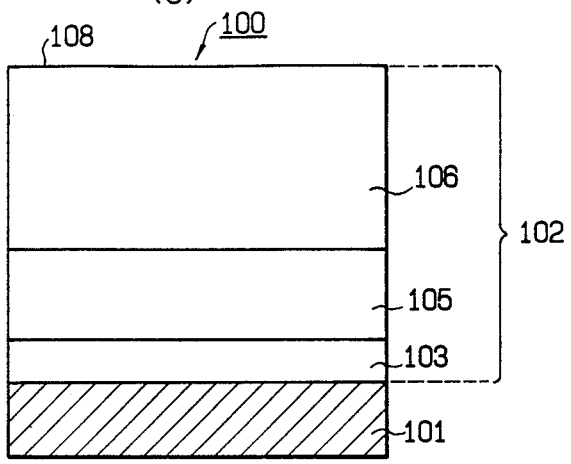
Figure 1:
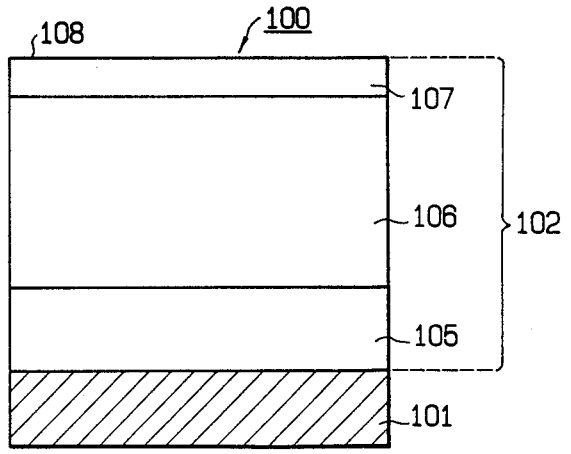
Figure 1:
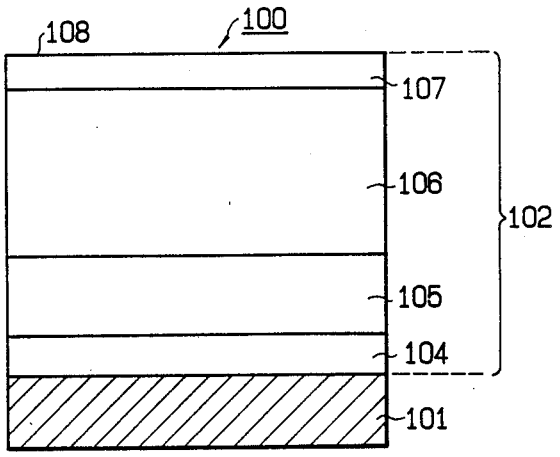
Figure 1:
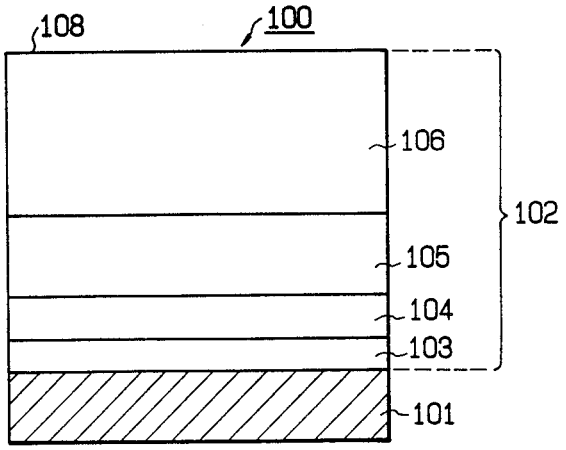
Figure 1:
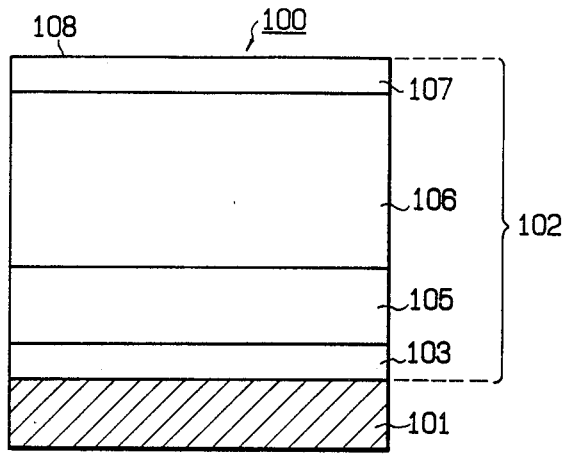
Figure 1:
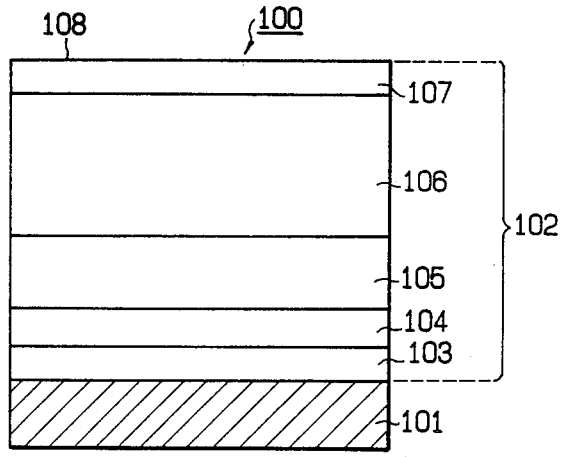

Representative embodiments of the light receiving member for use in electrophotography according to this invention will now be explained more specifically referring to the drawings. The description is not intended to limit the scope of this invention.

Representative light receiving members for use in electrophotography according to this invention are as shown in FIG. 1(A) through FIG. 1(H), in which are shown a light receiving member 100 and a light receiving layer 102 having a CGL 105 consisting substantially of the foregoing Non-Si(H,X) material and a CTL 106 which is composed of the foregoing Non-SiCM(O,N) material. Illustrated in FIG. 1(A) is a typical representative light receiving member for use in electrophotography according to this invention comprised of the substrate 101 and a light receiving layer 102 constituted by the CGL 105 and the CTL 106 having a free surface 108.

Illustrated in FIG. 1(B) is another representative light receiving member for use in electrophotography according to this invention comprised of the substrate 101 and a light receiving layer 102 constituted by a charge injection inhibition layer 104, the CGL 105 and the CTL having a free surface 108.

Illustrated in FIG. 1(C) is another representative light receiving member for use in electrophotography according to this invention comprised of the substrate 101 and a light receiving layer 102 constituted by an IR absorption layer 103, the CGL 105 and the CTL 106 having a free surface 108.

Illustrated in FIG. 1(D) is another representative light receiving member for use in electrophotography according to this invention comprised of the substrate 101 and a light receiving layer 102 constituted by the CGL 105, the CTL 106 and a surface layer 107 having a free surface 108.

Illustrated in FIG. 1(E) is another representative light receiving member for use in electrophotography according to this invention comprised of the substrate 101 and a light receiving layer 102 constituted by the charge injection inhibition layer 104, the CGL 105, the CTL 106 and the surface layer 107 having a free surface 108.

Illustrated in FIG. 1(F) is another representative light receiving member for use in electrophotography according to this invention comprised of the substrate 101 and a light receiving layer 102 constituted by the IR absorption layer 103, the charge injection inhibition layer 104, the CGL 105 and the CTL 106 having a free surface 108.

Illustrated in FIG. 1(G) is another representative light receiving member for use in electrophotography according to this invention comprised of the substrate 101 and a light receiving layer 102 constituted by the IR absorption layer 103, the CGL 105, the CTL 106 and the surface layer 107 having a free surface 108.

Illustrated in FIG. 1(H) is another representative light receiving member for use in electrophotography according to this invention comprised of the substrate 101 and a light receiving layer 102 constituted by the IR absorption layer 103, the charge injection inhibition layer 104, the CGL 105, the CTL 106 and the surface layer 107 having a free surface 108.

Now, explanation will be made for the substrate and each constitutent layer in the light receiving member of this invention.

Substrate 101 (or 501)

The substrate 101 for use in this invention may either be electroconductive or insulative. The electroconductive substrate can include, for example, metals such as NiCr, stainless steels, Al, Cr, Mo, Au, Nb, Ta, V, Ti, Pt and Pb or the alloys thereof.

The electrically insulative substrate can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and deposited with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $SnO_2$, ITO ($In_2O_3+SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vacuum deposition, electron beam vapor deposition, sputtering, etc., or applying lamination with the metal to the surface. The substrate may be of any configuration such as cylindrical, belt-like or plate-like shape, which can be properly determined depending on the application uses.

The thickness of the support member is properly determined so that the light receiving member as desired can be formed.

In the case where flexibility is required for the light receiving member, it can be made as thin as possible within a range capable of sufficiently providing the function as the substrate. However, the thickness is usually greater than 10 μm in view of the fabrication and handling or mechanical strength of the substrate.

And, it is possible for the surface of the substrate to be uneven in order to eliminate occurrence of defective images caused by a so-called interference fringe pattern being apt to appear in the formed images in the case where the image formation is carried out using coherent monochromatic light such as laser beams.

In that case, the uneven surface shape of the substrate can be formed by the grinding work with means of an appropriate cutting tool, for example, having a V-form bite.

That is, said cutting tool is firstly fixed to the predetermined position of milling machine or lathe, then, for example, a cylindrical substrate is moved regularly in the predetermined direction while being rotated in accordance with the predetermined program to thereby obtain a surface-treated cylindrical substrate of a surface having irregularities in reverse V-form with a desirably pitch and depth.

The irregularities thus formed at the surface of the cylindrical substrate form a helical structure along the center axis of the cylindrical substrate. The helical structure of making the reverse V-form irregularities of the surface of the cylindrical substrate may be double or treble. Or otherwise, it may be of a cross-helical structure.

Further, the irregularities at the surface of the cylindrical substrate may be composed of said helical structure and a delay line formed along the center axis of the cylindrical substrate. The cross-sectional form of the convex of the irregularity formed at the substrate surface is in a reverse V-form in order to attain controlled unevenness of the layer thickness in the minute column for each layer to be formed and secure desired adhesion and electric contact between the substrate and the layer formed directly thereon.

Figure 2:
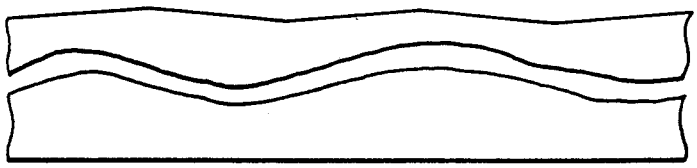
FIG. 2(A) through FIG. 2(C) are partially schematic cross-sectional views illustrating examples of the shape at the surface of the substrate in the light receiving member for use in electrophotography according to this invention.
Figure 2:
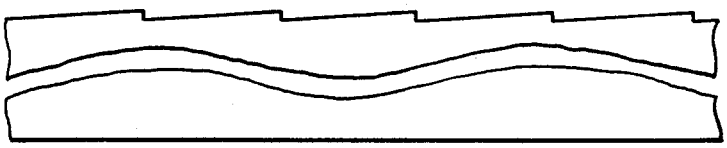
Figure 2:
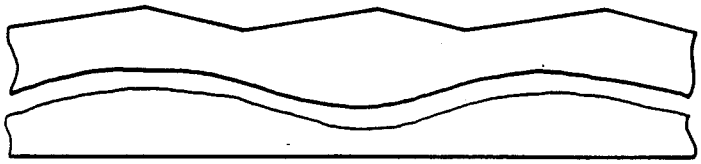

And it is desirable for the reverse V-form to be an equilateral triangle, right-angled triangle or inequilateral triangle as shown in FIG. 2(A) through FIG. 2(C). Among these triangle forms, equilateral triangle form and right-angled triangle form are most preferred.

Each dimension of the irregularities to be formed at the substrate surface under the controlled conditions is properly determined having a due regard on the following points.

That is, firstly, a layer composed of A-Si(H,X) to constitute a light receiving layer, for instance, is structurally sensitive to the surface state of the layer to be formed and the layer quality is apt to largely change in accordance with the surface state.

Therefore, it is necessary for the dimension of the irregularity to be formed at the substrate surface to be determined not to invite any decrease in the layer quality of the layer composed of A-Si(H,X).

Secondly, should there exist extreme irregularities on the free surface of the light receiving layer, cleaning in the cleaning process after the formation of visible images becomes difficult to sufficiently carry out. In addition, in the case of carrying out the cleaning with a blade, the blade will be soon damaged.

From the viewpoints of avoiding the problems in the layer formation and the electrophotographic processes, and from the conditions to prevent occurrence of the problems due to interference fringe patterns, the pitch of the irregularity to be formed at the substrate surface is preferably 0.3 to 50 μm, more preferably 1 to 200 μm, and, most preferably, 5.0 to 50 μm.

As for the maximum depth of the irregularity, it is preferably 0.1 to 5.0 μm, more preferably 0.3 to 3.0 μm, and, most preferably, 0.6 to 2.0 μm.

And when the pitch and the depth of the irregularity lie respectively in the above-mentioned range, the inclination of the slope of the dent (or the linear convex) of the irregularity is preferably 1° to 20°, more preferably 3° to 15°, and, most preferably, 4° to 10°.

Further, as for the maximum figure of a thickness difference based on the ununiformity in the layer thickness of each layer to be formed on such substrate surface, in the meaning within the same pitch, it is preferably 0.1 to 2.0 μm, more preferably 0.1 to 1.5 μm, and, most preferably, 0.2 μm to 1 μm.

In alternative, the irregularity at the substrate surface may be composed of a plurality of fine spherical dimples which are more effective in eliminating the occurrence of defective images caused by the interference fringe patterns especially in the case of using coherent monochromatic light such as laser beams.

In that case, the scale of each of the irregularities composed of a plurality of fine spherical dimples is smaller than the resolving power required for the light receiving member for use in electrophotography.

Figure 3:
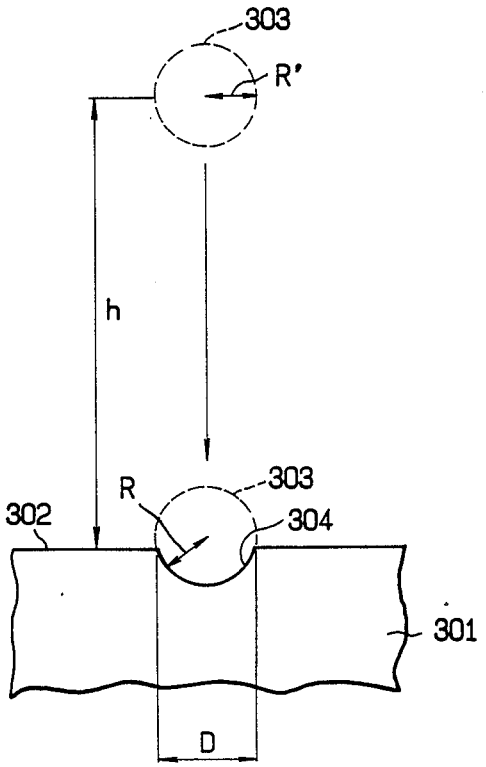
FIGS. 3 and 4 are schematic explanatory views of a preferred method for preparing a substrate having a desirable surface suited as the substrate in the light receiving member for use in electrophotography according to this invention.
Figure 4:
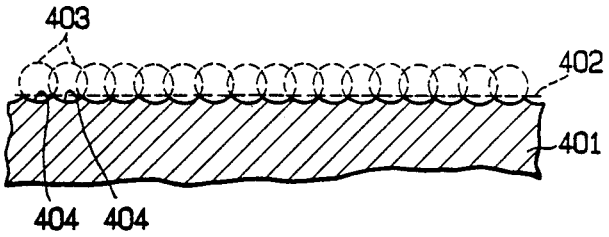

A typical method of forming the irregularities composed of a plurality of fine spherical dimples at the substrate surface will be hereunder explained referring to FIG. 3 and FIG. 4.

FIG. 3 is a schematic view for a typical example of the shape at the surface of the substrate in the light receiving member for use in electrophotography according to this invention, in which a portion of the uneven shape is enlarged. In FIG. 3, there are shown a substrate 301, a substrate surface 302, a rigid true sphere 303, and a spherical dimple 304.

FIG. 3 also shows a preferred method of preparing the surface shape as mentioned above. That is, the rigid true sphere 303 is caused to fall gravitationally from a position at a predetermined height above the substrate surface 302 and collides against the substrate surface 302 to thereby form the spherical dimple 304. A plurality of fine spherical dimples 304 each substantially of an identical radius of curvature R and of an identical width D can be formed to the substrate surface 302 by causing a plurality or rigid true spheres 303 substantially of an identical diameter R' to fall from identical height h simultaneously or sequentially.

FIG. 4 shows a typical embodiment of a substrate formed with the uneven shape composed of a plurality of spherical dimples at the surface as described above.

In the embodiment shown in FIG. 4, a plurality of dimples pits 404, 404 . . . substantially of an identical radius of curvature and substantially of an identical width are formed while being closely overlapped with each other thereby forming an uneven shape regularly by causing to fall a plurality of spheres 403, 403, . . . regularly and substantially from an identical height to different positions at the surface 402 of the substrate 401. In this case, it is naturally required for forming the dimples 404, 404, . . . overlapped with each other that the spheres 403, 403, . . . are graviationally dropped such that the times of collision of the respective spheres 403 to the support 402 and displaced from each other.

By the way, the radius of curvature R and the width D of the uneven shape formed by the spherical dimples at the substrate surface of the light receiving member for use in electrophotography according to this invention constitute an important factor for effectively attaining the advantageous effect of preventing occurrence of the interference fringe in the light receiving member for use in electrophotography according to this invention. The present inventors carried out various experiments and, as a result, found the following facts.

That is, if the radius of curvature R and the width D satisfy the following equation:

$$\frac{D}{R} \geqq 0.035$$

0.5 or more Newton rings due to the sharing interference are present in each of the dimples. Further, if they satisfy the following equation:

$$\frac{D}{R} \geqq 0.055$$

one or more Newton rings due to the sharing interference are present in each of the dimples. From the foregoing, it is preferred that the ratio D/R is greater than 0.035 and, preferably, greater than 0.055 for dispersing the interference fringes resulted throughout the light receiving member in each of the dimples thereby preventing occurrence of the interference fringe in the light receiving member.

Further, it is desired that the width D of the unevenness formed by the scraped dimple is about 500 μm at the maximum, preferably, less than 200 μm and, more preferably less than 100 μm.

Figure 5:
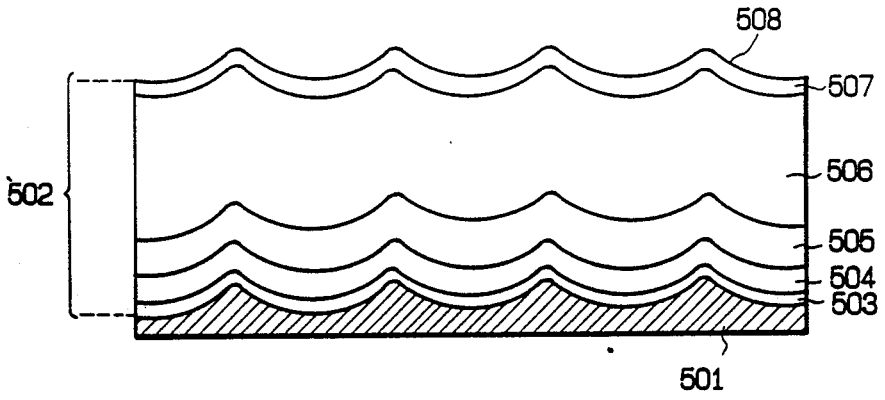
FIG. 5 is a partially schematic cross-sectional view illustrating a preferred example of the light receiving member for use in electrophotography according to this invention which has a light receiving layer having the layer constitution as shown in FIG. 1(H) on the substrate having a desirable surface prepared in accordance with the method shown in FIGS. 3 and 4.

Illustrated in FIG. 5 is a schematic view illustrating a desired embodiment of the light receiving member according to this invention in which is shown the light receiving member comprising the above-mentioned substrate 501 and the light receiving layer 502 constituted by an IR absorption layer 503, a charge injection inhibition layer 504, the CGL 505, the CTL 506 and a surface layer 507 having a free surface 508.

IR Absorption Layer 103 (or 503)

The IR absorption layer 103 (or 503) in the light receiving member for use in electrophotography according to this invention is composed of a non-single-crystal material containing at least one kind selected from germanium atoms (Ge) and tin atoms (Sn) hereinafter referred to as "atoms (Ge,Sn)", at least one kind selected from hydrogen atoms (H) and halogen atoms (X), and preferably silicon atoms (Si) also hereinafter referred to as "Non-(Ge,Sn)(Si)(H,X)" . For the atoms (Ge,Sn) to be contained in the IR absorption layer, they may be distributed uniformly in its entire layer region or unevenly in the direction toward the layer thickness of its entire layer region.

But in any case, it is necessary for the atoms (Ge,Sn) to be distributed uniformly in the direction parallel to the surface of the substrate in order to provide the uniformness of the characteristics to be brought out.

(Herein or hereinafter, the uniform distribution means that the distribution of related atoms in a layer is uniform both in the direction parallel to the surface of the substrate and in the thicknesswise direction. The uneven distribution means that the distribution of related atoms in a layer is uniform in the direction parallel to the surface of the substrate but is uneven in the thicknesswise direction).

That is, in the case where the atoms (Ge,Sn) are contained unevenly in the thicknesswise direction in the entire layer region the atoms (Ge,Sn) are so incorporated as to be in a distributed state that such atoms are more largely distributed in the layer region adjacent to the substrate than in the layer region apart from the substrate (namely in the layer region adjacent to the interface) or in a distributed state opposite to the above state.

In the light receiving member for use in electrophotography according to this invention, it is desired for the state of the atoms (Ge,Sn) to be contained in the IR absorption layer to be distributed in such state as above stated in thicknesswise direction, and in the direction parallel to the surface of the substrate, to be nonuniformly distributed.

In a preferred embodiment, the atoms (Ge,Sn) are being continuously distributed in the entire layer region with a concentration distribution being changed in a way of being decreased from the layer region adjacent to the substrate toward the layer region adjacent to the interface with the CGL or the charge injection inhibition layer. Because of this, the affinity of the IR absorption layer with the CGL or the charge injection inhibition layer becomes sufficient.

In addition, in the case where the distributing concentration of germanium atom is made significantly large in the extreme layer region of the IR absorption layer adjacent to the substrate, such long wavelength light remained unabsorbed during from the CTL through the CGL that is often observed in the case of using a semiconductor laser as the light source becomes absorbed substantially and completely by the IR absorption layer. As a result, occurrence of the interference caused by light reflection from the surface of the substrate can be effectively prevented.

Explanation will be made to the typical embodiments of the distribution of the atoms (Ge,Sn) to be contained unevenly in the thicknesswise direction of the IR absorption layer with reference to FIG. 6 through FIG. 11. However, this invention is not way limited only to these embodiments.

In FIGS. 6 through 11, the abscissa represent the distribution concentration C of the atoms (Ge,Sn) and the ordinate represents the thickness of the IR absorption layer; and $t_B$ represents the extreme position of the IR absorption containing the atoms (Ge,Sn). And the IR absorption layer is formed from the $t_B$ side toward the $t_T$ side.

Figure 6:
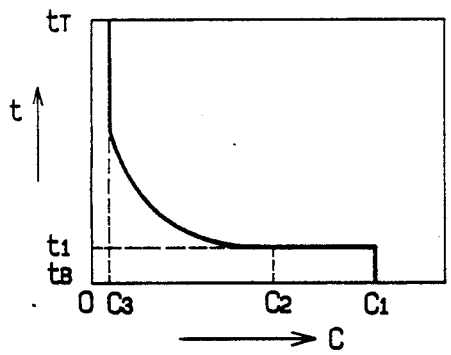
FIG. 6 through FIG. 11 are explanatory views illustrating a distribution state of germanium atom and tin atom in the IR absorption layer.

FIG. 6 shows the first typical example of the thicknesswise distribution of the atoms (Ge,Sn) in the IR absorption layer. In this example, the atoms (Ge,Sn) are distributed such that the concentration C remains constant at a value $C_1$ in the range from position $t_B$ to position $t_1$, and the concentration C gradually and continuously decreases from $C_2$ in the range from position $t_1$ to position $t_T$, where the concentration of the atoms (Ge,Sn) is $C_3$.

Figure 7:
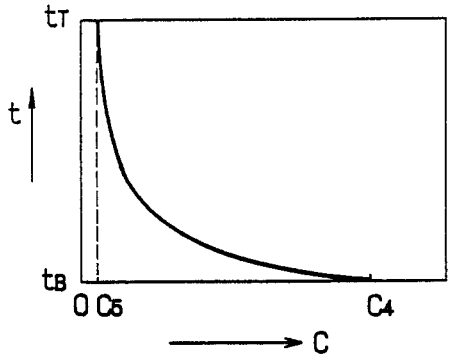

In the example shown in FIG. 7, the distribution concentration C of the atoms (Ge,Sn) contained in the IR absorption layer is such that concentration $C_4$ at position B continuously decreases to concentration $C_5$ at position $t_T$.

Figure 8:
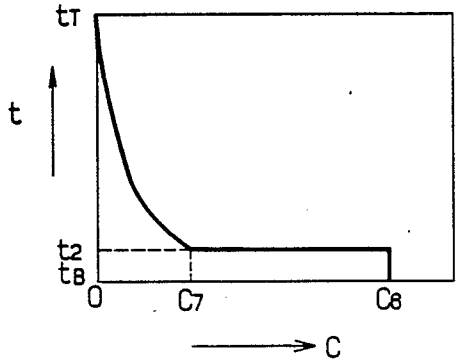

In the example shown in FIG. 8, the distribution concentration C of the atoms (Ge,Sn) is such that the concentration $C_6$ remains constant in the range from position $t_B$ and position $t_2$ and it gradually and continuously decreases from $C_7$ in the range from position $t_2$ and position $t_T$. The concentration at position $t_T$ is substantially zero. ("Substantially zero" means that the concentration is lower than the detectable limit.)

Figure 9:
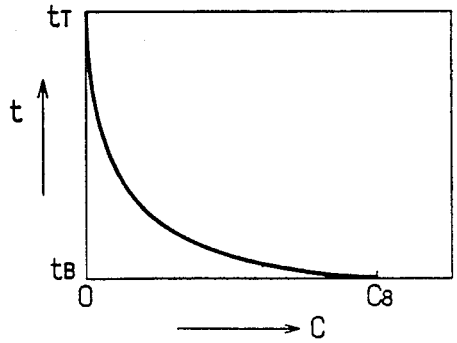

In the example shown in FIG. 9, the distribution concentration C of the atoms (Ge,Sn) is such that concentration $C_8$ gradually and continously decreases in the range from position $t_B$ and position $t_T$, at which it is substantially zero.

Figure 10:
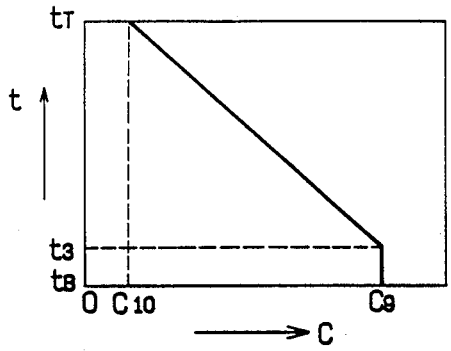

In the example shown in FIG. 10, the distribution concentration C of the atoms (Ge,Sn) is such that concentration $C_9$ remains constant in the range from position $t_B$ to position $t_3$, and concentration $C_9$ linearly decreases to concentration $C_{10}$ in the range from position $t_3$ to position $t_T$.

Figure 11:
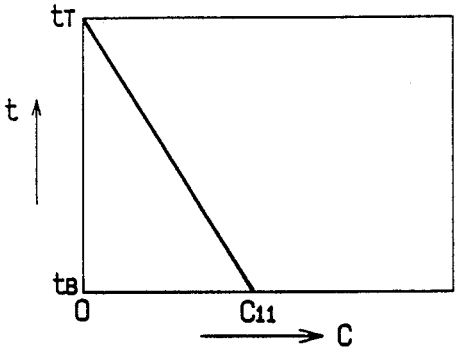

In the example shown in FIG. 11, the distribution concentration C of the atoms (Ge,Sn) is such that concentration $C_{11}$ linearly decreases in the range from position $t_B$ to position $t_T$, at which the concentration is substantially zero.

Several examples of the thicknesswise distribution of the atoms (Ge,Sn) in the IR absorption layer are illustrated in FIG. 6 through FIG. 11. In the light receiving member for use in electrophotography of this invention, the IR absorption layer is desired to be such that contains not only the atoms (Ge,Sn) but also silicon atoms and the concentration C of the atoms (Ge,Sn) is high in the layer region adjacent to the substrate but it is considerably low in the opposite layer region adjacent to the interface. In this case, it is desired for the IR absorption layer to be so formed that the maximum concentration $C_{max}$ of the atoms (Ge,Sn) to be distributed in the thicknesswise direction becomes a specific amount in the quantitative relationship of the amount of the atoms (Ge,Sn) versus the sum of the amount of the atoms (Ge,Sn) and the amount of silicon atoms to be contained in the IR absorption layer, which is preferably greater than $1\times10^3$ atomic ppm, more preferably greater than $5\times10^3$ atomic ppm, and most preferably, greater than $1\times10^4$ atomic ppm.

And the amount of the atoms (Ge,Sn) to be contained in the IR absorption layer should be properly determined depending upon the requirements for the provision of the IR absorption layer. In view of this, it is preferably 1 to $1\times10^6$ atomic ppm, more preferably $1\times10^2$ to $9.5\times10^5$ atomic ppm, and, most preferably, $5\times10^2$ to $8\times10^5$ atomic ppm.

Further, the IR absorption layer may contain at least one kind selected from a conductivity controlling element (Mr), carbon atoms (C), oxygen atoms (0) and nitrogen atoms (N).

As the conductivity controlling element (Mr), so-called impurities in the field of semiconductor can be mentioned, and those usable herein can include the group III atoms which provide p-type conductivity and the group V atoms which provide n-type conductivity.

Specifically, the group III atoms can include B (boron), Al (aluminum), Ga (gallium), In (indium) and Tl (thallium), B and Ga being particularly preferred. The group V atoms can include P (phosphorus), As (arsenic), Sb (antimony), and Bi (bismuth), P and Sb being particularly preferred.

The amount of such conductivity controlling element (Mr) to be contained in the IR absorption layer is preferably $1\times10^{-2}$ to $5\times10^5$ atomic ppm, more preferably $5\times10^{-1}$ to $1\times10^4$ atomic ppm, and, most preferably, 1 to $5\times10^3$ atomic ppm.

As for the amount of at least one kind selected from carbon atoms, oxygen atoms and nitrogen atoms to be contained in the IR absorption layer, it is preferably $1\times10^{-2}$ to 40 atomic %, more preferably $5\times10^{-2}$ to 30 atomic %, and most preferably, $1\times10^{-1}$ to 25 atomic %.

As above described, the IR absorption layer may contain hydrogen atoms (H) or/and halogen atoms (X).

In the case where at least one kind selected from hydrogen atoms (H) and halogen atoms (X) is incorporated into the IR absorption layer, dangling bonds are effectively compensated to thereby make the layer to be in high quality.

The halogen atom (X) includes, specifically, fluorine, chlorine, bromine and iodine. And among these halogen atoms, fluorine and chlorine are particularly preferred.

The amount of the hydrogen atoms (H), the amount of the halogen atom (X) or the sum of the amounts for the hydrogen atoms and the halogen atoms (H+X) to be contained in the IR absorption layer is preferably $1\times10^{-2}$ to 40 atomic %, more preferably $5\times10^{-2}$ to 30 to atomic %, and most preferably $1\times10^{-1}$ to 25 atomic %.

For the thickness of the IR absorption layer, it is preferably 0.05 to 25 μm, more preferably, 0.07 to 20 μm, and, most preferably, 0.1 to 15 μm in the viewpoints of bringing about desired electrophotographic characteristics and economical effects.

Charge Injection Inhibition Layer 104 (or 504)

The charge injection inhibition layer 104 (or 504) of the light receiving member for use in electrophotography is composed typically of a Non-SiMo(H,X) material. It may be composed also of a Non-Si(C,O,N) material or a Non-Si(C,O,N)(H,X,Mo) material. The charge injection inhibition layer in the light receiving member for use in electrophotography of this invention is formed so as to have a rectification property of preventing a charge carrier from being injected from the substrate side into the CGL at the time when one polarity charge is applied on the surface of the light receiving layer 102 and of not exhibiting said function in the case where the other polarity charge is applied thereon.

In order for the charge injection inhibition layer to be accompanied with such function, a relatively large amount of a conductivity controlling element (Mo) providing the corresponding conduction type is incorporated thereinto. And the conductivity controlling element (Mo) is so incorporated into the charge injection inhibition layer that it is contained in the entire layer region in an uniform state or in an uneven state for its concentration distribution C (Mo) in the thicknesswise direction.

The conductivity controlling element (Mo) to be contained in the charge injection inhibition layer may be such that provides a different polarity from or the same polarity as that of the conductivity controlling element (M) or (Mr) to be contained in the CTL or the IR absorption layer. It may be also such that is different from or the same as the conductivity controlling element (M) or (Mr).

However, in a preferred embodiment, the conductivity controlling element (Mo) to be contained in the charge injection inhibition layer is desired to be such that provides a different polarity from that of the conductivity controlling element (M) to be contained in the CTL.

In any case, what are above stated should be properly determined depending upon the requirements for a light receiving member for use in electrophotography intended to obtain.

Explanation will be made to the typical embodiments for incorporating the conductivity controlling element (Mo) of the group III or the group V into the charge injection inhibition layer in an uneven concentration distribution state in the thicknesswise direction with reference to FIG. 12 through FIG. 16.

In FIG. 12 through FIG. 16, the abscissa represents the distribution concentration C of the group III atoms or group V atoms and the ordinate represents the thickness of the charge injection inhibition layer; and $t_B$ represents the extreme position of the layer adjacent to the substrate and $t_T$ represents the other extreme position of the layer which is opposite to the substrate side.

The charge injection inhibition layer is formed from the $t_B$ side toward the $t_T$ side.

Figure 12:
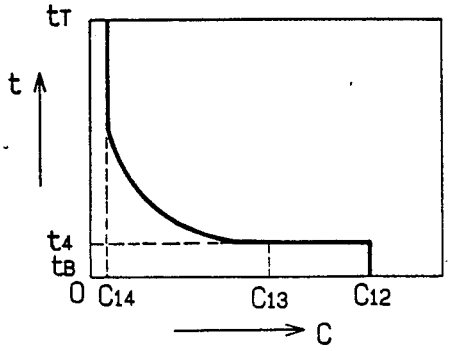
FIG. 12 through FIG. 16 are explanatory views illustrating a distribution state of a conductivity controlling element in the charge injection inhibition layer.

FIG. 12 shows the first typical example of the thicknesswise distribution of the group III atoms or group V atoms in the charge injection inhibition layer. In this example, the group III atoms or group V atoms are distributed such that the concentration C remains constant at a value $C_{12}$ in the range from position $t_B$ to position $t_4$, and the concentration C gradually and continuously decreases from $C_{13}$ in the range from position $t_4$ to position $t_T$, where the concentration C of the group III atoms or group V atoms is $C_{14}$.

Figure 13:
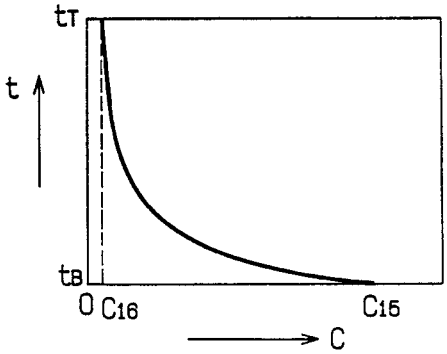

In the example shown in FIG. 13, the distribution concentration C of the group III atoms or group V atoms contained in the layer is such that concentration $C_{15}$ at position $t_B$ continuously decreases to concentration $C_{16}$ at position $t_T$.

Figure 14:
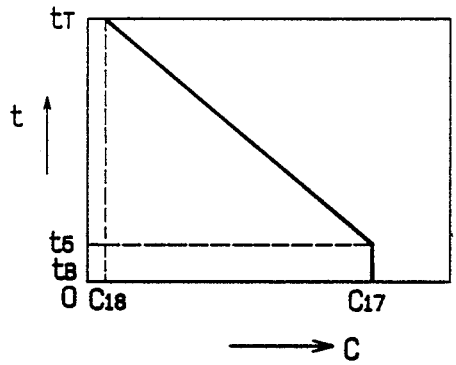

In the example shown in FIG. 14, the distribution concentration C of the group III atoms or group V atoms is such that concentration $C_{17}$ remains constant in the range from position $t_B$ to position $t_5$, and concentration $C_{17}$ linearly decreases to concentration $C_{18}$ in the range from position $t_5$ to position $t_T$.

Figure 15:
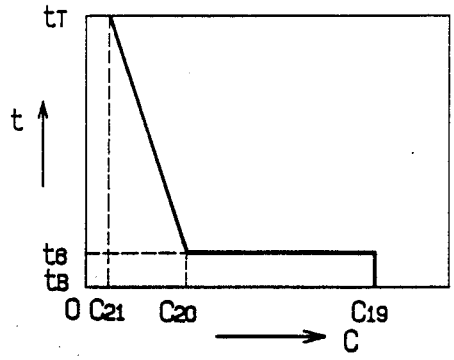

In the example shown in FIG. 15, the distribution concentration C of the group III atoms or group V atoms is such that concentration $C_{19}$ remains constant in the range from position $t_B$ and position $t_6$ and it linearly decreases from $C_{20}$ to $C_{21}$ in the range from position $t_6$ to position $t_T$.

Figure 16:
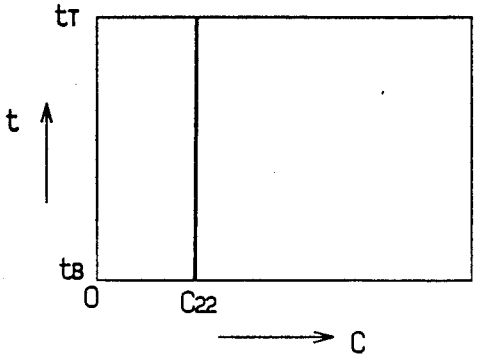

In the example shown in FIG. 16, the distribution concentration C of the group III atoms or group V atoms is such that concentration $C_{22}$ remains constant in the range from position $t_B$ and position $t_T$.

In the case of incorporating the conductivity controlling element (Mo) into the charge injection inhibition layer in a state that it is distributed largely in a layer region in the substrate side, it is desired for the layer to be so formed that the maximum concentration $C_{max}$ of the conductivity controlling element (Mo) to be distributed therein becomes preferably greater than 50 atomic ppm, more preferably greater than 80 atomic ppm and most preferably, greater than 100 atomic ppm.

For the amount of the conductivity controlling element (Mo) to be contained in the charge injection inhibition layer, it is properly determined according to desired requirements. However, it is preferably $3\times10$ to $5\times10^4$ atomic ppm, more preferably $5\times10$ to $1\times10^4$ atomic ppm, and, most preferably, $1\times10^2$ to $5\times10^3$ atomic ppm.

Now the incorporation of at least one kind selected from carbon atoms, oxygen atoms and nitrogen atoms [hereinafter referred to as "the atoms (C,O,N)"] into the charge injection inhibition layer causes improvements in the adhesion of the charge injection inhibition layer with the substrate or other constituent layer.

Explanation will be made to the typical embodiments for incorporating the atoms (C,O,N) in a state that they are distributed in the thicknesswise direction of the charge injection inhibition layer while referring to FIG. 17 through FIG. 23.

In FIG. 17 through FIG. 23, the abscissa represents the distribution concentration C of the atoms (C,O,N), and the ordinate represents the thickness of the charge injection inhibition layer; and $t_B$ represents the extreme position of the layer adjacent to the substrate and $t_T$ represents the other extreme position of the layer which is opposite to substrate side. The charge injection inhibition layer is formed from the $t_B$ side toward the $t_T$ side.

Figure 17:
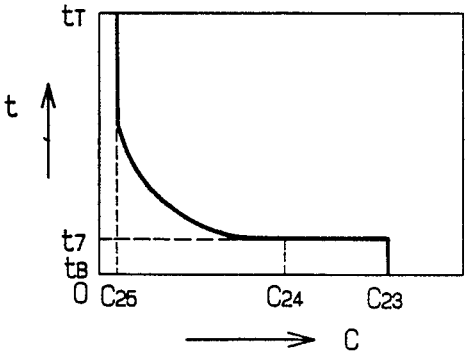
FIG. 17 through FIG. 23 are explanatory views illustrating a distribution state of at least one kind selected from carbon atoms, oxygen atoms and nitrogen atoms in the charge injection inhibition layer.

FIG. 17 shows the first typical example of the thicknesswise distribution of the atoms (C,O,N) in the charge injection inhibition layer. In this example, the atoms (C,O,N) are distributed such that the concentration C remains constant at a value $C_{23}$ in the range from position $t_B$ to position $t_7$, and the concentration C gradually and continuously decreases from $C_{24}$ in the range from position $t_7$ to position $t_T$, where the concentration of the atoms (C,O,N) is $C_{25}$.

Figure 18:
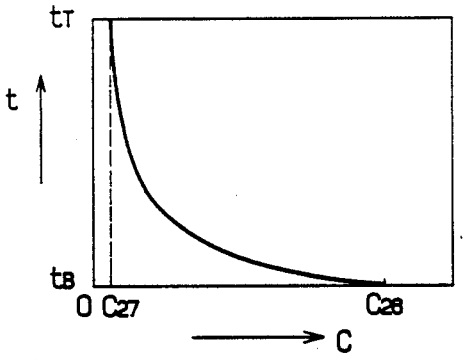

In the example shown in FIG. 18, the distribution concentration C of the atoms (C,O,N) contained in the charge injection inhibition layer is such that concentration $C_{26}$ at position $t_B$ continuously decreases to concentration $C_{27}$ at position $t_T$.

Figure 19:
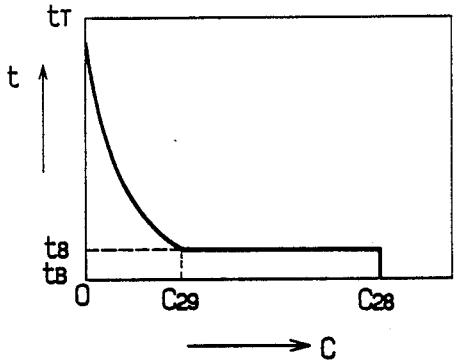

In the example shown in FIG. 19, the distribution concentration C of the atoms (C,O,N) is such that the concentration C remains constant at a value $C_{28}$ in the range from position $t_B$ and position $t_8$ and from $C_{29}$, it gradually and continuously decreases from position $t_8$ and becomes substantially zero between $t_8$ and $t_T$.

Figure 20:
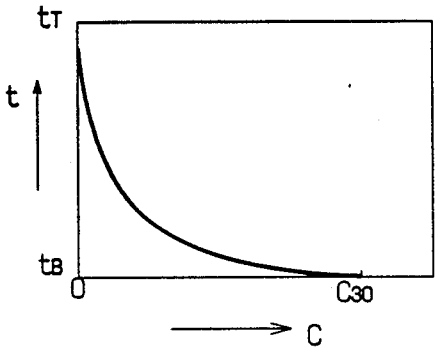

In the example shown in FIG. 20, the distribution concentration C of the atoms (C,O,N) is such that concentration $C_{30}$ gradually and continuously decreases from position $t_B$ and becomes substantially zero between $t_B$ and $t_T$.

Figure 21:
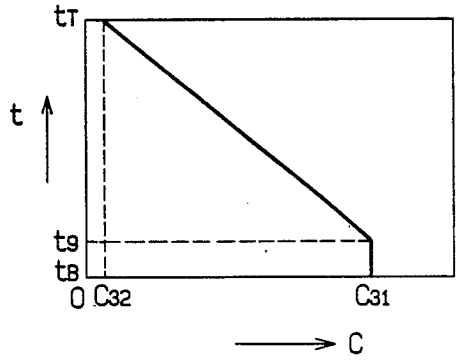

In the example shown in FIG. 21, the distribution concentration C of the atoms (C,O,N) is such that concentration C remains constant at a value of $C_{31}$ in the range from position $t_B$ to position $t_9$, and concentration $C_{31}$ linearly decreases to concentration $C_{32}$ in the range from position $t_9$ to position $t_T$.

Figure 22:
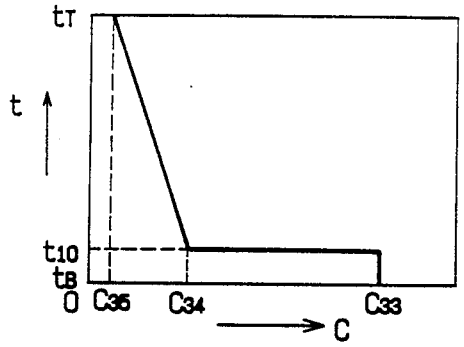

In the example shown in FIG. 22, the distribution concentration C of the atoms (C,O,N) is such that concentration C remains constant at a value of $C_{33}$ in the range from position $t_B$ and position $t_{10}$ and it linearly decreases from $C_{34}$ to $C_{35}$ in the range from position $t_{10}$ to position $t_T$.

Figure 23:
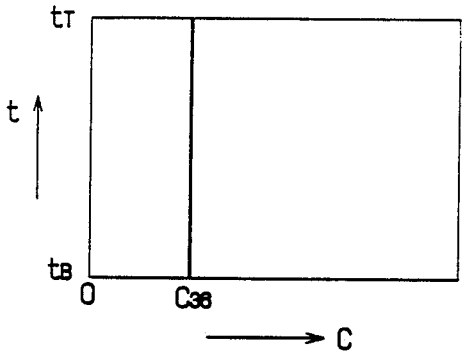

In the example shown in FIG. 23, the distribution concentration C of the atoms (C,O,N) is such that concentration $C_{36}$ remains constant in the range from position $t_B$ and position $t_T$.

In the case where the atoms (C,O,N) are contained in the charge injection inhibition layer such that the distribution concentration C of the atoms (C,O,N) in the layer is higher in the layer region near the substrate, the thicknesswise distribution of the atoms (C,O,N) is made in such way that the maximum concentration $C_{max}$ of the atoms (C,O,N) is controlled to be preferably greater than $5\times10^2$ atomic ppm, more preferably, greater than $8\times10^2$ atomic ppm, and, most preferably, greater than $1\times10^3$ atomic ppm.

As for the amount of the atoms (C,O,N) to be contained in the charge injection inhibition layer, it is properly determined according to desired requirements. However, it is preferably $1\times10^{-3}$ to 50 atomic %, more preferably, $2\times10^{-3}$ atomic % to 40 atomic %, and, most preferably, $3\times10^{-3}$ to 30 atomic %.

In the case where at least one kind selected from hydrogen atoms (H) and halogen atoms (X) is incorporated into the charge injection inhibition layer, dangling bonds are effectively compensated to thereby make the layer to be in high quality.

The halogen atom (X) includes, specifically, fluorine, chlorine, bromine and iodine. And among these halogen atoms, fluorine and chlorine are particularly preferred.

The amount of the hydrogen atoms (H), the amount of the halogen atoms (X) or the sum of the amounts for the hydrogen atoms and the halogen atoms (H+X) to be contained in the charge injection inhibition layer is preferably 1 to 50 atomic %, more preferably 5 to 40 atomic %, and most preferably 10 to 30 atomic %.

For the thickness of the charge injection inhibition layer, it is preferably $1\times10^{-2}$ to 10 μm, more preferably, $5\times10^{-2}$ to 8 μm, and, most preferably, $1\times10^{-1}$ to 5 μm in the viewpoints of bringing about desired electrophotographic characteristics and economical effects.

Charge Carrier Generation Layer (CGL) 105 (or 505)

The CGL 105 (or 505) in the light receiving member for use in electrophotography of this invention is composed substantially of a Non-Si(H,X) material containing neither the foregoing conductivity controlling element nor the atoms (C,O,N), and it exhibits desired photoconductive characteristics and charge carrier generation characteristics.

In the case where hydrogen atoms (H) or/and halogen atoms (X) is contained, dangling bonds are effectively compensated whereby not only the photoconductive characteristics but also the layer quality being promoted.

The halogen atom (X) includes, specifically, fluorine, chlorine, bromine and iodine. And among these halogen atoms, fluorine and chlorine are particularly preferred.

The amount of the hydrogen atoms (H), the amount of the halogen atoms (X) or the sum of the amounts for the hydrogen atoms and the halogen atoms (H+X) to be contained in the CGL is preferably 1 to 40 atomic %, more preferably 5 to 30 atomic %, and most preferably 10 to 20 atomic %.

For the thickness of the CGL, it is properly determined in order for the CGL to have desired electrophotographic characteristics and to effectively function to generate a charge carrier in accordance with an absorption coefficient of light from the light source to be used in a electrophotographic image-making system and also in the economical viewpoint.

However, it is preferably $1\times10^{-2}$ to 30 μm, more preferably $1\times10^{-1}$ to 20 μm, and most preferably, 1 to 10 μm.

Charge Carrier Transport Layer (CTL) 106 (or 506)

The CTL 106 (or 506) in the light receiving member for use in electrophotography of this invention is composed of a Non-SiMC(O,N)(H,X) material, and it effectively exhibits charge carrier transport characteristics and desired electrophotographic characteristics The CTL may contain, in addition to carbon atoms, oxygen atoms or/and nitrogen atoms [hereinafter referred to as the atoms [C(O,N)] in a state that they are distributed uniformely in the entire layer region or unevenly in the thicknesswise direction in the entire layer region.

The conductivity controlling element (M) to be contained in the CTL is a member selected from the group consisting of boron, aluminum, gallium, indium and thallium belonging group III that provide a p-type conductivity or a member selected from the group consisting of phosphorus, arsenic, antimony and bismuth belonging to group V that provide an n-type conductivity.

The CTL contains such selected conductivity controlling element (M) in an uneven state in the thicknesswise direction in the entire layer region. Specifically, such selected conductivity controlling element (M) is so contained in the CTL that its distribution concentration in the thicknesswise direction becomes uneven in at least a partial layer region.

It is possible for the atoms [C(O,N)] to be contained in the CTL in the same way as the conductivity controlling element (M).

Explanation will be made to the typical embodiments for distributing the foregoing selected conductivity controlling element (M) [hereinafter referred to as "the element M"] in the thicknesswise direction in the CTL with reference to FIG. 24 through FIG. 39.

In FIG. 24 through FIG. 39, the abscissa represents the distribution concentration C of the element M and the ordinate represents the thickness of the CTL; and $t_B$ represents the extreme interface position of the CTL which is adjacent to the CGL and $t_T$ representative the other extreme position of the CTL which is opposite to said interface position. The CTL is formed from the $t_B$ side toward the $t_T$ side.

Figure 24:
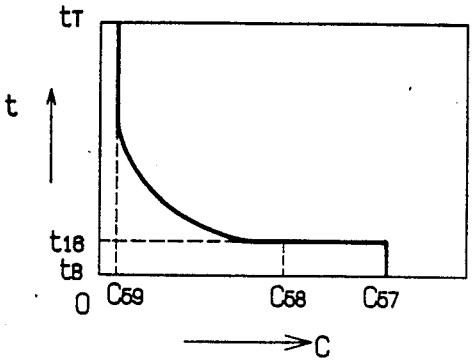
FIG. 24 through FIG. 39 are explanatory views illustrating a distribution state of a conductivity controlling element in the CTL.

FIG. 24 shows the first typical example of the thicknesswise distribution of the element M in the CTL. In this example, the element M is distributed such that the concentration C remains constant at a value $C_{57}$ in the range from position $t_B$ to $t_{16}$, and it gradually and continuously decreases from concentration $C_{58}$ in the range from position $t_{16}$ to position $t_T$, where the concentration C is made to be concentration $C_{59}$.

Figure 25:
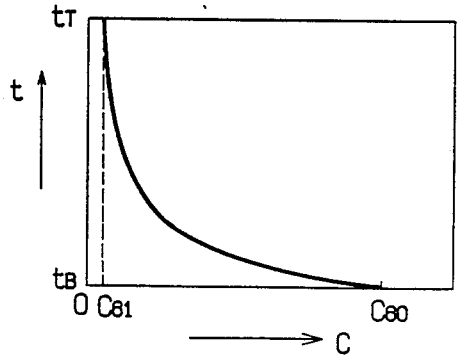

In the example shown in FIG. 25, the distribution concentration C of the element M contained in the CTL is such that the concentration C gradually and continuously decreases from concentration $C_{60}$ at position $t_B$ to concentration $C_{61}$ at position $t_T$.

Figure 26:
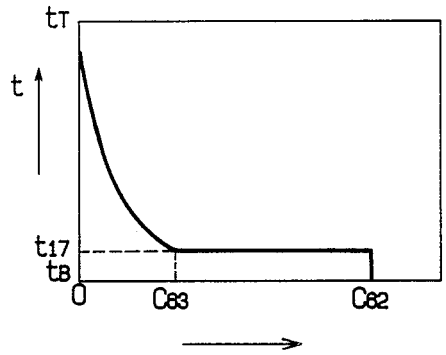

In the example shown in FIG. 26, the distribution concentration C of the element M contained in the CTL is such that the concentration C remains constant at a value $C_{62}$ in the range from position $t_B$ to $t_{17}$, and from concentration $C_{63}$, it gradually and continuously decreases from position $t_{17}$ and becomes substantially zero between $t_{17}$ and $t_T$.

Figure 27:
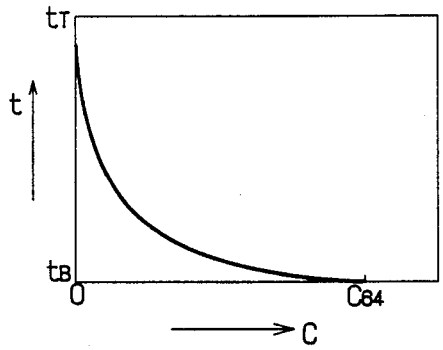

In the example shown in FIG. 27, the distribution concentration C of the element M contained in the CTL is such that concentration $C_{64}$ at position $t_B$ gradually and continuously decreases from position $t_B$ and becomes substantially zero between position $t_B$ and position $t_T$.

Figure 28:
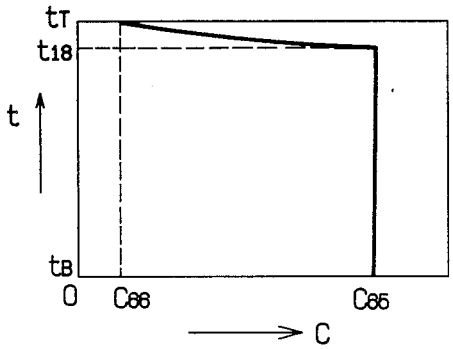

In the example shown in FIG. 28, the distribution concentration C of the element M is such that the concentration C remains constant at a value $C_{67}$ in the range from position $t_B$ to position $t_{18}$ and it linearly decreases from $C_{65}$ in the range from position $t_{18}$ to position $t_T$, where the concentration of the element M is made to be concentration $C_{66}$.

Figure 29:
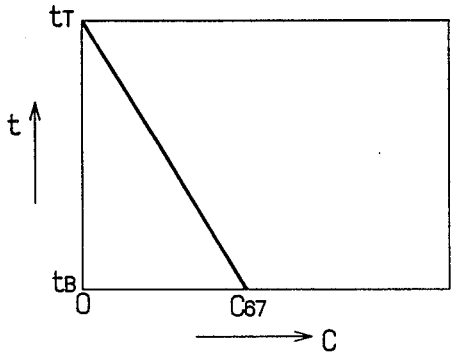

In the example shown in FIG. 29, the distribution concentration C of the element M is such that the concentration C linearly decreases from concentration $C_{67}$ to become substantially zero in the range from position $t_B$ to position $t_T$.

Figure 30:
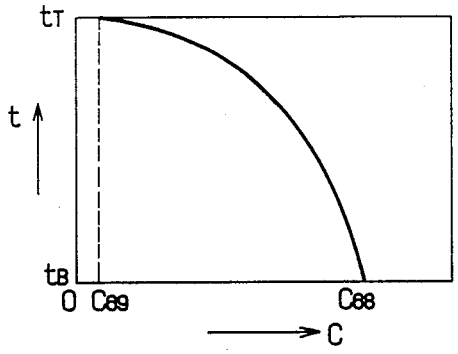

In the example shown in FIG. 30, the distribution concentration C of the element M contained in the CTL is such that the concentration C gradually and continuously decreases concentration $C_{68}$ in the range from position $t_B$ to position $t_T$ and it becomes concentration $C_{69}$ at position $t_T$.

Figure 31:
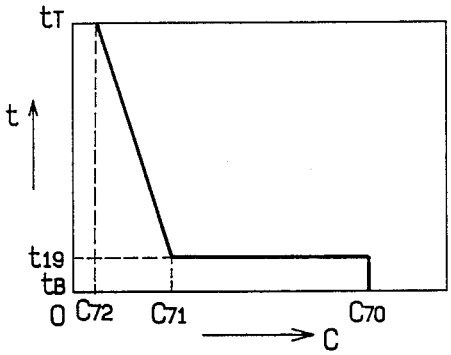

In the example shown in FIG. 31, the distribution concentration C of the element M contained in the CTL is such that the concentration C remains constant at a value $C_{70}$ in the range from position $t_B$ to position $t_{19}$ and it linearly decreases from concentration $C_{71}$ to concentration $C_{72}$ in the range from position $t_{19}$ to position $t_T$.

Figure 32:
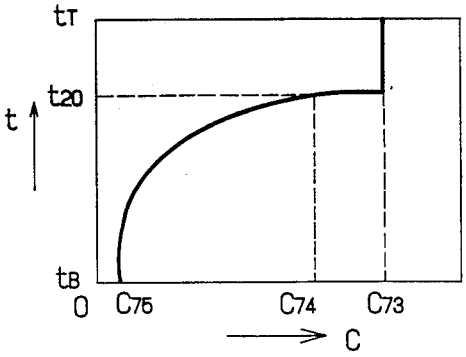

In the example shown in FIG. 32, the distribution concentration C of the element M contained in the CTL is such that the concentration C gradually and continuously increases from concentration $C_{75}$ to concentration $C_{74}$ in the range from position $t_B$ to position $t_{20}$, and it remains constant at a value $C_{73}$ in the range from position $t_{20}$ to position $t_T$.

Figure 33:
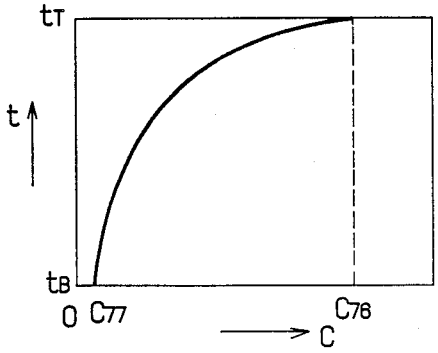

In the example shown in FIG. 33, the distribution concentration C of the element M contained in the CTL is such that the concentration C gradually and continuously increases from concentration $C_{77}$ to concentration $C_{76}$ in the range from position $t_B$ to position $t_T$.

Figure 34:
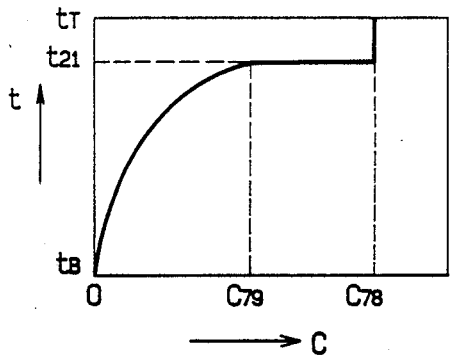

In the example shown in FIG. 34, the distribution concentration C of the element M contained in the CTL is such that the concentration C gradually and continuously increases from substantially zero value to concentration $C_{79}$ in the range from position $t_B$ to position $t_{21}$, and it remains constant at a value $C_{78}$ from position $t_{21}$ to position $t_T$.

Figure 35:
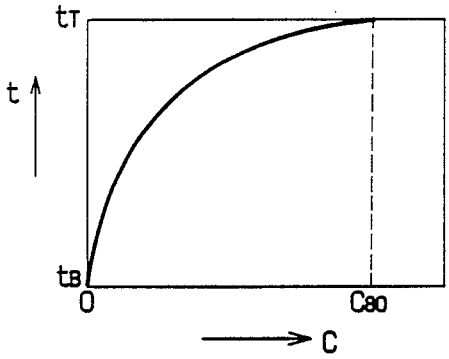

In the example shown in FIG. 35, the distribution concentration C of the element M contained in the CTL is such that the concentration C gradually and continuously increases from substantially zero value to concentration $C_{80}$ in the range from position $t_B$ to position $t_T$.

Figure 36:
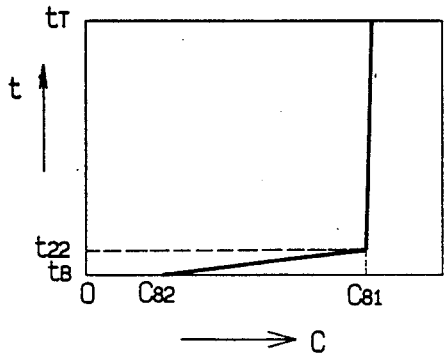

In the example shown in FIG. 36, the distribution concentration C of the element M contained in the CTL is such that the concentration C linearly increases from concentration $C_{82}$ to concentration $C_{81}$ in the range from position $t_B$ to $t_{22}$, and it remains constant at a value $C_{81}$ from position $t_B$ to $t_{22}$, and it remains constant at a value $C_{81}$ from position $t_{22}$ to $t_T$.

Figure 37:
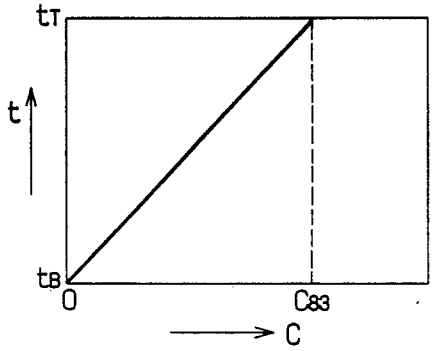

In the example shown in FIG. 37, the distribution concentration C of the element M contained in the CTL is such that the concentration C linearly increases from substantially zero value to concentration $C_{83}$ in the range from position $t_B$ to position $t_T$.

Figure 38:
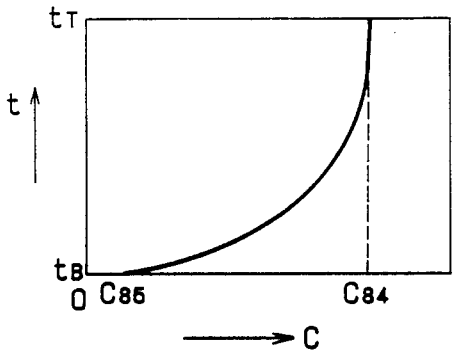

In the example shown in FIG. 38, the distribution concentration C of the element M contained in the CTL is such that the concentration C gradually and continuously increases from concentration $C_{85}$ to concentration $C_{84}$ in the range from position $t_B$ to position $t_T$.

Figure 39:
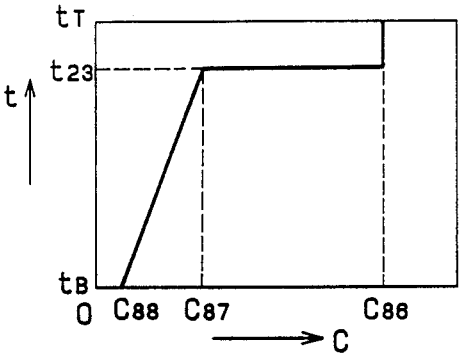

In the example shown in FIG. 39, the distribution concentration C of the element M contained in the CTL is such that the concentration C linearly increases from concentration $C_{88}$ to concentration $C_{87}$ in the range from position $t_B$ to position $t_{23}$, and it remains constant at a value $C_{86}$ in the range from position $t_{23}$ to position $t_T$.

Now, in the following, explanation will be made to the typical embodiments for distributing the atoms [C(O,N)] in the thicknesswise direction in the CTL with reference to FIG. 40 through FIG. 49.

In FIG. 40 through FIG. 49, the abscissa represents the distribution concentration C of the atoms [C(O,N)] and the ordinate represents the thickness of the CTL; and $t_B$ represents the extreme interface position of the CTL which is adjacent to the CGL and $t_T$ represents the other extreme position of the CTL which is opposite to said interface position. The CTL is formed from the $t_B$ side toward the $t_T$ side.

Figure 40:
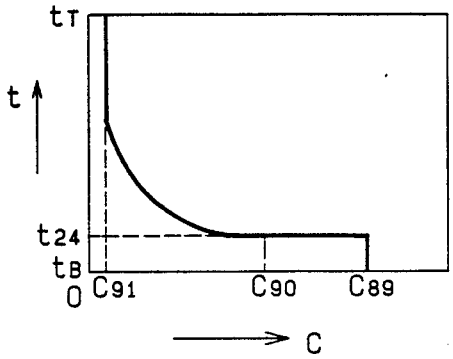
FIG. 40 through FIG. 49 are explanatory views illustrating a distribution state of at least one kind selected from carbon atoms, oxygen atoms and nitrogen atoms in the CTL.

FIG. 40 shows the first typical example of the thicknesswise distribution of the atoms [C(O,N)] in the CTL. In this example, the atoms [C(O,N)] is distributed such that the concentration C remains constant at a value $C_{89}$ in the range from position $t_B$ to position $t_{24}$, and it gradually and continuously decreases from concentration $C_{90}$ in the range from position $t_{24}$ to position $t_T$, where it becomes concentration $C_{91}$.

Figure 41:
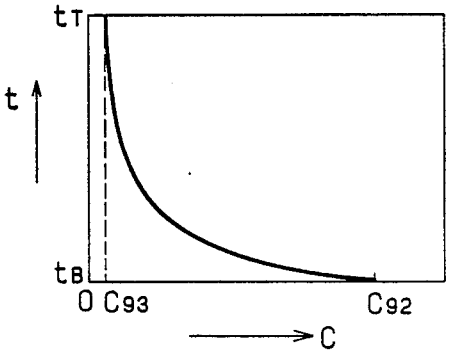

In the example shown in FIG. 41, the distribution concentration C of the atoms [C(O,N)] contained in the CTL is such that the concentration C gradually and continuously decreases from concentration $C_{92}$ in the range from position $t_B$ to position $t_T$, where it becomes concentration $C_{93}$.

Figure 42:
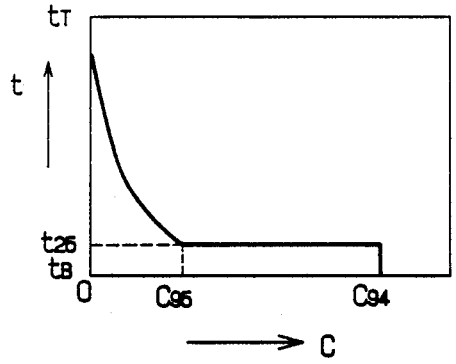

In the example shown in FIG. 42, the distribution concentration C of the atoms [C(O,N)] contained in the CTL is such that the concentration C remains constant at a value $C_{94}$ in the range from position $t_B$ to position $t_{25}$, and it gradually and continuously decreases from concentration $C_{95}$ in the range from position $t_{25}$ to position $t_T$, where it becomes substantially zero value.

Figure 43:
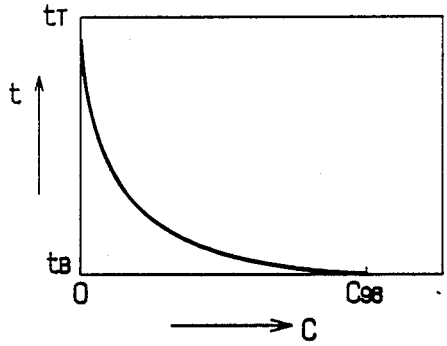

In the example shown in FIG. 43, the distribution concentration C of the atoms [C(O,N)] contained in the CTL is such that the concentration C gradually and continuously decreases from concentration $C_{96}$ in the range from position $t_B$ to position $t_T$, where it becomes substantially zero value.

Figure 44:
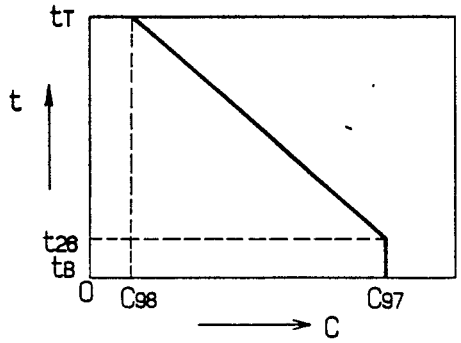

In the example shown in FIG. 44, the distribution concentration C of the atoms [C(O,N)] contained in the CTL is such that the concentration C remains constant at a value $C_{97}$ in the range from position $t_B$ to position $t_{26}$, and it linearly decreases to concentration $C_{98}$ in the range from position $t_{26}$ to position $t_T$, where it becomes concentration $C_{98}$.

Figure 45:
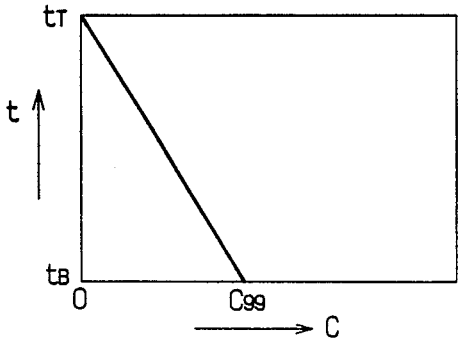

In the example shown in FIG. 45, the distribution concentration C of the atoms [C(O,N)] contained in the CTL is such that the concentration C linearly decreases from concentration $C_{99}$ in the range from position $t_B$ to position $t_T$, where it becomes substantially zero value.

Figure 46:
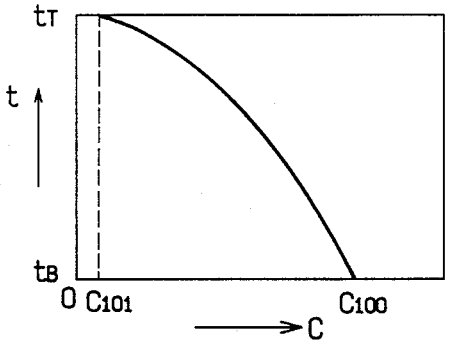

In the example shown in FIG. 46, the distribution concentration C of the atoms [C(O,N)] contained in the CTL is such that the concentration C gradually and continuously decreases from concentration $C_{100}$ in the range from position $t_B$ to $t_T$, where it becomes concentration $C_{101}$.

Figure 47:
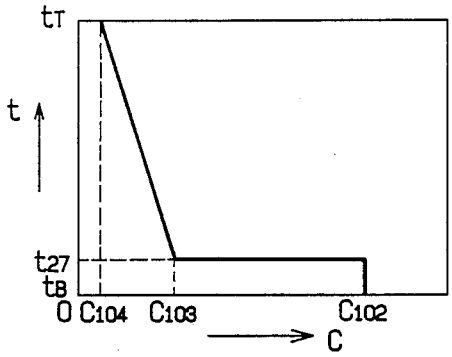

In the example shown in FIG. 47, the distribution concentration C of the atoms [C(O,N)] contained in the CTL is such that the concentration C remains constant at value $C_{102}$ in the range from position $t_B$ to position $t_{27}$ and it linearly decreases from concentration $C_{103}$ in the range from position $t_{27}$ to position $t_T$ to become concentration $C_{104}$ at position $t_T$.

Figure 48:
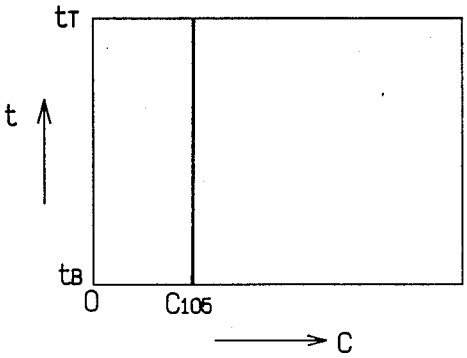

In the example shown in FIG. 48, the distribution concentration C of the atoms [C(O,N)] contained in the CTL is such that the concentration C remains constant at a value $C_{105}$.

Figure 49:
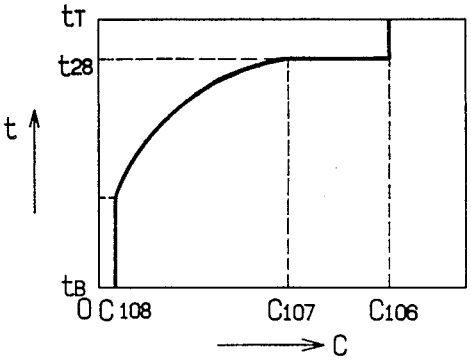

Most of the above-mentioned examples are related to the case where the distribution concentration C of the atoms [C(O,N)] contained in the CTL is made large in the $t_B$ side. But, it is possible to reverse the situation of such distribution concentration C, which means that the distribution concentration C of the atoms [C(O,N)] contained in the CTL is made large in the $t_T$ side, for example, in the way as shown in FIG. 49 which is reverse to the case of FIG. 40. That is, in the example shown in FIG. 49, the distribution concentration C of the atoms C(O,N) contained in the CTL is such that the concentration C remains constant at a value $C_{108}$ then gradually and continuously increases to become concentration $C_{107}$ in the range from position $t_B$ to position $t_{28}$, and it remains constant at a value $C_{106}$ in the range from position $t_{28}$ to position $t_T$.

In the light receiving member for use in electrophotography of this invention, the incorporation of the foregoing selected conductivity controlling element (M) into the CTL serves not only for controlling the conduction type and the conductivity but also for improving the charge injection efficiency between the CGL and the CTL.

The amount of the foregoing selected conductivity controlling element (M) to be contained in the CTL is sufficient to be in a relatively small amount.

Specifically, it is preferably $1\times10^{-3}$ to $1\times10^{3}$ atomic ppm, more preferably $5\times10^{-3}$ to $1\times10^{2}$ atomic ppm, and most preferably, $1\times10^{-2}$ to 50 atomic ppm.

In addition, the incorporation of carbon atoms and if necessary, oxygen atoms or/and nitrogen atoms, that is, the atoms [C(O,N)] into the CTL serves not only for improving the dark resistance and controlling the spectral sensitivity but also for improving the adhesion of the CTL with the CGL.

The amount of carbon atoms or the sum of amounts for the carbon atoms and at least one kind selected from oxygen atoms and nitrogen atoms to be contained in the CTL is preferably $1\times10^{-2}$ to $5\times10$ atomic %, more preferably $5\times10^{-2}$ to $4\times10$ atomic %, and most preferably, $1\times10^{-1}$ to $3\times10$ atomic %.

As above described, the CTL in the light receiving member for use in electrophotography may contain hydrogen atoms (H) or/and halogen atoms (X).

The incorporation of hydrogen atoms (H) or/and halogen atoms (X) into the CTL serves for compensating dangling bonds of silicon atoms in the layer to thereby improve the layer quality.

The halogen atom (X) to be contained in the CTL includes F (fluorine), Cl (chlorine), Br (bromine) and I (iodine), and F and Cl being particularly preferred.

The amount of hydrogen atoms (H), the amount of the halogen atoms (X) or the sum of the amounts for the hydrogen atom and the halogen atoms (H+X) to be contained in the CTL is preferably 1 to 70 atomic %, more preferably 5 to 50 atomic %, and most preferably, 10 to 30 atomic %. As for the thickness of the CTL, it is preferably 5 to 50 μm, more preferably 10 to 40 μm, and most preferably, 20 to 30 μm in the viewpoint of obtaining desired electrophotographic characteristics and also in an economical viewpoint.

Surface Layer 107 (or 507)

The surface layer 107 (or 507) in the light receiving member for use in electrophotography of this invention is composed of a Non-Si(C,O,N)(H,X) material which does not contain any conductivity controlling element as such element M contained in the CTL.

As for at least one kind selected from carbon atoms, oxygen atoms and nitrogen atoms [hereinafter referred to as "the atoms (C,O,N)"] to be contained in the surface layer, the atoms (C,O,N) may be contained either in a state that they are distributed uniformly in the entire layer region or in a state that they are contained uniformly in the thicknesswise direction but are distributed unevenly.

However, in any case, it is necessary for the distribution of the atoms (C,O,N) to be uniform in the direction to the surface of the substrate in order to unify the characteristics required for the layer.

Explanation will be made to the typical embodiments for distributing the atoms (O,C,N) in the thicknesswise direction in the surface layer with reference to FIG. 50 through FIG. 59.

In FIG. 50 through FIG. 59, the abscissa represents the distribution concentration C of the atoms (C,O,N) and the ordinate represents the thickness of the surface layer; and $t_B$ represents the extreme interface position of the surface layer which is adjacent to the CTL and $t_T$ represents the other extreme position of the surface layer in the free surface side. The surface layer is formed from the $t_B$ side toward the $t_T$ side.

Figure 50:
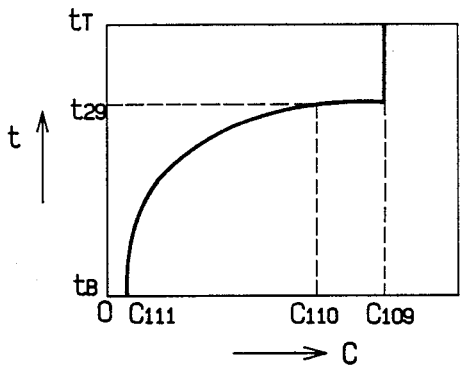
FIG. 50 through FIG. 59 are explanatory views illustrating a distribution state of at least one kind selected from carbon atoms, oxygen atoms and nitrogen atoms in the surface layer.

FIG. 50 shows the first typical example of the thicknesswise distribution of the atoms (C,O,N) in the surface layer. In this example, the distribution concentration C of the atoms (C,O,N) contained in the surface layer is such that the concentration C gradually and continuously increases from concentration $C_{111}$ to concentration $C_{110}$ in the range from position $t_B$ to position $t_{29}$, and it remains constant at a value $C_{109}$ in the range from position $t_{20}$ to position $t_T$.

Figure 51:
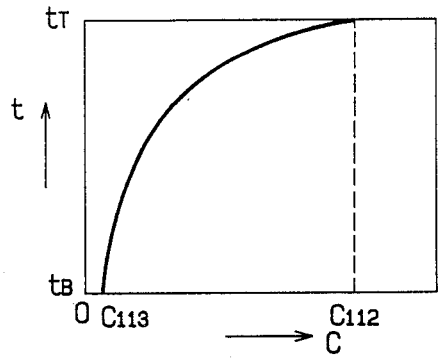

In the example shown in FIG. 51, the distribution concentration C of the atoms (C,O,N) contained in the surface layer is such that the concentration C gradually and continuously increases from concentration $C_{113}$ to concentration $C_{112}$ in the range from position $t_B$ to position $t_T$.

Figure 52:
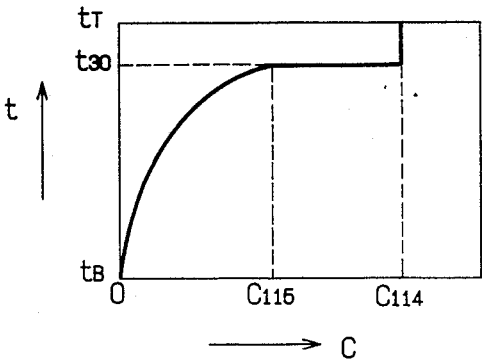

In the example shown in FIG. 52, the distribution concentration C of the atoms (C,O,N) contained in the surface layer is such that the concentration C gradually and continuously increases from substantially zero value to concentration $C_{115}$ in the range from position $t_B$ to position $t_{30}$, and it remains constant at a value $C_{114}$ from position $t_{30}$ to position $t_T$.

Figure 53:
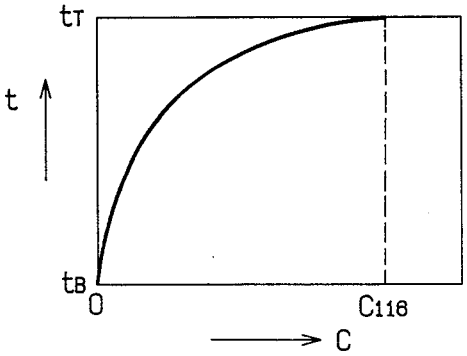

In the example shown in FIG. 53, the distribution concentration C of the atoms (C,O,N) contained in the surface layer is such that the concentration C gradually and continuously increases from substantially zero value to concentration $C_{116}$ in the range from position $t_B$ to position $t_T$.

Figure 54:
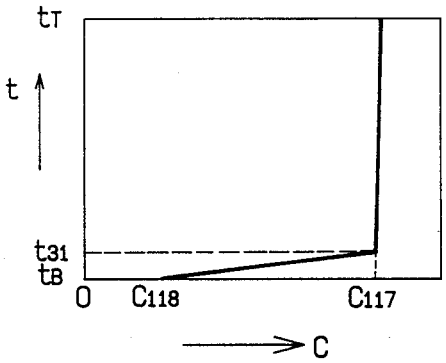

In the example shown in FIG. 54, the distribution concentration C of the atoms (C,O,N) contained in the surface layer is such that the concentration C linearly increases from concentration $C_{118}$ to concentration $C_{117}$ in the range from position $t_B$ to $t_{31}$, and it remains constant at a value $C_{117}$ from position $t_{31}$ to $t_T$.

Figure 55:
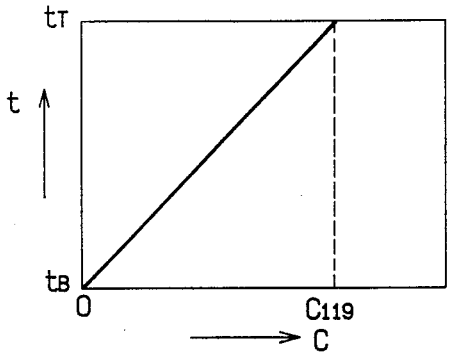

In the example shown in FIG. 55, the distribution concentration C of the atoms (C,O,N) contained in the surface layer is such that the concentration C linearly increases from substantially zero value to concentration $C_{119}$ in the range from position $t_B$ to position $t_T$.

Figure 56:
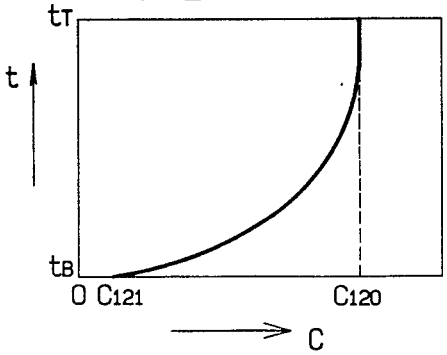

In the example shown in FIG. 56, the distribution concentration C of the atoms (C,O,N) contained in the surface layer is such that the concentration C gradually and continuously increases from concentration $C_{121}$ to concentration $C_{120}$ in the range from position $t_B$ to position $t_T$.

Figure 57:
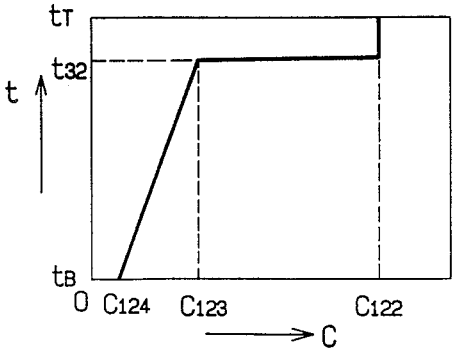

In the example shown in FIG. 57, the distribution concentration C of the atoms (C,O,N) contained in the surface layer is such that the concentration C linearly increases from concentration $C_{124}$ to concentration $C_{123}$ in the range from position $t_B$ to position $t_{32}$, and it remains constant at a value $C_{122}$ in the range from position $t_{32}$ to position $t_T$.

Figure 58:
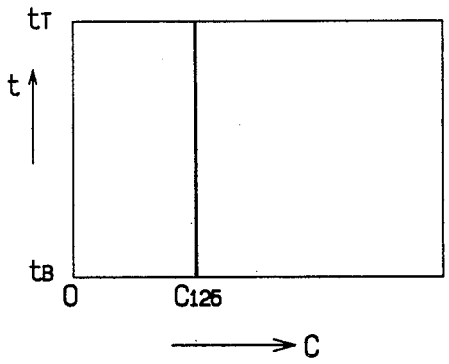

In the example shown in FIG. 58, the distribution concentration C of the atoms (C,O,N) contained in the surface layer is such that the concentration C remains constant at a value $C_{125}$ in the range from position $t_B$ to position $t_T$.

Figure 59:
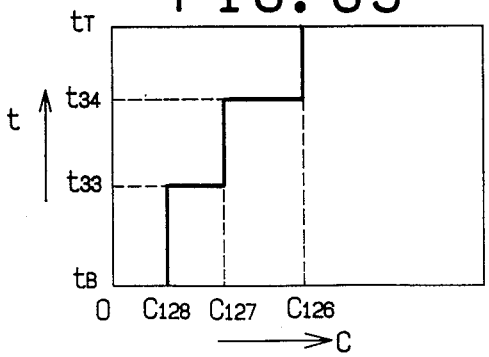

In the example shown in FIG. 59, the distribution concentration C of the atoms (C,O,N) contained in the surface layer is such that the concentration C remains constant at a value $C_{128}$ in the range from position $t_B$ to position $t_{33}$, then again remains constant at a value $C_{127}$ in the range from position $t_{33}$ to position $t_{34}$ and finally remains constant at a value $C_{126}$ in the range from position $t_{34}$ to position $t_T$.

The incorporation of the atoms (C,O,N) into the surface layer serves not only for improving the dark resistance but also for making the layer to have a desired hardness.

The amount of the atoms (C,O,N) to be contained in the surface layer is preferably $1\times10^{-3}$ to 90 atomic %, more preferably $1\times10^{-1}$ to 90 atomic %, and most preferably, 10 to 80 atomic %.

As above described, the surface layer in the light receiving member for use in electrophotography may contain hydrogen atoms (H) or/and halogen atoms (X).

The incorporation of hydrogen atoms (H) or/and halogen atoms (X) into the surface layer serves for compensating dangling bonds of silicon atoms in the layer to thereby improve the layer quality.

The halogen atom (X) to be contained in the surface layer includes F (fluorine), Cl (chlorine), Br (bromine) and I (iodine), and F and Cl being particularly preferred.

The amount of hydrogen atoms (H), the amount of the halogen atoms (X) or the sum of the amounts for the hydrogen atoms and the halogen atoms (H+X) to be contained in the CTL is preferably 1 to 70 atomic %, more preferably 5 to 50 atomic %, and most preferably, 10 to 30 atomic %.

As for the thickness of the surface layer, it is preferably 0.003 to 30 μm, more preferably 0.01 to 20 μm, and most preferably, 0.1 to 10 μm in the viewpoint of obtaining desired electrophotographic characteristics and also in an economical viewpoint.

Formation of The Light Receiving Layer 102 (or 502)

Each layer to constitute the light receiving layer 102 (or 502) of the light receiving member for use in electrophotography according to this invention can be properly formed by vacuum deposition method utilizing the discharge phenomena such as glow discharging method (alternating-current discharging CVD such as low-frequency CVD, high-frequency CVD and microwave CVD or direct-current CVD), reactive sputtering method, ion plating method, light CVD method and thermal induced CVD method wherein relevant raw material gases are selectively used.

Other than these methods, recently proposed hydrogen radical chemical vapor deposition method (see, Japanese Journal of Applied Physics vol. 25, No. 3, March, 1986, pp. L188 to L190) [hereinafter referred to as "HR-CVD method"] or fluorine oxidation chemical vapor deposition method utilizing the oxidation reaction of $SiH_4$ with $F_2$ [hereinafter referred to as "FO-CVD method"] can be also employed.

These methods are properly used selectively depending on the factors such as the manufacturing conditions, the installation cost required, production scale and properties required for a light receiving layer to be prepared.

The glow discharging method, reactive sputtering method, ion plating method, HR-CVD method and FO-CVD method are suitable since the control for the condition upon preparing the light receiving members having desired properties are relatively easy, and hydrogen atoms, halogen atoms and other atoms can be introduced easily together with silicon atoms.

And these methods may be selectively used together in one identical system.

Basically, when a layer composed of a Non-Si(H,X) material to be the CGL is formed, for example, by the glow discharging method, a gaseous raw material capable of supplying silicon atoms (Si) are introduced together with a gaseous raw material for introducing hydrogen atoms (H) and/or halogen atoms (X) into a deposition chamber the inside pressure of which can be reduced, glow discharge is generated in the deposition chamber, and a layer composed of Non-Si(H,X) is formed on the surface of a substrate placed in the deposition chamber.

In the case of forming said layer using the reactive sputtering method, using an Si target in an inert gas atmosphere of Ar or He or in a mixed gas atmosphere containing such inert gas as the main constituent, and if necessary, introducing a hydrogen atom (H) supplying raw material gas and/or a halogen atom (X) supplying raw material gas into a sputtering deposition chamber, the Si target is sputtered in a plasma atmosphere to thereby form said layer on a substrate placed in the sputtering deposition chamber.

To form said layer by the ion-plating process, the vapor of silicon is allowed to pass through a desired gas plasma atmosphere. The silicon vapor is produced by heating polycrystal silicon or single crystal silicon held in a boat. The heating is accomplished by resistance heating or electron beam method (E.B. method).

In order to form a layer composed of Non-Si(H,X) by the HR-CVD methed, a Si supplying raw material gas is introduced under predetermined conditions into an activation chamber provided separately from but next to a deposition chamber to thereby generate species (A) using a glow discharge energy or thermal energy, and at the same time, hydrogen atoms (H) supplying raw material gas and/or halogen atom (X) supplying raw material gas are introduced under predetermined conditions into another activation chamber provided separately from but next to the deposition chamber to thereby generate species (B) using the abovementioned activation energy, and the resultant two species (A) and (B)

are separately introduced into the deposition chamber to cause chemical reaction among them resulting in forming said layer on a substrate placed in the deposition chamber.

And, in order to form a layer composed of Non-Si(H,X) by the FO-CVD method, Si supplying raw material gas and halogen (X) gas are separately introduced under respective predetermined conditions into a deposition chamber to thereby cause chemical reaction between the two materials resulting in forming said layer on a substrate placed in the deposition chamber.

The gaseous raw material for supplying Si can include gaseous or gasifiable silicon hydrides (silanes) such as $SiH_4$, $Si_2H_6$, $Si_3H_8$, $Si_4H_{10}$, etc., $SiH_4$ and $Si_2H_6$ being particularly preferred in view of the easy layer forming work and the good efficiency for the supply of Si.

Further various halogen compounds can be mentioned as the gaseous raw material for supplying halogen atom (X), and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, ICl, IBr, etc.; and silicon halides such as $SiF_4$, $Si_2F_6$, $SiCl_4$, and $SiBr_4$. The use of the gaseous or gasifiable silicon halide as described above is particularly advantageous since a layer composed of a halogen atom-containing Non-Si:H material can be formed with no additional use of the gaseous starting silicon hydride material for supplying Si.

In the case of forming a layer composed of a Non-Si material containing halogen atoms, for example, by the glow discharging method, typically, a mixture of a gaseous silicon halide substance as the raw material for supplying Si and a gas such as Ar, $H_2$ and He is introduced into the deposition chamber having a substrate in a predetermined mixing ratio and at a predetermined gas flow rate, and the thus introduced gases are exposed to the action of glow discharge to thereby cause a gas plasma resulting in forming said layer on the substrate.

And, for incorporating hydrogen atoms in said layer, an appropriate gaseous raw material for supplying hydrogen atoms can be additionally used.

It is possible for the foregoing raw material gases to be mixed in a predetermined mixing ratio prior to introducing into the deposition chamber.

Now, the gaseous raw material usable for supplying hydrogen atoms can include those gaseous or gasifiable materials, for example, hydrogen gas ($H_2$), halides such as HF, HCl, HBr, and HI, silicon hydrides such as $SiH_4$, $Si_2H_6$, $Si_3H_8$, and $Si_4H_{10}$, or halogen-substituted silicon hydrides such as $SiH_2F_2$, $SiH_2I_2$, $SiH_2Cl_2$, $SiHCl_3$, $SiH_2Br_2$, and $SiHBr_3$. The use of these gaseous starting material is advantageous since the content of the hydrogen atoms (H), which are extremely effective in view of the control for the electrical or photoelectronic properties, can be controlled with ease. Then, the use of the hydrogen halide or the halogen-substituted silicon hydride as described above is particularly advantageous since the hydrogen atoms (H) are also introduced together with the introduction of the halogen atoms.

The amount of the hydrogen atoms (H) and/or the amount of the halogen atoms (X) to be contained in said layer can be adjusted properly be controlling related conditions, for example, the temperature of a substrate, the amount of a gaseous raw material copable of supplying the hydrogen atoms or the halogen atoms into the deposition chamber and the electric discharging power.

It is possible to form a desired layer composed of a Non-Si material containing halogen atoms to be the CGL by the reactive sputtering method, the ion plating method, the HR-CVD method or the FO-CVD method using a suitable halogen atom supplying raw material gas selected from the foregoing halogen atom supplying raw materials.

Likewise, it is possible to incorporate hydrogen atoms into said layer using a suitable hydrogen atom supplying raw material gas selected from the foregoing hydrogen atom supplying raw materials.

For example, in either case where the reactive sputtering method or the ion-plating method is employed, the layer may be incorporated with halogen atoms by introducing one of the above-mentioned gaseous halides or halogen-containing silicon compounds into the deposition chamber in which a plasma atmosphere of the gas is produced.

In the case where the layer is incorporated with hydrogen atoms in accordance with the sputtering process, a feed gas to liberate hydrogen is introduced into the deposition chamber in which a plasma atmosphere of the gas is produced. The feed gas to liberate halogen atoms includes the above-mentioned halogen-containing silicon compounds.

In the case of the reactive sputtering method, the layer composed of Non-Si(H,X) is formed on the substrate by using an Si target and by introducing a halogen-atom introducing gas and $H_2$ gas, if necessary, together with an inert gas such as He or Ar into the deposition chamber to thereby form a plasma atmosphere and then sputtering the Si target.

In order to form a layer composed of a Non-Si(H,X) further incorporated with a conductivity controlling element (M) or (Mo) selected from the group III atoms or from the group V atoms to result in the CTL composed of Non-SiMC(O,N)(H,X) or the charge injection inhibition layer using one of the foregoing methods, a raw material gas capable of supplying such element (M) or(Mo) is used together with the raw material for forming a Non-Si(H,X) layer upon forming the layer while controlling the amount to be fed.

Referring to the raw materials for introducing the group III atoms, they can include, for example, boron hydrides such as $B_2H_6$, $B_4H_{10}$, $B_5H_9$, $B_5H_{11}$, $B_6H_{10}$, $B_6H_{12}$, and $B_6H_{14}$, and boron halides such as $BF_3$, $BCl_3$, and $BBr_3$. In addition, $AlCl_3$, $CaCl_3$, $Ga(CH_3)_2$, $InCl_3$, $TlCl_3$, and the like can also be mentioned.

Referring to the raw material for introducing the group V atoms, they can include, for example, phosphorus hydrides such as $PH_3$, and $P_2H_6$ and phosphorus halides such as $PH_4I$, $PF_3$, $PF_5$, $PCl_3$, $PCl_5$, $PBr_3$, $PBr_5$, and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $BiCl_3$, and $BiBr_3$ can also be mentioned to as the effective raw material for introducing the group V atoms.

For the formation of a layer composed of Non-(Ge,Sn)(Si)(H,X) to be the IR absorption layer of the light receiving member for use in electrophotography, for example, by the glow discharging method, basically, gaseous raw material capable of supplying germanium atoms (Ge) and/or gaseous raw material capable of supplying tin atoms (Sn), and if necessary, gaseous raw material capable of supplying silicon atoms (Si), and gaseous raw material for introducing hydrogen atoms or/and halogen atoms are introduced into a deposition chamber the inside pressure of which can be reduced, glow discharge is generated in the deposition chamber, and a layer composed of Non-(Ge,Sn)(Si)(H,X) is formed on the surface of a substrate placed in the deposition chamber. In the case of forming a layer composed of Non-(Ge,Sn)(Si)(H,X) containing the germanium atoms (Ge) or/and the tin atoms (Sn) at uneven distribution concentration in the layer thicknesswise direction, such layer can be properly formed by controlling the distribution concentration of the Ge or/and the Sn along with a predetermined variation coefficient curve.

In order to form the above Non-(Ge,Sn)(Si)(H,X) layer by the reactive sputtering method, using one or more targets selected from a Si-target, Ge-target and Sn-target or using a target composed of Si and Ge or Sn, such target is engaged in sputtering in an atmosphere of inert gas such as He or Ar, and if necessary, gaseous raw material capable of supplying germanium atoms diluted with an inert gas such as He or Ar and/or gaseous raw material for introducing hydrogen atoms (H) and/or halogen atoms (H) are introduced into the sputtering deposition chamber thereby forming a plasma atmosphere with the gas. In the case of forming the layer containing the germanium atoms or/and the tin atoms at uneven distribution concentration, the target is subjected to sputtering while controlling the gas flow rate of gaseous raw material capable of supplying germanium atoms or/and tin atoms along with a predetermined variation coefficient curve.

To form the above Non-(Ge,Sn)(Si)(H,X) layer by the ion plating method, using one or more kinds selected from the group consisting of polycrystal-Ge and single-crystal-Ge, the group consisting of polycrystal-Sn and single-crystal-Sn, and the group consisting of polycrystal-Si and single-crystal-Si as a vapor source on a boat, the vapor source is evaporated by heating, which is accomplished by resistance heating method or electron beam method (E.B. method).

In order to form the above Non-(Ge,Sn)(Si)(H,X) layer by the HR-CVD method, germanium atom supplying gaseous raw material and/or tin atom supplying gaseous raw material, and if necessary, silicon atom supplying gaseous raw material, or a mixture of one or more of these gaseous raw materials are introduced under predetermined conditions into an activation chamber to thereby generate species (A) using a glow discharge energy or thermal energy, at the same time, hydrogen atom supplying gaseous raw material and/or halogen atom supplying gaseous raw material are introduced under predetermined conditions into another activation chamber to thereby generate species (B) using the above-mentioned activation energy, and the resultant two species (A) and (B) are separately introduced into a deposition chamber to cause chemical reaction among them resulting in forming said layer on a substrate placed in the deposition chamber. In the case of forming a layer composed of Non-(Ge,Sn)(Si)(H,X) containing the germanium atoms (Ge) or/and the tin atoms (Sn) at uneven distribution concentration in the layer thicknesswise direction, such layer can be properly formed by controlling the distribution concentration of the Ge or/and the Sn along with a predetermined variation coefficient curve.

And, to form the above Non-(Ge,Sn)(Si)(H,X) layer by the FO-CVD method, germanium supplying gaseous raw material and/or tin atom supplying gaseous raw material, and if necessary silicon atom supplying gaseous raw material are separately or together introduced under predetermined conditions into a deposition chamber, and at the same time, halogen gas is introduced under predetermined conditions into the deposition chamber separately from the above gaseous raw materials to cause chemical reaction among the gaseous materials resulting in forming said layer on a substrate placed in the deposition chamber.

In the case of forming a layer composed of Non-(Ge,Sn)(Si)(H,X) containing the germanium atoms (Ge) or/and the tin atoms (Sn) at uneven distribution concentration in the layer thicknesswise direction, such layer can be properly formed by controlling the distribution concentration of the Ge or/and the Sn along with a predetermined variation coefficient curve.

The feed gas to liberate Ge includes gaseous or gasifiable germanium hydrides such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, and $Ge_9H_{20}$, with $GeH_4$, $Ge_2H_6$, and $Ge_3H_8$, being preferable on account of their ease of handling and the effective liberation of germanium atoms.

Examples of the feed gas to release tin atoms (Sn) include tin hydride ($SnH_4$) and tin halides such as $SnF_2$, $SnF_4$, $SnCl_2$, $SnCl_4$, $SnBr_2$, $SnBr_4$, $SnI_2$, and $SnI_4$ which are in the gaseous form or gasifiable. Tin halides are preferable because they form on the substrate a layer containing halogen atoms. Among tin halides, $SnCl_4$ is particularly preferable because of its ease of handling and its efficient tin supply.

In the case where solid $SnCl_4$ is used as a raw material to supply tin atoms (Sn), it should preferably be gasified by blowing (bubbling) an inert gas (e.g., Ar and He) into it while heating. The gas thus generated is introduced, at a desired pressure, into the deposition chamber.

As the silicon atom supplying raw material, the halogen atom supplying raw material and the hydrogen atom supplying raw material, any of those above mentioned in the case of the CGL can be used.

As for the halogen atom supplying raw material, other than those above mentioned in the case of the CGL, it is also possible to use any of the following gaseous or gasifiable substances; hydrogen halides such as HF, HCl, HBr, and HI; halogen-substituted silanes such as $SiH_2F_2$, $SiH_2I_2$, $SiH_2Cl_2$, $SiHCl_3$, $SiH_2Br_2$, and $SiHBr_3$; germanium hydride halide such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, and $GeH_3I$; and germanium halides such as $GeF_4$, $GeCl_4$, $GeBr_4$, $GeI_4$, $GeF_2$, $GeCl_2$, $GeBr_2$, and $GeI_2$; halogen-substituted tin hydrides such as $SnHF_3$, $SnH_2F_2$, $SnH_3F$, $SnHCl_3$, $SnH_2Cl_2$, $SnH_3Cl$, $SnHBr_3$, $SnH_2Br_2$, $SnH_3Br$, $SnHI_3$, $SnH_2I_2$ and $SnH_3I$; and tin halides such as $SnF_4$, $SnCl_4$, $SnBr_4$, $SnI_4$, $SnF_2$, $SnCl_2$, $SnBr_2$ and $SnI_2$.

Among these halogen atom supplying substances, the use of the hydrogen halide or the halogen-substituted halide is particularly advantageous since the hydrogen atoms (H), which are extremely effective in view of the control for the electrical or photoelectronic properties, are also introduced together with the introduction of the halogen atoms.

The structural introduction of hydrogen atoms into the IR absorption layer in a preferred embodiment can be properly carried out by causing glow discharge in a gaseous atmosphere where the foregoing germanium hydride and/or the foregoing tin hydride, and if necessary, the foregoing silicon hydride, and hydrogen gas coexist in the deposition chamber.

The amount of the hydrogen atoms (H) and/or the amount of the halogen atoms (X) to be contained in said layer can be adjusted properly by controlling related conditions, for example, the temperature of a substrate, the amount of a gaseous raw material copable of supplying the hydrogen atoms or the halogen atoms into the deposition chamber and the electric discharging power. In order to structurally introduce the conductivity controlling element (Mr) selected from the foregoing group III or group V atoms into the IR absorption layer, it is possible to use any of the gaseous or gasifiable raw materials capable of supplying the group III atoms or the group V atoms illustrated in the case of the charge injection inhibition layer. Such raw material gas of supplying the element (Mr) is introduced together with the raw material contributing to formation of the IR absorption layer upon forming the layer while controlling the amount to be fed.

In order to introduce carbon atoms, oxygen atoms or nitrogen atoms into a layer to be formed in the case of forming the CTL, the charge injection inhibition layer, the IR absorption layer and the surface layer in the light receiving member for use in electrophotography according to this invention, one or more of a raw material capable of supplying carbon atoms, a raw material capable of supplying nitrogen atoms is introduced together with the raw material contributing to formation of such layer into the deposition chamber while controlling the amount to be fed.

That is, in order to form a layer containing carbon atoms using the glow discharging method, the HR-CVD method or the FO-CVD method, the gaseous raw material for introducing carbon atoms is added to the raw material selected as required from the raw materials for forming such layer. As the raw material for introducing carbon atoms, most of gaseous or gasifiable materials containing carbon atoms as the constituent atoms can be used.

For instance, it is possible to use a mixture of gaseous raw material containing silicon atoms (Si) as the constituent atoms, gaseous raw material containing carbon atoms (C) as the constituent atoms and, optionally, gaseous raw material containing hydrogen atoms (H) and/or halogen atoms (X) as the constituent atoms in a desired mixing ratio, a mixture of gaseous raw material containing silicon atoms (Si) as the constituent atoms and gaseous raw material containing carbon atoms (C) and hydrogen atoms (H) as the constituent atoms also in a desired mixing ratio, or a mixture of gaseous raw material containing silicon atoms (Si) and hydrogen atoms (H) as the constituent atoms and gaseous raw material containing carbon atoms (C) as the constituent atoms.

Those gaseous raw materials that are effectively usable herein can include gaseous or gasifiable substances containing carbon atoms (C) and hydrogen atoms (H) as the constituent atoms, such as those containing carbon atoms (C) and hydrogen atoms (H) as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material containing silicon atoms (Si), carbon atoms (C) and hydrogen atoms (H) as the constituent atoms can include silicided alkyls, for example, $Si(CH_3)_4$ and $Si(C_2H_5)_4$. In addition, carbon halide compounds such as $CF_4$, $CCl_4$ and $CH_3CF_4$ can also be mentioned in that they can also introduce halogen atoms (X) in addition to the introduction of carbon atoms.

In the case of forming such layer containing carbon atoms (C) by the reactive sputtering method, it is carried out by using a single crystal or polycrystalline Si wafer, a C (graphite) wafer or a wafer containing a mixture of Si and C as a target and sputtering them in a desired gas atmosphere.

In the case of using, for example, an Si wafer as a target, a gaseous raw material for introducing carbon atoms (C) is introduced while being optionally diluted with a silution gas such as Ar and He into a sputtering deposition chamber thereby forming gas plasmas with these gases and sputtering the Si wafer.

Alternatively, in the case of using Si and C as individual targets or as a single target comprising Si and C in admixture, gaseous raw material for introducing hydrogen atoms as the sputtering gas is optionally diluted with a dilution gas, introduced into a sputtering deposition chamber thereby forming gas plasmas and sputtering is carried out. As the gaseous raw material for introducing each of the atoms used in the sputtering process, those gaseous starting materials used in other methods as described above may be used as they are.

In order to form a layer containing oxygen atoms using the glow discharging method, the HR-CVD method or the FO-CVD method, the gaseous raw material for introducing the oxygen atoms is added to the raw material selected as required from the raw materials for forming such layer.

As the raw material for introducing oxygen atoms, most of those gaseous or gasifiable materials which contain at least oxygen atoms as the constituent atoms.

For instance, it is possible to use a mixture of a gaseous raw material containing silicon atoms (Si) as the constituent atoms, a gaseous starting material containing oxygen atoms (O) as the constituent atoms and, as required, a gaseous raw material containing hydrogen atoms (H) and/or halogen atoms (X) as the constituent atoms in a desired mixing ratio, a mixture of gaseous raw material containing silicon atoms (Si) as the constituent atoms and a gaseous raw material containing oxygen atoms (O) and hydrogen atoms (H) as the constituent atoms in a desired mixing ratio, or a mixture of gaseous raw material containing silicon atoms (Si) as the constituent atoms and a gaseous raw material containing silicon atoms (Si) oxygen atoms (O) and hydrogen atoms (H) as the constituent atoms.

Further, it is also possible to use a mixture of a gaseous raw material containing silicon atoms (Si) and hydrogen atoms (H) as the constituent atoms and a gaseous starting raw containing oxygen atoms (O) as the constituent atoms.

Specifically, there can be mentioned, for example, oxygen ($O_2$), ozone ($O_3$), nitrogen monoxide (NO), nitrogen dioxide ($NO_2$), dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes comprising silicon atoms (Si), oxygen atoms (O) and hydrogen atoms (H) as the constituent atoms, for example, disiloxane ($H_3SiOSiH_3$) and trisiloxane ($H_3SiOSiH_2OSiH_3$), etc.

In the case of forming such layer containing oxygen atoms by way of the reactive sputtering method, it may be carried out by sputtering a single crystal or polycrystalline Si wafer or $SiO_2$ wafer, or a wafer containing Si and $SiO_2$ in admixture is used as a target and sputtered them in various gas atmospheres.

For instance, in the case of using the Si wafer as the target, a gaseous starting material for introducing oxygen atoms and, optionally, hydrogen atoms and/or halogen atoms is diluted as required with a dilution gas, introduced into a sputtering deposition chamber, gas plasmas with these gases are formed and the Si wafer is sputtered.

Alternatively, sputtering may be carried out in the atmosphere of a dilution gas or in a gas atmosphere containing at least hydrogen atoms (H) and/or halogen atoms (X) as constituent atoms as a sputtering gas by using individually Si and $SiO_2$ targets or a single Si and $SiO_2$ mixed target. As the gaseous raw material for introducing the oxygen atoms, the gaseous raw material for introducing the oxygen atoms shown in other methods as described above can be used as the effective gas also in the sputtering.

In order to form a layer containing nitrogen atoms using the glow discharging method, the HR-CVD method or the FO-CVD method, the raw material for introducing nitrogen atoms is added to the raw material selected as required from the raw materials for forming such layer. As the raw material for introducing nitrogen atoms, most of gaseous or gasifiable materials which contain at least nitrogen atoms as the constituent atoms can be used.

For instance, it is possible to use a mixture of a gaseous raw material containing silicon atoms (Si) as the constituent atoms, a gaseous raw material containing nitrogen atoms (N) as the constituent atoms and, optionally, a gaseous raw material containing hydrogen atoms (H) and/or halogen atoms (X) as the constituent atoms in a desired mixing ratio, or a mixture of a gaseous raw material containing silicon atoms (Si) as the constituent atoms and a gaseous raw material containing nitrogen atoms (N) and hydrogen atoms (H) as the constituent atoms also in a desired mixing ratio.

Alternatively, it is also possible to use a mixture of a gaseous raw material containing nitrogen atoms (N) as the constituent atoms and a gaseous raw material containing silicon atoms (Si) and hydrogen atoms (H) as the constituent atoms.

The raw material that can be used effectively as the gaseous raw material for introducing the nitrogen atoms (N) used upon forming the layer containing nitrogen atoms can include gaseous or gasifiable nitrogen, nitrides and nitrogen compounds such as azide compounds containing at least nitrogen atoms (N) as the constituent atoms or both nitrogen atoms (N) and hydrogen atoms (H) as the constituent atoms, for example, nitrogen ($N_2$), ammonia ($NH_3$), hydrazine ($H_2NNH_2$), hydrogen azide ($HN_3$) and ammonium azide ($NH_3N_3$). In addition, nitrogen-halide compounds such as nitrogen trifluoride ($F_3N$) and nitrogen tetrafluoride ($F_4N_2$) can also be mentioned in that they can also introduce halogen atoms (X) in addition to the introduction of nitrogen atoms (N).

The layer containing nitrogen atoms may be formed by the sputtering method by using a single crystal or polycrystalline Si wafer of $Si_3N_4$ wafer or a wafer containing Si and $Si_3N_4$ in admixture as a target and sputtering them in various gas atmospheres.

In the case of using an Si wafer as a target, for instance, a gaseous starting material for introducing nitrogen atoms and, as required, hydrogen atoms and/or halogen atoms is diluted optionally with a dilution gas, and introduced into a sputtering deposition chamber to form gas plasmas with these gases and the Si wafer is sputtered.

Alternatively, Si and $Si_3H_4$ may be used as individual targets or as a single target comprising Si and $Si_3N_4$ in admixture and then sputtered in the atmosphere of a dilution gas or in a gaseous atmosphere containing at least hydrogen atoms (H) and/or halogen atoms (X) as the constituent atoms as for the sputtering gas. As the gaseous raw material for introducing nitrogen atoms, those gaseous raw materials for introducing the nitrogen atoms shown in other methods as described above can be used as the effective gas also in the case of the sputtering.

In order to form the layer having a desired thicknesswise distribution state (depth profile) for the distribution concentration C of the atoms (C,O,N) in the case of the glow discharging method, the HR-CVD method or the FO-CVD method, the raw material gas for introducing the atoms (O,C,N) is introduced into the deposition chamber while properly varying its flow rate in accordance with a predetermined variation coefficient curve upon forming the layer. In an example in this case, the gas flow rate may be varied, specifically, by gradually changing the opening degree of a predetermined needle valve disposed to the midway of the gas flow system, for example, manually or any of other means usually employed such as in externally driving motor. In this case, the variation of the flow rate may not necessarily be linear but a desired content curve may be obtained, for example, by controlling the flow rate along with a previously designed variation coefficient curve by using a microcomputer or the like.

The above-mentioned procedures can be also employed in the case of forming such layer by the reactive sputtering method. In an alternative in the case of using the reactive sputtering method, it can be carried out by using such target containing the atoms (O,C,N) in a state of being desirably varied in the thicknesswise direction.

The conditions upon forming the CGL, the CTL, the charge injection inhibition layer, the IR absorption layer and the surface layer to constitute the light receiving layer of the light receiving member for use in electrophotography, for example, the temperature of the support, the gas pressure in the deposition chamber, and the electric discharging power are important factors for obtaining desired respective layers having desired properties and they are properly selected while considering the functions of each layer to be made. Further, since these layer forming conditions may be varied depending on the kind and the amount of each of the atoms contained in respective layers, the conditions have to be determined also taking the kind or the amount of the atoms to be contained into consideration.

In a detailed example of forming a layer composed of an amorphous material, the temperature of the substrate is preferably from 50° to 400° C. and more preferably, from 100° to 300° C.; the gas pressure in the deposition chamber is preferably from $1\times10^{-4}$ to 10 Torr, more preferably $1\times10^{-3}$ Torr, and most preferably, $1\times10^{-2}$ to 1 Torr.

However, the actual conditions for forming each constituent layer such as temperature of the substrate, discharging power and the gas pressure in the deposition chamber cannot usually be determined with ease independent of each other. Accordingly, the conditions optimal to the layer formation are desirably determined based on relative and organic relationships for forming the amorphous material layer having desired properties.

In order to form a layer composed of a polycrystalline material, various methods can be used.

In one of such method using the plasma CVD method, such layer may be formed by adjusting the temperature of the substrate to 400° to 600° C.

In another method using the plasma CVD method, an amorphous-like layer is formed on the substrate being maintained at about 250° C. and the resultant layer is anealed to thereby prepare such layer composed of a polycrystalline material, wherein the anealing treatment is carried out by heating the substrate at a temperature between 400° C. and 600° C. for 5 to 30 minutes or by irradiating laser beam to the layer for 5 to 30 minutes.

DESCRIPTION OF THE PREFERRED EMBODIMENTS

The invention will be described more specifically while referring to examples, but the invention is no way limited only to these examples.

The light receiving member for use in electrophotography can be properly prepared using any of the fabrication apparatuses shown in FIGS. 60 through 63.

Figure 60:
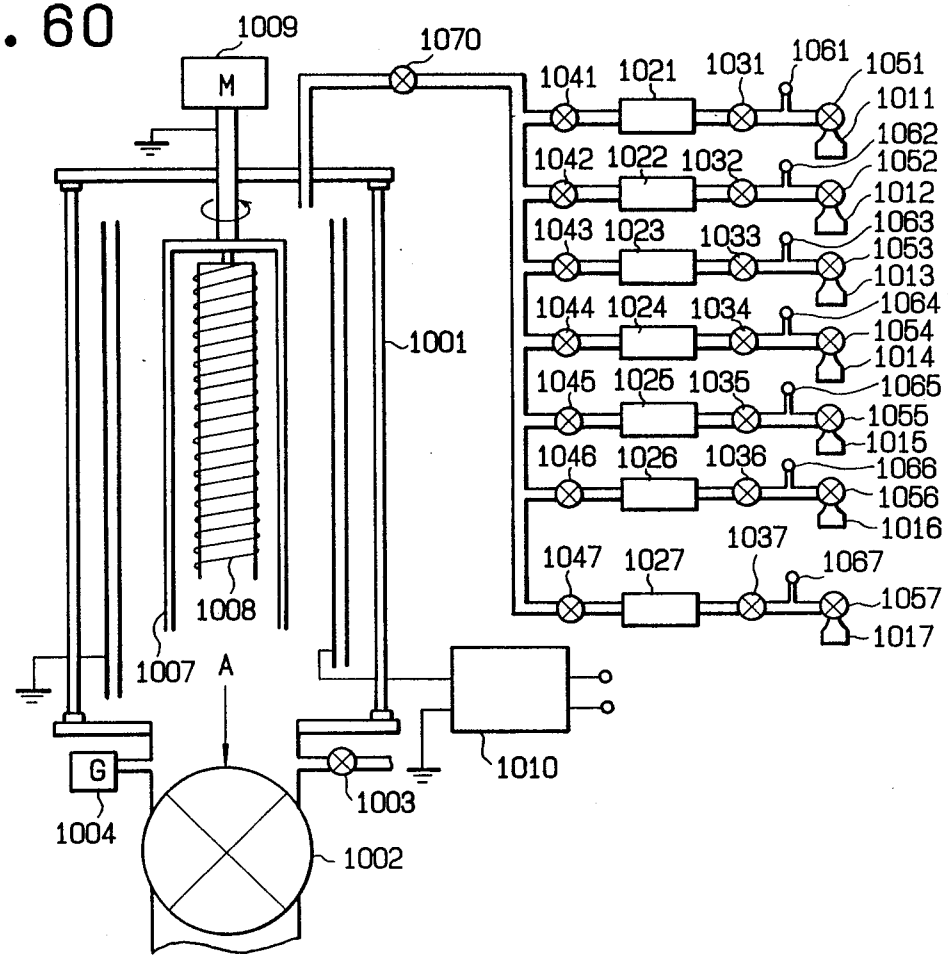
FIG. 60 is a schematic explanatory view of a RF glow discharging fabrication apparatus for preparing a light receiving layer of the light receiving member for use in electrophotography according to this invention.

FIG. 60 shows a representative fabrication apparatus by means of the glow discharging process.

In the fabrication apparatus shown in FIG. 60, gas reservoirs 1011, 1012, 1013, 1014, 1015, 1016 and 1017 illustrated in the figure are charged with gaseous raw materials for forming the respective layers in the light receiving member for use in electrophotography according to this invention, that is, for instance, $SiH_4$ gas (99.999% purity) in the reservoir 1011 $H_2$ gas (99.999% purity) in the reservoir 1012, $B_2H_6$ gas (99.999% purity) diluted with $H_2$ (referred to as "$B_2H_6/H_2$") in the reservoir 1013, NO gas (99.5% purity) in the reservoir 1014, $GeH_4$ gas (99.99% purity) in the reservoir 1015, $NH_3$ gas (99.999% purity) in the reservoir 1016, and $CH_4$ gas (99.999% purity) in the reservoir 1017.

Explanation will be made to preparing the light receiving member, for use in electrophotography according to this invention having the layer constitution for the light receiving layer on an Al cylindrical substrate as shown in FIG. 1(H).

There are used SiH4 gas, $B_2H_6/H_2$ gas, NO gas and $GeH_4$ gas for forming the IR absorption layer 103; $SiH_4$ gas, $H_2$ gas, $B_2H_6/H_2$ gas and NO gas for forming the charge injection inhibition layer 104; $SiH_4$ gas and $H_2$ gas for forming the CGL 105; $SiH_4$ gas, NO gas, $B_2H_6/H_2$ gas and $CH_4$ gas for forming the CTL 106; and $SiH_4$ gas and $CH_4$ gas for forming the surface layer 107.

Prior to the entrance of these gases into a reaction chamber 1001, it is confirmed that valves 1051 to 1057 for the gas reservoirs 1011 to 1017 and a leak valve 1003 are closed and that inlet valves 1031 to 1037, exit valves 1041 to 1047 and sub-valve 1070 are opened. Then, a main valve 1002 is at first opened to evacuate the inside of the reaction chamber 1001 and gas piping.

Then, upon observing that the reading on the vacuum gauge 1004 became about $5\times10^{-6}$ Torr, the sub-valve 1070 and the exit valves 1041 through 1047 are closed.

At first, $SiH_4$ gas from the reservoir 1011, $H_2$ gas from the reservoir 1012, $B_2H_6/H_2$ gas from the reservoir 1013, NO gas from the reservoir 1014, $NH_3$ gas from the reservoir 1015 and $CH_4$ gas from the reservoir 1016 are caused to flow into mass flow controllers 1021 through 1026 respectively by opening the inlet valves 1031 through 1036, controlling the pressure of exit pressure gauges 1061 through 1066 to 2 kg/cm2.

And, the cylindrical substrate 1007 being placed in the reaction chamber is heated to and maintained at a temperature of 50° to 350° C. by actuating a heater 1008.

After the preparatory works being thus completed, the formation of each of the IR absorption layer, the charge injection inhibition layer, the CGL, the CTL and the surface layer is commenced.

In order to form the IR absorption layer, the exit valves 1041, 1043, 1044 and 1045, and the sub-valve 1070 are gradually opened to enter $SiH_4$ gas, $B_2H_6/H_2$ gas, NO gas and $GeH_4$ gas into the reaction chamber 1001.

In this case, the exit valves 1041, 1043, 1044 and 1045 are adjusted so as to attain a desired valve for the ratio among the $SiH_4$ gas flow rate, the $B_2H_6/H_2$ gas flow rate, the NO gas flow rate and the $GeH_4$ gas flow rate, and the opening of the main valve 1002 is adjusted while observing the reading on the vacuum gauge 1004 so as to obtain a desired valve for the pressure inside the reaction chamber 1001. The, a power source 1010 is set to a predetermined electrical power to cause RF glow discharging in the reaction chamber 1001 while controlling the flow rates of the NO gas and/or the $B_2H_6/H_2$ gas in accordance with a previously designed variation coefficient curve, to thereby from the IR absorption layer on the cylindrical substrate. When the IR absorption layer has reached a desired thickness, the exit valves 1041, 1043, 1044 and 1045 are completely closed to stop the formation of the IR absorption layer.

The successive formation of the charge injection inhibition layer on the previously formed IR absorption layer is carried out in the following way.

That is, the exit valves 1041, 1042, 1043 and 1044, and the sub-valve 1070 are gradually opened to enter $SiH_4$ gas, $H_2$ gas, $B_2H_6/H_2$ gas and NO gas into the reaction chamber 1001.

In this case, the exit valves 1041, 1042, 1043 and 1044 are adjusted so as to attain a desired value for the ratio among the $SiH_4$ gas flow rate, the $H_2$gas flow rate, the $B_2H_6/H_2$ gas flow rate and the NO gas flow rate, and the opening of the main valve 1002 is adjusted while observing the reading on the vacuum gauge 1004 so as to obtain a desired value for the pressure inside the reaction chamber 1001. Then, the power source 1010 is set to a predetermined electrical power to cause RF glow discharging in the reaction chamber 1001 while controlling the flow rates of the NO gas and/or the $B_2H_6/H_2$ gas in accordance with a previously designed variation coefficient curve, to thereby from the charge injection inhibition layer on the IR absorption layer. When the charge injection inhibition layer has reached a desired thickness, the exit valves 1041, 1042, 1043 and 1044 are completely closed to stop the formation of the charge injection inhibition layer.

In order to form the CGL on the charge injection inhibition layer, the exit valves 1041 and 1042, and the subvalve 1070 are opened to enter $SiH_4$ gas and $H_2$ gas in the reaction chamber 1001.

In this case, the exit valves 1041 and 1042 are adjusted so as to attain a desired value for the ratio among the $SiH_4$ gas flow rate and the $H_2$ gas flow rate, and the opening of the main valve 1002 is adjusted while observing the reading on the vacuum gauge 1004 so as to obtain a desired value for the pressure inside the reaction chamber 1001. Then, the power source 1010 is set to a predetermined electrical power to cause RF glow discharging in the reaction chamber 1001, to thereby form the CGL on the charge injection inhibition layer. When the CGL has reached a desired thickness, the exit valves 1041 and 1042 are completely closed to stop the formation of the CGL.

In order to form the CTL on the CGL, the exit valves 1041, 1043, 1044 and 1047, and the sub-valve 1070 are gradually opened to enter $SiH_4$ gas, $B_2H_6/H_2$ gas, NO gas and $CH_4$ gas into the reaction chamber 1001.

In this case, the exit valves 1041, 1043, 1044 and 1047 are adjusted so as to attain a desired value for the ratio among the $SiH_4$ gas flow rate, the $B_2H_6/H_2$ gas flow rate, the NO gas flow rate and the $CH_4$ gas flow rate, and the opening of the main valve 1002 is adjusted while observing the reading on the vacuum gauge 1004 so as to obtain a desired value for the pressure inside the reaction chamber 1001. Then, the power source 1010 is set to a predetermined electrical power to cause RF glow discharging in the reaction chamber 1001 while controlling the flow rates of the $CH_4$ gas and/or the NO gas, and/or the $B_2H_6/H_2$ gas in accordance with a previously designed variation coefficient curve, to thereby form the CTL on the CGL. When the CTL has reached a desired thickness, the exit valves 1041, 1043, 1044 and 1047 are completely closed to stop the formation of the CTL.

In order to form the surface layer on the CTL, the exit valves 1041 and 1047, and the sub-valve 1070 are gradually opened to enter $SiH_4$ gas and $CH_4$ gas into the reaction chamber 1001.

In this case, the exit valves 1041 and 1047 are adjusted so as to attain a desired value for the ratio among the $SiH_4$ gas flow rate and the $CH_4$ gas flow rate, and the opening of the main valve 1002 is adjusted while observing the reading on the vacuum gauge 1004 so as to obtain a desired value for the pressure inside the reaction chamber 1001. Then, the power source 1010 is set to a predetermined electrical power to cause RF glow discharging in the reaction chamber 1001 to thereby form the surface layer on the CTL. When the surface layer has reached a desired thickness, the exit valves 1041 and 1047 are completely closed to stop the formation of the surface layer.

All of the exit valves other than those required for upon forming the respective layers are of course closed. Further, upon forming the respective layers, the inside of the system is once evacuated to a high vacuum degree as required by closing the exit valves 1041 through 1047 while entirely opening the sub-valve 1070 and entirely opening the main valve 1002.

Further, during the layer forming operation, the Al cylinder as substrate 1007 is rotated at a predetermined speed by the action of the motor 1009.

Figure 61:
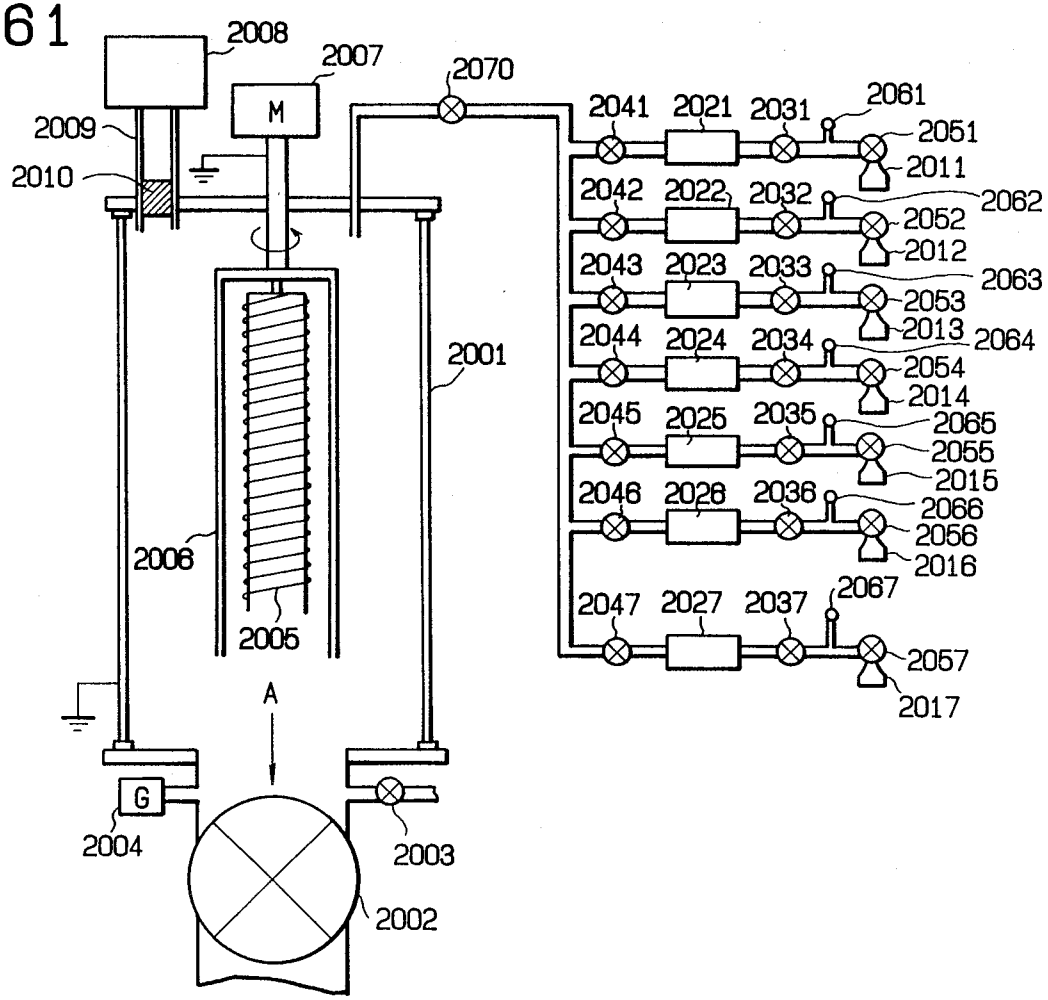
FIG. 61 is a schematic explanatory view of a microwave glow discharging fabrication apparatus for preparing a light receiving layer of the light receiving member for use in electrophotography according to this invention.

FIG. 61 shows another representative fabrication apparatus by means of the microwave ($\mu$W) glow discharging process.

Explanation will be made to preparing the light receiving member for use in electrophotography according to this invention having the layer constitution for the light receiving layer on an Al cylindrical substrate as shown in FIG. 1(H).

In the fabrication apparatus shown in FIG. 61, gas reservoirs 2011, 2012, 2013, 2014, 2016 and 2017 illustrated in the figure are charged with gaseous raw materials for forming the respective layers in the light receiving member for use in electrophotography according to this invention, that is, for instance, $SiH_4$ gas (99.999% purity) in the reservoir 2011, $H_2$ gas (99.999% purity)in the reservoir 2012, $B_2H_6$ gas (99.999% purity) diluted with $H_2$ (referred to as "$B_2H_6/H_2$") in the reservoir 2013, NO gas (99.5% purity) in the reservoir 2014, $GeH_4$ gas (99.999% purity) in the reservoir 2015, NH3 gas (99.99% purity) in the reservoir 2016, and $CH_4$ gas (99.999% purity) in the reservoir 2017.

There are used $SiH_4$ gas, $B_2H_6/H_2$ gas, NO gas and $GeH_4$ gas for forming the IR absorption layer 103; $SiH_4$ gas, $H_2$ gas, $B_2H_6/H_2$ gas and NO gas for forming the charge injection inhibition layer 104; $SiH_4$ gas and $H_2$ gas for forming the CGL 105; $SiH_4$ gas, $NH_3$ gas, $B_2H_6/H_2$ gas and $CH_4$ gas for forming the CTL 106; and $SiH_4$ gas and $CH_4$ gas for forming the surface layer 107.

Prior to the entrance of these gases into a reaction chamber 2001, it is confirmed that valves 2051 to 2057 for the gas reservoirs 2011 to 2017 and a leak valve 2003 are closed and that inlet valves 2031 to 2037, exit valves 2041 to 2047, and sub-valve 2070 are opened. Then, a main valve 2002 is at first opened to evacuate the inside of the reaction chamber 2001 and gas piping.

Then, upon observing that the reading on the vacuum gauge 2004 became about $5\times10^{-6}$ Torr, the sub-valve 2070 and the exit valves 2041 through 2046 are closed.

At first, $SiH_4$ gas from the reservoir 2011, $H_2$ gas from the reservoir 2012, $B_2H_6/H_2$ gas from the reservoir 2013, NO gas from the reservoir 2014, $GeH_4$ gas from the reservoir 2015, $NH_3$ gas from the reservoir 2016 and $CH_4$ gas from the reservoir 2017 are caused to flow into mass flow controllers 2012 through 2027 respectively by opening the inlet valves 2031 through 2037 controlling the pressure of exit pressure gauges 2061 through 2067 to 2 kg/cm$^2$.

And, the cylindrical substrate 2006 being placed in the reaction chamber 2001 is heated to and maintained at a temperature of 50° to 350° C. by actuating a heater 2005.

After the preparatory works being thus completed, the formation of each of the IR absorption layer, the charge injection inhibition layer, the CGL, the CTL and the surface layer is commenced.

In order to form the IR absorption layer, the exit valves 2041, 2043, 2044 and 2045, and the sub-valve 2070 are gradually opened to enter $SiH_4$ gas, $B_2H_6/H_2$ gas, NO gas and $GeH_4$ gas into the reaction chamber 2001.

In this case, the exit valves 2041, 2043, 2044 and 2045 are adjusted so as to attain a desired value for the ratio among the $SiH_4$ gas flow rate, the $B_2H_6/H_2$ gas flow rate, the NO gas flow rate and the $GeH_4$ gas flow rate, and the opening of the main valve 2002 is adjusted while observing the reading on the vacuum gauge 2004 so as to obtain a desired value for the pressure inside the reaction chamber 2001.

Then, a microwave power source 2008 being connected through a waveguide 2009 and a dielectric window 2010 to the reaction chamber 2001 through its upper wall and another microwave power source being also connected in the same way to the reaction chamber through its bottom wall (not shown) are together set to a predetermined electric power to cause microwave ($\mu$W) glow discharging in the reaction chamber 2001 while controlling the flow rates of the NO gas and/or the $B_2H_6/H_2$ gas in accordance with a predetermined variation coefficient curve, to thereby form the IR absorption layer on the cylindrical substrate. When the IR absorption layer has reached a desired thickness, the exit valves 2041, 2043, 2044 and 2045 are completely closed to stop the formation of the IR absorption layer.

The successive formation of the charge injection inhibition layer on the previously formed IR absorption layer is carried out in the following way.

That is, the exit valves 2041, 2042, 2043 and 2044, and the sub-valve 2070 are gradually opened to enter $SiH_4$ gas, $H_2$ gas, $B_2H_6/H_2$ gas and NO gas into the reaction chamber 2001.

In this case, the exit valves 2041, 2042, 2043 and 2044 are adjusted so as to attain a desired value for the ratio among the $SiH_4$ gas flow rate, the $H_2$ gas flow rate, the $B_2H_6/H_2$ gas flow rate and the NO gas flow rate, and the opening of the main valve 2002 is adjusted while observing the reading on the vacuum gauge 2004 so as to obtain a desired value for the pressure inside the reaction chamber 2001. Then, the above-mentioned two microwave power sources are together set to a predetermined electric power to cause microwave ($\mu$W) glow discharging in the reaction chamber 2001 while controlling the flow rates of the $B_2H_6/H_2$gas and/or the NO gas in accordance with a predetermined variation coefficient curve, to thereby form the charge injection inhibition layer on the IR absorption layer. When the charge injection inhibition layer has reached a desired thickness, the exit valves 2041, 2042, 2043 and 2044 are completely closed to stop the formation of the charge injection inhibition layer.

In order to form the CGL on the charge injection inhibition layer, the exit valves 2041 and 2042, and the sub-valve 2070 are opened to enter $SiH_4$ gas and $H_2$ gas in the reaction chamber 2001.

In this case, the exit valves 2041 and 2042 are adjusted so as to attain a desired value for the ratio among the $SiH_4$ gas flow rate and the $H_2$ gas flow rate, and the opening of the main valve 2002 is adjusted while observing the reading on the vacuum gauge 2004 so as to obtain a desired value for the pressure inside the reaction chamber 2001. Then, the above-mentioned two microwave source are together set to a predetermined electrical power to cause microwave ($\mu$W) glow discharging in the reaction chamber 2001, to thereby form the CGL on the charge injection inhibition layer. When the CGL has reached a desired thickness, the exit valves 1041 and 1042 are completely closed to stop the formation of the CGL.

In order to form the CTL on the CGL, the exit valves 2041, 2043, 2046 and 1047, and the sub-valve 2070 are gradually opened to enter $SiH_4$ gas, $B_2H_6/H_2$ gas, $NH_3$ gas and $CH_4$ gas into the reaction chamber 2001.

In this case, the exit valves 2041, 2043, 2046 and 2047 are adjusted so as to attain a desired value for the ratio among the $SiH_4$ gas flow rate, the $B_2H_6/H_2$ gas flow rate, the $NH_3$ gas flow rate and the $CH_4$ gas flow rate, and the opening of the main valve 2002 is adjusted while observing the reading on the vacuum gauge 2004 so as to obtain a desired value for the pressure inside the reaction chamber 2001. Then, the above-mentioned two microwave source are together set to a predetermined electrical power to cause microwave ($\mu$W) glow discharging in the reaction chamber 2001 while controlling the flow rates of the $B_2H_6/H_2$ gas and/or the $CH_4$ gas in accordance with a predetermined variation coefficient curve, to thereby form the CTL on the CGL. When the CGL has reached a desired thickness, the exit valves 1041 and 1042 are completely closed to stop the formation of the CGL.

In order to form the surface layer on the CTL, the exit valves 1041 and 1047, and the sub-valve 1070 are gradually opened to enter $SiH_4$ gas and $CH_4$ gas into the reaction chamber 1001.

In this case, the exit valves 1041 and 1047 are adjusted so as to attain a desired value for the ratio among the $SiH_4$ gas flow rate and the $CH_4$ gas flow rate, and the opening of the main valve 1002 is adjusted while observing the reading on the vacuum gauge 1004 so as to obtain a desired value for the pressure inside the reaction chamber 1001. Then, the above-mentioned two microwave source are together set to a predetermined electrical power to cause microwave ($\mu$W) glow discharging in the reaction chamber 2001, to thereby form the surface layer on the CTL. When the surface layer has reached a desired thickness, the exit valves 2041 and 2047 are completely closed to stop the formation of the surface layer.

All of the exit valves other than those required for upon forming the respective layers are of course closed. Further, upon forming the respective layers, the inside of the system is once evacuated to a high vacuum degree as required by closing the exit valves 2041 through 2046 while entirely opening the sub-valve 2070 and entirely opening the main valve 2002.

Further, during the layer forming operation, the Al cylinder as substrate 2006 is rotated at a predetermined speed by the action of the motor 2007.

Figure 62:
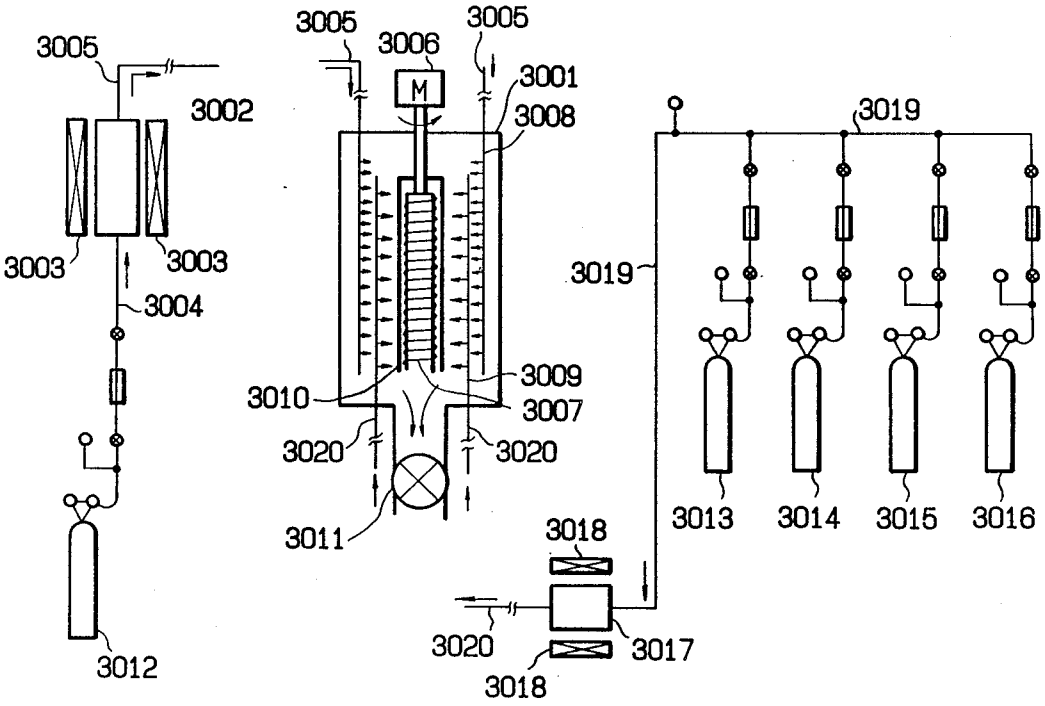
FIG. 62 is a schematic explanatory view of a fabrication apparatus by means of hydrogen radical chemical vapor deposition (hereinafter referred to as "HRCVD") for preparing a light receiving layer of the light receiving member for use in electrophotography according to this invention.

In FIG. 62, there is shown another representative fabrication apparatus by means of the HR-CVD process for preparing the light receiving member for use in electrophotography according to this invention.

Explanation will be made to preparation of the light receiving member for use in electrophotography according to this invention using the apparatus shown in FIG. 62.

In FIG. 62, there are shown deposition chamber 3001, activation chamber (A) 3002, microwave plasma generation means 3003 and 3018, a raw material gas feed pipe for active species (A) 3004, active species (A) conduit 3005, motor 3006, cylinder heater 3007, gas liberation pipes 3008 and 3009, cylindrical substrate 3010, and main exhaust valve 3011. Further, there are shown gas reservoirs 3012 through 3016, activation chamber (B) 3017, raw material supplying pipe 3019, and active species (B) conduit 3020.

Explanation will be made to the case of forming the light receiving member for use in electrophotography according to this invention having the light receiving layer on an Al cylindrical substrate as shown in FIG. 1(H) using the apparatus shown in FIG. 62.

As the raw material gases, there are used $SiH_4$ gas, $GeH_4$ gas, $B_2H_6/H_2$ gas, NO gas and $H_2$ gas for forming the IR absorption layer; $SiH_4$ gas, $B_2H_6/H_2$ gas, NO gas and $H_2$ gas for forming the charge injection inhibition layer; $SiH_4$ gas and $H_2$ gas for forming the CGL; $SiH_4$ gas, $SiF_4$ gas, $CH_4$ gas, $H_2$ gas and $B_2H_6/H_2$ gas for forming the CTL; and $SiH_4$ gas and $CH_4$ gas for forming the surface layer.

Firstly, an Al cylindrical substrate 3010 is fixed onto a substrate holder provided with the heater 3003 being suspended in the deposition chamber 3001 in a state that it can be rotated by the motor 3006.

Then, the air in the deposition chamber 3001 is evacuated to bring the inside to a vacuum of $5\times10^{-6}$ Torr.

Now, in order to form the IR absorption layer, $H_2$ gas from the reservoir 3012 is introduced through the gas feed pipe 3004 into the activation chamber (A) 3002 and the $H_2$ gas is activated by the action of the microwave plasma generation means 3003 to generated active hydrogen, which is successively introduced through the active species (A) conduit 3005 and the gas liberation pipe 3008 into the deposition chamber 3001. At the same time, $SiH_4$ gas from the reservoir 3013, $B_2H_6/H_2$ gas from the reservoir 3014, NO gas from the reservoir 3015, $CH_4$ gas from the reservoir 3016, $GeH_4$ gas and $SiF_4$ gas from the reservoirs (not shown) are introduced through the gas supplying pipe 3019 into the activation chamber (B) 3017 and these gases are activated by the action of the microwave plasma generation means 3018 to generate active species, which are successively introduced through the active species (B) conduit 3020 and the gas liberation pipe 3009 into the deposition chamber 3001. In each of the above cases, the flow rates of said raw material gases, the inner pressure, and the microwave power are all set to predetermined values respectively.

And, the Al cylindrical substrate 3010 is maintained at a predetermined temperature and the inside of the deposition chamber 3001 is properly evacuated by regulating the main valve 3011 to a predetermined vacuum.

In this way, the IR absorption layer is formed on the Al cylindrical substrate.

Using $H_2$ gas from the reservoir 3012, $SiH_4$ gas from the reservoir 3013, $B_2H_6/H_2$ gas from the reservoir 3014 and NO gas from the reservoir 3015, the above procedures are repeated to thereby form the charge injection inhibition layer on the IR absorption layer.

Likewise, using $H_2$ gas from the reservoir 3012 and $SiH_4$ gas from the reservoir 3013, the above procedures in the case of forming the IR absorption layer are repeated to thereby form the CGL on the charge injection inhibition layer.

Then, using $H_2$ gas from the reservoir 3012, $SiH_4$ gas from the reservoir 3013, $B_2H_6/H_2$ gas from the reservoir 3014, $CH_4$ gas from the reservoir 3016 and $SiF_4$ gas from the reservoir (not shown), the above procedures in the case of forming the IR absorption layer are repeated to thereby form the CTL on the CGL.

Finally, using $H_2$ gas from the reservoir 3012 and $SiH_4$ gas from the reservoir 3013, the procedures in the case of forming the CGL are repeated to thereby form the surface layer on the CTL.

And in any case where it is necessary to distribute the conductivity controlling element and/or the atoms (O,C,N) at uneven distribution concentration in the thicknesswise direction, the flow rate of the corresponding gas supplying such atoms is controlled properly in accordance with a predetermined variation coefficient curve.

Figure 63:
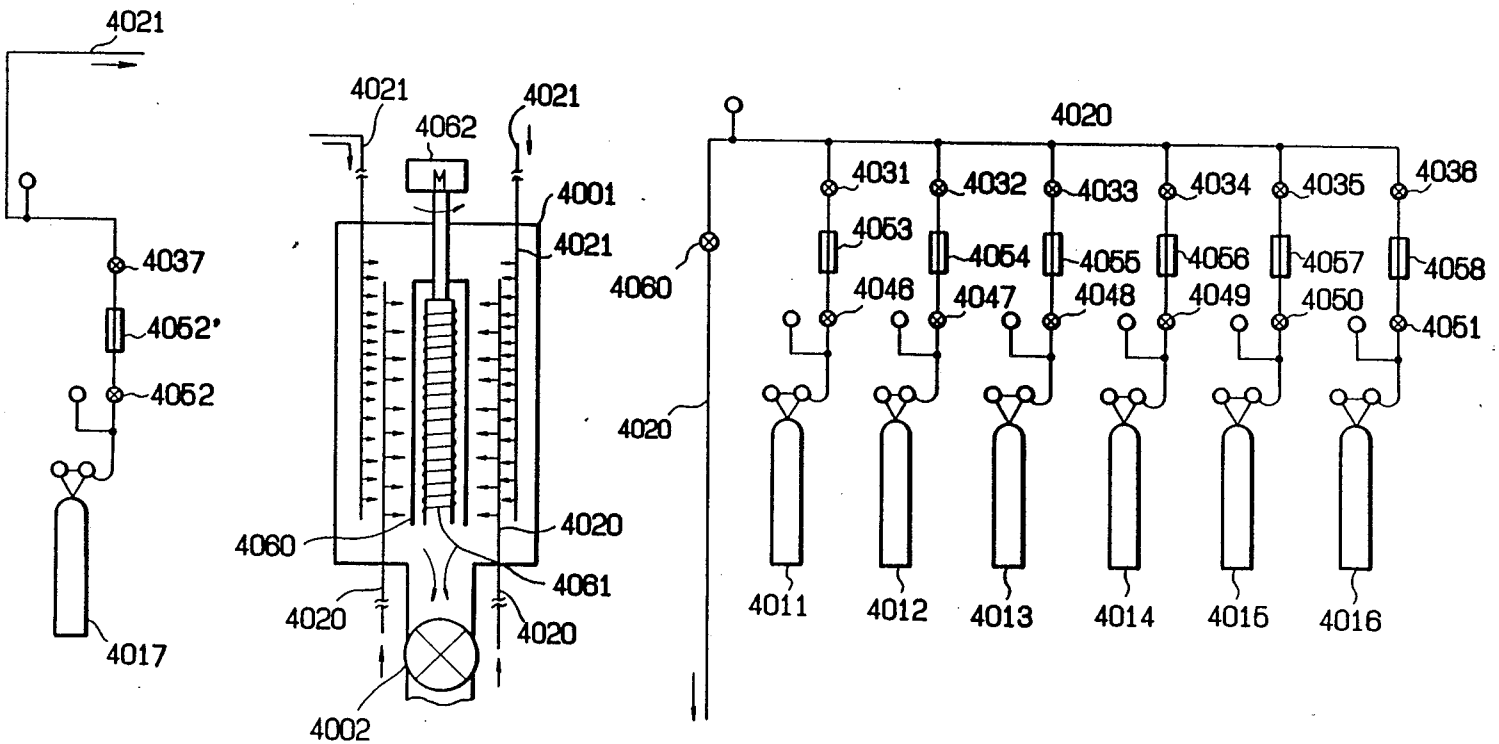
FIG. 63 is a schematic explanatory view of a fabrication apparatus by means of fluorine oxidation chemical vapor deposition (hereinafter referred to as "FOCVD") for preparing a light receiving layer of the light receiving member for use in electrophotography.

In FIG. 63, there is shown another representative fabrication apparatus by means of the FO-CVD process for preparing the light receiving member for use in electrophotography according to this invention.

Explanation will be made to preparation of the light receiving member for use in electrophotography according to this invention having the light receiving layer on an Al cylindrical substrate as shown in FIG. 1(H) using the apparatus shown in FIG. 63.

In the apparatus shown in FIG. 63, gas reservoirs 4011, 1012, 4013, 4014, 4015, 4016 and 4017 illustrated in the figure are charged with gaseous raw materials for forming the respective layers in the light receiving member for use in electrophotography according to this invention, that is, for instance, $SiH_4$ gas (99.999% purity) in the reservoir 4011, $H_2$ gas (99.999% purity) in the reservoir 4012, $B_2H_6$ gas (99.999% purity) diluted with $H_2$ (referred to as "$B_2H_6/H_2$ gas") in the reservoir 4013, NO gas (99.5% purity) in the reservoir 4014, $GeH_4$ gas (99.999% purity) in the reservoir 4015, $CH_4$ gas (99.999% purity) in the reservoir 4016 and $F_2$ gas (99.99% purity) diluted with $H_2$in the reservoir 4017.

As the raw material gases, there are used $SiH_4$ gas, $GeH_4$ gas, $B_2H_6/H_2$ gas, NO gas and $F_2$ gas for forming the IR absorption layer; $SiH_4$ gas, $B_2H_6/H_2$ gas, NO gas, $H_2$ gas and $F_2$ gas for forming the charge injection inhibition layer; $SiH_4$ gas, $H_2$ gas and $F_2$ gas for forming the CGL; $SiH_4$ gas, $F_2$ gas, $CH_4$ gas, and $B_2H_6/H_2$ gas for forming the CTL; and $SiH_4$ gas, $CH_4$ gas and $F_2$ gas for forming the surface layer.

In the apparatus shown in FIG. 63, the respective raw material gases from the reservoirs 4011 through 4015 are introduced respectively through mass flow controllers, 4053 to 4057, then raw material gas supplying pipe 4020 into the deposition chamber 4001.

On the other hand, the $F_2$ gas from the reservoir 4017 is introduced through mass flow controller 4052' and raw material gas supplying pipe 4021 into the deposition chamber 4001.

The inside of the deposition chamber 4001 is properly evacuated through main valve 4002 being mechanically connected to an exhaust apparatus (not shown).

Numeral 4060 stands for an Al cylindrical substrate 4060 placed on a substrate holder in which an electric heater 4061 being installed and which is suspended in the deposition chamber in a state that it can be rotated by motor 4062.

The electric heater 4061 serves to heat the Al cylindrical substrate 4060 or to aneal the film formed thereon.

Prior to the entrance of the raw material gases into the deposition chamber 4001, the inner pressure of the deposition chamber 4001 is adjusted to a vacuum of about $5\times10^{-6}$ Torr, and the raw material gases are introduced thereinto.

And, the temperature of the Al cylindrical substrate is adjusted to a temperature of 50° to 300° C.

In order to form the IR absorption layer, $SiH_4$ gas, $B_2H_6/H_2$ gas, NO gas and $GeH_4$ gas, and $F_2$ gas are entered respectively into the deposition chamber by opening the valves 4046, 4048, 4049, 4050 and 4052 and also gradually opening the exit valves 4031, 4033, 4034, 4035 and 4037, and the sub-valve 4060. In this case, the exit valves 4031, 4033, 4034, 4035 and 4037, and the sub-valve 4046 are adjusted so as to attain a desired valve for the ratio among the $SiH_4$ gas flow rate, the $B_2H_6/H_2$ gas flow rate, the NO gas flow rate, the $GeH_4$ gas flow rate and the $F_2$ gas flow rate, and the opening of the main valve 4002 is adjusted while observing the reading on a vacuum gauge (not shown) so as to obtain a desired value for the inner pressure of the deposition chamber 4001.

In this way, there is formed the IR absorption layer.

The above procedures are repeated to form the successive charge injection inhibition layer, CGL, CTL and surface layer using the corresponding raw material gases as above mentioned.

And in any case where it is necessary to distribute the conductivity controlling element and/or the atoms (O,C,N) at uneven distribution concentration in the thicknesswise direction, the flow rate of the corresponding gas supplying such atoms is controlled properly in accordance with a predetermined variation coefficient curve.

In any of the above-mentioned cases using one of the apparatuses shown in FIGS. 60 through 63, it is possible to use an appropriate dilution gas such as He, Ar, etc. in order to dilute the raw material gas to control the chemical reaction among the raw materials or to make discharging stable at the time of forming each layer. And, such dilution gas can be used alone or in a mixture with the raw material gas.

EXAMPLE 1

There were prepared multiple light receiving members for use in electrophotography on Al cylinders having a mirror plane surface under the conditions shown in Tables 1 through 4 using the RF glow discharging fabrication apparatus shown in FIG. 60.

For the resultant light receiving members (hereinafter, this kind light receiving member being referred to as "drum"), they were set to a conventional electrophotographic copying machine having digital exposure functions and using a semiconductor laser beam of 780 nm wavelength to examine the electrophotographic characteristics such as initial charge-retentivity, photosensitivity, residual potential, appearance of a ghost, etc., and also reduction in the charge-retentivity, surface shaving and increase of defective images after two million times repeated shots.

In addition, there was examined dielectric strength by impressing a DC voltage.

Further in addition, there was examined surface disfigurement resistance by pressing the round end point of a needle onto the surface while supplying a predetermined load.

The results obtained of the above various evaluations are shown in Table 5.

As Table 5 illustrates, it can be recognized that every drum is satisfactory for every evaluation item, and excels particularly in the initial charge-retentivity and the durability.

EXAMPLE 2

There were prepared multiple drums under the conditions shown in Tables 1, 2, 6 and 7 using the RF glow discharging fabrication apparatus shown in FIG. 60.

Evaluations were made on the resultant drums in the same way as in Example 1.

There were obtained the results as shown in Table 8.

As Table 8 illustrates, it can be recognized that every drum is satisfactory for every evaluation item.

EXAMPLE 3

There were prepared multiple drums under the conditions shown in Tables 1, 2, 9 and 10 using the RF glow discharging fabrication apparatus shown in FIG. 60.

Evaluations were made on the resultant drums in the same way as in Example 1.

There were obtained the results as shown in Table 11.

As Table 11 illustrates, it can be recognized that every drum is satisfactory for every evaluation item.

EXAMPLE 4

There were prepared multiple drums under the conditions shown in Tables 1, 2, 12 and 13 using the RF glow discharging fabrication apparatus shown in FIG. 60

Evaluations were made on the resultant drums in the same way as in Example 1.

There were obtained the results as shown in Table 14.

As Table 14 illustrates, it can be recognized that every drum is satisfactory for every evaluation item.

EXAMPLE 5

There were prepared multiple drums under the conditions shown in Tables 1, 2, 15 and 16 using the RF glow discharging fabrication apparatus shown in FIG. 60.

Evaluations were made on the resultant drums in the same way as in Example 1.

There were obtained the results as shown in Table 17.

As Table 17 illustrates, it can be recognized that every drum is satisfactory for every evaluation item.

EXAMPLE 6

There were prepared multiple drums under the conditions shown in Tables 1, 2, 18 and 19 using the RF glow discharging fabrication apparatus shown in FIG. 60.

Evaluations were made on the resultant drums in the same way as in Example 1.

There were obtained the results as shown in Table 20.

As Table 20 illustrates, it can be recognized that every drum is satisfactory for every evaluation item.

EXAMPLE 17

There were prepared multiple drums under the conditions shown in Tables 1, 2, 21 and 22 using the RF glow discharging fabrication apparatus shown in FIG. 60.

Evaluations were made on the resultant drums in the same way as in Example 1.

There were obtained the results as shown in Table 23.

As Table 23 illustrates, it can be recognized that every drum is satisfactory for every evaluation item.

EXAMPLE 8

There were prepared multiple drums under the conditions shown in Tables 1, 2, 24 and 25 using the RF glow discharging fabrication apparatus shown in FIG. 60.

Evaluations were made on the resultant drums in the same way as in Example 1.

There were obtained the results as shown in Table 26.

As Table 26 illustrates, it can be recognized that every drum is satisfactory for every evaluation item.

EXAMPLE 9

There were prepared multiple drums under the conditions shown in Tables 1, 2, 27 and 28 using the RF glow discharging fabrication apparatus shown in FIG. 60.

Evaluations were made on the resultant drums in the same way as in Example 1.

There were obtained the results as shown in Table 29.

As Table 29 illustrates, it can be recognized that every drum is satisfactory for every evaluation item.

EXAMPLE 10

There were prepared multiple drums under the conditions shown in Tables 1, 2, 30 and 31 using the RF glow discharging fabrication apparatus shown in FIG. 60.

Evaluations were made on the resultant drums in the same way as in Example 1.

There were obtained the results as shown in Table 32.

As Table 32 illustrates, it can be recognized that every drum is satisfactory for every evaluation item.

EXAMPLE 11

There were prepared multiple drums under the conditions shown in Tables 1, 2, 33 and 34 using the RF glow discharging fabrication apparatus shown in FIG. 60.

Evaluations were made on the resultant drums in the same way as in Example 1.

There were obtained the results as shown in Table 35.

As Table 35 illustrates, it can be recognized that every drum is satisfactory for every evaluation item.

EXAMPLE 12

There were prepared multiple drums under the conditions shown in Tables 1, 2, 36 and 37 using the RF glow discharging fabrication apparatus shown in FIG. 60.

Evaluations were made on the resultant drums in the same way as in Example 1.

There were obtained the results as shown in Table 38.

As Table 38 illustrates, it can be recognized that every drum is satisfactory for every evaluation item.

EXAMPLE 13

There were prepared multiple drums under the conditions shown in Tables 1, 2, 39 and 40 using the RF glow discharging fabrication apparatus shown in FIG. 60.

Evaluations were made on the resultant drums in the same way as in Example 1.

There were obtained the results as shown in Table 41.

As Table 41 illustrates, it can be recognized that every drum is satisfactory for every evaluation item.

EXAMPLE 14

There were prepared multiple drums under the conditions shown in Tables 1, 2, 42 and 43 using the RF glow discharging fabrication apparatus shown in FIG. 60.

Evaluations were made on the resultant drums in the same way as in Example 1.

There were obtained the results as shown in Table 44.

As Table 44 illustrates, it can be recognized that every drum is satisfactory for every evaluation item.

EXAMPLE 15

There were prepared multiple drums under the conditions shown in Tables 1, 2, 45 and 46 using the RF glow discharging fabrication apparatus shown in FIG. 60.

Evaluations were made on the resultant drums in the same way as in Example 1.

There were obtained the results as shown in Table 47.

As Table 47 illustrates, it can be recognized that every drum is satisfactory for every evaluation item.

EXAMPLE 16

There were prepared multiple drums under the conditions shown in Tables 1, 2, 48 and 49 using the RF glow discharging fabrication apparatus shown in FIG. 60.

Evaluations were made on the resultant drums in the same way as in Example 1.

There were obtained the results as shown in Table 50.

As Table 50 illustrates, it can be recognized that every drum is satisfactory for every evaluation item.

EXAMPLE 17

There were prepared multiple drums under the conditions shown in Tables 1, 2, 51 and 52 using the RF glow discharging fabrication apparatus shown in FIG. 60.

Evaluations were made on the resultant drums in the same way as in Example 1.

There were obtained the results as shown in Table 53.

As Table 53 illustrates, it can be recognized that every drum is satisfactory for every evaluation item.

EXAMPLE 18

There were prepared multiple drums under the conditions shown in Tables 1, 2, 54 and 55 using the RF glow discharging fabrication apparatus shown in FIG. 60.

Evaluations were made on the resultant drums in the same way as in Example 1.

There were obtained the results as shown in Table 56.

As Table 56 illustrates, it can be recognized that every drum is satisfactory for every evaluation item.

EXAMPLE 19

There were prepared multiple drums under the conditions shown in Tables 1, 2, 57 and 58 using the RF glow discharging fabrication apparatus shown in FIG. 60.

Evaluations were made on the resultant drums in the same way as in Example 1.

There were obtained the results as shown in Table 59.

As Table 59 illustrates, it can be recognized that every drum is satisfactory for every evaluation item.

EXAMPLE 20

There were prepared multiple drums under the conditions shown in Tables 1, 2, 60 and 61 using the RF glow discharging fabrication apparatus shown in FIG. 60.

Evaluations were made on the resultant drums in the same way as in Example 1.

There were obtained the results as shown in Table 62.

As Table 62 illustrates, it can be recognized that every drum is satisfactory for every evaluation item.

EXAMPLE 21

There were prepared multiple drums under the conditions shown in Tables 1, 2, 63 and 64 using the RF glow discharging fabrication apparatus shown in FIG. 60.

Evaluations were made on the resultant drums in the same way as in Example 1.

There were obtained the results as shown in Table 65.

As Table 65 illustrates, it can be recognized that every drum is satisfactory for every evaluation item.

EXAMPLE 22

There were prepared multiple drums under the conditions shown in Tables 1, 2, 66 and 67 using the RF glow discharging fabrication apparatus shown in FIG. 60.

Evaluations were made on the resultant drums in the same way as in Example 1.

There were obtained the results as shown in Table 68.

As Table 68 illustrates, it can be recognized that every drum is satisfactory for every evaluation item.

EXAMPLE 23

There were prepared multiple drums under the conditions shown in Tables 1, 2, 69 and 70 using the RF glow discharging fabrication apparatus shown in FIG. 60.

Evaluations were made on the resultant drums in the same way as in Example 1.

There were obtained the results as shown in Table 71.

As Table 71 illustrates, it can be recognized that every drum is satisfactory for every evaluation item.

EXAMPLE 24

There were prepared multiple drums under the conditions shown in Tables 1, 2, 72 and 73 using the RF glow discharging fabrication apparatus shown in FIG. 60.

Evaluations were made on the resultant drums in the same way as in Example 1.

There were obtained the results as shown in Table 74.

As Table 74 illustrates, it can be recognized that every drum is satisfactory for every evaluation item.

EXAMPLE 25

There were prepared multiple drums under the conditions shown in Tables 1, 2, 75 and 76 using the RF glow discharging fabrication apparatus shown in FIG. 60.

Evaluations were made on the resultant drums in the same way as in Example 1.

There were obtained the results as shown in Table 77.

As Table 77 illustrates, it can be recognized that every drum is satisfactory for every evaluation item.

EXAMPLE 26

There were prepared multiple drums under the conditions shown in Tables 1, 2, 78 and 79 using the RF glow discharging fabrication apparatus shown in FIG. 60.

Evaluations were made on the resultant drums in the same way as in Example 1.

There were obtained the results as shown in Table 80.

As Table 80 illustrates, it can be recognized that every drum is satisfactory for every evaluation item.

EXAMPLE 27

There were prepared multiple drums under the conditions shown in Tables 1, 2, 81 and 82 using the RF glow discharging fabrication apparatus shown in FIG. 60.

Evaluations were made on the resultant drums in the same way as in Example 1.

There were obtained the results as shown in Table 83.

As Table 83 illustrates, it can be recognized that every drum is satisfactory for every evaluation item.

EXAMPLE 28

There were prepared multiple drums under the conditions shown in Tables 1, 2, 84 and 85 using the RF glow discharging fabrication apparatus shown in FIG. 60.

Evaluations were made on the resultant drums in the same way as in Example 1.

There were obtained the results as shown in Table 86.

As Table 86 illustrates, it can be recognized that every drum is satisfactory for every evaluation item.

EXAMPLE 29

There were prepared multiple drums under the conditions shown in Tables 1, 2, 87 and 88 using the RF glow discharging fabrication apparatus shown in FIG. 60.

Evaluations were made on the resultant drums in the same way as in Example 1.

There were obtained the results as shown in Table 89.

As Table 89 illustrates, it can be recognized that every drum is satisfactory for every evaluation item.

EXAMPLE 30

There were prepared multiple drums under the conditions shown in Tables 1, 2, 90 and 91 using the RF glow discharging fabrication apparatus shown in FIG. 60.

Evaluations were made on the resultant drums in the same way as in Example 1.

There were obtained the results as shown in Table 92.

As Table 92 illustrates, it can be recognized that every drum is satisfactory for every evaluation item.

EXAMPLE 31

There were prepared multiple drums under the conditions shown in Tables 1, 2, 93 and 94 using the RF glow discharging fabrication apparatus shown in FIG. 60.

Evaluations were made on the resultant drums in the same way as in Example 1.

There were obtained the results as shown in Table 95.

As Table 95 illustrates, it can be recognized that every drum is satisfactory for every evaluation item.

EXAMPLE 32

There were prepared multiple drums under the conditions shown in Tables 1, 2, 96 and 97 using the RF glow discharging fabrication apparatus shown in FIG. 60.

Evaluations were made on the resultant drums in the same way as in Example 1.

There were obtained the results as shown in Table 98.

As Table 98 illustrates, it can be recognized that every drum is satisfactory for every evaluation item.

Example 33

There were prepared multiple drums under the conditions shown in Tables 1, 2, 99 and 100 using the RF glow discharging fabrication apparatus shown in FIG. 60.

Evaluations were made on the resultant drums in the same way as in Example 1.

There were obtained the results as shown in Table 101.

As Table 101 illustrates, it can be recognized that every drum is satisfactory for every evaluation item.

EXAMPLE 34

There were prepared multiple drums under the conditions shown in Tables 1, 2, 102 and 103 using the RF glow discharging fabrication apparatus shown in FIG. 60.

Evaluations were made on the resultant drums in the same way as in Example 1.

There were obtained the results as shown in Table 104.

As Table 104 illustrates, it can be recognized that every drum is satisfactory for every evaluation item.

EXAMPLE 35

There were prepared multiple drums under the conditions shown in Tables 1, 2, 105 and 106 using the RF glow discharging fabrication apparatus shown in FIG. 60.

Evaluations were made on the resultant drums in the same way as in Example 1.

There were obtained the results as shown in Table 107.

As Table 107 illustrates, it can be recognized that every drum is satisfactory for every evaluation item.

EXAMPLE 36

There were prepared multiple drums under the conditions shown in Tables 1, 2, 108 and 109 using the RF glow discharging fabrication apparatus shown in FIG. 60.

Evaluations were made on the resultant drums in the same way as in Example 1.

There were obtained the results as shown in Table 110.

As Table 110 illustrates, it can be recognized that every drum is satisfactory for every evaluation item.

EXAMPLE 37

There were prepared multiple drums on Al cylinders having a mirror plane surface under the conditions shown in Table 111, 112, 113 and 114 using the microwave CVD fabrication apparatus shown in FIG. 61.

Evaluations were made on the resultant drums in the same way as in Example 1. There were obtained the results as shown in Table 115.

As Table 115 illustrates, it can be recognized that every drum is satisfactory for every evaluation item, and excels particularly in the initial charge-retentivity and the durability.

EXAMPLE 38

There were prepared multiple drums on Al cylinders having a mirror plane surface under the conditions shown in Tables 116, 117, 118 and 119 using the HR-CVD fabrication apparatus shown in FIG. 62.

Evaluations were made on the resultant drums in the same way as in Example 1.

There were obtained the results as shown in Table 120.

As Table 120 illustrates, it can be recognized that every drum is satisfactory for every evaluation item, and excels particularly in the initial charge-retentivity and the durability

EXAMPLE 39

There were prepared multiple drums on Al cylinders having a mirror plane surface under the conditions shown in Tables 121, 122, 123 and 124 using the FO-CVD fabrication apparatus shown in FIG. 62.

Evaluations were made on the resultant drums in the same way as in Example 1.

There were obtained the results as shown in Table 125.

As Table 125 illustrates, it can be recognized that every drum is satisfactory for every evaluation item, and excels particularly in the initial charge-retentivity and the durability.

EXAMPLE 40

A plurality of Al cylinders having a mirror grinded surface were treated by means of a surface cutting method using a cutting tool to thereby provide surface treated Al cylinders having the cross-sectional patters as shown in Table 127.

Using the glow discharging fabrication apparatus shown in FIG. 60, a light receiving layer was formed on each of the above Al cylinders under the conditions shown in Table 126 to thereby obtain multiple drums.

Every drum was set to a conventional electrophotographic copying machine having digital exposure functions and using a semiconductor laser beam of 780 nm wavelength to examine various evaluation items in the same way as in Example 1. There were obtained the results as shown in Table 128.

EXAMPLE 41

Figure 69:
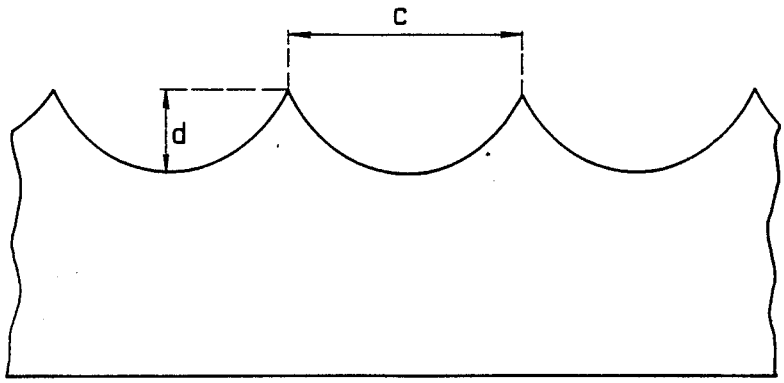
FIG. 69 is a partially schematic cross-sectional view illustrating an example of the surface shape composed of a plurality of fine spherical dimples for the cylindrical substrate of the light receiving member for use in electrophotography according to this invention.

A plurality of Al cylinders having a mirror grinded surface were further treated by means of the foregoing surface treating method using bearing balls to thereby provide surface treated Al cylinders having the cross-sectional configurations as shown in FIG. 69 and the crosssectional patterns as shown in Table 130.

Using the Rf glow discharging fabrication apparatus shown in FIG. 60, a light receiving layer was formed on each of the above Al cylinders under the conditions shown in Table 129 to thereby obtain multiple drums.

Every drum was set to a conventional electrophotographic copying machine having digital exposure functions and using a semiconductor laser beam of 780 nm wavelength to examine various evaluation items in the same way as in Example 1. There were obtained the results as shown in Table 131

EXAMPLE 42

There were prepared multiple drums on Al cylinders having a mirror plane surface under the conditions shown in Tables 132, 133, 134 and 135 using the Rf glow discharging fabrication apparatus shown in FIG. 60.

Evaluations were made on the resultant drums in the same way as in Example 1.

There were obtained the results as shown in Table 136.

As Table 136 illustrates, it can be recognized that every drum is satisfactory for every evaluation item, and excels particularly in the initial charge-retentivity and the durability.

EXAMPLES 43 to 140

Under the conditions shown in in Table 137, there were prepared a plurality of drum samples (Sample Nos. 101A to 2218G).

The resultant samples were evaluated in the same way as in Example 1.

There were obtained the evaluation results as shown in Table 138 through Table 243.

In each example, there was employed the constituent layer forming conditions expressed by the corresponding No. in the column "Corresponding Table No." in Table 137, and the prepared layer is shown by the mark "0" in the column "Prepared Layer" in that Table.

In each example, as for the corresponding combination Table relating to the CTL/CGL in Sample No., when the last two numerals of the figure for the Sample No. are common, it means that the same CTL/CGL combination was chosen.

TABLE 1

| | Film forming Conditions of CGL | | | | |
|---|---|---|---|---|---|
| Name of layer | Gas used & its flow rate (SCCM) | Substrate temperature (°C.) | RF power (W) | Internal pressure (Torr) | Layer thickness (μm) |
| CGL 1 | $SiH_4$ 200<br>$H_2$ 200 | 250 | 300 | 0.40 | 1 |
| CGL 2 | $SiH_4$ 150<br>$SiF_4$ 50<br>$H_2$ 200 | 250 | 300 | 0.40 | 2 |
| CGL 3 | $SiH_4$ 200<br>He 200 | 250 | 300 | 0.40 | 5 |
| CGL 4 | $SiH_4$ 200<br>Ar 200 | 250 | 350 | 0.40 | 2 |

TABLE 2

Figure 64:
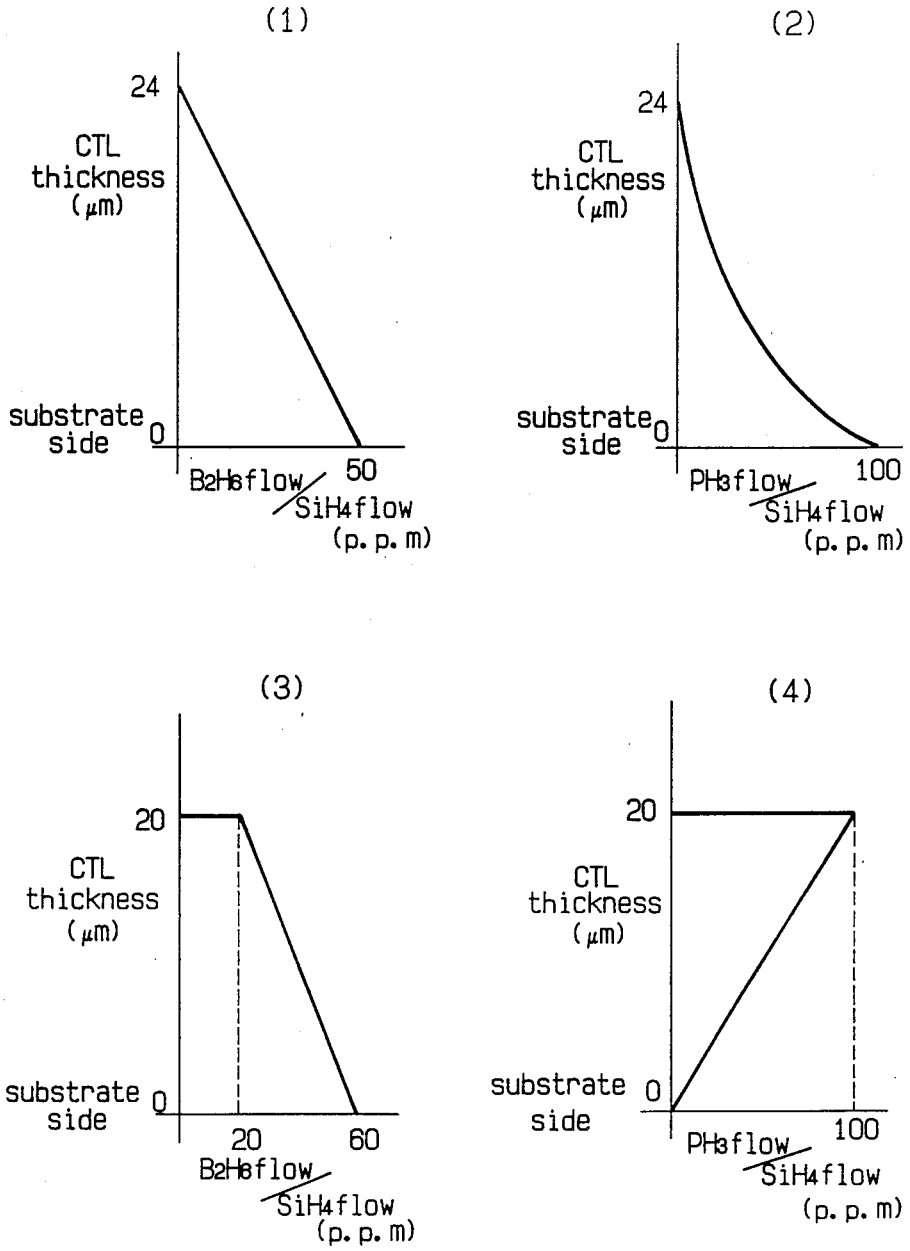
FIG. 64(1) through FIG. 64(8) are explanatory views illustrating diversification patters for the flow rates of an impurity supplying raw material gas and a doping raw material gas at the time of forming the CTL of the light receiving member for use in electrophotography according to this invention by means of RF glow discharging process.
Figure 64:
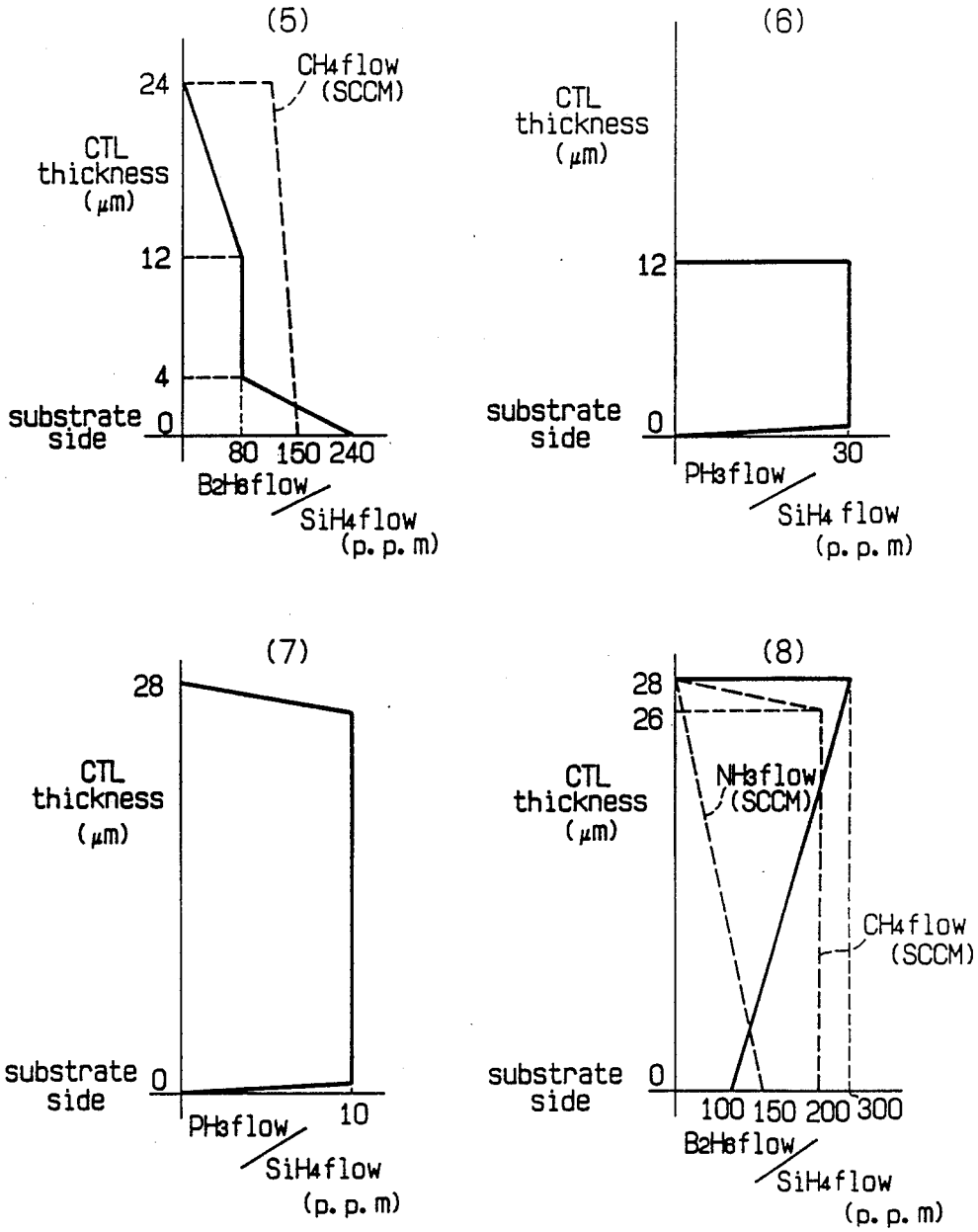

| | Film Forming Conditions of CTL | | | | |
|---|---|---|---|---|---|
| Name of layer | Gas used & its flow rate (SCCM) | Substrate temperature (°C.) | RF power (W) | Internal pressure (Torr) | Layer thickness (μm) |
| CTL 1 | $SiH_4$ 100<br>$SiF_4$ 50<br>$CH_4$ 450<br>$B_2H_6$ [FIG. 64 (1)] | 250 | 300 | 0.40 | 24 |
| CTL 2 | $SiH_4$ 250<br>$C_2H_2$ 400<br>$PH_3$ [FIG. 64 (2)] | 250 | 300 | 0.42 | 24 |
| CTL 3 | $SiH_4$ 300<br>$C_2H_2$ 350<br>$B_2H_6$ [FIG. 64 (3)] | 250 | 200 | 0.35 | 20 |
| CTL 4 | $SiH_4$ 80<br>$C_2H_4$ 600<br>$PH_3$ [FIG. 64 (4)] | 250 | 350 | 0.45 | 20 |
| CTL 5 | $SiH_4$ 120<br>$N_2$ 500<br>$CH_4$ [FIG. 64 (5)]<br>$B_2H_6$ [FIG. 64 (5)] | 250 | 350 | 0.45 | 24 |
| CTL 6 | $SiH_4$ 150<br>$NH_3$ 300<br>$CH_4$ 300<br>$PH_3$ [FIG. 64 (6)] | 250 | 300 | 0.40 | 12 |
| CTL 7 | $SiH_4$ 350<br>$C_2H_4$ 25<br>Ar 200<br>$PH_3$ [FIG. 64 (7)] | 250 | 250 | 0.38 | 28 |
| CTL 8 | $SiH_4$ 500<br>NO 60<br>$B_2H_6$ [FIG. 64 (8)]<br>$NH_3$ [FIG. 64 (8)]<br>$CH_4$ [FIG. 64 (8)] | 250 | 300 | 0.40 | 28 |

TABLE 3

| | CTL No | | | | | | | |
|---|---|---|---|---|---|---|---|---|
| CGL No | CTL 1 | CTL 2 | CTL 3 | CTL 4 | CTL 5 | CTL 6 | CTL 7 | CTL 8 |
| | Drum No | | | | | | | |
| CGL 1 | 101 | 102 | 103 | 104 | 105 | 106 | 107 | 108 |
| CGL 2 | 109 | 110 | 111 | 112 | 113 | 114 | 115 | 116 |
| CGL 3 | 117 | | | | | | | |
| CGL 4 | 118 | | | | | | | |

TABLE 4

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ (substrate side 0.7 μm) | 50 | | | | |
| | (surface side 0.3 μm) | 50 → 0 | | | | |
| | (constantly decrease) | | | | | |
| | $B_2H_6$ (against $SiH_4$) | 1000 ppm | | | | |
| | NO | 10 | | | | |
| | $H_2$ | 100 | | | | |
| Charge injection inhibition layer | $SiH_4$ | 100 | 250 | 150 | 0.35 | 3 |
| | $B_2H_6$ (against $SiH_4$) | 800 ppm | | | | |
| | $H_2$ | 100 | | | | |
| | NO | 10 | | | | |
| CGL/CTL | Combination as shown in Table 3 | | | | | |
| Surface layer | $SiH_4$ | 50 | 250 | 150 | 0.4 | 0.5 |
| | $CH_4$ | 600 | | | | |

TABLE 5

| Drum No. | initial charge-retentivity | photo-sensitivity | residual potential | ghost | durability |
|---|---|---|---|---|---|
| 101 | ◎ | ○ | Δ | ○ | ◎ |
| 102 | ◎ | ○ | Δ | ○ | ◎ |
| 103 | ◎ | ○ | Δ | ○ | ◎ |
| 104 | ◎ | ○ | Δ | ○ | ◎ |
| 105 | ◎ | ○ | Δ | ○ | ◎ |
| 106 | ◎ | ○ | Δ | ○ | ◎ |
| 107 | ◎ | ○ | Δ | ○ | ◎ |
| 108 | ◎ | ○ | Δ | ○ | ◎ |
| 109 | ◎ | ○ | Δ | ○ | ◎ |
| 110 | ◎ | ○ | Δ | ○ | ◎ |
| 111 | ◎ | ○ | Δ | ○ | ◎ |
| 112 | ◎ | ○ | Δ | ○ | ◎ |
| 113 | ◎ | ○ | Δ | ○ | ◎ |
| 114 | ◎ | ○ | Δ | ○ | ◎ |
| 115 | ◎ | ○ | Δ | ○ | ◎ |
| 116 | ◎ | ○ | Δ | ○ | ◎ |
| 117 | ◎ | ○ | Δ | ○ | ◎ |
| 118 | ◎ | ○ | Δ | ○ | ◎ |

◎: Excellent
Δ: practically applicable
○: good
X: practically not applicable

TABLE 8

| Drum No. | initial charge-retentivity | photo-sensitivity | residual potential | ghost | durability |
|---|---|---|---|---|---|
| 201 | ◎ | ○ | Δ | ○ | ◎ |
| 202 | ◎ | ○ | Δ | ○ | ◎ |
| 203 | ◎ | ○ | Δ | ○ | ◎ |
| 204 | ◎ | ○ | Δ | ○ | ◎ |
| 205 | ◎ | ○ | Δ | ○ | ◎ |
| 206 | ◎ | ○ | Δ | ○ | ◎ |
| 207 | ◎ | ○ | Δ | ○ | ◎ |
| 208 | ◎ | ○ | Δ | ○ | ◎ |
| 209 | ◎ | ○ | Δ | ○ | ◎ |
| 210 | ◎ | ○ | Δ | ○ | ◎ |
| 211 | ◎ | ○ | Δ | ○ | ◎ |
| 212 | ◎ | ○ | Δ | ○ | ◎ |
| 213 | ◎ | ○ | Δ | ○ | ◎ |
| 214 | ◎ | ○ | Δ | ○ | ◎ |
| 215 | ◎ | ○ | Δ | ○ | ◎ |
| 216 | ◎ | ○ | Δ | ○ | ◎ |
| 217 | ◎ | ○ | Δ | ○ | ◎ |
| 218 | ◎ | ○ | Δ | ○ | ◎ |

◎: Excellent
Δ: practically applicable
○: good
X: practically not applicable

TABLE 6

| CGL No | CTL No: CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 201 | 202 | 203 | 204 | 205 | 206 | 207 | 208 |
| CGL 2 | 209 | 210 | 211 | 212 | 213 | 214 | 215 | 216 |
| CGL 3 | 217 | | | | | | | |
| CGL 4 | 218 | | | | | | | |

TABLE 9

| CGL No | CTL No: CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 301 | 302 | 303 | 304 | 305 | 306 | 307 | 308 |
| CGL 2 | 309 | 310 | 311 | 312 | 313 | 314 | 315 | 316 |
| CGL 3 | 317 | | | | | | | |
| CGL 4 | 318 | | | | | | | |

TABLE 7

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | | | | |
| | $GeH_4$ (substrate side 0.7 μm) | 50 | | | | |
| | (surface side 0.3 μm) | 50 → 0 | | | | |
| | (constantly decrease) | | | | | |
| | $B_2H_6$ (against $SiH_4$) | 1000 ppm | 250 | 150 | 0.35 | 1 |
| | NO (substrate side 0.7 μm) | 10 | | | | |
| | (surface side 0.3 μm) | 10 → 0 | | | | |
| | (constantly decrease) | | | | | |
| Charge injection inhibition layer | $SiH_4$ | 100 | | | | |
| | $B_2H_6$ (against $SiH_4$) | 800 ppm | | | | |
| | $H_2$ | 100 | | | | |
| | NO (substrate side 2 μm) | 10 | 250 | 150 | 0.35 | 3 |
| | surface side 1 μm) | 10 → 0 | | | | |
| | (constantly decrease) | | | | | |
| CGL/CTL | Combination as shown in Table 6 | | | | | |
| Surface layer | $SiH_4$ | 20 | 250 | 150 | 0.4 | 0.5 |
| | $CH_4$ | 500 | | | | |

TABLE 10

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | | | | |
| | $GeH_4$ (substrate side 0.7 μm) | 50 | | | | |
| | (surface side 0.3 μm) | 50 → 0 | | | | |
| | (constantly decrease) | | 250 | 150 | 0.35 | 1 |
| | $B_2H_6$ (against $SiH_4$) | 1000 ppm | | | | |
| | NO | 10 | | | | |
| | $H_2$ | 100 | | | | |
| Charge injection inhibition layer | $SiH_4$ | 100 | | | | |
| | $B_2H_6$ (against $SiH_4$) | 800 ppm | 250 | 150 | 0.35 | 3 |
| | $H_2$ | 100 | | | | |
| | NO | 10 | | | | |
| CGL/CTL | Combination as shown in Table 9 | | | | | |

TABLE 10-continued

| Name of layer | Gas used & its flow rate (SCCM) | | Substrate temperature (°C.) | RF power (W) | Internal pressure (Torr) | Layer thickness (μm) |
|---|---|---|---|---|---|---|
| Surface layer | $SiH_4$ (substrate side) | 350 → 10 (surface side) | | | | |
| | $CH_4$ (substrate side) | 10 → 600 (surface side) | 250 | 150 | 0.4 | 1 |
| | (constantly diversify) | | | | | |

TABLE 11

| Drum No. | initial charge-retentivity | photo-sensitivity | residual potential | ghost | durability |
|---|---|---|---|---|---|
| 301 | ◎ | ○ | ○ | ○ | ◎ |
| 302 | ◎ | ○ | ○ | ○ | ◎ |
| 303 | ◎ | ○ | ○ | ○ | ◎ |
| 304 | ◎ | ○ | ○ | ○ | ◎ |
| 305 | ◎ | ○ | ○ | ○ | ◎ |
| 306 | ◎ | ○ | ○ | ○ | ◎ |
| 307 | ◎ | ○ | ○ | ○ | ◎ |
| 308 | ◎ | ○ | ○ | ○ | ◎ |
| 309 | ◎ | ○ | ○ | ○ | ◎ |
| 310 | ◎ | ○ | ○ | ○ | ◎ |
| 311 | ◎ | ○ | ○ | ○ | ◎ |
| 312 | ◎ | ○ | ○ | ○ | ◎ |
| 313 | ◎ | ○ | ○ | ○ | ◎ |
| 314 | ◎ | ○ | ○ | ○ | ◎ |
| 315 | ◎ | ○ | ○ | ○ | ◎ |
| 316 | ◎ | ○ | ○ | ○ | ◎ |
| 317 | ◎ | ○ | ○ | ○ | ◎ |
| 318 | ◎ | ○ | ○ | ○ | ◎ |

◎: Excellent
Δ: practically applicable
○: good
X: practically not applicable

TABLE 14

| Drum No. | initial charge-retentivity | photo-sensitivity | residual potential | ghost | durability |
|---|---|---|---|---|---|
| 401 | ◎ | ○ | ○ | ○ | ◎ |
| 402 | ◎ | ○ | ○ | ○ | ◎ |
| 403 | ◎ | ○ | ○ | ○ | ◎ |
| 404 | ◎ | ○ | ○ | ○ | ◎ |
| 405 | ◎ | ○ | ○ | ○ | ◎ |
| 406 | ◎ | ○ | ○ | ○ | ◎ |
| 407 | ◎ | ○ | ○ | ○ | ◎ |
| 408 | ◎ | ○ | ○ | ○ | ◎ |
| 409 | ◎ | ○ | ○ | ○ | ◎ |
| 410 | ◎ | ○ | ○ | ○ | ◎ |
| 411 | ◎ | ○ | ○ | ○ | ◎ |
| 412 | ◎ | ○ | ○ | ○ | ◎ |
| 413 | ◎ | ○ | ○ | ○ | ◎ |
| 414 | ◎ | ○ | ○ | ○ | ◎ |
| 415 | ◎ | ○ | ○ | ○ | ◎ |
| 416 | ◎ | ○ | ○ | ○ | ◎ |
| 417 | ◎ | ○ | ○ | ○ | ◎ |
| 418 | ◎ | ○ | ○ | ○ | ◎ |

◎: Excellent
Δ: practically applicable
○: good
X: practically not applicable

TABLE 12

| CGL No | CTL No CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 401 | 402 | 403 | 404 | 405 | 406 | 407 | 408 |
| CGL 2 | 409 | 410 | 411 | 412 | 413 | 414 | 415 | 416 |
| CGL 3 | 417 | | | | | | | |
| CGL 4 | 418 | | | | | | | |

TABLE 15

| CGL No | CTL No CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 501 | 502 | 503 | 504 | 505 | 506 | 507 | 508 |
| CGL 2 | 509 | 510 | 511 | 512 | 513 | 514 | 515 | 516 |
| CGL 3 | 517 | | | | | | | |
| CGL 4 | 518 | | | | | | | |

TABLE 13

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | | | | |
| | $GeH_4$ (substrate side 0.7 μm) | 50 | | | | |
| | (surface side 0.3 μm) | 50 → 0 | | | | |
| | (constantly decrease) | | 250 | 150 | 0.35 | 1 |
| | $B_2H_6$ (against $SiH_4$) | 800 ppm | | | | |
| | NO | 10 | | | | |
| Charge injection inhibition layer | $SiH_4$ | 100 | | | | |
| | $B_2H_6$ (against $SiH_4$) | 800 ppm | | | | |
| | $H_2$ | 100 | | | | |
| | NO (substrate side 2 μm) | 10 | 250 | 150 | 0.35 | 3 |
| | (surface side 1 μm) | 10 → 0 | | | | |
| | (constantly decrease) | | | | | |
| CGL/CTL | Combination as shown in Table 12 | | | | | |
| Surface layer | $SiH_4$ | 20 | 250 | 150 | 0.4 | 1 |
| | $CH_4$ | 500 | | | | |

TABLE 16

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption | $SiH_4$ | 100 | 250 | 150 | 0.35 | 1 |
| | $GeH_4$ (substrate side 0.7 μm) | 50 | | | | |

TABLE 16-continued

| Name of layer | Gas used & its flow rate (SCCM) | | Substrate temperature (°C.) | RF power (W) | Internal pressure (Torr) | Layer thickness (μm) |
|---|---|---|---|---|---|---|
| layer | (surface side 0.3 μm) (constantly decrease) | 50 → 0 | | | | |
| | $B_2H_6$ (against $SiH_4$) | 1000 ppm | | | | |
| | NO | 10 | | | | |
| | $H_2$ | 100 | | | | |
| Charge injection inhibition layer | $SiH_4$ | 100 | 250 | 150 | 0.35 | 3 |
| | $B_2H_6$ (against $SiH_4$) | 1000 ppm | | | | |
| | $H_2$ | 100 | | | | |
| | NO | 10 | | | | |
| CGL/CTL | Combination as shown in Table 15 | | | | | |
| Surface layer | $SiH_4$ (substrate side) (surface side) | 350 → 10 | 250 | 150 | 0.4 | 1 |
| | $CH_4$ (substrate side) (surface side) (constantly diversity | 10 → 600 | | | | |

TABLE 17

| Drum No. | initial charge-retentivity | photo-sensitivity | residual potential | ghost | durability |
|---|---|---|---|---|---|
| 501 | ◎ | ○ | ○ | ○ | ◎ |
| 502 | ◎ | ○ | ○ | ○ | ◎ |
| 503 | ◎ | ○ | ○ | ○ | ◎ |
| 504 | ◎ | ○ | ○ | ○ | ◎ |
| 505 | ◎ | ○ | ○ | ○ | ◎ |
| 506 | ◎ | ○ | ○ | ○ | ◎ |
| 507 | ◎ | ○ | ○ | ○ | ◎ |
| 508 | ◎ | ○ | ○ | ○ | ◎ |
| 509 | ◎ | ○ | ○ | ○ | ◎ |
| 510 | ◎ | ○ | ○ | ○ | ◎ |
| 511 | ◎ | ○ | ○ | ○ | ◎ |
| 512 | ◎ | ○ | ○ | ○ | ◎ |
| 513 | ◎ | ○ | ○ | ○ | ◎ |
| 514 | ◎ | ○ | ○ | ○ | ◎ |
| 515 | ◎ | ○ | ○ | ○ | ◎ |
| 516 | ◎ | ○ | ○ | ○ | ◎ |
| 517 | ◎ | ○ | ○ | ○ | ◎ |
| 518 | ◎ | ○ | ○ | ○ | ◎ |

◎: Excellent
○: good
Δ: practically applicable
X: practically not applicable

TABLE 18

| | CTL No Drum No | | | | | | | |
|---|---|---|---|---|---|---|---|---|
| CGL No | CTL 1 | CTL 2 | CTL 3 | CTL 4 | CTL 5 | CTL 6 | CTL 7 | CTL 8 |
| CGL 1 | 601 | 602 | 603 | 604 | 605 | 606 | 607 | 608 |
| CGL 2 | 609 | 610 | 611 | 612 | 613 | 614 | 615 | 616 |
| CGL 3 | 617 | | | | | | | |
| CGL 4 | 618 | | | | | | | |

TABLE 19

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ (substrate side 0.7 μm) | 50 | | | | |
| | (surface side 0.3 μm) (constantly decrease) | 50 → 0 | | | | |
| | $B_2H_6$ (against $SiH_4$) | 1200 ppm | | | | |
| | NO (substrate side 0.7 μm) | 50 | | | | |
| | (surface side 0.3 μm) (constantly decrease) | 5 → 10 | | | | |
| Charge injection inhibition layer | $SiH_4$ | 100 | 250 | 150 | 0.35 | 3 |
| | $B_2H_6$ (against $SiH_4$) | 1200 ppm | | | | |
| | $H_2$ | 100 | | | | |
| | NO (substrate side 2 μm) | 10 | | | | |
| | (surface side 1 μm) (constantly decrease) | 10 → 0 | | | | |
| CGL/CTL | Combination as shown in Table 18 | | | | | |
| Surface layer | $SiH_4$ (substrate side) (surface side) | 350 → 10 | 250 | 150 | 0.4 | 1 |
| | $CH_4$ (substrate side) (surface side) (constantly diversify | 10 → 600 | | | | |

TABLE 20

| Drum No. | initial charge-retentivity | photo-sensitivity | residual potential | ghost | durability |
|---|---|---|---|---|---|
| 601 | ◎ | ○ | ○ | ○ | ◎ |
| 602 | ◎ | ○ | ○ | ○ | ◎ |
| 603 | ◎ | ○ | ○ | ○ | ◎ |
| 604 | ◎ | ○ | ○ | ○ | ◎ |
| 605 | ◎ | ○ | ○ | ○ | ◎ |
| 606 | ◎ | ○ | ○ | ○ | ◎ |
| 607 | ◎ | ○ | ○ | ○ | ◎ |
| 608 | ◎ | ○ | ○ | ○ | ◎ |
| 609 | ◎ | ○ | ○ | ○ | ◎ |
| 610 | ◎ | ○ | ○ | ○ | ◎ |
| 611 | ◎ | ○ | ○ | ○ | ◎ |
| 612 | ◎ | ○ | ○ | ○ | ◎ |
| 613 | ◎ | ○ | ○ | ○ | ◎ |
| 614 | ◎ | ○ | ○ | ○ | ◎ |
| 615 | ◎ | ○ | ○ | ○ | ◎ |
| 616 | ◎ | ○ | ○ | ○ | ◎ |

TABLE 20-continued

| Drum No. | initial charge-retentivity | photo-sensitivity | residual potential | ghost | durability |
|---|---|---|---|---|---|
| 617 | ◎ | ○ | ○ | ○ | ◎ |
| 618 | ◎ | ○ | ○ | ○ | ◎ |

◎: Excellent
○: good
Δ: practically applicable
X: practically not applicable

TABLE 21

| CGL No | CTL No Drum No CTL 2 | CTL 3 | CTL 4 | CTL 5 | CTL 6 | CTL 7 | CTL 8 | CTL |
|---|---|---|---|---|---|---|---|---|
| CGL 1 | 701 | 702 | 703 | 704 | 705 | 706 | 707 | 708 |
| CGL 2 | 709 | 710 | 711 | 712 | 713 | 714 | 715 | 716 |
| CGL 3 | 717 | | | | | | | |
| CGL 4 | 718 | | | | | | | |

TABLE 22

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ (substrate side 0.7 μm) | 50 | | | | |
| | (surface side 0.3 μm) (constantly decrease) | 50 → 0 | | | | |
| | $B_2H_6$ (against $SiH_4$) | 1000 ppm | | | | |
| | NO (substrate side 0.7 μm) | 10 | | | | |
| | (surface side 0.3 μm) (constantly decrease) | 10 → 0 | | | | |
| Charge injection inhibition layer | $SiH_4$ | 100 | 250 | 150 | 0.35 | 3 |
| | $B_2H_6$ (against $SiH_4$) | 800 ppm | | | | |
| | $H_2$ | 100 | | | | |
| | NO | 10 | | | | |
| CGL/CTL | Combination as shown in Table 21 | | | | | |
| Surface layer | $SiH_4$ | 50 | 250 | 150 | 0.4 | 1 |
| | $CH_4$ | 500 | | | | |

TABLE 23

| Drum No. | initial charge-retentivity | photo-sensitivity | residual potential | ghost | durability |
|---|---|---|---|---|---|
| 701 | ◎ | ○ | ○ | ○ | ◎ |
| 702 | ◎ | ○ | ○ | ○ | ◎ |
| 703 | ◎ | ○ | ○ | ○ | ◎ |
| 704 | ◎ | ○ | ○ | ○ | ◎ |
| 705 | ◎ | ○ | ○ | ○ | ◎ |
| 706 | ◎ | ○ | ○ | ○ | ◎ |

TABLE 23-continued

| Drum No. | initial charge-retentivity | photo-sensitivity | residual potential | ghost | durability |
|---|---|---|---|---|---|
| 707 | ◎ | ○ | ○ | ○ | ◎ |
| 708 | ◎ | ○ | ○ | ○ | ◎ |
| 709 | ◎ | ○ | ○ | ○ | ◎ |
| 710 | ◎ | ○ | ○ | ○ | ◎ |
| 711 | ◎ | ○ | ○ | ○ | ◎ |
| 712 | ◎ | ○ | ○ | ○ | ◎ |
| 713 | ◎ | ○ | ○ | ○ | ◎ |
| 714 | ◎ | ○ | ○ | ○ | ◎ |
| 715 | ◎ | ○ | ○ | ○ | ◎ |
| 716 | ◎ | ○ | ○ | ○ | ◎ |
| 717 | ◎ | ○ | ○ | ○ | ◎ |
| 718 | ◎ | ○ | ○ | ○ | ◎ |

◎: Excellent
○: good
Δ: practically applicable
X: practically not applicable

TABLE 24

| CGL No | CTL No Drum No CTL 1 | CTL 2 | CTL 3 | CTL 4 | CTL 5 | CTL 6 | CTL 7 | CTL 8 |
|---|---|---|---|---|---|---|---|---|
| CGL 1 | 801 | 802 | 803 | 804 | 805 | 806 | 807 | 808 |
| CGL 2 | 809 | 810 | 811 | 812 | 813 | 814 | 815 | 816 |
| CGL 3 | 817 | | | | | | | |
| CGL 4 | 818 | | | | | | | |

TABLE 25

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ (substrate side 0.7 μm) | 50 | | | | |
| | (surface side 0.3 μm) (constantly decrease) | 50 → 0 | | | | |
| | $B_2H_6$ (against $SiH_4$) | 800 ppm | | | | |
| | NO (substrate side 0.7 μm) | 10 | | | | |
| | (surface side 0.3 μm) (constantly decrease) | 10 → 0 | | | | |
| Charge injection inhibition layer | $SiH_4$ | 100 | 250 | 150 | 0.35 | 3 |
| | $B_2H_6$ (against $SiH_4$) | 800 ppm | | | | |
| | $H_2$ | 100 | | | | |
| | NO (substrate side 2 μm) | 10 | | | | |
| | (surface side 1 μm) (constantly decrease) | 10 → 0 | | | | |
| CGL/CTL | Combination as shown in Table 24 | | | | | |
| Surface layer | $SiH_4$ | 50 | 250 | 150 | 0.4 | 2 |
| | $CH_4$ | 500 | | | | |

TABLE 26

| Drum No. | initial charge-retentivity | photo-sensitivity | residual potential | ghost | durability |
|---|---|---|---|---|---|
| 801 | ◎ | ○ | ○ | ○ | ◎ |
| 802 | ◎ | ○ | ○ | ○ | ◎ |
| 803 | ◎ | ○ | ○ | ○ | ◎ |
| 804 | ◎ | ○ | ○ | ○ | ◎ |
| 805 | ◎ | ○ | ○ | ○ | ◎ |
| 806 | ◎ | ○ | ○ | ○ | ◎ |
| 808 | ◎ | ○ | ○ | ○ | ◎ |
| 808 | ◎ | ○ | ○ | ○ | ◎ |
| 809 | ◎ | ○ | ○ | ○ | ◎ |
| 810 | ◎ | ○ | ○ | ○ | ◎ |
| 811 | ◎ | ○ | ○ | ○ | ◎ |
| 812 | ◎ | ○ | ○ | ○ | ◎ |
| 813 | ◎ | ○ | ○ | ○ | ◎ |
| 814 | ◎ | ○ | ○ | ○ | ◎ |
| 815 | ◎ | ○ | ○ | ○ | ◎ |
| 816 | ◎ | ○ | ○ | ○ | ◎ |
| 817 | ◎ | ○ | ○ | ○ | ◎ |
| 818 | ◎ | ○ | ○ | ○ | ◎ |

◎: Excellent
○: good
Δ: practically applicable
X: practically not applicable

TABLE 29

| Drum No. | initial charge-retentivity | photo-sensitivity | residual potential | ghost | durability |
|---|---|---|---|---|---|
| 901 | ◎ | ○ | ○ | ○ | ◎ |
| 902 | ◎ | ○ | ○ | ○ | ◎ |
| 903 | ◎ | ○ | ○ | ○ | ◎ |
| 904 | ◎ | ○ | ○ | ○ | ◎ |
| 905 | ◎ | ○ | ○ | ○ | ◎ |
| 906 | ◎ | ○ | ○ | ○ | ◎ |
| 909 | ◎ | ○ | ○ | ○ | ◎ |
| 908 | ◎ | ○ | ○ | ○ | ◎ |
| 909 | ◎ | ○ | ○ | ○ | ◎ |
| 910 | ◎ | ○ | ○ | ○ | ◎ |
| 911 | ◎ | ○ | ○ | ○ | ◎ |
| 912 | ◎ | ○ | ○ | ○ | ◎ |
| 913 | ◎ | ○ | ○ | ○ | ◎ |
| 914 | ◎ | ○ | ○ | ○ | ◎ |
| 915 | ◎ | ○ | ○ | ○ | ◎ |
| 916 | ◎ | ○ | ○ | ○ | ◎ |
| 917 | ◎ | ○ | ○ | ○ | ◎ |
| 918 | ◎ | ○ | ○ | ○ | ◎ |

◎: Excellent
○: good
Δ: practically applicable
X: practically not applicable

TABLE 27

| | CTL No Drum No | | | | | | | |
|---|---|---|---|---|---|---|---|---|
| CGL No | CTL 1 | CTL 2 | CTL 3 | CTL 4 | CTL 5 | CTL 6 | CTL 7 | CTL 8 |
| CGL 1 | 901 | 902 | 903 | 904 | 905 | 906 | 907 | 908 |
| CGL 2 | 909 | 910 | 911 | 912 | 913 | 914 | 915 | 916 |
| CGL 3 | 917 | | | | | | | |
| CGL 4 | 918 | | | | | | | |

TABLE 30

| | CTL No Drum No | | | | | | | |
|---|---|---|---|---|---|---|---|---|
| CGL No | CTL 1 | CTL 2 | CTL 3 | CTL 4 | CTL 5 | CTL 6 | CTL 7 | CTL 8 |
| CGL 1 | 1001 | 1002 | 1003 | 1004 | 1005 | 1006 | 1007 | 1008 |
| CGL 2 | 1009 | 1010 | 1011 | 1012 | 1013 | 1014 | 1015 | 1016 |
| CGL 3 | 1017 | | | | | | | |
| CGL 4 | 1018 | | | | | | | |

TABLE 28

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ (substrate side 0.7 μm) | 50 | | | | |
| | (surface side 0.3 μm) (Constantly decrease) | 50 → 0 | | | | |
| | $B_2H_6$ (against $SiH_4$) | 800 ppm | | | | |
| | NO | 10 | | | | |
| Charge injection inhibition layer | $SiH_4$ | 100 | 250 | 150 | 0.35 | 3 |
| | $B_2H_6$ (against $SiH_4$) | 800 ppm | | | | |
| | $H_2$ | 100 | | | | |
| | NO | 10 | | | | |
| CGL/CTL | Combination as shown in Table 27 | | | | | |
| Surface layer | $SiH_4$ | 200 | 250 | 150 | 0.4 | 2 |
| | $SiF_4$ | 50 | | | | |
| | NO | 50 | | | | |
| | $CH_4$ | 5 | | | | |
| | $NH_3$ | 5 | | | | |

TABLE 31

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ (substrate side 0.7 μm) | 50 | | | | |
| | (surface side 0.3 μm) (constantly decrease) | 50 → 0 | | | | |
| | $B_2H_6$ (against $SiH_4$) | 800 ppm | | | | |
| | NO | 10 | | | | |
| Charge injection inhibition layer | $SiH_4$ | 100 | 250 | 150 | 0.35 | 3 |
| | $B_2H_6$ (against $SiH_4$) | 800 ppm | | | | |
| | $H_2$ | 100 | | | | |
| | NO(substrate side 2 μm) | 10 | | | | |
| | (surface side 1 μm) (constantly decrease) | 10 → 0 | | | | |
| CGL/CTL | Combination as shown in Table 30 | | | | | |
| Surface | $SiH_4$ | 200 | 250 | 150 | 0.4 | 2 |

TABLE 31-continued

| Name of layer | Gas used & its flow rate (SCCM) | | Substrate temperature (°C.) | RF power (W) | Internal pressure (Torr) | Layer thickness (μm) |
|---|---|---|---|---|---|---|
| layer | $SiF_4$ | 50 | | | | |
| | NO | 50 | | | | |
| | $CH_4$ | 5 | | | | |
| | $NH_3$ | 5 | | | | |

TABLE 32

| Drum No. | initial charge-retentivity | photo-sensitivity | residual potential | ghost | durability |
|---|---|---|---|---|---|
| 1001 | ◎ | ○ | ○ | ○ | ◎ |
| 1002 | ◎ | ○ | ○ | ○ | ◎ |
| 1003 | ◎ | ○ | ○ | ○ | ◎ |
| 1004 | ◎ | ○ | ○ | ○ | ◎ |
| 1005 | ◎ | ○ | ○ | ○ | ◎ |
| 1006 | ◎ | ○ | ○ | ○ | ◎ |
| 1007 | ◎ | ○ | ○ | ○ | ◎ |
| 1008 | ◎ | ○ | ○ | ○ | ◎ |
| 1009 | ◎ | ○ | ○ | ○ | ◎ |
| 1010 | ◎ | ○ | ○ | ○ | ◎ |
| 1011 | ◎ | ○ | ○ | ○ | ◎ |
| 1012 | ◎ | ○ | ○ | ○ | ◎ |
| 1013 | ◎ | ○ | ○ | ○ | ◎ |
| 1014 | ◎ | ○ | ○ | ○ | ◎ |
| 1015 | ◎ | ○ | ○ | ○ | ◎ |
| 1016 | ◎ | ○ | ○ | ○ | ◎ |
| 1017 | ◎ | ○ | ○ | ○ | ◎ |
| 1018 | ◎ | ○ | ○ | ○ | ◎ |

◎: Excellent
○: good
Δ: practically applicable
x: practically not appplicable

TABLE 35

| Drum No. | initial charge-retentivity | photo-sensitivity | residual potential | ghost | durability |
|---|---|---|---|---|---|
| 1101 | ◎ | ○ | Δ | ○ | ◎ |
| 1102 | ◎ | ○ | Δ | ○ | ◎ |
| 1103 | ◎ | ○ | Δ | ○ | ◎ |
| 1104 | ◎ | ○ | Δ | ○ | ◎ |
| 1105 | ◎ | ○ | Δ | ○ | ◎ |
| 1106 | ◎ | ○ | Δ | ○ | ◎ |
| 1107 | ◎ | ○ | Δ | ○ | ◎ |
| 1108 | ◎ | ○ | Δ | ○ | ◎ |
| 1109 | ◎ | ○ | Δ | ○ | ◎ |
| 1110 | ◎ | ○ | Δ | ○ | ◎ |
| 1111 | ◎ | ○ | Δ | ○ | ◎ |
| 1112 | ◎ | ○ | Δ | ○ | ◎ |
| 1113 | ◎ | ○ | Δ | ○ | ◎ |
| 1114 | ◎ | ○ | Δ | ○ | ◎ |
| 1115 | ◎ | ○ | Δ | ○ | ◎ |
| 1116 | ◎ | ○ | Δ | ○ | ◎ |
| 1117 | ◎ | ○ | Δ | ○ | ◎ |
| 1118 | ◎ | ○ | Δ | ○ | ◎ |

◎: Excellent
○: good
Δ: practically applicable
x: practically not applicable

TABLE 33

| | CTL No | | | | | | | |
|---|---|---|---|---|---|---|---|---|
| | CTL | CTL | CTL | CTL | CTL | CTL | CTL | CTL |
| | Drum No | | | | | | | |
| CGL No | 1 | 2 | 3 | 4 | 5 | 6 | 7 | 8 |
| CGL 1 | 1101 | 1102 | 1103 | 1104 | 1105 | 1106 | 1107 | 1108 |
| CGL 2 | 1109 | 1110 | 1111 | 1112 | 1113 | 1114 | 1115 | 1116 |
| CGL 3 | 1117 | | | | | | | |
| CGL 4 | 1118 | | | | | | | |

TABLE 36

| | CTL No | | | | | | | |
|---|---|---|---|---|---|---|---|---|
| | CTL | CTL | CTL | CTL | CTL | CTL | CTL | CTL |
| | Drum No | | | | | | | |
| CGL No | 1 | 2 | 3 | 4 | 5 | 6 | 7 | 8 |
| CGL 1 | 1201 | 1202 | 1203 | 1204 | 1205 | 1206 | 1207 | 1208 |
| CGL 2 | 1209 | 1210 | 1211 | 1212 | 1213 | 1214 | 1215 | 1216 |
| CGL 3 | 1217 | | | | | | | |
| CGL 4 | 1218 | | | | | | | |

TABLE 34

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $CH_4$ (substrate side 0.7 μm) | 10 | | | | |
| | (surface side 0.3 μm) | | | | | |
| | (constantly decrease) | | | | | |
| | NO (substrate side 0.7 μm) | 5 | | | | |
| | (surface side 0.3 μm) | 5 → 0 | | | | |
| | (constantly decrease) | | | | | |
| | $N_2$ (substrate side 0.7 μm) | 30 | | | | |
| | (surface side 0.3 μm) | 30 → 0 | | | | |
| | (constantly decrease) | | | | | |
| Charge injection inhibition layer | $SiH_4$ | 100 | | | | |
| | $B_2H_6$ (against $SiH_4$) | 800 ppm | 250 | 150 | 0.35 | 3 |
| | $H_2$ | 100 | | | | |
| | NO | 10 | | | | |
| CGL/CTL | Combination as shown in Table 33 | | | | | |
| Surface layer | $SiH_4$ | 50 | 250 | 150 | 0.4 | 5 |
| | $CH_4$ | 600 | | | | |

TABLE 37

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $CH_4$ (substrate side 0.7 μm) | 10 | | | | |
| | (surface side 0.3 μm) | 10 → 0 | | | | |
| | (constantly decrease) | | | | | |
| | NO | 10 | | | | |
| | $N_2$ (substrate side 0.7 μm) | 30 | | | | |
| | (surface side 0.3 μm) | 30 → 0 | | | | |
| | (constantly decrease) | | | | | |
| Charge injection inhibition layer | $SiH_4$ | 100 | 250 | 150 | 0.35 | 3 |
| | $B_2H_6$ (against $SiH_4$) | 800 ppm | | | | |
| | $H_2$ | 100 | | | | |
| | NO(substrate side 2 μm) | 10 | | | | |
| | (surface side 1 μm) | 10 → 0 | | | | |
| | (constantly decrease) | | | | | |
| CGL/CTL | Combination as shown in Table 36 | | | | | |
| Surface layer | $SiH_4$ | 50 | 250 | 150 | 0.4 | 5 |
| | $CH_4$ | 600 | | | | |

TABLE 38

| Drum No. | initial charge-retentivity | photo-sensitivity | residual potential | ghost | durability |
|---|---|---|---|---|---|
| 1201 | ◎ | ○ | Δ | ○ | ◎ |
| 1202 | ◎ | ○ | Δ | ○ | ◎ |
| 1203 | ◎ | ○ | Δ | ○ | ◎ |
| 1204 | ◎ | ○ | Δ | ○ | ◎ |
| 1205 | ◎ | ○ | Δ | ○ | ◎ |
| 1206 | ◎ | ○ | Δ | ○ | ◎ |
| 1207 | ◎ | ○ | Δ | ○ | ◎ |
| 1208 | ◎ | ○ | Δ | ○ | ◎ |
| 1209 | ◎ | ○ | Δ | ○ | ◎ |
| 1210 | ◎ | ○ | Δ | ○ | ◎ |
| 1211 | ◎ | ○ | Δ | ○ | ◎ |
| 1212 | ◎ | ○ | Δ | ○ | ◎ |
| 1213 | ◎ | ○ | Δ | ○ | ◎ |
| 1214 | ◎ | ○ | Δ | ○ | ◎ |
| 1215 | ◎ | ○ | Δ | ○ | ◎ |
| 1216 | ◎ | ○ | Δ | ○ | ◎ |
| 1217 | ◎ | ○ | Δ | ○ | ◎ |
| 1218 | ◎ | ○ | Δ | ○ | ◎ |

◎: Excellent
○: good
Δ: practically applicable
x: practically not applicable

TABLE 39

| | CTL No | | | | | | | |
|---|---|---|---|---|---|---|---|---|
| | CTL | CTL | CTL | CTL | CTL | CTL | CTL | CTL |
| | Drum No | | | | | | | |
| CGL No | 1 | 2 | 3 | 4 | 5 | 6 | 7 | 8 |
| CGL 1 | 1301 | 1302 | 1303 | 1304 | 1305 | 1306 | 1307 | 1308 |
| CGL 2 | 1309 | 1310 | 1311 | 1312 | 1313 | 1314 | 1315 | 1316 |
| CGL 3 | 1317 | | | | | | | |
| CGL 4 | 1318 | | | | | | | |

TABLE 40

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $CH_4$ (substrate side 0.7 μm) | 10 | | | | |
| | (surface side 0.3 μm) | 10 → 0 | | | | |
| | (constantly decrease) | | | | | |
| | NO (substrate side 0.7 μm) | 30 | | | | |
| | $N_2$ (surface side 0.3 μm) | 30 → 0 | | | | |
| | (constantly decrease) | | | | | |
| Charge injection inhibition layer | $SiH_4$ | 100 | 250 | 150 | 0.35 | 3 |
| | $B_2H_6$ (against $SiH_4$) | 800 ppm | | | | |
| | $H_2$ | 100 | | | | |
| | NO | 10 | | | | |
| CGL/CTL | Combination as shown in Table 39 | | | | | |
| Surface layer | $SiH_4$ | 20 | 250 | 150 | 0.4 | 1 |
| | $CH_4$ | 500 | | | | |

TABLE 41

| Drum No. | initial charge-retentivity | photo-sensitivity | residual potential | ghost | durability |
|---|---|---|---|---|---|
| 1301 | ◎ | ○ | ○ | ○ | ◎ |
| 1302 | ◎ | ○ | ○ | ○ | ◎ |
| 1303 | ◎ | ○ | ○ | ○ | ◎ |
| 1304 | ◎ | ○ | ○ | ○ | ◎ |
| 1305 | ◎ | ○ | ○ | ○ | ◎ |
| 1306 | ◎ | ○ | ○ | ○ | ◎ |
| 1307 | ◎ | ○ | ○ | ○ | ◎ |
| 1308 | ◎ | ○ | ○ | ○ | ◎ |
| 1309 | ◎ | ○ | ○ | ○ | ◎ |
| 1310 | ◎ | ○ | ○ | ○ | ◎ |
| 1311 | ◎ | ○ | ○ | ○ | ◎ |
| 1312 | ◎ | ○ | ○ | ○ | ◎ |
| 1313 | ◎ | ○ | ○ | ○ | ◎ |
| 1314 | ◎ | ○ | ○ | ○ | ◎ |
| 1315 | ◎ | ○ | ○ | ○ | ◎ |
| 1316 | ◎ | ○ | ○ | ○ | ◎ |
| 1317 | ◎ | ○ | ○ | ○ | ◎ |

TABLE 41-continued

| Drum No. | initial charge-retentivity | photo-sensitivity | residual potential | ghost | durability |
|---|---|---|---|---|---|
| 1318 | ◎ | ○ | ○ | ○ | ◎ |

◎: Excellent
○: good
Δ: practically applicable
x: practically not applicable

TABLE 42

| | CTL No | | | | | | | |
|---|---|---|---|---|---|---|---|---|
| | CTL | CTL | CTL | CTL | CTL | CTL | CTL | CTL |
| | Drum No | | | | | | | |
| CGL No | 1 | 2 | 3 | 4 | 5 | 6 | 7 | 8 |
| CGL 1 | 1401 | 1402 | 1403 | 1404 | 1405 | 1406 | 1407 | 1408 |
| CGL 2 | 1409 | 1410 | 1411 | 1412 | 1413 | 1414 | 1415 | 1416 |
| CGL 3 | 1417 | | | | | | | |
| CGL 4 | 1418 | | | | | | | |

TABLE 44-continued

| Drum No. | initial charge-retentivity | photo-sensitivity | residual potential | ghost | durability |
|---|---|---|---|---|---|
| 1406 | ◎ | ○ | ○ | ○ | ◎ |
| 1407 | ◎ | ○ | ○ | ○ | ◎ |
| 1408 | ◎ | ○ | ○ | ○ | ◎ |
| 1409 | ◎ | ○ | ○ | ○ | ◎ |
| 1410 | ◎ | ○ | ○ | ○ | ◎ |
| 1411 | ◎ | ○ | ○ | ○ | ◎ |
| 1412 | ◎ | ○ | ○ | ○ | ◎ |
| 1413 | ◎ | ○ | ○ | ○ | ◎ |
| 1414 | ◎ | ○ | ○ | ○ | ◎ |
| 1415 | ◎ | ○ | ○ | ○ | ◎ |
| 1416 | ◎ | ○ | ○ | ○ | ◎ |
| 1417 | ◎ | ○ | ○ | ○ | ◎ |
| 1418 | ◎ | ○ | ○ | ○ | ◎ |

◎: Excellent
○: good
Δ: practically applicable
x: practically not applicable

TABLE 43

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $CH_4$ (substrate side 0.7 μm) | 10 | | | | |
| | (surface side 0.3 μm) (constantly decrease) | 10 → 0 | | | | |
| | NO | 10 | | | | |
| | $N_2$ (substrate side 0.7 μm) | 30 | | | | |
| | (surface side 0.3 μm) (constantly decrease) | 30 → 0 | | | | |
| Charge injection inhibition layer | $SiH_4$ | 100 | 250 | 150 | 0.35 | 3 |
| | $B_2H_6$ (against $SiH_4$) | 800 ppm | | | | |
| | $H_2$ | 100 | | | | |
| | NO (substrate side 2 μm) | 10 | | | | |
| | (surface side 1 μm) (constantly decrease) | 10 → 0 | | | | |
| CGL/CTL | Combination as shown in Table 42 | | | | | |
| Surface layer | $SiH_4$ | 20 | 250 | 150 | 0.4 | 1 |
| | $CH_4$ | 500 | | | | |

TABLE 44

| Drum No. | initial charge-retentivity | photo-sensitivity | residual potential | ghost | durability |
|---|---|---|---|---|---|
| 1401 | ◎ | ○ | ○ | ○ | ◎ |
| 1402 | ◎ | ○ | ○ | ○ | ◎ |
| 1403 | ◎ | ○ | ○ | ○ | ◎ |
| 1404 | ◎ | ○ | ○ | ○ | ◎ |
| 1405 | ◎ | ○ | ○ | ○ | ◎ |

TABLE 45

| | CTL No | | | | | | | |
|---|---|---|---|---|---|---|---|---|
| | CTL | CTL | CTL | CTL | CTL | CTL | CTL | CTL |
| | Drum No | | | | | | | |
| CGL No | 1 | 2 | 3 | 4 | 5 | 6 | 7 | 8 |
| CGL 1 | 1501 | 1502 | 1503 | 1504 | 1505 | 1506 | 1507 | 1508 |
| CGL 2 | 1509 | 1510 | 1511 | 1512 | 1513 | 1514 | 1515 | 1516 |
| CGL 3 | 1517 | | | | | | | |
| CGL 4 | 1518 | | | | | | | |

TABLE 46

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | | | | |
| | $GeH_4$ | | 50 | | | | |
| | $CH_4$ | (substrate side 0.7 μm) | 10 | | | | |
| | | (surface side 0.3 μm) (constantly decrease) | 10 → 0 | 250 | 150 | 0.35 | 1 |
| | NO | (substrate side 0.7 μm) | 5 | | | | |
| | | (surface sie 0.3 μm) (constantly decrease) | 5 → 0 | | | | |
| | $N_2$ | (substrate side 0.7 μm) | 30 | | | | |
| | | (surface side 0.3 μm) (constantly decrease) | 30 → 0 | | | | |
| Charge injection inhibition layer | $SiH_4$ | | 100 | | | | |
| | $B_2H_6$ | (against $SiH_4$) | 800 ppm | 250 | 150 | 0.35 | 3 |
| | $H_2$ | | 100 | | | | |
| | NO | | 10 | | | | |
| CGL/CTL | Combination as shown in Table 45 | | | | | | |

TABLE 46-continued

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| Surface layer | $SiH_4$ | (substrate side) (surface side) | 350 → 10 | | | | |
| | $CH_4$ | (substrate side) (surface side) (constantly diversify) | 10 → 600 | 250 | 150 | 0.4 | 1 |

TABLE 47

| Drum No. | initial charge-retentivity | photo-sensitivity | residual potential | ghost | durability |
|---|---|---|---|---|---|
| 1501 | ◎ | ○ | ○ | ○ | ◎ |
| 1502 | ◎ | ○ | ○ | ○ | ◎ |
| 1503 | ◎ | ○ | ○ | ○ | ◎ |
| 1504 | ◎ | ○ | ○ | ○ | ◎ |
| 1505 | ◎ | ○ | ○ | ○ | ◎ |
| 1506 | ◎ | ○ | ○ | ○ | ◎ |
| 1507 | ◎ | ○ | ○ | ○ | ◎ |
| 1508 | ◎ | ○ | ○ | ○ | ◎ |
| 1509 | ◎ | ○ | ○ | ○ | ◎ |
| 1510 | ◎ | ○ | ○ | ○ | ◎ |
| 1511 | ◎ | ○ | ○ | ○ | ◎ |
| 1512 | ◎ | ○ | ○ | ○ | ◎ |
| 1513 | ◎ | ○ | ○ | ○ | ◎ |
| 1514 | ◎ | ○ | ○ | ○ | ◎ |
| 1515 | ◎ | ○ | ○ | ○ | ◎ |
| 1516 | ◎ | ○ | ○ | ○ | ◎ |
| 1517 | ◎ | ○ | ○ | ○ | ◎ |
| 1518 | ◎ | ○ | ○ | ○ | ◎ |

◎: Excellent
○: good
Δ: practically applicable
X: practically not applicable

TABLE 48

| CGL No | CTL No CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 1601 | 1602 | 1603 | 1604 | 1605 | 1606 | 1607 | 1608 |
| CGL 2 | 1609 | 1610 | 1611 | 1612 | 1613 | 1614 | 1615 | 1616 |
| CGL 3 | 1617 | | | | | | | |

TABLE 48-continued

| CGL No | CTL No CTL 1 | CTL 2 | CTL 3 | CTL 4 | CTL 5 | CTL 6 | CTL 7 | CTL 8 |
|---|---|---|---|---|---|---|---|---|
| CGL 4 | 1618 | | | | | | | |

TABLE 49

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 110 | | | | |
| | $GeH_4$ | | 50 | | | | |
| | $CH_4$ | (substrate side 0.7 μm) | 10 | | | | |
| | | (surface side 0.3 μm) (constantly decrease) | 10 → 0 | 250 | 150 | 0.35 | 1 |
| | NO | | 10 | | | | |
| | $H_2$ | | 50 | | | | |
| | $N_2$ | (substrate side 0.7 μm) | 30 | | | | |
| | | (surface side 0.3 μm) (constantly decrease) | 30 → 0 | | | | |
| Charge injection inhibition layer | $SiH_4$ | | 110 | | | | |
| | $B_2H_6$ | (against $SiH_4$) (substrate side 2 μm) | 800 ppm | | | | |
| | | (surface side 1 μm) (constantly decrease) | 800 → 0 ppm | 250 | 150 | 0.35 | 3 |
| | $H_2$ | | 100 | | | | |
| | NO | (substrate side 2 μm) | 10 | | | | |
| | | (surface side 1 μm) (constantly decrease) | 10 → 0 | | | | |
| CGL/CTL | Combination as shown in Table 48 | | | | | | |
| Surface layer | $SiH_4$ | (substrate side) (surface side) | 350 → 10 | | | | |
| | $CH_4$ | (substrate side) (surface side) (constantly diversify) | 10 → 600 | 250 | 150 | 0.4 | 1 |

TABLE 50

| Drum No. | initial charge-retentivity | photo-sensitivity | residual potential | ghost | durability |
|---|---|---|---|---|---|
| 1601 | ◎ | ○ | ○ | ○ | ◎ |
| 1602 | ◎ | ○ | ○ | ○ | ◎ |
| 1603 | ◎ | ○ | ○ | ○ | ◎ |
| 1604 | ◎ | ○ | ○ | ○ | ◎ |
| 1605 | ◎ | ○ | ○ | ○ | ◎ |
| 1606 | ◎ | ○ | ○ | ○ | ◎ |
| 1607 | ◎ | ○ | ○ | ○ | ◎ |
| 1608 | ◎ | ○ | ○ | ○ | ◎ |
| 1609 | ◎ | ○ | ○ | ○ | ◎ |
| 1610 | ◎ | ○ | ○ | ○ | ◎ |
| 1611 | ◎ | ○ | ○ | ○ | ◎ |
| 1612 | ◎ | ○ | ○ | ○ | ◎ |
| 1613 | ◎ | ○ | ○ | ○ | ◎ |
| 1614 | ◎ | ○ | ○ | ○ | ◎ |
| 1615 | ◎ | ○ | ○ | ○ | ◎ |
| 1616 | ◎ | ○ | ○ | ○ | ◎ |
| 1617 | ◎ | ○ | ○ | ○ | ◎ |
| 1618 | ◎ | ○ | ○ | ○ | ◎ |

◎: Excellent
○: good
Δ: practically applicable
X: practically not applicable

TABLE 51

| CGL No | CTL 1 | CTL 2 | CTL 3 | CTL 4 | CTL 5 | CTL 6 | CTL 7 | CTL 8 |
|---|---|---|---|---|---|---|---|---|
| | CTL No | | | | | | | |
| | Drum No | | | | | | | |
| CGL 1 | 1701 | 1702 | 1703 | 1704 | 1705 | 1706 | 1707 | 1708 |
| CGL 2 | 1709 | 1710 | 1711 | 1712 | 1713 | 1714 | 1715 | 1716 |
| CGL 3 | 1717 | | | | | | | |
| CGL 4 | 1718 | | | | | | | |

TABLE 53-continued

| Drum No. | initial charge-retentivity | photo-sensitivity | residual potential | ghost | durability |
|---|---|---|---|---|---|
| 1713 | ◎ | ○ | ○ | ○ | ◎ |
| 1714 | ◎ | ○ | ○ | ○ | ◎ |
| 1715 | ◎ | ○ | ○ | ○ | ◎ |
| 1716 | ◎ | ○ | ○ | ○ | ◎ |
| 1717 | ◎ | ○ | ○ | ○ | ◎ |
| 1718 | ◎ | ○ | ○ | ○ | ◎ |

◎: Excellent

TABLE 52

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | | | | |
| | $GeH_4$ | | 50 | | | | |
| | $CH_4$ | (substrate side 0.7 μm) | 10 | | | | |
| | | (surface side 0.3 μm) (constantly decrease) | 10 → 0 | 250 | 150 | 0.35 | 1 |
| | NO | (substrate side 0.7 μm) | 5 | | | | |
| | | (surface side 0.3 μm) (constantly decrease) | 5 → 0 | | | | |
| | $N_2$ | (substrate side 0.7 μm) | 30 | | | | |
| | | (surface side 0.3 μm) (constantly decrease) | 30 → 0 | | | | |
| Charge injection inhibition layer | $SiH_4$ | | 100 | | | | |
| | $B_2H_6$ | (against $SiH_4$) | 800 ppm | 250 | 150 | 0.35 | 3 |
| | $H_2$ | | 100 | | | | |
| | NO | | 10 | | | | |
| CGL/CTL | Combination as shown in Table 51 | | | | | | |
| Surface layer | $SiH_4$ | | 50 | 250 | 150 | 0.4 | 2 |
| | $NH_3$ | | 500 | | | | |

TABLE 53

| Drum No. | initial charge-retentivity | photo-sensitivity | residual potential | ghost | durability |
|---|---|---|---|---|---|
| 1701 | ◎ | ○ | ○ | ○ | ◎ |
| 1702 | ◎ | ○ | ○ | ○ | ◎ |
| 1703 | ◎ | ○ | ○ | ○ | ◎ |
| 1704 | ◎ | ○ | ○ | ○ | ◎ |
| 1705 | ◎ | ○ | ○ | ○ | ◎ |
| 1706 | ◎ | ○ | ○ | ○ | ◎ |
| 1707 | ◎ | ○ | ○ | ○ | ◎ |
| 1708 | ◎ | ○ | ○ | ○ | ◎ |
| 1709 | ◎ | ○ | ○ | ○ | ◎ |
| 1710 | ◎ | ○ | ○ | ○ | ◎ |
| 1711 | ◎ | ○ | ○ | ○ | ◎ |
| 1712 | ◎ | ○ | ○ | ○ | ◎ |

○: good
Δ: practically applicable
X: practically not applicable

TABLE 54

| CGL No | CTL 1 | CTL 2 | CTL 3 | CTL 4 | CTL 5 | CTL 6 | CTL 7 | CTL 8 |
|---|---|---|---|---|---|---|---|---|
| | CTL No | | | | | | | |
| | Drum No | | | | | | | |
| CGL 1 | 1801 | 1802 | 1803 | 1804 | 1805 | 1806 | 1807 | 1808 |
| CGL 2 | 1809 | 1810 | 1811 | 1812 | 1813 | 1814 | 1815 | 1816 |
| CGL 3 | 1817 | | | | | | | |
| CGL 4 | 1818 | | | | | | | |

TABLE 55

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | | | | |
| | $GeH_4$ | | 50 | | | | |
| | $CH_4$ | (substrate side 0.7 μm) | 10 | | | | |
| | | (surface side 0.3 μm) (constantly decrease) | 10 → 0 | 250 | 150 | 0.35 | 1 |
| | NO | | 10 | | | | |
| | $N_2$ | (substrate side 0.7 μm) | 30 | | | | |
| | | (surface side 0.3 μm) (constantly decrease) | 30 → 0 | | | | |
| Charge injection inhibition layer | $SiH_4$ | | 100 | | | | |
| | $B_2H_6$ | (against $SiH_4$) (substrate side 2 μm) | 800 ppm | | | | |
| | | (surface side 1 μm) (constantly decrease) | 800 → 0 ppm | 250 | 150 | 0.35 | 3 |
| | $H_2$ | | 100 | | | | |
| | NO | (substrate side 2 μm) | 10 | | | | |
| | | (surface side 1 μm) (constantly decrease) | 10 → 0 | | | | |
| CGL/CTL | Combination as shown in Table 54 | | | | | | |
| Surface layer | $SiH_4$ | | 50 | 250 | 150 | 0.4 | 2 |
| | $NH_3$ | | 500 | | | | |

TABLE 56

| Drum No. | initial charge-retentivity | photo-sensitivity | residual potential | ghost | durability |
|---|---|---|---|---|---|
| 1801 | ◎ | ○ | ◎ | ○ | ◎ |
| 1802 | ◎ | ○ | ◎ | ○ | ◎ |
| 1803 | ◎ | ○ | ◎ | ○ | ◎ |
| 1804 | ◎ | ○ | ◎ | ○ | ◎ |
| 1805 | ◎ | ○ | ◎ | ○ | ◎ |
| 1806 | ◎ | ○ | ◎ | ○ | ◎ |
| 1807 | ◎ | ○ | ◎ | ○ | ◎ |
| 1808 | ◎ | ○ | ◎ | ○ | ◎ |
| 1809 | ◎ | ○ | ◎ | ○ | ◎ |
| 1810 | ◎ | ○ | ◎ | ○ | ◎ |
| 1811 | ◎ | ○ | ◎ | ○ | ◎ |
| 1812 | ◎ | ○ | ◎ | ○ | ◎ |
| 1813 | ◎ | ○ | ◎ | ○ | ◎ |
| 1814 | ◎ | ○ | ◎ | ○ | ◎ |
| 1815 | ◎ | ○ | ◎ | ○ | ◎ |
| 1816 | ◎ | ○ | ◎ | ○ | ◎ |
| 1817 | ◎ | ○ | ◎ | ○ | ◎ |
| 1818 | ◎ | ○ | ◎ | ○ | ◎ |

◎: Excellent
○: good
Δ: practically applicable
X: practically not applicable

TABLE 59

| Drum No. | initial charge-retentivity | photo-sensitivity | residual potential | ghost | durability |
|---|---|---|---|---|---|
| 1901 | ◎ | ◎ | ○ | ◎ | ◎ |
| 1902 | ◎ | ◎ | ○ | ◎ | ◎ |
| 1903 | ◎ | ◎ | ○ | ◎ | ◎ |
| 1904 | ◎ | ◎ | ○ | ◎ | ◎ |
| 1905 | ◎ | ◎ | ○ | ◎ | ◎ |
| 1906 | ◎ | ◎ | ○ | ◎ | ◎ |
| 1907 | ◎ | ◎ | ○ | ◎ | ◎ |
| 1908 | ◎ | ◎ | ○ | ◎ | ◎ |
| 1909 | ◎ | ◎ | ○ | ◎ | ◎ |
| 1910 | ◎ | ◎ | ○ | ◎ | ◎ |
| 1911 | ◎ | ◎ | ○ | ◎ | ◎ |
| 1912 | ◎ | ◎ | ○ | ◎ | ◎ |
| 1913 | ◎ | ◎ | ○ | ◎ | ◎ |
| 1914 | ◎ | ◎ | ○ | ◎ | ◎ |
| 1915 | ◎ | ◎ | ○ | ◎ | ◎ |
| 1916 | ◎ | ◎ | ○ | ◎ | ◎ |
| 1917 | ◎ | ◎ | ○ | ◎ | ◎ |
| 1918 | ◎ | ◎ | ○ | ◎ | ◎ |

◎: Excellent
○: good
Δ: practically applicable
X: practically not applicable

TABLE 57

| CGL No | CTL No: CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 1901 | 1902 | 1903 | 1904 | 1905 | 1906 | 1907 | 1908 |
| CGL 2 | 1909 | 1910 | 1911 | 1912 | 1913 | 1914 | 1915 | 1916 |
| CGL 3 | 1917 | | | | | | | |
| CGL 4 | 1918 | | | | | | | |

TABLE 60

| CGL No | CTL No: CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 2001 | 2002 | 2003 | 2004 | 2005 | 2006 | 2007 | 2008 |
| CGL 2 | 2009 | 2010 | 2011 | 2012 | 2013 | 2014 | 2015 | 2016 |
| CGL 3 | 2017 | | | | | | | |
| CGL 4 | 2018 | | | | | | | |

TABLE 58

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | | | | |
| | $GeH_4$ | | 50 | | | | |
| | $CH_4$ | (substrate side 0.7 μm) | 10 | | | | |
| | | (surface side 0.3 μm) (constantly decrease) | 10 → 0 | 250 | 150 | 0.35 | 1 |
| | NO | | 10 | | | | |
| | $N_2$ | (substrate side 0.7 μm) | 30 | | | | |
| | | (surface side 0.3 μm) (constantly decrease) | 30 → 0 | | | | |
| Charge injection inhibition layer | $SiH_4$ | | 100 | | | | |
| | $B_2H_6$ | (against $SiH_4$) | 800 ppm | 250 | 150 | 0.35 | 3 |
| | $H_2$ | | 100 | | | | |
| | NO | | 10 | | | | |
| CGL/CTL | Combination as shown in Table 57 | | | | | | |
| Surface layer | $SiH_4$ | | 200 | | | | |
| | $SiF_4$ | | 50 | | | | |
| | NO | | 50 | 250 | 150 | 0.4 | 2 |
| | $CH_4$ | | 5 | | | | |
| | $NH_3$ | | 5 | | | | |

TABLE 61

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $CH_4$ (substrate side 0.7 μm) | 10 | | | | |
| | (surface side 0.3 μm) (constantly decrease) | 10 → 0 | | | | |
| | NO | 10 | | | | |
| | $N_2$ (substrate side 0.7 μm) | 30 | | | | |
| | (surface side 0.3 μm) (constantly descrease) | 30 → 0 | | | | |
| Charge | $SiH_4$ | 100 | 250 | 150 | 0.35 | 3 |

TABLE 61-continued

| Name of layer | Gas used & its flow rate (SCCM) | | Substrate temperature (°C.) | RF power (W) | Internal pressure (Torr) | Layer thickness (μm) |
|---|---|---|---|---|---|---|
| injection inhibition layer | $B_2H_6$ (against $SiH_4$) | 800 ppm | | | | |
| | $H_2$ | 100 | | | | |
| | NO (substrate side 2 μm) | 10 | | | | |
| | (surface side 1 μm) | 10 → 0 | | | | |
| | (constantly decrease) | | | | | |
| CGL/CTL Surface layer | Combination as shown in Table 60 | | | | | |
| | $SiH_4$ | 200 | 250 | 150 | 0.4 | 2 |
| | $SiF_4$ | 50 | | | | |
| | NO | 50 | | | | |
| | $CH_4$ | 5 | | | | |
| | $NH_3$ | 5 | | | | |

TABLE 62

| Drum No. | initial charge-retentivity | photo-sensitivity | residual potential | ghost | durability |
|---|---|---|---|---|---|
| 2001 | ◎ | ○ | ○ | ○ | ◎ |
| 2002 | ◎ | ○ | ○ | ○ | ◎ |
| 2003 | ◎ | ○ | ○ | ○ | ◎ |
| 2004 | ◎ | ○ | ○ | ○ | ◎ |
| 2005 | ◎ | ○ | ○ | ○ | ◎ |
| 2006 | ◎ | ○ | ○ | ○ | ◎ |
| 2007 | ◎ | ○ | ○ | ○ | ◎ |
| 2008 | ◎ | ○ | ○ | ○ | ◎ |
| 2009 | ◎ | ○ | ○ | ○ | ◎ |
| 2010 | ◎ | ○ | ○ | ○ | ◎ |
| 2011 | ◎ | ○ | ○ | ○ | ◎ |
| 2012 | ◎ | ○ | ○ | ○ | ◎ |
| 2013 | ◎ | ○ | ○ | ○ | ◎ |
| 2014 | ◎ | ○ | ○ | ○ | ◎ |
| 2015 | ◎ | ○ | ○ | ○ | ◎ |
| 2016 | ◎ | ○ | ○ | ○ | ◎ |
| 2017 | ◎ | ○ | ○ | ○ | ◎ |
| 2018 | ◎ | ○ | ○ | ○ | ◎ |

◎: Excellent
Δ: practically applicable
○: good
X: practically not applicable

TABLE 63

| CGL No | CTL No 1 | CTL 2 | CTL 3 | CTL 4 | CTL 5 | CTL 6 | CTL 7 | CTL 8 |
|---|---|---|---|---|---|---|---|---|
| | Drum No. | | | | | | | |

TABLE 63-continued

| CGL No | CTL No 1 | CTL 2 | CTL 3 | CTL 4 | CTL 5 | CTL 6 | CTL 7 | CTL 8 |
|---|---|---|---|---|---|---|---|---|
| CGL 1 | 2101 | 2102 | 2103 | 2104 | 2105 | 2106 | 2107 | 2108 |
| CGL 2 | 2109 | 2110 | 2111 | 2112 | 2113 | 2114 | 2115 | 2116 |
| CGL 3 | 2117 | | | | | | | |
| CGL 4 | 2118 | | | | | | | |

TABLE 64

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $CH_4$ (substrate side 0.7 μm) | 10 | | | | |
| | (surface side 0.3 μm) | 10 → 0 | | | | |
| | (constantly decrease) | | | | | |
| | NO (substrate side 0.7 μm) | 5 | | | | |
| | (surface side 0.3 μm) | 5 → 0 | | | | |
| | (constantly decrease) | | | | | |
| | $N_2$ (substrate side 0.7 μm) | 30 | | | | |
| | (surface side 0.3 μm) | 30 → 0 | | | | |
| | (constantly decrease) | | | | | |
| Charge injection inhibition layer | $SiH_4$ | 100 | 250 | 150 | 0.35 | 3 |
| | $H_2$ | 100 | | | | |
| | NO (substrate side 2 μm) | 10 | | | | |
| | (surface side 1 μm) | 10 → 0 | | | | |
| | (constantly decrease) | | | | | |
| | $CH_4$ (substrate side 2 μm) | 100 | | | | |
| | (surface side 1 μm) | 100 → 0 | | | | |
| | (constantly decrease) | | | | | |
| CGL/CTL Surface layer | Combination as shown in Table 63 | | | | | |
| | $SiH_4$ | 50 | 250 | 150 | 0.4 | 5 |
| | $CH_4$ | 600 | | | | |

TABLE 65

| Drum No | initial charge-retentivity | photo-sensitivity | residual potential | ghost | durability |
|---|---|---|---|---|---|
| 2101 | ◎ | ○ | Δ | ○ | ◎ |
| 2102 | ◎ | ○ | Δ | ○ | ◎ |
| 2103 | ◎ | ○ | Δ | ○ | ◎ |
| 2104 | ◎ | ○ | Δ | ○ | ◎ |
| 2105 | ◎ | ○ | Δ | ○ | ◎ |
| 2106 | ◎ | ○ | Δ | ○ | ◎ |
| 2107 | ◎ | ○ | Δ | ○ | ◎ |
| 2108 | ◎ | ○ | Δ | ○ | ◎ |
| 2109 | ◎ | ○ | Δ | ○ | ◎ |
| 2110 | ◎ | ○ | Δ | ○ | ◎ |
| 2111 | ◎ | ○ | Δ | ○ | ◎ |
| 2112 | ◎ | ○ | Δ | ○ | ◎ |
| 2113 | ◎ | ○ | Δ | ○ | ◎ |
| 2114 | ◎ | ○ | Δ | ○ | ◎ |
| 2115 | ◎ | ○ | Δ | ○ | ◎ |
| 2116 | ◎ | ○ | Δ | ○ | ◎ |
| 2117 | ◎ | ○ | Δ | ○ | ◎ |

TABLE 65-continued

| Drum No | initial charge-retentivity | photo-sensitivity | residual potential | ghost | durability |
|---|---|---|---|---|---|
| 2118 | ◎ | ○ | Δ | ○ | ◎ |

: Excellent
Δ: practically applicable
: good
X: practically not applicable

TABLE 66

| CGL No | CTL No CTL 1 | CTL 2 | CTL 3 | CTL 4 | CTL 5 | CTL 6 | CTL 7 | CTL 8 |
|---|---|---|---|---|---|---|---|---|
| | Drum No. | | | | | | | |
| CGL 1 | 2201 | 2202 | 2203 | 2204 | 2205 | 2206 | 2207 | 2208 |
| CGL 2 | 2209 | 2210 | 2211 | 2212 | 2213 | 2214 | 2215 | 2216 |
| CGL 3 | 2217 | | | | | | | |
| CGL 4 | 2218 | | | | | | | |

TABLE 68-continued

| Drum No | initial charge-retentivity | photo-sensitivity | residual potential | ghost | durablity |
|---|---|---|---|---|---|
| 2206 | ◎ | ○ | ○ | ◎ | ◎ |
| 2207 | ◎ | ○ | ○ | ◎ | ◎ |
| 2208 | ◎ | ○ | ○ | ◎ | ◎ |
| 2209 | ◎ | ○ | ○ | ◎ | ◎ |
| 2210 | ◎ | ○ | ○ | ◎ | ◎ |
| 2211 | ◎ | ○ | ○ | ◎ | ◎ |
| 2212 | ◎ | ○ | ○ | ◎ | ◎ |
| 2213 | ◎ | ○ | ○ | ◎ | ◎ |
| 2214 | ◎ | ○ | ○ | ◎ | ◎ |
| 2215 | ◎ | ○ | ○ | ◎ | ◎ |
| 2216 | ◎ | ○ | ○ | ◎ | ◎ |
| 2217 | ◎ | ○ | ○ | ◎ | ◎ |
| 2218 | ◎ | ○ | ○ | ◎ | ◎ |

◎: Excellent
Δ: practically applicable
○: good
X: practically not applicable

TABLE 67

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $SnH_4$ | 50 | | | | |
| | $PH_3$ (against $Si_4$) | 800 ppm | | | | |
| | NO | 5 | | | | |
| | $N_2$ | 30 | | | | |
| | $H_2$ | 100 | | | | |
| | $GeH_4$ | 10 | | | | |
| Charge injection inhibition layer | $SiH_4$ | 150 | 250 | 150 | 0.35 | 3 |
| | $SiF_4$ | 50 | | | | |
| | $GeH_4$ | 10 | | | | |
| | $PH_3$ (against $SiH_4$) | | | | | |
| | (substrate side 2 μm) | 800 ppm | | | | |
| | (surface side 1 μm) | 800 → 0 ppm | | | | |
| | (constantly descrease) | | | | | |
| | NO (substrate side 2 μm) | 5 | | | | |
| | (surface side 1 μm) | 5 → 0 | | | | |
| | (constantly decrease) | | | | | |
| | $CH_4$ (substrate side 2 μm) | 20 | | | | |
| | (surface side 1 μm) | 20 → 0 | | | | |
| | (constantly decrease) | | | | | |
| CGL/CTL | Combination as shown in Table 66 | | | | | |
| Surface layer | $SiH_4$ | 10 | 250 | 200 | 0.4 | 2 |
| | $N_2$ | 500 | | | | |
| | $CH_4$ | 20 | | | | |

TABLE 68

| Drum No | initial charge-retentivity | photo-sensitivity | residual potential | ghost | durablity |
|---|---|---|---|---|---|
| 2201 | ◎ | ○ | ○ | ◎ | ◎ |
| 2202 | ◎ | ○ | ○ | ◎ | ◎ |
| 2203 | ◎ | ○ | ○ | ◎ | ◎ |
| 2204 | ◎ | ○ | ○ | ◎ | ◎ |
| 2205 | ◎ | ○ | ○ | ◎ | ◎ |

TABLE 69

| CGL No | CTL No CTL 1 | CTL 2 | CTL 3 | CTL 4 | CTL 5 | CTL 6 | CTL 7 | CTL 8 |
|---|---|---|---|---|---|---|---|---|
| | Drum No. | | | | | | | |
| CGL 1 | 2301 | 2302 | 2303 | 2304 | 2305 | 2306 | 2307 | 2308 |
| CGL 2 | 2309 | 2310 | 2311 | 2312 | 2313 | 2314 | 2315 | 2316 |
| CGL 3 | 2317 | | | | | | | |
| CGL 4 | 2318 | | | | | | | |

TABLE 70

| Name of layer | Gas used & its flow rate (SCCM) | | Substrate Temperature (°C.) | RF power (W) | Internal pressure (Torr) | Layer thickness (μm) |
|---|---|---|---|---|---|---|
| IR absorption layer | $SiH_4$ | 100 | 250 | 160 | 0.35 | 1 |
| | $SnH_4$ | 50 | | | | |
| | $PH_3$ (against $SiH_4$) | 800 ppm | | | | |
| | NO | 10 | | | | |
| | $N_2$ | 30 | | | | |
| | $H_2$ | 100 | | | | |
| | $GeH_4$ | 10 | | | | |
| Charge injection inhibition | $SiH_4$ | 150 | 250 | 150 | 0.35 | 3 |
| | $SiF_4$ | 50 | | | | |
| | $GeH_4$ | 10 | | | | |

TABLE 70-continued

| Name of layer | Gas used & its flow rate (SCCM) | | Substrate Temperature (°C.) | RF power (W) | Internal pressure (Torr) | Layer thickness (μm) |
|---|---|---|---|---|---|---|
| layer | $PH_3$ (against $SiH_4$) | | | | | |
| | (substrate side 2 μm) | 800 ppm | | | | |
| | (surface side 1 μm) | 800 → 0 | | | | |
| | (constantly decreased) | ppm | | | | |
| | NO (substrate side 2 μm) | 10 | | | | |
| | (surface side 1 μm) | 10 → 0 | | | | |
| | (constantly decrease) | | | | | |
| | $CH_4$ (substrate side 2 μm) | 20 | | | | |
| | (surface side 1 μm) | 20 → 0 | | | | |
| | (constantly decrease) | | | | | |
| CGL/CTL | Combination as shown in Table 69 | | | | | |
| Surface layer | $SiH_4$ | 20 | 250 | 150 | 0.4 | 1 |
| | $CH_4$ | 500 | | | | |

TABLE 71

| Drum No | initial charge-retentivity | photo-sensitivity | residual potential | ghost | durability |
|---|---|---|---|---|---|
| 2301 | ◎ | ○ | ◎ | ○ | ◎ |
| 2302 | ◎ | ○ | ◎ | ○ | ◎ |
| 2303 | ◎ | ○ | ◎ | ○ | ◎ |
| 2304 | ◎ | ○ | ◎ | ○ | ◎ |
| 2305 | ◎ | ○ | ◎ | ○ | ◎ |
| 2306 | ◎ | ○ | ◎ | ○ | ◎ |
| 2307 | ◎ | ○ | ◎ | ○ | ◎ |
| 2308 | ◎ | ○ | ◎ | ○ | ◎ |
| 2309 | ◎ | ○ | ◎ | ○ | ◎ |
| 2310 | ◎ | ○ | ◎ | ○ | ◎ |
| 2311 | ◎ | ○ | ◎ | ○ | ◎ |
| 2312 | ◎ | ○ | ◎ | ○ | ◎ |
| 2313 | ◎ | ○ | ◎ | ○ | ◎ |
| 2314 | ◎ | ○ | ◎ | ○ | ◎ |
| 2315 | ◎ | ○ | ◎ | ○ | ◎ |
| 2316 | ◎ | ○ | ◎ | ○ | ◎ |
| 2317 | ◎ | ○ | ◎ | ○ | ◎ |
| 2318 | ◎ | ○ | ◎ | ○ | ◎ |

◎: Excellent
Δ: practically applicable
○: good
X: practically not applicable

TABLE 72

| CGL No | CTL No: CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 2401 | 2402 | 2403 | 2404 | 2405 | 2406 | 2407 | 2408 |
| CGL 2 | 2409 | 2410 | 2411 | 2412 | 2413 | 2414 | 2415 | 2416 |
| CGL 3 | 2417 | | | | | | | |
| CGL 4 | 2418 | | | | | | | |

TABLE 73

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $SnH_4$ | 50 | | | | |
| | $PH_3$ (against $SiH_4$) | 800 ppm | | | | |
| | NO | 10 | | | | |
| | $N_2$ | 30 | | | | |
| | $H_2$ | 100 | | | | |
| Charge injection inhibition layer | $SiH_4$ | 150 | 250 | 150 | 0.35 | 3 |
| | $SiF_4$ | 50 | | | | |
| | $GeH_4$ | 10 | | | | |
| | $PH_3$ (against $SiH_4$) | | | | | |
| | (substrate side 2 μm) | 800 ppm | | | | |
| | (surface side 1 μm) | 800 → 0 | | | | |
| | (constantly decrease) | ppm | | | | |
| | NO (substrate side 2 μm) | 10 | | | | |
| | (surface side 1 μm) | 10 → 0 | | | | |
| | (constantly drecease) | | | | | |
| | $CH_4$ (substrate side 2 μm) | 20 | | | | |
| | (surface side 1 μm) | 20 → 0 | | | | |
| | (constantly decrease) | | | | | |
| CGL/CTL Surface layer | Combination as shown in Table 72 | | | | | |
| | $SiH_4$ (substrate side) | 350 → 10 | 250 | 150 | 0.4 | 1 |
| | (surface side) | | | | | |
| | $CH_4$ (substrate side) | 10 → 600 | | | | |
| | (surface side) | | | | | |
| | (constantly diversify) | | | | | |

TABLE 74

| Drum No | initial charge-retentivity | photo-sensitivity | residual potential | ghost | durability |
|---|---|---|---|---|---|
| 2401 | ◎ | ○ | ◎ | ○ | ◎ |
| 2402 | ◎ | ○ | ◎ | ○ | ◎ |
| 2403 | ◎ | ○ | ◎ | ○ | ◎ |
| 2404 | ◎ | ○ | ◎ | ○ | ◎ |
| 2405 | ◎ | ○ | ◎ | ○ | ◎ |
| 2406 | ◎ | ○ | ◎ | ○ | ◎ |
| 2407 | ◎ | ○ | ◎ | ○ | ◎ |
| 2408 | ◎ | ○ | ◎ | ○ | ◎ |
| 2409 | ◎ | ○ | ◎ | ○ | ◎ |
| 2410 | ◎ | ○ | ◎ | ○ | ◎ |
| 2411 | ◎ | ○ | ◎ | ○ | ◎ |
| 2412 | ◎ | ○ | ◎ | ○ | ◎ |
| 2413 | ◎ | ○ | ◎ | ○ | ◎ |

TABLE 74-continued

| Drum No | initial charge-retentivity | photo-sensitivity | residual potential | ghost | durability |
|---|---|---|---|---|---|
| 2414 | ◎ | ○ | ◎ | ○ | ◎ |
| 2415 | ◎ | ○ | ◎ | ○ | ◎ |
| 2416 | ◎ | ○ | ◎ | ○ | ◎ |
| 2417 | ◎ | ○ | ◎ | ○ | ◎ |
| 2418 | ◎ | ○ | ◎ | ○ | ◎ |

◎: Excellent
Δ: practically applicable
○: good
X: practically not applicable

TABLE 75

| CGL No | CTL No CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 2501 | 2502 | 2503 | 2504 | 2505 | 2506 | 2507 | 2508 |
| CGL 2 | 2509 | 2510 | 2511 | 2512 | 2513 | 2514 | 2515 | 2516 |
| CGL 3 | 2517 | | | | | | | |
| CGL 4 | 2518 | | | | | | | |

TABLE 76

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | 250 | 150 | 0.35 | 1 |
| | $SnH_4$ | | 50 | | | | |
| | $PH_3$ | (against $SiH_4$) | 800 ppm | | | | |
| | NO | 10 | | | | | |
| | $H_2$ | | 100 | | | | |
| Charge injection inhibition layer | $SiH_4$ | | 150 250 | 150 | 0.35 | 3 | |
| | $SiF_4$ | | 50 | | | | |
| | $GeH_4$ | | 10 | | | | |
| | $PH_3$ | (against $SiH_4$) | | | | | |
| | | (substrate side 2 μm) | 800 ppm | | | | |
| | | (surface side 1 μm) | 800 →0 ppm | | | | |
| | | (constantly decrease) | | | | | |
| | NO | (substrate side 2 μm) | 10 | | | | |
| | | (surface side 1 μm) | 10 →0 | | | | |
| | | (constantly decrease) | | | | | |
| | $CH_4$ | (substrate side 2 μm) | 20 | | | | |
| | | (surface side 1 μm) | 20 → 0 | | | | |
| | | (constantly decrease) | | | | | |
| CGL/CTL | Combination as shown in Table 75 | | | | | | |
| Surface layer | $SiH_4$ | | 50 | 250 | 100 | 0.4 | 2 |
| | $NH_3$ | | 500 | | | | |

TABLE 77

| Drum No. | initial charge-retentivity | photo-sensitivity | residual potential | ghost | durability |
|---|---|---|---|---|---|
| 2501 | ◎ | ○ | ○ | ◎ | ◎ |
| 2502 | ◎ | ○ | ○ | ◎ | ◎ |
| 2503 | ◎ | ○ | ○ | ◎ | ◎ |

TABLE 77-continued

| Drum No. | initial charge-retentivity | photo-sensitivity | residual potential | ghost | durability |
|---|---|---|---|---|---|
| 2504 | ◎ | ○ | ○ | ◎ | ◎ |
| 2505 | ◎ | ○ | ○ | ◎ | ◎ |
| 2506 | ◎ | ○ | ○ | ◎ | ◎ |
| 2507 | ◎ | ○ | ○ | ◎ | ◎ |
| 2508 | ◎ | ○ | ○ | ◎ | ◎ |
| 2509 | ◎ | ○ | ○ | ◎ | ◎ |
| 2510 | ◎ | ○ | ○ | ◎ | ◎ |
| 2511 | ◎ | ○ | ○ | ◎ | ◎ |
| 2512 | ◎ | ○ | ○ | ◎ | ◎ |
| 2513 | ◎ | ○ | ○ | ◎ | ◎ |
| 2514 | ◎ | ○ | ○ | ◎ | ◎ |
| 2515 | ◎ | ○ | ○ | ◎ | ◎ |
| 2516 | ◎ | ○ | ○ | ◎ | ◎ |
| 2517 | ◎ | ○ | ○ | ◎ | ◎ |
| 2518 | ◎ | ○ | ○ | ◎ | ◎ |

◎: Excellent
Δ: practically applicable
○: good
X: practically not applicable

TABLE 78

| CGL No | CTL No CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 2601 | 2602 | 2603 | 2604 | 2605 | 2606 | 2607 | 2608 |
| CGL 2 | 2609 | 2610 | 2611 | 2612 | 2613 | 2614 | 2615 | 2616 |
| CGL 3 | 2617 | | | | | | | |
| CGL 4 | 2618 | | | | | | | |

TABLE 79

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | 250 | 160 | 0.35 | 1 |
| | $SnH_4$ | | 50 | | | | |
| | $PH_3$ | (against $SiH_4$) | 800 ppm | | | | |
| | NO | | 10 | | | | |
| | $N_2$ | | 30 | | | | |
| | $H_2$ | | 100 | | | | |
| | $GeH_4$ | | 10 | | | | |
| Charge injection inhibition layer | $SiH_4$ | | 150 | 250 | 150 | 0.35 | 3 |
| | $SiF_4$ | | 50 | | | | |
| | $GeH_4$ | | 10 | | | | |
| | $PH_3$ | (against $SiH_4$) | | | | | |

TABLE 79-continued

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| | | (substrate side 2 μm) | 800 ppm | | | | |
| | | (surface side 1 μm) | 800 → 0 ppm | | | | |
| | | (constantly decrease) | | | | | |
| | NO | (substrate side 2 μm) | 10 | | | | |
| | | (surface side 1 μm) | 10 → 0 | | | | |
| | | (constantly decrease) | | | | | |
| | $CH_4$ | (substrate side 2 μm) | 20 | | | | |
| | | (surface side 1 μm) | 20 → 0 | | | | |
| | | (constantly decrease) | | | | | |
| CGL/CTL | | Combination as shown in Table 78 | | | | | |
| Surface layer | $SiH_4$ | | 200 | 250 | 150 | 0.4 | 2 |
| | $SiF_4$ | | 50 | | | | |
| | NO | | 50 | | | | |
| | $CH_4$ | | 5 | | | | |
| | $NH_4$ | | 5 | | | | |

TABLE 80

| Drum No. | initial charge-retentivity | photo-sensitivity | residual potential | ghost | durability |
|---|---|---|---|---|---|
| 2601 | ◎ | ○ | ○ | ○ | ◎ |
| 2602 | ◎ | ○ | ○ | ○ | ◎ |
| 2603 | ◎ | ○ | ○ | ○ | ◎ |
| 2604 | ◎ | ○ | ○ | ○ | ◎ |
| 2605 | ◎ | ○ | ○ | ○ | ◎ |
| 2606 | ◎ | ○ | ○ | ○ | ◎ |
| 2607 | ◎ | ○ | ○ | ○ | ◎ |
| 2608 | ◎ | ○ | ○ | ○ | ◎ |
| 2609 | ◎ | ○ | ○ | ○ | ◎ |
| 2610 | ◎ | ○ | ○ | ○ | ◎ |
| 2611 | ◎ | ○ | ○ | ○ | ◎ |
| 2612 | ◎ | ○ | ○ | ○ | ◎ |
| 2613 | ◎ | ○ | ○ | ○ | ◎ |
| 2614 | ◎ | ○ | ○ | ○ | ◎ |
| 2615 | ◎ | ○ | ○ | ○ | ◎ |
| 2616 | ◎ | ○ | ○ | ○ | ◎ |
| 2617 | ◎ | ○ | ○ | ○ | ◎ |
| 2618 | ◎ | ○ | ○ | ○ | ◎ |

◎: Excellent
Δ: practically applicable
○: good
X: practically not applicable

TABLE 81

| CGL No | CTL No: CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 2701 | 2702 | 2703 | 2704 | 2705 | 2706 | 2707 | 2708 |
| CGL 2 | 2709 | 2710 | 2711 | 2712 | 2713 | 2714 | 2715 | 2716 |
| CGL 3 | 2717 | | | | | | | |
| CGL 4 | 2718 | | | | | | | |

TABLE 82

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | 250 | 150 | 0.35 | 1 |
| | $GeH_4$ | 10 | | | | | |
| | $CH_4$ | (substrate side 0.7 μm) | 25 | | | | |
| | | (surface side 0.3 μm) | 25 → 20 | | | | |
| | | (constantly decrease) | | | | | |
| | NO | | 10 | | | | |
| Charge injection inhibition layer | $SiH_4$ | | 150 | 250 | 150 | 0.35 | 3 |
| | $SiF_4$ | | 50 | | | | |
| | $GeH_4$ | | 10 | | | | |
| | $PH_3$ | (against $SiH_4$) | | | | | |
| | | (substrate side 2 μm) | 800 ppm | | | | |
| | | (surface side 1 μm) | 800 → 0 ppm | | | | |
| | | (constantly decrease) | | | | | |
| | NO | (substrate side 2 μm) | 10 | | | | |
| | | (surface side 1 μm) | 10 → 0 | | | | |
| | | (constantly decrease) | | | | | |
| | $CH_4$ | (substrate side 2 μm) | 20 | | | | |
| | | (surface side 1 μm) | 20 → 0 | | | | |
| | | (constantly decrease) | | | | | |
| CG/CTL | | Combination as shown in Table 81 | | | | | |
| Surface layer | $SiH_4$ | | 10 | 250 | 200 | 0.4 | 2 |
| | $N_2$ | | 500 m | | | | |
| | $CH_4$ 20 | | | | | | |

TABLE 83

| Drum No. | initial charge-retentivity | photo-sensitivity | residual potential | ghost | durability |
|---|---|---|---|---|---|
| 2701 | ◎ | ○ | ○ | ◎ | ◎ |
| 2702 | ◎ | ○ | ○ | ◎ | ◎ |
| 2703 | ◎ | ○ | ○ | ◎ | ◎ |
| 2704 | ◎ | ○ | ○ | ◎ | ◎ |
| 2705 | ◎ | ○ | ○ | ◎ | ◎ |
| 2706 | ◎ | ○ | ○ | ◎ | ◎ |
| 2707 | ◎ | ○ | ○ | ◎ | ◎ |
| 2708 | ◎ | ○ | ○ | ◎ | ◎ |
| 2709 | ◎ | ○ | ○ | ◎ | ◎ |
| 2710 | ◎ | ○ | ○ | ◎ | ◎ |
| 2711 | ◎ | ○ | ○ | ◎ | ◎ |
| 2712 | ◎ | ○ | ○ | ◎ | ◎ |
| 2713 | ◎ | ○ | ○ | ◎ | ◎ |

TABLE 83-continued

| Drum No. | initial charge-retentivity | photo-sensitivity | residual potential | ghost | durability |
|---|---|---|---|---|---|
| 2714 | ◎ | ○ | ○ | ◎ | ◎ |
| 2715 | ◎ | ○ | ○ | ◎ | ◎ |
| 2716 | ◎ | ○ | ○ | ◎ | ◎ |
| 2717 | ◎ | ○ | ○ | ◎ | ◎ |
| 2718 | ◎ | ○ | ○ | ◎ | ◎ |

◎: Excellent
Δ: practically applicable
○: good
X: practically not applicable

TABLE 84

| CGL No | CTL No CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 2801 | 2802 | 2803 | 2804 | 2805 | 2806 | 2807 | 2808 |
| CGL 2 | 2809 | 2810 | 2811 | 2812 | 2813 | 2814 | 2815 | 2816 |
| CGL 3 | 2817 | | | | | | | |
| CGL 4 | 2818 | | | | | | | |

TABLE 85

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | 250 | 150 | 0.35 | 1 |
| | $GeH_4$ | | 50 | | | | |
| | $CH_4$ | (substrate side 0.7 μm) | 10 | | | | |
| | | (surface side 0.3 μm) (constantly decrease) | 10 → 0 | | | | |
| | NO | | 10 | | | | |
| | $N_2$ | (substrate side 0.7 μm) | 30 | | | | |
| | | (surface side 0.3 μm) (constantly decrease) | 30 → 0 | | | | |
| Charge injection inhibition layer | $SiH_4$ | | 150 250 | 150 | 0.35 | 3 | |
| | $SiF_4$ | | 50 | | | | |
| | $GeH_4$ | | 10 | | | | |
| | $PH_3$ | (against $SiH_4$) | | | | | |
| | | (substrate side 2 μm) | 800 ppm | | | | |
| | | (surface side 1 μm) (constantly decrease) | 800 → 0 ppm | | | | |
| | NO | (substrate side 2 μm) | 10 | | | | |
| | | (surface side 1 μm) (constantly decrease) | 10 → 0 | | | | |
| | $CH_4$ | (substrate side 2 μm) | 20 | | | | |
| | | (surface side 1 μm) (constantly decrease) | 20 → 0 | | | | |
| CGL/CTL | Combination as shown in Table 84 | | | | | | |
| Surface layer | $SiH_4$ | | 20 | 250 | 150 | 0.4 | 1 |
| | $CH_4$ | | 500 | | | | |

TABLE 86

| Drum No. | initial charge-retentivity | photo-sensitivity | residual potential | ghost | durability |
|---|---|---|---|---|---|
| 2801 | ◎ | ◎ | ○ | ○ | ◎ |
| 2802 | ◎ | ◎ | ○ | ○ | ◎ |
| 2803 | ◎ | ◎ | ○ | ○ | ◎ |

TABLE 86-continued

| Drum No. | initial charge-retentivity | photo-sensitivity | residual potential | ghost | durability |
|---|---|---|---|---|---|
| 2804 | ◎ | ◎ | ○ | ◎ | ◎ |
| 2805 | ◎ | ◎ | ○ | ◎ | ◎ |
| 2806 | ◎ | ◎ | ○ | ◎ | ◎ |
| 2807 | ◎ | ◎ | ○ | ◎ | ◎ |
| 2808 | ◎ | ◎ | ○ | ◎ | ◎ |
| 2809 | ◎ | ◎ | ○ | ◎ | ◎ |
| 2810 | ◎ | ◎ | ○ | ◎ | ◎ |
| 2811 | ◎ | ◎ | ○ | ◎ | ◎ |
| 2812 | ◎ | ◎ | ○ | ◎ | ◎ |
| 2813 | ◎ | ◎ | ○ | ◎ | ◎ |
| 2814 | ◎ | ◎ | ○ | ◎ | ◎ |
| 2815 | ◎ | ◎ | ○ | ◎ | ◎ |
| 2816 | ◎ | ◎ | ○ | ◎ | ◎ |
| 2817 | ◎ | ◎ | ○ | ◎ | ◎ |
| 2818 | ◎ | ◎ | ○ | ◎ | ◎ |

◎: Excellent
Δ: practically applicable
○: good
X: practically not applicable

TABLE 87

| CGL No | CTL No CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 2901 | 2902 | 2903 | 2904 | 2905 | 2906 | 2907 | 2908 |
| CGL 2 | 2909 | 2910 | 2911 | 2912 | 2913 | 2914 | 2915 | 2916 |
| CGL 3 | 2917 | | | | | | | |
| CGL 4 | 2918 | | | | | | | |

TABLE 88

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | 250 | 150 | 0.35 | 1 |
| | $GeH_4$ | | 50 | | | | |
| | $CH_4$ | (substrate side 0.7 μm) | 10 | | | | |
| | | (surface side 0.3 μm) (constantly decrease) | 10 → 0 | | | | |
| | NO | (substrate side 0.7 μm) | 5 | | | | |
| | | (surface side 0.3 μm) (constantly decrease) | 5 → 0 | | | | |

TABLE 88-continued

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| | $N_2$ | (substrate side 0.7 μm) | 30 | | | | |
| | | (surface side 0.3 μm) | 30 → 0 | | | | |
| | | (constantly decrease) | | | | | |
| Charge injection inhibition layer | $SiH_4$ | | 150 | 250 | 150 | 0.35 | 3 |
| | $SiF_4$ | | 50 | | | | |
| | $GeH_4$ | | 10 | | | | |
| | $PH_3$ | (against $SiH_4$) | | | | | |
| | | (substrate side 2 μm) | 800 ppm | | | | |
| | | (surface side 1 μm) | 800 → 0 ppm | | | | |
| | | (constantly decrease) | | | | | |
| | NO | (substrate side 2 μm) | 10 | | | | |
| | | (surface side 1 μm) | 10 → 0 | | | | |
| | | (constantly decrease) | | | | | |
| | $CH_4$ | (substrate side 2 μm) | 20 | | | | |
| | | (surface side 1 μm) | 20 → 0 | | | | |
| | | (constantly decrease) | | | | | |
| CGL/CTL | Combination as shown in Table 87 | | | | | | |
| Surface layer | $SiH_4$ | (substrate side) | 350 → 10 | 250 | 150 | 0.4 | 1 |
| | | (surface side) | | | | | |
| | $CH_4$ | (substrate side) | 10 → 600 | | | | |
| | | (surface side) | | | | | |
| | | (constantly diversify) | | | | | |

TABLE 89

| Drum No. | initial charge-retentivity | photo-sensitivity | residual potential | ghost | durability |
|---|---|---|---|---|---|
| 2901 | ◎ | ◎ | ○ | ◎ | ◎ |
| 2902 | ◎ | ◎ | ○ | ◎ | ◎ |
| 2903 | ◎ | ◎ | ○ | ◎ | ◎ |
| 2904 | ◎ | ◎ | ○ | ◎ | ◎ |
| 2905 | ◎ | ◎ | ○ | ◎ | ◎ |
| 2906 | ◎ | ◎ | ○ | ◎ | ◎ |
| 2907 | ◎ | ◎ | ○ | ◎ | ◎ |
| 2908 | ◎ | ◎ | ○ | ◎ | ◎ |
| 2909 | ◎ | ◎ | ○ | ◎ | ◎ |
| 2910 | ◎ | ◎ | ○ | ◎ | ◎ |
| 2911 | ◎ | ◎ | ○ | ◎ | ◎ |
| 2912 | ◎ | ◎ | ○ | ◎ | ◎ |
| 2913 | ◎ | ◎ | ○ | ◎ | ◎ |
| 2914 | ◎ | ◎ | ○ | ◎ | ◎ |
| 2915 | ◎ | ◎ | ○ | ◎ | ◎ |
| 2916 | ◎ | ◎ | ○ | ◎ | ◎ |
| 2917 | ◎ | ◎ | ○ | ◎ | ◎ |

TABLE 89-continued

| Drum No. | initial charge-retentivity | photo-sensitivity | residual potential | ghost | durability |
|---|---|---|---|---|---|
| 2918 | ◎ | ◎ | ○ | ◎ | ◎ |

◎: Excellent
Δ: practically applicable
○: good
X: practically not applicable

TABLE 90

| CGL No | CTL No Drum No CTL 1 | CTL 2 | CTL 3 | CTL 4 | CTL 5 | CTL 6 | CTL 7 | CTL 8 |
|---|---|---|---|---|---|---|---|---|
| CGL 1 | 3001 | 3002 | 3003 | 3004 | 3005 | 3006 | 3007 | 3008 |
| CGL 2 | 3009 | 3010 | 3011 | 3012 | 3013 | 3014 | 3015 | 3016 |
| CGL 3 | 3017 | | | | | | | |
| CGL 4 | 3018 | | | | | | | |

TABLE 91

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | 250 | 150 | 0.35 | 1 |
| | $GeH_4$ | | 50 | | | | |
| | $CH_4$ | (substrate side 0.7 μm) | 10 | | | | |
| | | (surface side 0.3 μm) | 10 → 0 | | | | |
| | | (constantly decrease) | | | | | |
| | NO | (substrate side 0.7 μm) | 5 | | | | |
| | | (surface side 0.3 μm) | 5 → 0 | | | | |
| | | (constantly decrease) | | | | | |
| | $N_2$ | (substrate side 0.7 μm) | 30 | | | | |
| | | (surface side 0.3 μm) | 30 → 0 | | | | |
| | | (constantly decrease) | | | | | |
| Charge injection inhibition layer | $SiH_4$ | | 150 | 250 | 150 | 0.35 | 3 |
| | $SiF_4$ | | 50 | | | | |
| | $GeH_4$ | | 10 | | | | |
| | $PH_3$ | (against $SiH_4$) | | | | | |
| | | (substrate side 2 μm) | 800 ppm | | | | |
| | | (surface side 1 μm) | 800 → 0 ppm | | | | |
| | | (constantly decrease) | | | | | |
| | NO | (substrate side 2 μm) | 10 | | | | |
| | | (surface side 1 μm) | 10 → 0 | | | | |
| | | (constantly decrease) | | | | | |
| | $CH_4$ | (substrate side 2 μm) | 20 | | | | |
| | | (surface side 1 μm) | 20 → 0 | | | | |
| | | (constantly decrease) | | | | | |
| CGL/CTL | Combination as shown in Table 90 | | | | | | |

TABLE 91-continued

| Name of layer | Gas used & its flow rate (SCCM) | | Substrate temperature (°C.) | RF power (W) | Internal pressure (Torr) | Layer thickness (μm) |
|---|---|---|---|---|---|---|
| Surface layer | $SiH_4$ | 50 | 250 | 100 | 0.4 | 2 |
| | $NH_3$ | 500 | | | | |

TABLE 92

| Drum No. | initial charge-retentivity | photo-sensitivity | residual potential | ghost | durability |
|---|---|---|---|---|---|
| 3001 | ◎ | ◎ | ◎ | ◎ | ◎ |
| 3002 | ◎ | ◎ | ◎ | ◎ | ◎ |
| 3003 | ◎ | ◎ | ◎ | ◎ | ◎ |
| 3004 | ◎ | ◎ | ◎ | ◎ | ◎ |
| 3005 | ◎ | ◎ | ◎ | ◎ | ◎ |
| 3006 | ◎ | ◎ | ◎ | ◎ | ◎ |
| 3007 | ◎ | ◎ | ◎ | ◎ | ◎ |
| 3008 | ◎ | ◎ | ◎ | ◎ | ◎ |
| 3009 | ◎ | ◎ | ◎ | ◎ | ◎ |
| 3010 | ◎ | ◎ | ◎ | ◎ | ◎ |
| 3011 | ◎ | ◎ | ◎ | ◎ | ◎ |
| 3012 | ◎ | ◎ | ◎ | ◎ | ◎ |
| 3013 | ◎ | ◎ | ◎ | ◎ | ◎ |
| 3014 | ◎ | ◎ | ◎ | ◎ | ◎ |
| 3015 | ◎ | ◎ | ◎ | ◎ | ◎ |
| 3016 | ◎ | ◎ | ◎ | ◎ | ◎ |
| 3017 | ◎ | ◎ | ◎ | ◎ | ◎ |
| 3018 | ◎ | ◎ | ◎ | ◎ | ◎ |

◎: Excellent
Δ: practically applicable
○: good
X: practically not applicable

TABLE 93

| CGL No | CTL No Drum No CTL 1 | CTL 2 | CTL 3 | CTL 4 | CTL 5 | CTL 6 | CTL 7 | CTL 8 |
|---|---|---|---|---|---|---|---|---|
| CGL 1 | 3101 | 3102 | 3103 | 3104 | 3105 | 3106 | 3107 | 3108 |
| CGL 2 | 3109 | 3110 | 3111 | 3112 | 3113 | 3114 | 3115 | 3116 |
| CGL 3 | 3117 | | | | | | | |

TABLE 93-continued

| CGL No | CTL No Drum No CTL 1 | CTL 2 | CTL 3 | CTL 4 | CTL 5 | CTL 6 | CTL 7 | CTL 8 |
|---|---|---|---|---|---|---|---|---|
| CGL 4 | 3118 | | | | | | | |

TABLE 94

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | 250 | 150 | 0.35 | 1 |
| | $GeH_4$ | | 10 | | | | |
| | $CH_4$ | (substrate side 0.7 μm) | 10 | | | | |
| | | (surface side 0.3 μm) (constantly decrease) | 10 → 0 | | | | |
| | NO | | 10 | | | | |
| | $N_2$ | (substrate side 0.7 μm) | 30 | | | | |
| | | (surface side 0.3 μm) (constantly decrease) | 30 → 0 | | | | |
| Charge injection inhibition layer | $SiH_4$ | | 150 | 250 | 150 | 0.35 | 3 |
| | $SiF_4$ | | 50 | | | | |
| | $GeH_4$ | | 10 | | | | |
| | $PH_3$ | (against $SiH_4$) | | | | | |
| | | (substrate side 2 μm) | 800 ppm | | | | |
| | | (surface side 1 μm) (constantly decrease) | 800 → 0 ppm | | | | |
| | NO | (substrate side 2 μm) | 10 | | | | |
| | | (surface side 1 μm) (constantly decrease) | 10 → 0 | | | | |
| | $CH_4$ | (substrate side 2 μm) | 20 | | | | |
| | | (surface side 1 μm) (constantly decrease) | 20 → 0 | | | | |
| CGL/CTL | Combination as shown in Table 93 | | | | | | |
| Surface layer | $SiH_4$ | | 200 | 250 | 100 | 0.4 | 2 |
| | $SiF_4$ | | 50 | | | | |
| | NO | | 50 | | | | |
| | $CH_4$ | | 5 | | | | |
| | $NH_3$ | | 5 | | | | |

TABLE 95

| Drum No. | initial charge-retentivity | photo-sensitivity | residual potential | ghost | durability |
|---|---|---|---|---|---|
| 3101 | ◎ | ◎ | ○ | ◎ | ◎ |
| 3102 | ◎ | ◎ | ○ | ◎ | ◎ |
| 3103 | ◎ | ◎ | ○ | ◎ | ◎ |
| 3104 | ◎ | ◎ | ○ | ◎ | ◎ |
| 3105 | ◎ | ◎ | ○ | ◎ | ◎ |
| 3106 | ◎ | ◎ | ○ | ◎ | ◎ |
| 3107 | ◎ | ◎ | ○ | ◎ | ◎ |
| 3108 | ◎ | ◎ | ○ | ◎ | ◎ |
| 3109 | ◎ | ◎ | ○ | ◎ | ◎ |
| 3110 | ◎ | ◎ | ○ | ◎ | ◎ |
| 3111 | ◎ | ◎ | ○ | ◎ | ◎ |
| 3112 | ◎ | ◎ | ○ | ◎ | ◎ |
| 3113 | ◎ | ◎ | ○ | ◎ | ◎ |
| 3114 | ◎ | ◎ | ○ | ◎ | ◎ |
| 3115 | ◎ | ◎ | ○ | ◎ | ◎ |
| 3116 | ◎ | ◎ | ○ | ◎ | ◎ |
| 3117 | ◎ | ◎ | ○ | ◎ | ◎ |
| 3118 | ◎ | ◎ | ○ | ◎ | ◎ |

◎: Excellent
Δ: practically applicable
○: good
X: practically not applicable

TABLE 96

| CGL No | CTL No Drum No CTL 1 | CTL 2 | CTL 3 | CTL 4 | CTL 5 | CTL 6 | CTL 7 | CTL 8 |
|---|---|---|---|---|---|---|---|---|
| CGL 1 | 3201 | 3202 | 3203 | 3204 | 3205 | 3206 | 3207 | 3208 |
| CGL 2 | 3209 | 3210 | 3211 | 3212 | 3213 | 3214 | 3215 | 3216 |
| CGL 3 | 3217 | | | | | | | |
| CGL 4 | 3218 | | | | | | | |

TABLE 98-continued

| Drum No. | initial charge-retentivity | photo-sensitivity | residual potential | ghost | durability |
|---|---|---|---|---|---|
| 3213 | ◎ | ◎ | ○ | ◎ | ◎ |
| 3214 | ◎ | ◎ | ○ | ◎ | ◎ |
| 3215 | ◎ | ◎ | ○ | ◎ | ◎ |
| 3216 | ◎ | ◎ | ○ | ◎ | ◎ |
| 3217 | ◎ | ◎ | ○ | ◎ | ◎ |
| 3218 | ◎ | ◎ | ○ | ◎ | ◎ |

◎: Excellent

TABLE 97

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | 250 | 150 | 0.35 | 1 |
| | $GeH_4$ | | 50 | | | | |
| | $CH_4$ | | 5 | | | | |
| | NO | (substrate side 0.7 μm) | 10 | | | | |
| | | (surface side 0.3 μm) (constantly decrease) | 10 → 0 | | | | |
| | $N_2$ | (substrate side 0.7 μm) | 30 | | | | |
| | | (surface side 0.3 μm) (constantly decrease) | 30 → 0 | | | | |
| Charge injection inhibition layer | $SiH_4$ | | 100 | 250 | 300 | 0.35 | 3 |
| | $H_2$ | | 100 | | | | |
| | NO | (substrate side 2 μm) | 10 | | | | |
| | | (surface side 1 μm) (constantly decrease) | 10 → 0 | | | | |
| | $CH_4$ | | 120 | | | | |
| CGL/CTL | Combination as shown in Table 96 | | | | | | |
| Surface layer | $SiH_4$ | | 10 | 250 | 200 | 0.4 | 2 |
| | $N_2$ | | 500 | | | | |
| | $CH_4$ | | 20 | | | | |

TABLE 98

| Drum No. | initial charge-retentivity | photo-sensitivity | residual potential | ghost | durability |
|---|---|---|---|---|---|
| 3201 | ◎ | ◎ | ○ | ◎ | ◎ |
| 3202 | ◎ | ◎ | ○ | ◎ | ◎ |
| 3203 | ◎ | ◎ | ○ | ◎ | ◎ |
| 3204 | ◎ | ◎ | ○ | ◎ | ◎ |
| 3205 | ◎ | ◎ | ○ | ◎ | ◎ |
| 3206 | ◎ | ◎ | ○ | ◎ | ◎ |
| 3207 | ◎ | ◎ | ○ | ◎ | ◎ |
| 3208 | ◎ | ◎ | ○ | ◎ | ◎ |
| 3209 | ◎ | ◎ | ○ | ◎ | ◎ |
| 3210 | ◎ | ◎ | ○ | ◎ | ◎ |
| 3211 | ◎ | ◎ | ○ | ◎ | ◎ |
| 3212 | ◎ | ◎ | ○ | ◎ | ◎ |

○: good
Δ: practically applicable
X: practically not applicable

TABLE 99

| CGL No | CTL No Drum No CTL 1 | CTL 2 | CTL 3 | CTL 4 | CTL 5 | CTL 6 | CTL 7 | CTL 8 |
|---|---|---|---|---|---|---|---|---|
| CGL 1 | 3301 | 3302 | 3303 | 3304 | 3305 | 3306 | 3307 | 3308 |
| CGL 2 | 3309 | 3310 | 3311 | 3312 | 3313 | 3314 | 3315 | 3316 |
| CGL 3 | 3317 | | | | | | | |
| CGL 4 | 3318 | | | | | | | |

TABLE 100

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | 250 | 150 | 0.35 | 1 |
| | $GeH_4$ | | 50 | | | | |
| | $CH_4$ | (substrate side 0.7 μm) | 10 | | | | |
| | | (surface side 0.3 μm) (constantly decrease) | 10 → 0 | | | | |
| | NO | | 10 | | | | |
| | $N_2$ | (substrate side 0.7 μm) | 30 | | | | |
| | | (surface side 0.3 μm) (constantly decrease) | 30 → 0 | | | | |
| Charge injection inhibition layer | $SiH_4$ | | 100 | 250 | 300 | 0.35 | 3 |
| | $H_2$ | | 100 | | | | |
| | NO | (substrate side 2 μm) | 10 | | | | |
| | | (surface side 1 μm) (constantly decrease) | 10 → 0 | | | | |
| | $CH_4$ | (substrate side 2 μm) | 100 | | | | |
| | | (surface side 1 μm) (constantly decrease) | 100 → 0 | | | | |
| CGL/CTL | Combination as shown in Table 99 | | | | | | |
| Surface layer | $SiH_4$ | | 20 | 250 | 150 | 0.4 | 1 |
| | $CH_4$ | | 500 | | | | |

TABLE 101

| Drum No. | initial charge-retentivity | photo-sensitivity | residual potential | ghost | durability |
|---|---|---|---|---|---|
| 3301 | ◎ | ◎ | ◎ | ○ | ◎ |
| 3302 | ◎ | ◎ | ◎ | ○ | ◎ |
| 3303 | ◎ | ◎ | ◎ | ○ | ◎ |
| 3304 | ◎ | ◎ | ◎ | ○ | ◎ |
| 3305 | ◎ | ◎ | ◎ | ○ | ◎ |
| 3306 | ◎ | ◎ | ◎ | ○ | ◎ |
| 3307 | ◎ | ◎ | ◎ | ○ | ◎ |
| 3308 | ◎ | ◎ | ◎ | ○ | ◎ |
| 3309 | ◎ | ◎ | ◎ | ○ | ◎ |
| 3310 | ◎ | ◎ | ◎ | ○ | ◎ |
| 3311 | ◎ | ◎ | ◎ | ○ | ◎ |
| 3312 | ◎ | ◎ | ◎ | ○ | ◎ |
| 3313 | ◎ | ◎ | ◎ | ○ | ◎ |
| 3314 | ◎ | ◎ | ◎ | ○ | ◎ |
| 3315 | ◎ | ◎ | ◎ | ○ | ◎ |
| 3316 | ◎ | ◎ | ◎ | ○ | ◎ |
| 3317 | ◎ | ◎ | ◎ | ○ | ◎ |
| 3318 | ◎ | ◎ | ◎ | ○ | ◎ |

◎: Excellent
Δ: practically applicable
○: good
X: practically not applicable

TABLE 104

| Drum No. | initial charge-retentivity | photo-sensitivity | residual potential | ghost | durability |
|---|---|---|---|---|---|
| 3401 | ◎ | ○ | ◎ | ◎ | ◎ |
| 3402 | ◎ | ○ | ◎ | ◎ | ◎ |
| 3403 | ◎ | ○ | ◎ | ◎ | ◎ |
| 3404 | ◎ | ○ | ◎ | ◎ | ◎ |
| 3405 | ◎ | ○ | ◎ | ◎ | ◎ |
| 3406 | ◎ | ○ | ◎ | ◎ | ◎ |
| 3407 | ◎ | ○ | ◎ | ◎ | ◎ |
| 3408 | ◎ | ○ | ◎ | ◎ | ◎ |
| 3409 | ◎ | ○ | ◎ | ◎ | ◎ |
| 3410 | ◎ | ○ | ◎ | ◎ | ◎ |
| 3411 | ◎ | ○ | ◎ | ◎ | ◎ |
| 3412 | ◎ | ○ | ◎ | ◎ | ◎ |
| 3413 | ◎ | ○ | ◎ | ◎ | ◎ |
| 3414 | ◎ | ○ | ◎ | ◎ | ◎ |
| 3415 | ◎ | ○ | ◎ | ◎ | ◎ |
| 3416 | ◎ | ○ | ◎ | ◎ | ◎ |
| 3417 | ◎ | ○ | ◎ | ◎ | ◎ |
| 3418 | ◎ | ○ | ◎ | ◎ | ◎ |

◎: Excellent
Δ: practically applicable
○: good
X: practically not applicable

TABLE 102

| | CTL No Drum No | | | | | | | |
|---|---|---|---|---|---|---|---|---|
| CGL No | CTL 1 | CTL 2 | CTL 3 | CTL 4 | CTL 5 | CTL 6 | CTL 7 | CTL 8 |
| CGL 1 | 3401 | 3402 | 3403 | 3404 | 3405 | 3406 | 3407 | 3408 |
| CGL 2 | 3409 | 3410 | 3411 | 3412 | 3413 | 3414 | 3415 | 3416 |
| CGL 3 | 3417 | | | | | | | |
| CGL 4 | 3418 | | | | | | | |

TABLE 105

| | CTL No | | | | | | | |
|---|---|---|---|---|---|---|---|---|
| Drum No CGL No | CTL 1 | CTL 2 | CTL 3 | CTL 4 | CTL 5 | CTL 6 | CTL 7 | CTL 8 |
| CGL 1 | 3501 | 3502 | 3503 | 3504 | 3505 | 3506 | 3507 | 3508 |
| CGL 2 | 3509 | 3510 | 3511 | 3512 | 3513 | 3514 | 3515 | 3516 |
| CGL 3 | 3517 | | | | | | | |
| CGL 4 | 3518 | | | | | | | |

TABLE 103

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | 250 | 150 | 0.35 | 1 |
| | $GeH_4$ | | 50 | | | | |
| | $CH_4$ | (substrate side 0.7 μm) | 10 | | | | |
| | | (surface side 0.3 μm) (constantly decrease) | 10 → 0 | | | | |
| | NO | (substrate side 0.7 μm) | 5 | | | | |
| | | (surface side 0.3 μm) (constantly decrease) | 5 → 0 | | | | |
| | $N_2$ | (substrate side 0.7 μm) | 30 | | | | |
| | | (surface side 0.3 μm) (constantly decrease) | 30 → 0 | | | | |
| Charge injection inhibition layer | $SiH_4$ | | 100 | 250 | 300 | 0.35 | 3 |
| | $H_2$ | | 100 | | | | |
| | NO | (substrate side 2 μm) | 10 | | | | |
| | | (surface side 1 μm) (constantly decrease) | 10 → 0 | | | | |
| | $CH_4$ | (substrate side 2 μm) | 100 | | | | |
| | | (surface side 1 μm) (constantly decrease) | 100 → 0 | | | | |
| CGL/CTL | Combination as shown in Table 102 | | | | | | |
| Surface layer | $SiH_4$ | (substrate side) (surface side) | 350 → 10 | 250 | 150 | 0.4 | 1 |
| | $CH_4$ | (substrate side) (surface side) (constantly diversify) | 10 → 600 | | | | |

TABLE 106

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $CH_4$ | 20 | | | | |
| | NO (substrate side 0.7 μm) | 5 | | | | |

TABLE 106-continued

| Name of layer | Gas used & its flow rate (SCCM) | | Substrate temperature (°C.) | RF power (W) | Internal pressure (Torr) | Layer thickness (μm) |
|---|---|---|---|---|---|---|
| | (surface side 0.3 μm) (constantly decrease) | 5 → 0 | | | | |
| | $N_2$ (substrate side 0.7 μm) | 5 | | | | |
| | (surface side 0.3 μm) (constantly decrease) | 5 → 0 | | | | |
| Charge injection inhibition layer | $SiH_4$ | 100 | 250 | 300 | 0.35 | 3 |
| | $H_2$ | 100 | | | | |
| | NO (substrate side 2 μm) | 10 | | | | |
| | (surface side 1 μm) (constantly decrease) | 10 → 0 | | | | |
| | $CH_4$ (substrate side 2 μm) | 100 | | | | |
| | (surface side 1 μm) (constantly decrease) | 100 → 0 | | | | |
| CGL/CTL | Combination as shown in Table 105 | | | | | |
| Surface layer | $SiH_4$ | 50 | 250 | 100 | 0.4 | 1 |
| | $NH_3$ | 500 | | | | |

TABLE 107

| Drum No. | initial charge-retentivity | photo-senitivity | residual potential | ghost | durability |
|---|---|---|---|---|---|
| 3501 | ◎ | ○ | ○ | ◎ | ◎ |
| 3502 | ◎ | ○ | ○ | ◎ | ◎ |
| 3503 | ◎ | ○ | ○ | ◎ | ◎ |
| 3504 | ◎ | ○ | ○ | ◎ | ◎ |
| 3505 | ◎ | ○ | ○ | ◎ | ◎ |
| 3506 | ◎ | ○ | ○ | ◎ | ◎ |
| 3507 | ◎ | ○ | ○ | ◎ | ◎ |
| 3508 | ◎ | ○ | ○ | ◎ | ◎ |
| 3509 | ◎ | ○ | ○ | ◎ | ◎ |
| 3510 | ◎ | ○ | ○ | ◎ | ◎ |
| 3511 | ◎ | ○ | ○ | ◎ | ◎ |
| 3512 | ◎ | ○ | ○ | ◎ | ◎ |
| 3513 | ◎ | ○ | ○ | ◎ | ◎ |
| 3514 | ◎ | ○ | ○ | ◎ | ◎ |
| 3515 | ◎ | ○ | ○ | ◎ | ◎ |
| 3516 | ◎ | ○ | ○ | ◎ | ◎ |
| 3517 | ◎ | ○ | ○ | ◎ | ◎ |
| 3518 | ◎ | ○ | ○ | ◎ | ◎ |

◎: Excellent
○: good
Δ: practically applicable
X: practically not applicable

TABLE 108

| Drum No / CGL No | CTL No: CTL 1 | CTL 2 | CTL 3 | CTL 4 | CTL 5 | CTL 6 | CTL 7 | CTL 8 |
|---|---|---|---|---|---|---|---|---|
| CGL 1 | 3601 | 3602 | 3603 | 3604 | 3605 | 3606 | 3607 | 3608 |
| CGL 2 | 3609 | 3610 | 3611 | 3612 | 3613 | 3614 | 3615 | 3616 |
| CGL 3 | 3617 | | | | | | | |
| CGL 4 | 3618 | | | | | | | |

TABLE 109

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $CH_4$ (substrate side 0.7 μm) | 10 | | | | |
| | (surface side 0.3 μm) (constantly decrease) | 10 → 0 | | | | |
| | NO | 10 | | | | |
| | $N_2$ (substrate side 0.7 μm) | 30 | | | | |
| | (surface side 0.3 μm) (constantly decrease) | 30 → 0 | | | | |
| Charge injection inhibition layer | $SiH_4$ | 100 | 250 | 300 | 0.35 | 3 |
| | $H_2$ | 100 | | | | |
| | NO (substrate side 2 μm) | 10 | | | | |
| | (surface side 1 μm) (constantly decrease) | 10 → 0 | | | | |
| | $CH_4$ (substrate side 2 μm) | 100 | | | | |
| | (surface side 1 μm) (constantly decrease) | 100 → 0 | | | | |
| CGL/CTL | Combination as shown in Table 108 | | | | | |
| Surface layer | $SiH_4$ | 200 | 250 | 150 | 0.4 | 2 |
| | $SiF_4$ | 50 | | | | |
| | NO | 50 | | | | |
| | $CH_4$ | 5 | | | | |
| | $NH_3$ | 5 | | | | |

TABLE 110

| Drum No. | initial charge-retentivity | photo-sensitivity | residual potential | ghost | durability |
|---|---|---|---|---|---|
| 3601 | ◎ | ○ | ○ | ○ | ◎ |
| 3602 | ◎ | ○ | ○ | ○ | ◎ |
| 3603 | ◎ | ○ | ○ | ○ | ◎ |
| 3604 | ◎ | ○ | ○ | ○ | ◎ |
| 3605 | ◎ | ○ | ○ | ○ | ◎ |
| 3606 | ◎ | ○ | ○ | ○ | ◎ |
| 3607 | ◎ | ○ | ○ | ○ | ◎ |
| 3608 | ◎ | ○ | ○ | ○ | ◎ |
| 3609 | ◎ | ○ | ○ | ○ | ◎ |
| 3610 | ◎ | ○ | ○ | ○ | ◎ |
| 3611 | ◎ | ○ | ○ | ○ | ◎ |
| 3612 | ◎ | ○ | ○ | ○ | ◎ |
| 3613 | ◎ | ○ | ○ | ○ | ◎ |

TABLE 110-continued

| Drum No. | initial charge-retentivity | photo-sensitivity | residual potential | ghost | durability |
|---|---|---|---|---|---|
| 3614 | ◎ | ○ | ○ | ○ | ◎ |
| 3615 | ◎ | ○ | ○ | ○ | ◎ |
| 3616 | ◎ | ○ | ○ | ○ | ◎ |
| 3617 | ◎ | ○ | ○ | ○ | ◎ |
| 3618 | ◎ | ○ | ○ | ○ | ◎ |

◎: Excellent
○: good
Δ: practically applicable
X: practically not applicable

TABLE 111

| Drum No / CGL No | CTL No CTL 1 | CTL 2 | CTL 3 | CTL 4 | CTL 5 | CTL 6 | CTL 7 | CTL 8 |
|---|---|---|---|---|---|---|---|---|
| CGL 1 | 3701 | 3702 | 3703 | 3704 | 3705 | 3706 | 3707 | 3708 |
| CGL 2 | 3709 | 3710 | 3711 | 3712 | 3713 | 3714 | 3715 | 3716 |
| CGL 3 | 3717 | | | | | | | |
| CGL 4 | 3718 | | | | | | | |

TABLE 112

| Name of layer | Gas used & its flow rate (SCCM) | | Substrate temperature (°C.) | Microwave power (W) | Internal pressure (Torr) | Layer thickness (μm) |
|---|---|---|---|---|---|---|
| IR absorption layer | $SiH_4$ | 100 | 250 | 110 | 1.5 | 1 |
| | $GeH_4$ | 50 | | | | |
| | $B_2H_6$(against $SiH_4$ | 1000 ppm | | | | |
| | NO | 5 | | | | |
| Charge injection inhibition layer | $SiH_4$ | 100 | 250 | 110 | 1.5 | 3 |
| | $B_2H_6$(against $SiH_4$) | 1600 ppm | | | | |
| | $H_2$ | 80 | | | | |
| | NO (substrate side 2 μm) | 5 | | | | |
| | (surface side 1 μm) | 5 → 0 | | | | |
| | (constantly decrease) | | | | | |
| CGL/CTL | Combination as shown in Table 111 | | | | | |
| Surface layer | $SiH_4$ | 30 | 250 | 170 | 3.0 | 1 |
| | $CH_4$ | 250 | | | | |

TABLE 113

Film Forming Conditions of CGL

| Name of layer | Gas used & its flow rate (SCCM) | | Substrate temperature (°C.) | micro-wave power (W) | Internal pressure (mTorr) | Layer thickness (μm) |
|---|---|---|---|---|---|---|
| CGL 1 | $SiH_4$ | 150 | 250 | 300 | 2 | 1 |
| | $H_2$ | 150 | | | | |
| | $SiH_4$ | 120 | | | | |
| CGL 2 | $SiF_4$ | 40 | 250 | 300 | 2 | 2 |
| | $H_2$ | 150 | | | | |
| CGL 3 | $SiH_4$ | 150 | 250 | 300 | 2 | 5 |
| | He | 160 | | | | |
| CGL 4 | $SiH_4$ | 150 | 250 | 300 | 2 | 2 |
| | Ar | 150 | | | | |

TABLE 114

Film Forming Conditions of CTL

Figure 65:
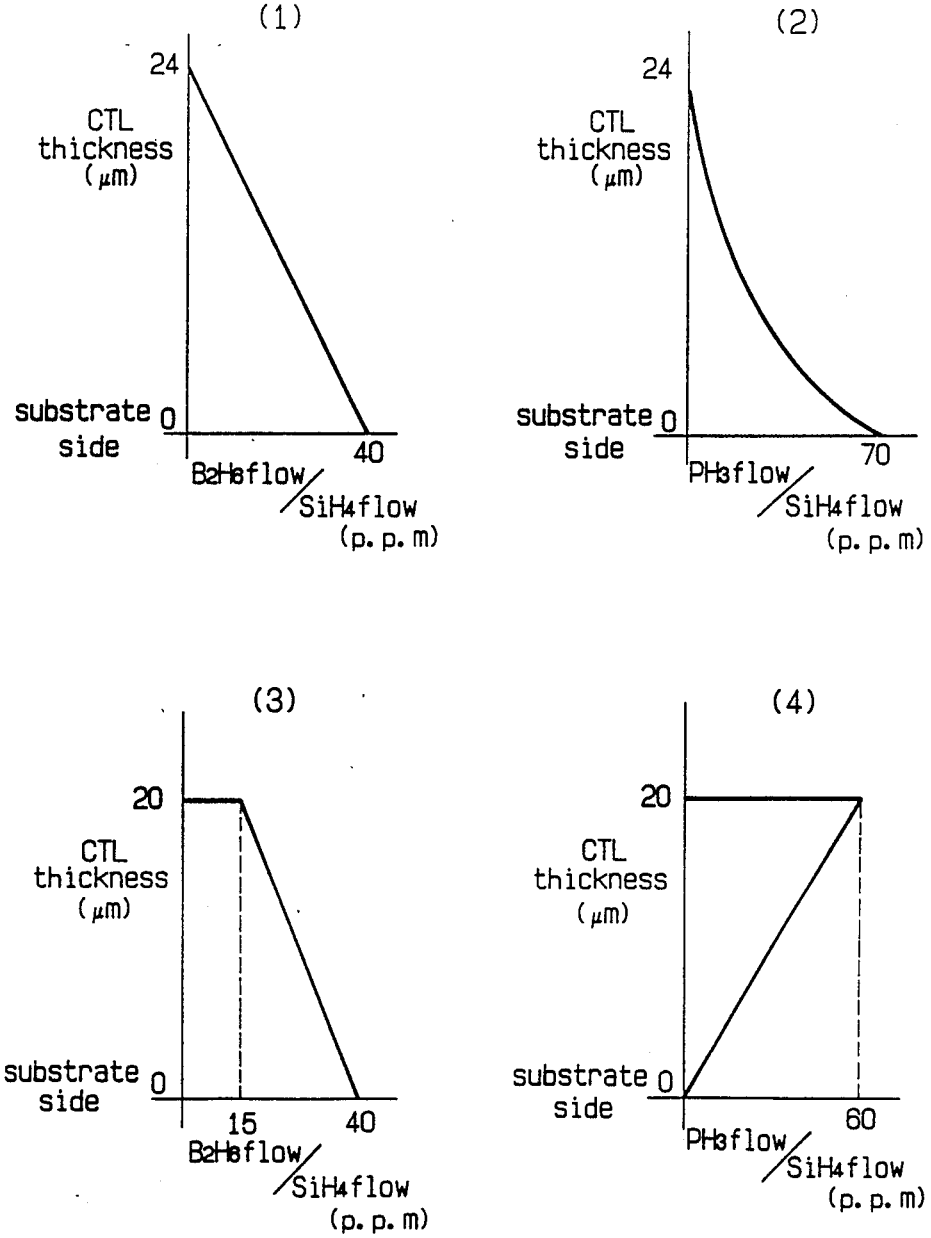
FIG. 65(1) through FIG. 65(8) are explanatory views illustrating diversification patterns for the flow rates of an impurity supplying raw material gas and a doping raw material gas at the time of forming the CTL of the light receiving member for use in electrophotography according to this invention by means of microwave glow discharging process.
Figure 65:
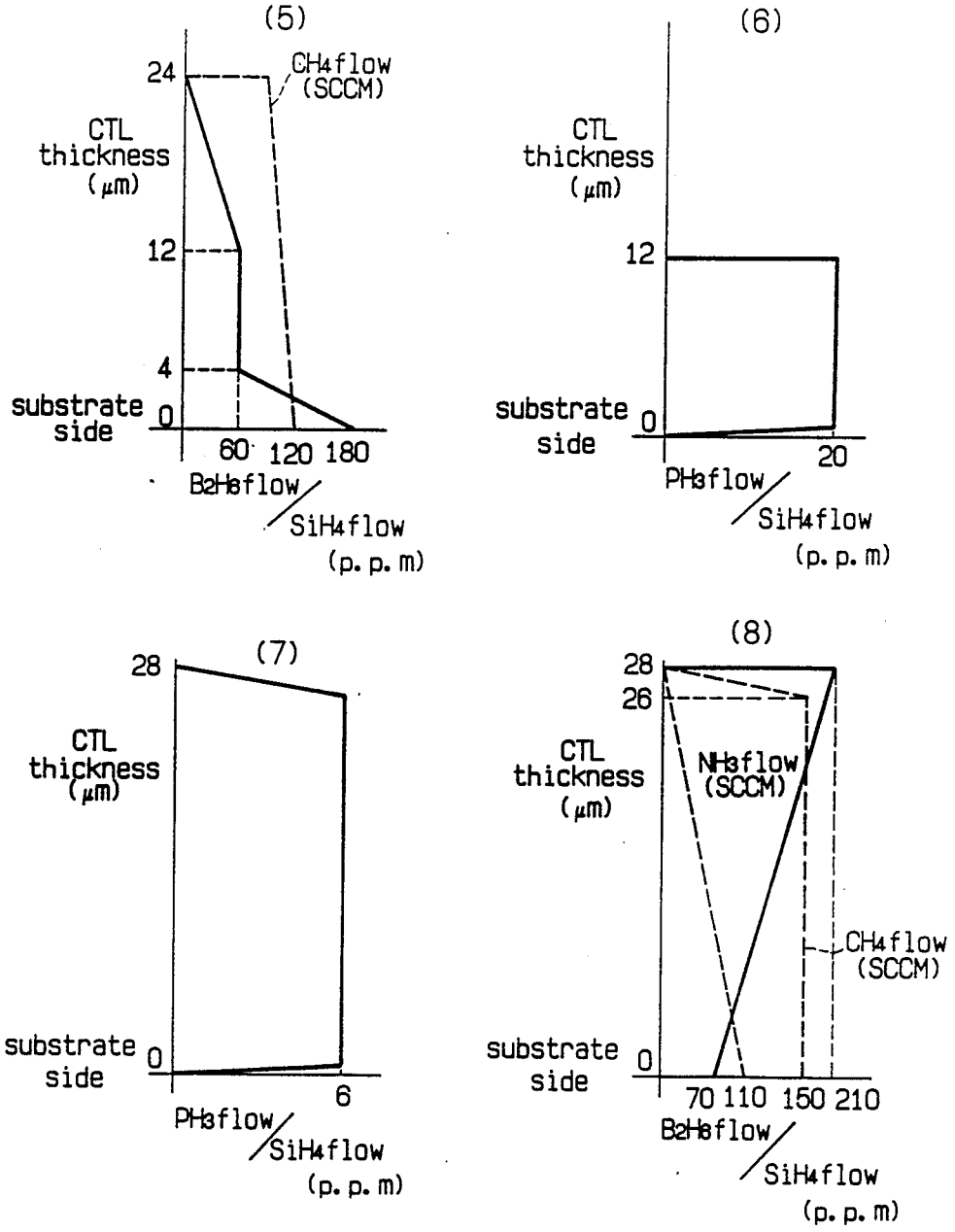

| Name of layer | Gas used & its flow rate (SCCM) | | Substrate temperature (°C.) | micro-wave power (W) | Internal pressure (mTorr) | Layer thickness (μm) |
|---|---|---|---|---|---|---|
| CTL 1 | $SiH_4$ | 70 | 250 | 300 | 3 | 24 |
| | $SiF_4$ | 40 | | | | |
| | $CH_4$ | 300 | | | | |
| | $B_2H_6$ | [FIG.65 (1)] | | | | |
| CTL 2 | $SiH_4$ | 180 | 250 | 300 | 3 | 24 |
| | $C_2H_2$ | 300 | | | | |
| | $PH_3$ | [FIG.65 (2)] | | | | |
| CTL 3 | $SiH_4$ | 200 | 250 | 300 | 3 | 20 |
| | $C_2H_4$ | 250 | | | | |

TABLE 114-continued

Film Forming Conditions of CTL

| Name of layer | Gas used & its flow rate (SCCM) | | Substrate temperature (°C.) | micro-wave power (W) | Internal pressure (mTorr) | Layer thickness (μm) |
|---|---|---|---|---|---|---|
| | $B_2H_6$ | [FIG.65 (3)] | | | | |
| CTL 4 | $SiH_4$ | 60 | 250 | 350 | 3 | 20 |
| | $N_2$ | 450 | | | | |
| | $PH_3$ | [FIG.65 (4)] | | | | |
| CTL 5 | $SiH_4$ | 80 | 250 | 350 | 3 | 24 |
| | $C_2H_4$ | 350 | | | | |
| | $CH_4$ | [FIG.65 (5)] | | | | |
| | $B_2H_6$ | [FIG.65 (5)] | | | | |
| CTL 6 | $SiH_4$ | 110 | 250 | 300 | 3 | 12 |
| | $NH_3$ | 220 | | | | |
| | $CH_4$ | 200 | | | | |
| | $PH_3$ | [FIG.65 (6)] | | | | |
| CTL 7 | $SiH_4$ | 240 | 250 | 250 | 3 | 28 |
| | $C_2H_4$ | | 16 | | | |
| | Ar | 150 | | | | |
| | $PH_3$ | [FIG.65 (7)] | | | | |
| CTL 8 | $SiH_4$ | 350 | 250 | 300 | 3 | 28 |
| | NO | 40 | | | | |
| | $B_2H_6$ | [FIG.65 (8)] | | | | |
| | $NH_3$ | [FIG.65 (8)] | | | | |
| | $CH_4$ | [FIG.65 (8)] | | | | |

TABLE 115

| Drum No. | initial charge-retentivity | photo-senitivity | residual potential | ghost | durability |
|---|---|---|---|---|---|
| 3701 | ◎ | ○ | ○ | ○ | ◎ |
| 3702 | ◎ | ○ | ○ | ○ | ◎ |
| 3703 | ◎ | ○ | ○ | ○ | ◎ |
| 3704 | ◎ | ○ | ○ | ○ | ◎ |
| 3705 | ◎ | ○ | ○ | ○ | ◎ |
| 3706 | ◎ | ○ | ○ | ○ | ◎ |
| 3707 | ◎ | ○ | ○ | ○ | ◎ |
| 3708 | ◎ | ○ | ○ | ○ | ◎ |
| 3709 | ◎ | ○ | ○ | ○ | ◎ |
| 3710 | ◎ | ○ | ○ | ○ | ◎ |
| 3711 | ◎ | ○ | ○ | ○ | ◎ |
| 3712 | ◎ | ○ | ○ | ○ | ◎ |
| 3713 | ◎ | ○ | ○ | ○ | ◎ |
| 3714 | ◎ | ○ | ○ | ○ | ◎ |
| 3715 | ◎ | ○ | ○ | ○ | ◎ |
| 3716 | ◎ | ○ | ○ | ○ | ◎ |
| 3717 | ◎ | ○ | ○ | ○ | ◎ |
| 3718 | ◎ | ○ | ○ | ○ | ◎ |

◎: Excellent
○: good
Δ: practically applicable
X: practically not applicable

TABLE 116

| Drum No / CGL No | CTL No: CTL 1 | CTL 2 | CTL 3 | CTL 4 | CTL 5 | CTL 6 | CTL 7 | CTL 8 |
|---|---|---|---|---|---|---|---|---|
| CGL 1 | 3801 | 3802 | 3803 | 3804 | 3805 | 3806 | 3807 | 3808 |
| CGL 2 | 3809 | 3810 | 3811 | 3812 | 3813 | 3814 | 3815 | 3816 |
| CGL 3 | 3817 | | | | | | | |
| CGL 4 | 3818 | | | | | | | |

TABLE 117

| Name of layer | Gas used & its flow rate (SCCM) | | Substrate temperature (°C.) | Internal pressure (Torr) | Layer thickness (μm) |
|---|---|---|---|---|---|
| IR absorption layer | $SiF_4$ | 60 | 250 | 0.35 | 1 |
| | $SiH_4$ | 40 | | | |
| | $GeH_4$ (substrate side 0.7 μm) | 20 | | | |
| | (surface side 0.3 μm) | 20 → 0 | | | |
| | (constantly decrease) | | | | |
| | $B_2H_6$ (against $SiH_4$) | 1000 ppm | | | |
| | NO (substrate side 0.7 μm) | 4 | | | |
| | (surface side 0.3 μm) | 4 → 0 | | | |
| | (constantly decrease) | | | | |
| | $H_2$ | 80 | | | |
| Charge injection inhibition layer | $SiF_4$ | 60 | 250 | 0.35 | 3 |
| | $SiH_4$ | 40 | | | |
| | $B_2H_6$ (against $SiH_4$) | 800 ppm | | | |
| | $H_2$ | 40 | | | |
| | NO (substrate side 2 μm) | 4 | | | |
| | (surface side 1 μm) | 4 → 0 | | | |
| | (constantly decrease) | | | | |
| | $H_2$ | 80 | | | |
| CGL/CTL Surface layer | Combination as shown in Table 116 | | | | |
| | $SiF_4$ | 200 | 250 | 0.40 | 1 |
| | $SiH_4$ | 8 | | | |
| | $CH_4$ | 200 | | | |
| | $H_2$ | 200 | | | |

TABLE 118

Figure 66:
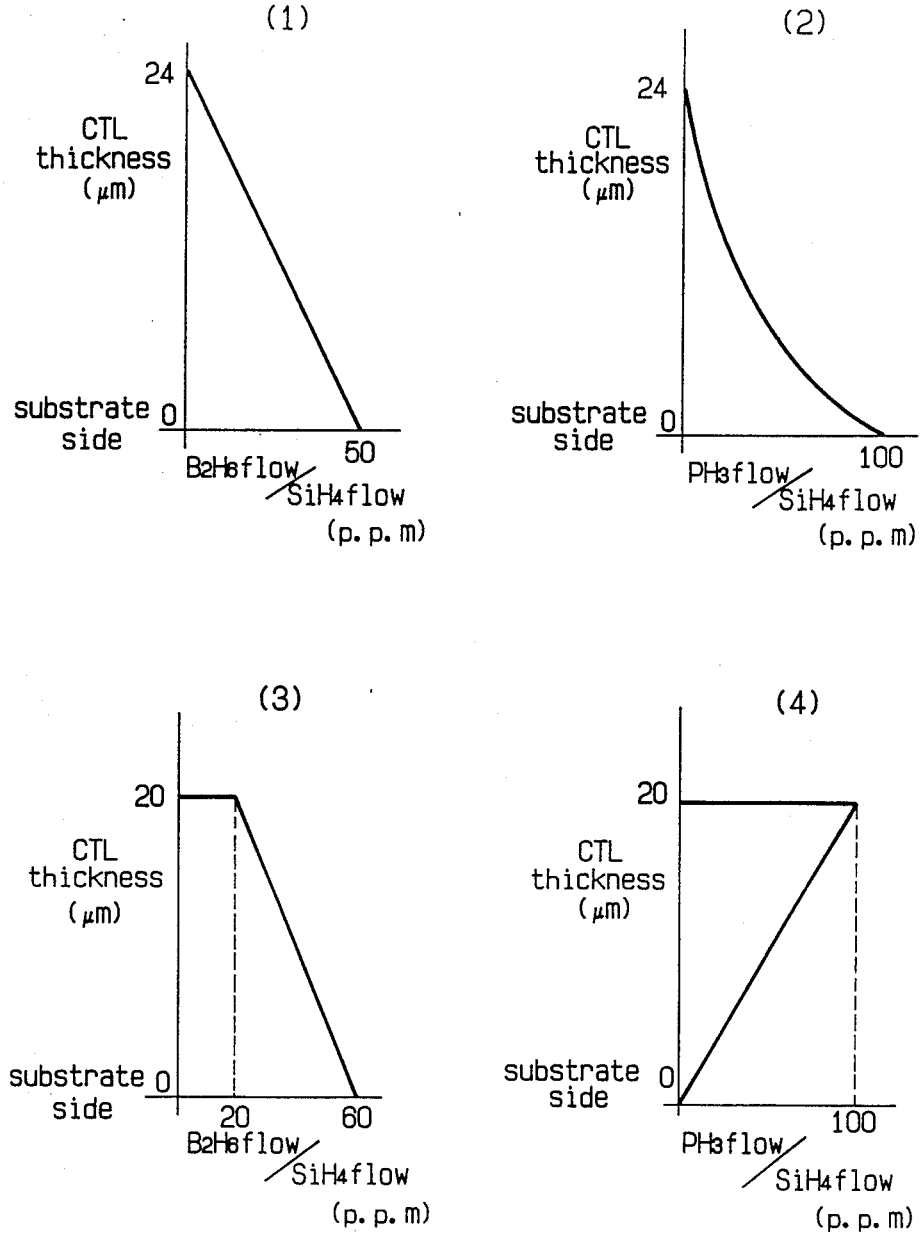
FIG. 66(1) through FIG. 66(8) are explanatory views illustrating diversification patterns for the flow rates of an impurity supplying raw material gas and a doping raw material gas at the time of forming the CTL of the light receiving member for use in electrophotography according to this invention by means of HRCVD.
Figure 66:
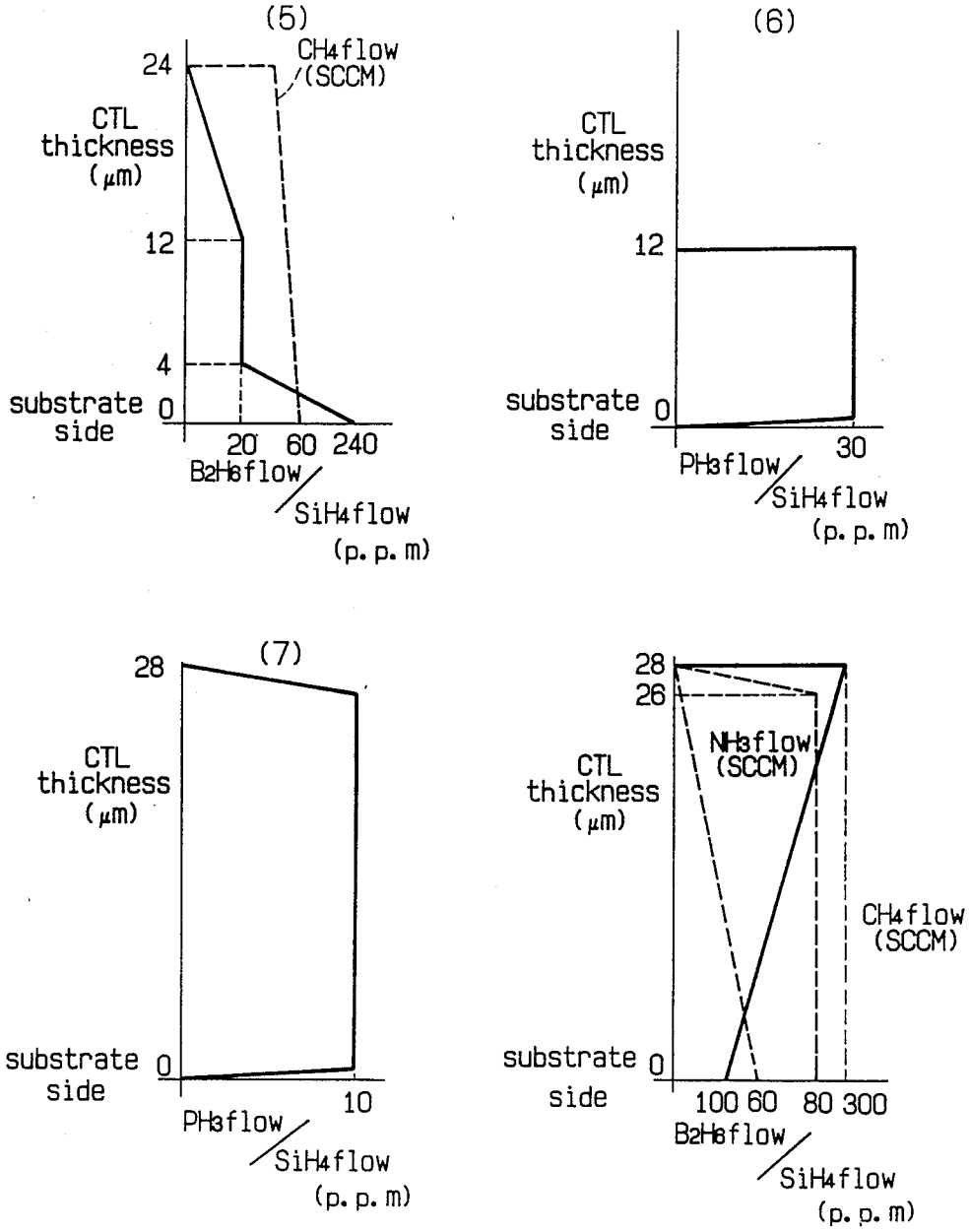

| Name of layer | Film Forming Conditions of CTL: Gas used & its flow rate (SCCM) | | Substrate temperature (°C.) | Internal pressure (Torr) | Layer thickness (μm) |
|---|---|---|---|---|---|
| CTL 1 | $SiH_4$ | 30 | 250 | 0.40 | 24 |
| | $SiF_4$ | 100 | | | |
| | $CH_4$ | 140 | | | |
| | $H_2$ | 200 | | | |
| | $B_2H_6$ | [FIG.66 (1)] | | | |
| CTL 2 | $SiH_4$ | 100 | 250 | 0.40 | 24 |
| | $SiF_4$ | 150 | | | |
| | $C_2H_2$ | 160 | | | |
| | $H_2$ | 200 | | | |
| | $PH_3$ | [FIG.66 (2)] | | | |
| CTL 3 | $SiH_4$ | 120 | 250 | 0.35 | 20 |
| | $SiF_4$ | 150 | | | |
| | $C_2H_2$ | 140 | | | |
| | $H_2$ | 200 | | | |
| | $B_2H_6$ | [FIG.66 (3)] | | | |
| CTL 4 | $SiH_4$ | 30 | 250 | 0.45 | 20 |
| | $SiF_4$ | 150 | | | |
| | $C_2H_4$ | 240 | | | |
| | $H_2$ | 200 | | | |
| | $PH_3$ | [FIG.66 (4)] | | | |
| CTL 5 | $SiH_4$ | 50 | 250 | 0.45 | 24 |
| | $SiF_4$ | 150 | | | |
| | $N_2$ | 200 | | | |
| | $H_2$ | 200 | | | |
| | $CH_4$ | [FIG.66 (5)] | | | |
| | $B_2H_6$ | [FIG.66 (5)] | | | |
| CTL 6 | $SiH_4$ | 60 | 250 | 0.40 | 12 |
| | $SiF_4$ | 150 | | | |
| | $NH_3$ | 120 | | | |
| | $CH_4$ | 120 | | | |
| | $H_2$ | 200 | | | |
| | $PH_3$ | [FIG.66 (6)] | | | |
| CTL 7 | $SiH_4$ | 140 | 250 | 0.38 | 28 |
| | $SiF_4$ | 150 | | | |
| | $C_2H_4$ | 10 | | | |

TABLE 118-continued

| Name of layer | Film Forming Conditions of CTL: Gas used & its flow rate (SCCM) | | Substrate temperature (°C.) | Internal pressure (Torr) | Layer thickness (μm) |
|---|---|---|---|---|---|
| | $H_2$ | 200 | | | |
| | $PH_3$ | [FIG.66 (7)] | | | |
| CTL 8 | $SiH_4$ | 200 | 250 | 0.40 | 28 |
| | $SiF_4$ | 150 | | | |
| | NO | 25 | | | |
| | $H_2$ | 200 | | | |
| | $B_2H_6$ | [FIG.66 (8)] | | | |
| | $NH_3$ | [FIG.66 (8)] | | | |
| | $CH_4$ | [FIG.66 (8)] | | | |

TABLE 119

| Name of layer | Film Forming Conditions of CGL: Gas used & its flow rate (SCCM) | | Substrate temperature (°C.) | Internal pressure (Torr) | Layer thickness (μm) |
|---|---|---|---|---|---|
| CGL 1 | $SiH_4$ | 80 | 250 | 0.40 | 1 |
| | $SiF_4$ | 100 | | | |
| | $H_2$ | 80 | | | |
| CGL 2 | $SiH_4$ | 60 | 250 | 0.40 | 2 |
| | $SiF_4$ | 120 | | | |
| | $H_2$ | 80 | | | |
| CGL 3 | $SiH_4$ | 80 | 250 | 0.40 | 5 |
| | $SiF_4$ | 100 | | | |
| | $H_2$ | 80 | | | |
| CGL 4 | $SiH_4$ | 80 | 250 | 0.40 | 2 |
| | $SiF_4$ | 100 | | | |
| | $H_2$ | 80 | | | |
| | Ar | 40 | | | |

TABLE 120

| Drum No. | initial charge-retentivity | photo-sensitivity | residual potential | ghost | durability |
|---|---|---|---|---|---|
| 3801 | ◎ | ○ | ○ | ○ | ◎ |
| 3802 | ◎ | ○ | ○ | ○ | ◎ |
| 3803 | ◎ | ○ | ○ | ○ | ◎ |
| 3804 | ◎ | ○ | ○ | ○ | ◎ |
| 3805 | ◎ | ○ | ○ | ○ | ◎ |
| 3806 | ◎ | ○ | ○ | ○ | ◎ |
| 3807 | ◎ | ○ | ○ | ○ | ◎ |
| 3808 | ◎ | ○ | ○ | ○ | ◎ |
| 3809 | ◎ | ○ | ○ | ○ | ◎ |

TABLE 120-continued

| Drum No. | initial charge-retentivity | photo-sensitivity | residual potential | ghost | durability |
|---|---|---|---|---|---|
| 3810 | ◎ | ○ | ○ | ○ | ◎ |
| 3811 | ◎ | ○ | ○ | ○ | ◎ |
| 3812 | ◎ | ○ | ○ | ○ | ◎ |
| 3813 | ◎ | ○ | ○ | ○ | ◎ |
| 3814 | ◎ | ○ | ○ | ○ | ◎ |
| 3815 | ◎ | ○ | ○ | ○ | ◎ |
| 3816 | ◎ | ○ | ○ | ○ | ◎ |
| 3817 | ◎ | ○ | ○ | ○ | ◎ |
| 3818 | ◎ | ○ | ○ | ○ | ◎ |

◎: Excellent
○: good
Δ: practically applicable
X : practically not applicable

TABLE 121

| CGL No | CTL No CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 3901 | 3902 | 3903 | 3904 | 3905 | 3906 | 3907 | 3908 |
| CGL 2 | 3909 | 3910 | 3911 | 3912 | 3913 | 3914 | 3915 | 3916 |
| CGL 3 | 3917 | | | | | | | |

TABLE 122

| Name of layer | Gas used & its flow rate (SCCM) | | | Substrate temperature (°C.) | Internal pressure (Torr) | Layer thickness (μm) |
|---|---|---|---|---|---|---|
| IR absorption layer | $SiH_4$ | | 100 | 250 | 0.40 | 1 |
| | $GeH_4$ | | 50 | | | |
| | $B_2H_6$ | (against $SiH_4$) | 1500 ppm | | | |
| | NO | | 5 | | | |
| | $F_2$ | | 200 | | | |
| Charge injection inhibition layer | $SiH_4$ | | 100 | 250 | 0.36 | 3 |
| | $B_2H_6$ | (against $SiH_4$) | 1500 ppm | | | |
| | $H_2$ | | 20 | | | |
| | NO | (substrate side 2 μm) | 5 | | | |
| | | (surface side 1 μm) (constantly decrease) | 5 → 0 | | | |
| | $F_2$ | | 200 | | | |
| CGL/CTL | Combination as shown in Table 121 | | | | | |
| Surface layer | $SiH_4$ | | 30 | 250 | 0.40 | 1 |
| | $CH_4$ | | 250 | | | |
| | $F_2$ | | 350 | | | |

TABLE 123

| Name of layer | Film Forming Conditions of CGL: Gas used & its flow rate (SCCM) | | Substrate temperature (°C.) | Internal pressure (Torr) | Layer thickness (μm) |
|---|---|---|---|---|---|
| CGL 1 | $SiH_4$ | 200 | 250 | 0.40 | 1 |
| | $H_2$ | 20 | | | |
| | $F_2$ | 300 | | | |
| CGL 2 | $SiH_4$ | 150 | 250 | 0.40 | 2 |
| | $H_2$ | 20 | | | |
| | He | 200 | | | |
| | $F_2$ | 400 | | | |
| CGL 3 | $SiH_4$ | 200 | 250 | 0.40 | 5 |
| | He | 200 | | | |
| | $F_2$ | 200 | | | |

TABLE 124

| Name of layer | Film Forming Conditions of CTL: Gas used & its flow rate (SCCM) | | Substrate temperature (°C.) | Internal pressure (Torr) | Layer thickness (μm) |
|---|---|---|---|---|---|
| CTL 1 | $SiH_4$ | 100 | 250 | 0.40 | 24 |
| | $CH_4$ | 450 | | | |

TABLE 124-continued

Figure 67:
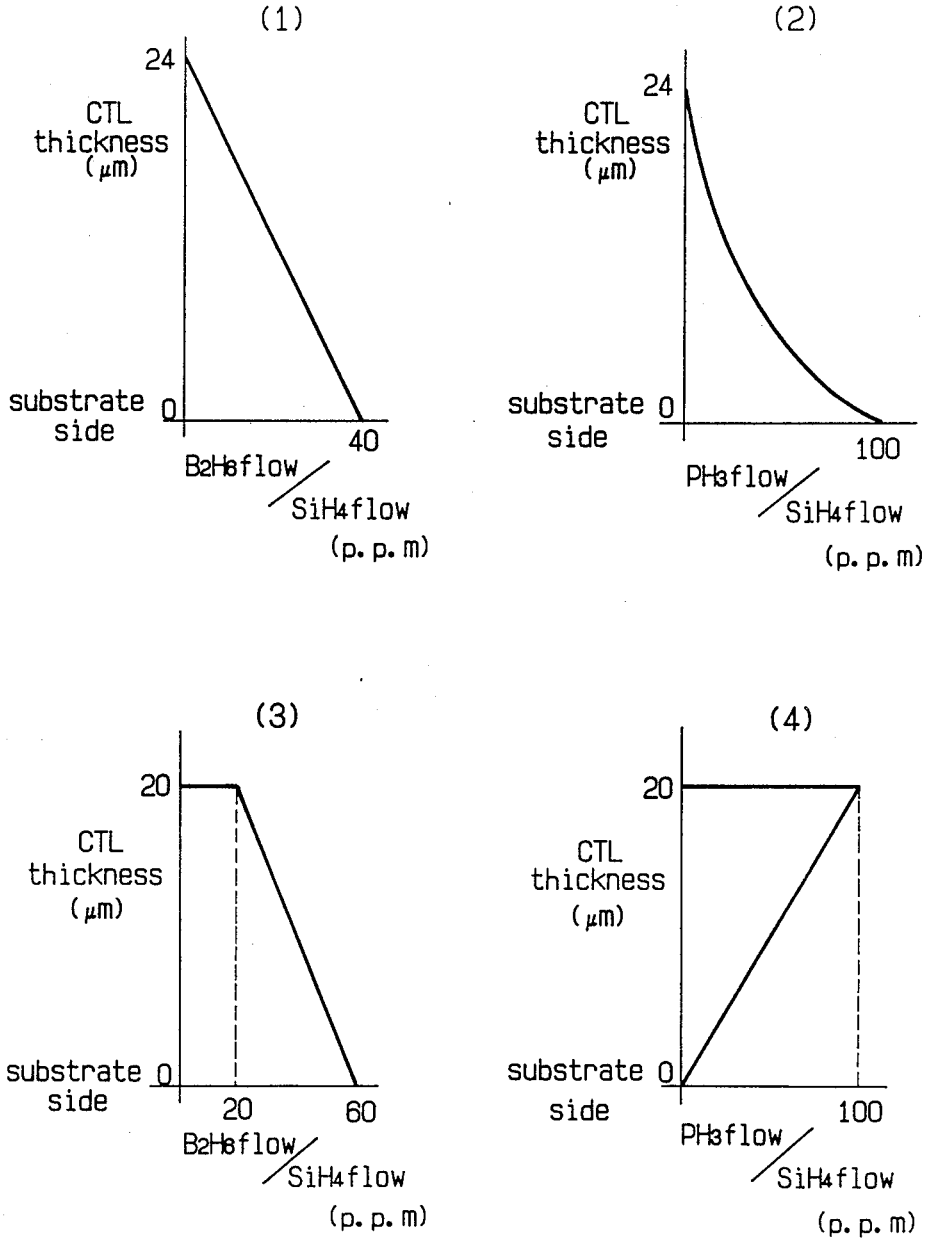
FIG. 67(1) through FIG. 67(8) are explanatory views illustrating diversification patterns for the flow rates of an impurity supplying raw material gas and a doping raw material gas at the time of forming the CTL of the light receiving member for use in electrophotography according to this invention by means of FOCVD.
Figure 67:
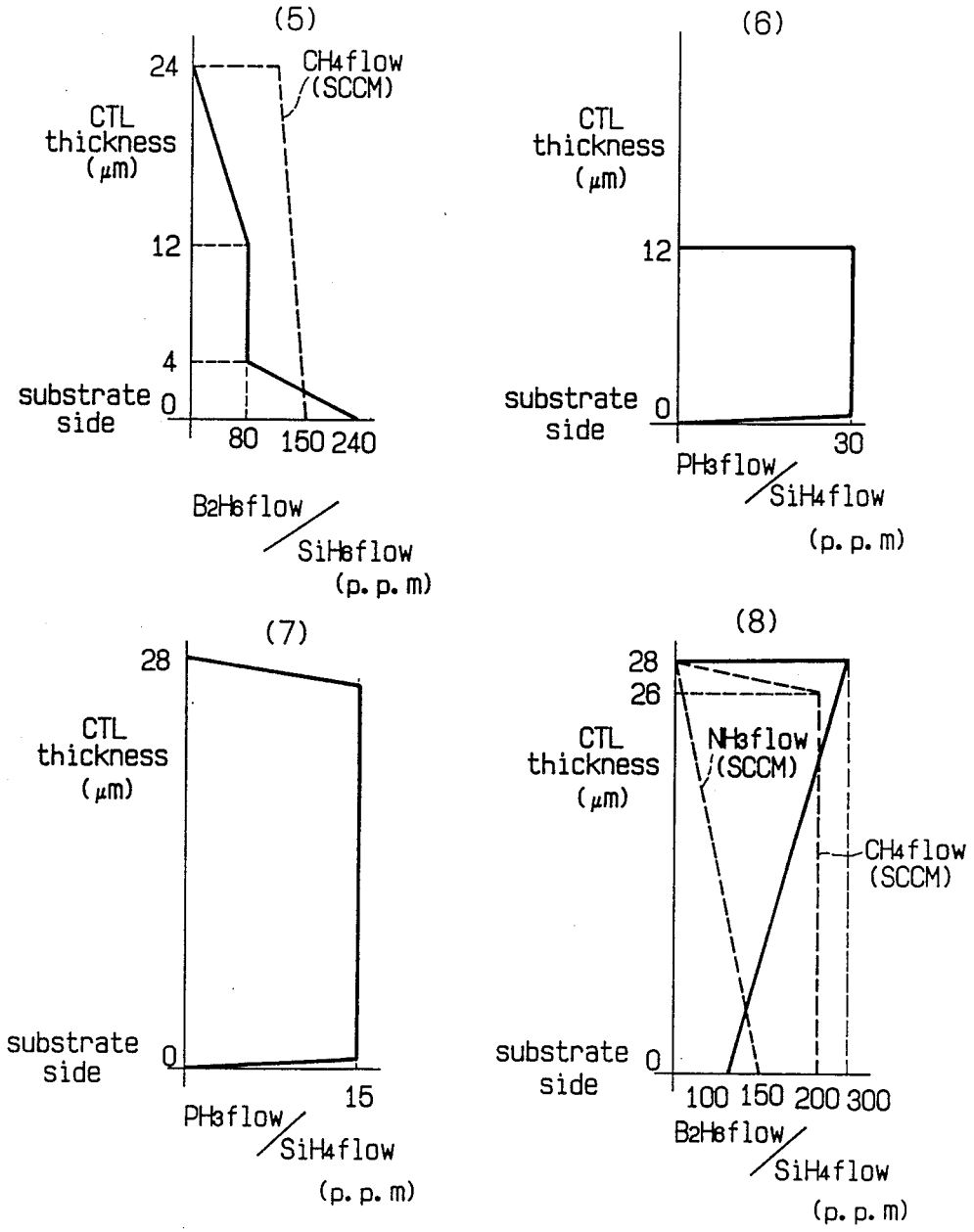
Figure 68:
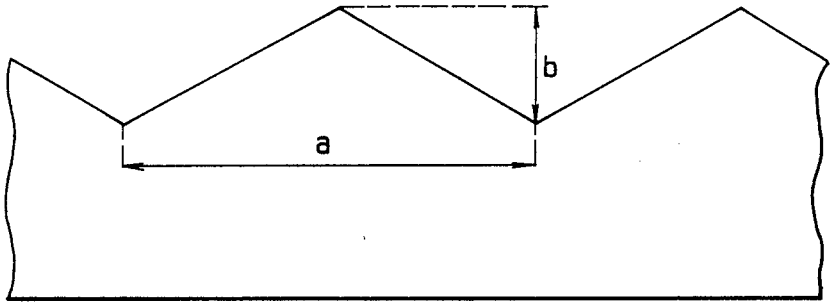
FIG. 68 is a partially schematic cross-sectional view illustrating an example of the surface shape composed of reverse V-form irregularities for the cylindrical substrate of the light receiving member for use in electrophotography according to this invention.

| Name of layer | Film Forming Conditions of CTL: Gas used & its flow rate (SCCM) | | Substrate temperature (°C.) | Internal pressure (Torr) | Layer thickness (μm) |
|---|---|---|---|---|---|
| | $B_2H_6$ | [FIG.67(1)] | | | |
| | $F_2$ | 600 | | | |
| CTL 2 | $SiH_4$ | 250 | 250 | 0.42 | 24 |
| | $C_2H_2$ | 400 | | | |
| | $PH_3$ | [FIG.67(2)] | | | |
| | $F_2$ | 650 | | | |
| CTL 3 | $SiH_4$ | 300 | 250 | 0.35 | 20 |
| | $C_2H_2$ | 350 | | | |
| | $B_2H_6$ | [FIG.67(3)] | | | |
| | $F_2$ | 700 | | | |
| CTL 4 | $SiH_4$ | 80 | 250 | 0.45 | 20 |
| | $C_2H_4$ | 500 | | | |
| | $PH_3$ | [FIG.67(4)] | | | |
| | $F_2$ | 450 | | | |
| CTL 5 | $SiH_4$ | 120 | 250 | 0.45 | 24 |
| | $NH_3$ | 400 | | | |
| | $CH_4$ | [FIG.67(5)] | | | |
| | $B_2H_6$ | [FIG.67(5)] | | | |
| | $F_2$ | [FIG.67(5)] | | | |
| CTL 6 | $SiH_4$ | 150 | 250 | 0.40 | 12 |
| | $NH_3$ | 300 | | | |
| | $CH_4$ | 300 | | | |
| | $PH_3$ | [FIG.67(6)] | | | |
| | $F_2$ | 550 | | | |
| CTL 7 | $SiH_4$ | 350 | 250 | 0.38 | 28 |
| | $C_2H_4$ | 25 | | | |
| | Ar | 200 | | | |
| | $PH_3$ | [FIG.67(7)] | | | |
| | $F_2$ | 500 | | | |
| CTL 8 | $SiH_4$ | 500 | 250 | 0.40 | 28 |
| | NO | 60 | | | |
| | $B_2H_6$ | [FIG.67(8)] | | | |
| | $NH_3$ | [FIG.67(8)] | | | |
| | $CH_4$ | [FIG.67(8)] | | | |
| | $F_2$ | 550 | | | |

TABLE 125

| Drum No. | initial charge-retentivity | photo-sensitivity | residual potential | ghost | durability |
|---|---|---|---|---|---|
| 3901 | ◎ | ○ | ○ | ○ | ◎ |
| 3902 | ◎ | ○ | ○ | ○ | ◎ |
| 3903 | ◎ | ○ | ○ | ○ | ◎ |
| 3904 | ◎ | ○ | ○ | ○ | ◎ |
| 3905 | ◎ | ○ | ○ | ○ | ◎ |
| 3906 | ◎ | ○ | ○ | ○ | ◎ |
| 3907 | ◎ | ○ | ○ | ○ | ◎ |
| 3908 | ◎ | ○ | ○ | ○ | ◎ |
| 3909 | ◎ | ○ | ○ | ○ | ◎ |
| 3910 | ◎ | ○ | ○ | ○ | ◎ |

TABLE 125-continued

| Drum No. | initial charge-retentivity | photo-sensitivity | residual potential | ghost | durability |
|---|---|---|---|---|---|
| 3911 | ◎ | ○ | ○ | ○ | ◎ |
| 3912 | ◎ | ○ | ○ | ○ | ◎ |
| 3913 | ◎ | ○ | ○ | ○ | ◎ |
| 3914 | ◎ | ○ | ○ | ○ | ◎ |
| 3915 | ◎ | ○ | ○ | ○ | ◎ |
| 3916 | ◎ | ○ | ○ | ○ | ◎ |
| 3917 | ◎ | ○ | ○ | ○ | ◎ |
| 3918 | ◎ | ○ | ○ | ○ | ◎ |

◎: Excellent
○: good
Δ: practically applicable
X: practically not applicable

TABLE 126

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $B_2H_6$ (against $SiH_4$) | 800 ppm | | | | |
| | NO | 10 | | | | |
| Charge injection inhibition layer | $SiH_4$ | 100 | 250 | 150 | 0.35 | 3 |
| | $B_2H_6$ (against $SiH_4$) | 800 ppm | | | | |
| | $H_2$ | 100 | | | | |
| | NO | 10 | | | | |
| CGL | $SiH_4$ | 200 | | | | |
| | $H_2$ | 200 | | | | |
| CTL | $SiH_4$ | 250 | 250 | 300 | 0.42 | 24 |
| | $C_2H_2$ | 400 | | | | |
| | $PH_3$ | 1 → 0 ppm | | | | |
| Surface layer | $SiH_4$ | 20 | 250 | 150 | 0.4 | 1 |
| | $CH_4$ | 500 | | | | |

TABLE 127

| Drum No. | 4001 | 4002 | 4003 | 4004 | 4005 |
|---|---|---|---|---|---|
| a [μm] | 25 | 50 | 50 | 12 | 12 |
| b [μm] | 0.8 | 2.5 | 0.8 | 1.5 | 0.3 |

TABLE 128

| Drum No. | initial charge-retentivity | photo-sensitivity | residual potential | ghost | durability | defective image | interference fringe |
|---|---|---|---|---|---|---|---|
| 4001 | ◎ | ○ | ○ | ○ | ○ | ◎ | ○ |
| 4002 | ◎ | ○ | ○ | ○ | ○ | ◎ | ○ |
| 4003 | ◎ | ○ | ○ | ○ | ○ | ◎ | ○ |
| 4004 | ◎ | ○ | ○ | ○ | ○ | ◎ | ○ |
| 4005 | ◎ | ○ | ○ | ○ | ○ | ◎ | ○ |

◎: Excellent
○: good
Δ: practically applicable
X: practically not applicable

TABLE 129

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $B_2H_6$ (against $SiH_4$) | 800 ppm | | | | |
| | NO | 10 | | | | |
| Charge injection inhibition layer | $SiH_4$ | 100 | 250 | 150 | 0.35 | 3 |
| | $B_2H_6$ (against $SiH_4$) | 800 ppm | | | | |
| | $H_2$ | 100 | | | | |
| | NO | 10 | | | | |
| CGL | $SiH_4$ | 200 | 250 | 300 | 0.40 | 1 |
| | $H_2$ | 200 | | | | |
| CTL | $SiH_4$ | 250 | 250 | 300 | 0.42 | 24 |
| | $C_2H_2$ | 400 | | | | |
| | $PH_3$ | 1 → 0 ppm | | | | |
| Surface layer | $SiH_4$ | 20 | 250 | 150 | 0.40 | 1 |
| | $CH_4$ | 500 | | | | |

TABLE 130

| Drum No. | 4011 | 4012 | 4013 | 4014 | 4015 |
|---|---|---|---|---|---|
| c [μm] | 30 | 40 | 50 | 70 | 100 |
| d [μm] | 0.7 | 1.0 | 1.2 | 2 | 5 |

TABLE 131

| Drum No. | initial charge-retentivity | photo-sensitivity | residual potential | ghost | durability | defective image | interference fringe |
|---|---|---|---|---|---|---|---|
| 4011 | ◎ | ○ | ○ | ○ | ◎ | ◎ | ○ |
| 4012 | ◎ | ○ | ○ | ○ | ◎ | ◎ | ◎ |
| 4013 | ◎ | ○ | ○ | ○ | ◎ | ◎ | ◎ |
| 4014 | ◎ | ○ | ○ | ○ | ◎ | ◎ | ○ |
| 4015 | ◎ | ○ | ○ | ○ | ◎ | ◎ | ○ |

◎: Excellent
○: good
Δ: practically applicable
X : practically not applicable

TABLE 132

| CGL No | CTL No CTL 1 | CTL 2 | CTL 3 | CTL 4 | CTL 5 | CTL 6 | CTL 7 | CTL 8 |
|---|---|---|---|---|---|---|---|---|
| | Drum No | | | | | | | |
| CGL 1 | 4101 | 4102 | 4103 | 4104 | 4105 | 4106 | 4107 | 4108 |
| CGL 2 | 4109 | 4110 | 4111 | 4112 | 4113 | 4114 | 4115 | 4116 |
| CGL 3 | 4117 | | | | | | | |

TABLE 133

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 350 | 500 | 0.35 | 1 |
| | $GeH_4$ | 50 | | | | |
| | $B_2H_6$ (against $SiH_4$) | 800 ppm | | | | |
| | NO | 10 | | | | |
| Charge injection inhibition layer | $SiH_4$ | 100 | 350 | 500 | 0.35 | 3 |
| | $B_2H_6$ (against $SiH_4$) | 800 ppm | | | | |
| | $H_2$ | 500 | | | | |
| | NO | 10 | | | | |
| CGL/CTL | Combination as shown in Table 132 | | | | | |
| Surface layer | $SiH_4$ | 20 | 350 | 500 | 0.40 | 1 |
| | $CH_4$ | 500 | | | | |

TABLE 134

| Name of layer | Film Forming Conditions CGL: Gas used & its flow rate (SCCM) | | Substrate temperature (°C.) | RF power (W) | Internal pressure (Torr) | Layer thickness (μm) |
|---|---|---|---|---|---|---|
| CGL 1 | $SiH_4$ | 200 | 350 | 700 | 0.40 | 1 |
| | $H_2$ | 1000 | | | | |
| CGL 2 | $SiH_4$ | 150 | 350 | 700 | 0.40 | 2 |
| | $SiF_4$ | 50 | | | | |
| | $H_2$ | 1000 | | | | |
| CGL 3 | $SiH_4$ | 200 | 350 | 650 | 0.40 | 5 |
| | He | 200 | | | | |

TABLE 135

| Name of Layer | Film Forming Conditions of CTL: Gas used & its flow rate (SCCM) | Substrate temperature (°C.) | RF power (W) | Internal pressure (Torr) | Layer thickness (μm) |
|---|---|---|---|---|---|
| CTL 1 | $SiH_4$ 100 | 350 | 700 | 0.40 | 24 |

TABLE 135-continued

Figure 70:
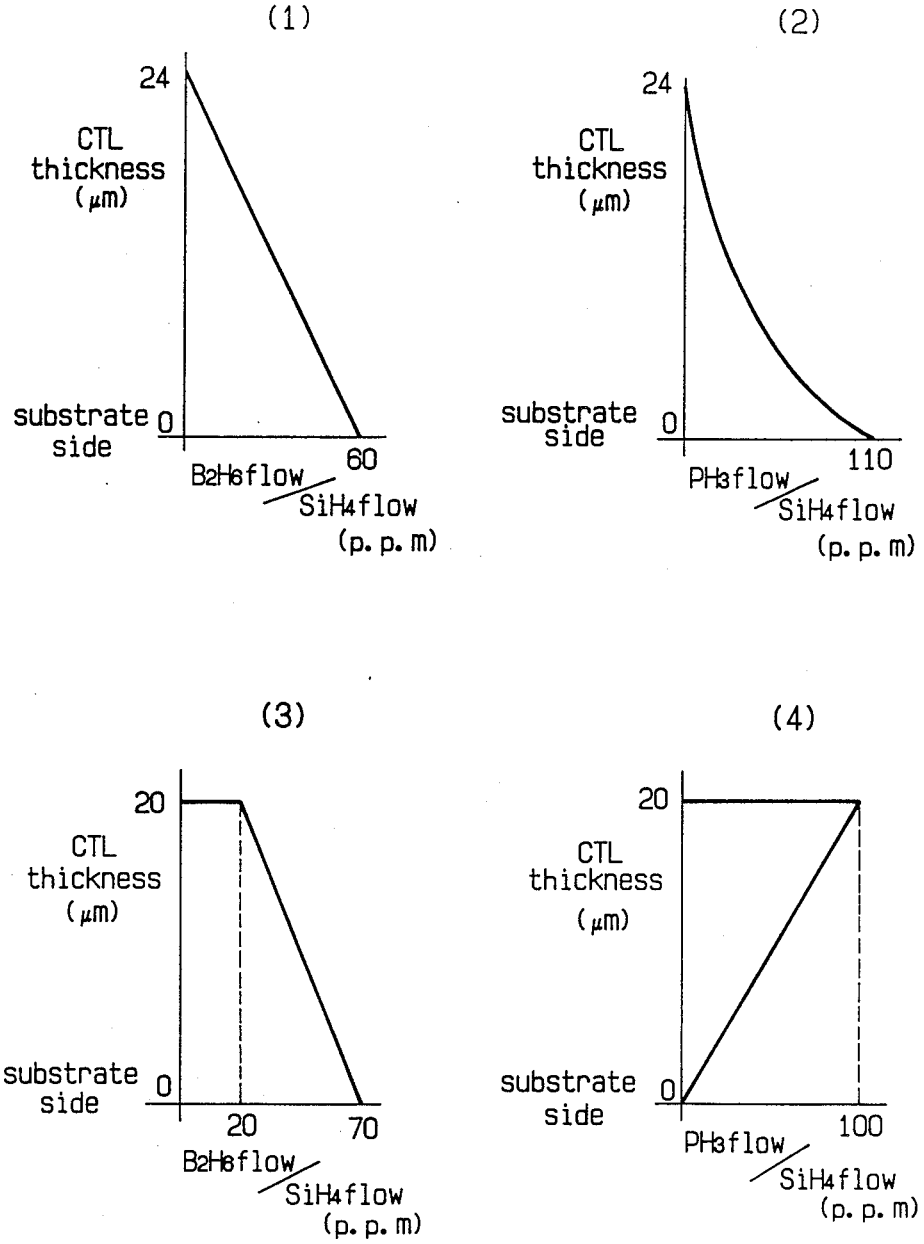
FIG. 70(1) through FIG. 70(8) are another explanatory views illustrating diversification patterns for the flow rates of an impurity supplying raw material gas and a doping raw material gas at the time of forming the CTL of the light receiving member for use in electrophotography according to this invention by means of RF glow discharging process.
Figure 70:
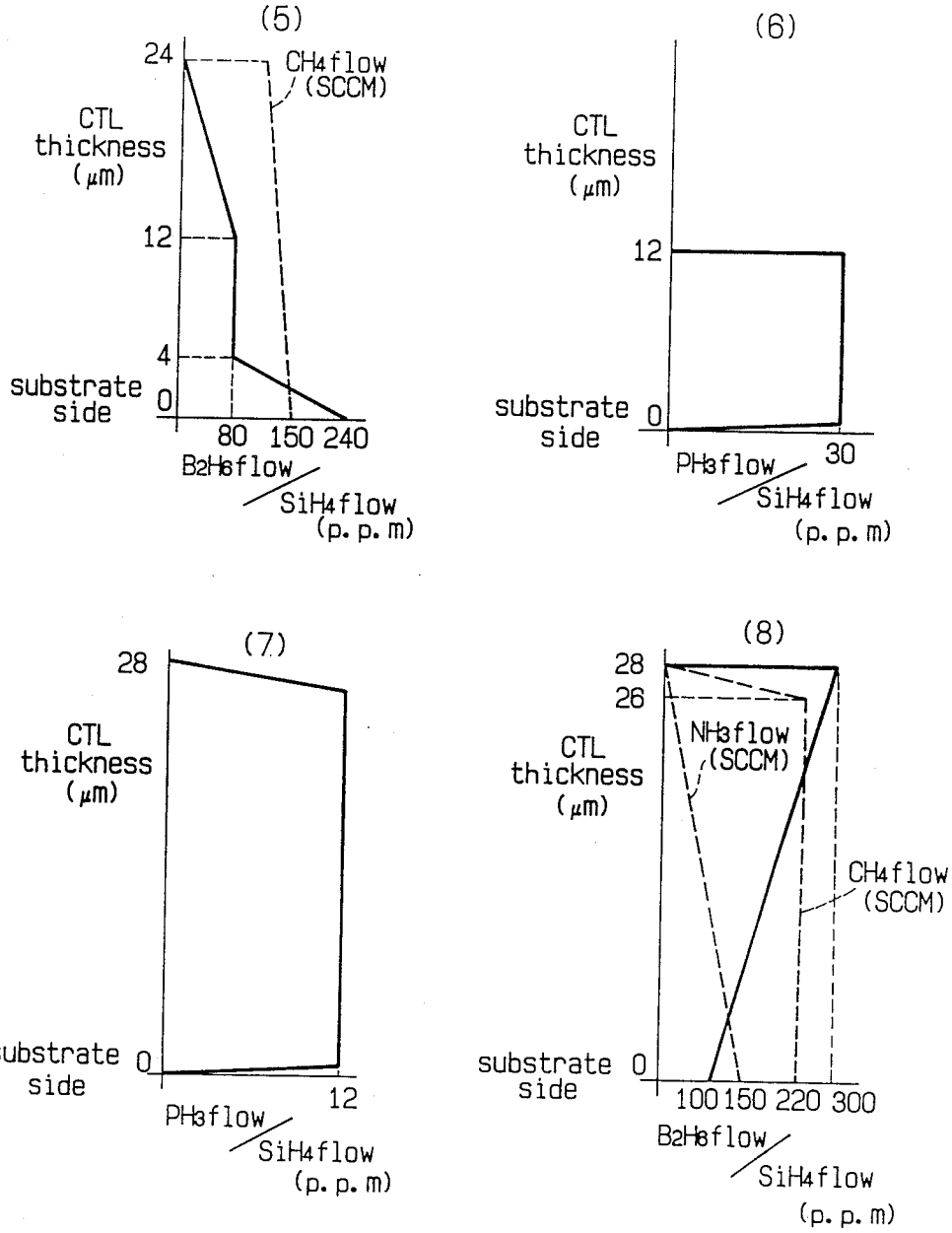

| Name of Layer | Film Forming Conditions of CTL: Gas used & its flow rate (SCCM) | Substrate temperature (°C.) | RF power (W) | Internal pressure (Torr) | Layer thickness (μm) |
|---|---|---|---|---|---|
| | $SiF_4$ 50<br>$CH_4$ 450<br>$B_2H_6$[FIG. 70(1)] | | | | |
| CTL 2 | $SiH_4$ 250<br>$C_2H_2$ 400<br>$PH_3$ [FIG. 70(2)] | 350 | 700 | 0.42 | 24 |
| CTL 3 | $SiH_4$ 300<br>$C_2H_2$ 350<br>$B_2H_6$[FIG. 70(3)] | 350 | 700 | 0.35 | 20 |
| CTL 4 | $SiH_4$ 80<br>$C_2H_4$ 600<br>$PH_3$ [FIG. 70(4)] | 350 | 750 | 0.45 | 20 |
| CTL 5 | $SiH_4$ 120<br>$N_2$ 500<br>$CH_4$ [FIG. 70(5)]<br>$B_2H_6$ [FIG. 70(5)] | 350 | 750 | 0.45 | 24 |
| CTL 6 | $SiH_4$ 150<br>$NH_3$ 300<br>$CH_4$ 300<br>$PH_3$ [FIG. 70(6)] | 350 | 700 | 0.40 | 12 |
| CTL 7 | $SiH_4$ 350<br>$C_2H_4$ 25<br>Ar 200<br>$PH_3$ [FIG. 70(7)] | 350 | 600 | 0.38 | 28 |
| CTL 8 | $SiH_4$ 500<br>NO 60<br>$B_2H_6$ [FIG. 70(8)]<br>$NH_3$ [FIG. 70(8)]<br>$CH_4$ [FIG. 70(8)] | 350 | 600 | 0.40 | 28 |

TABLE 136

| Drum No. | initial charge-retentivity | photo-senitivity | residual potential | ghost | durability |
|---|---|---|---|---|---|
| 4101 | ◎ | ○ | ○ | ○ | ◎ |
| 4102 | ◎ | ○ | ○ | ○ | ◎ |
| 4103 | ◎ | ○ | ○ | ○ | ◎ |
| 4104 | ◎ | ○ | ○ | ○ | ◎ |
| 4105 | ◎ | ○ | ○ | ○ | ◎ |

TABLE 136-continued

| Drum No. | initial charge-retentivity | photo-senitivity | residual potential | ghost | durability |
|---|---|---|---|---|---|
| 4106 | ◎ | ○ | ○ | ○ | ◎ |
| 4107 | ◎ | ○ | ○ | ○ | ◎ |
| 4108 | ◎ | ○ | ○ | ○ | ◎ |
| 4109 | ◎ | ○ | ○ | ○ | ◎ |
| 4110 | ◎ | ○ | ○ | ○ | ◎ |
| 4111 | ◎ | ○ | ○ | ○ | ◎ |
| 4112 | ◎ | ○ | ○ | ○ | ◎ |
| 4113 | ◎ | ○ | ○ | ○ | ◎ |
| 4114 | ◎ | ○ | ○ | ○ | ◎ |
| 4115 | ◎ | ○ | ○ | ○ | ◎ |
| 4116 | ◎ | ○ | ○ | ○ | ◎ |
| 4117 | ◎ | ○ | ○ | ○ | ◎ |
| 4118 | ◎ | ○ | ○ | ○ | ◎ |

◎: Excellent
○: good
Δ: practically applicable
X : practically not applicable

TABLE 137

| Example No. | Sample No. | Corresponding Table No. | Layer formed: IR absorption layer | Charge injection inhibition layer | CGL/CTL | Surface layer | Evaluation Table No. |
|---|---|---|---|---|---|---|---|
| 43 | 101A~118A | 4 | — | — | ○ | — | 138 |
| 44 | 201A~218A | 112 | — | — | ○ | — | 139 |
| 45 | 301A~318A | 117 | — | — | ○ | — | 140 |
| 46 | 401A~417A | 122 | — | — | ○ | — | 141 |
| 47 | 501A~505A | 126 | — | — | ○ | — | 142A |
| 48 | 511A~515A | 129 | — | — | ○ | — | 143A |
| 49 | 601A~617A | 133 | — | — | ○ | — | 144 |
| 50 | 101B~118B | 4 | — | ○ | ○ | — | 145 |
| 51 | 201B~218B | 7 | — | ○ | ○ | — | 146 |
| 52 | 301B~318B | 64 | — | ○ | ○ | — | 147 |
| 53 | 401B~418B | 67 | — | ○ | ○ | — | 148 |
| 54 | 501B~518B | 112 | — | ○ | ○ | — | 149 |
| 55 | 601B~618B | 117 | — | ○ | ○ | — | 150 |
| 56 | 701B~717B | 122 | — | ○ | ○ | — | 151 |
| 57 | 801B~805B | 126 | — | ○ | ○ | — | 152A |
| 58 | 811B~815B | 129 | — | ○ | ○ | — | 153A |
| 59 | 901B~917B | 133 | — | ○ | ○ | — | 154 |
| 60 | 101C~118C | 4 | ○ | — | ○ | — | 155 |
| 61 | 201C~218C | 46 | ○ | — | ○ | — | 156 |
| 62 | 301C~318C | 79 | ○ | — | ○ | — | 157 |
| 63 | 401C~418C | 112 | ○ | — | ○ | — | 158 |
| 64 | 501C~518C | 117 | ○ | — | ○ | — | 159 |
| 65 | 601C~617C | 122 | ○ | — | ○ | — | 160 |
| 66 | 701C~705C | 126 | ○ | — | ○ | — | 161A |
| 67 | 711C~715C | 129 | ○ | — | ○ | — | 162A |
| 68 | 801C~817C | 133 | ○ | — | ○ | — | 163 |
| 69 | 101D~118D | 4 | — | ○ | ○ | ○ | 164 |
| 70 | 201D~218D | 7 | — | ○ | ○ | ○ | 165 |
| 71 | 301D~318D | 10 | — | ○ | ○ | ○ | 166 |
| 72 | 401D~418D | 22 | — | ○ | ○ | ○ | 167 |
| 73 | 501D~518D | 58 | — | ○ | ○ | ○ | 168 |
| 74 | 601D~618D | 169 | — | ○ | ○ | ○ | 170 |
| 75 | 701D~718D | 112 | — | ○ | ○ | ○ | 171 |
| 76 | 801D~818D | 117 | — | ○ | ○ | ○ | 172 |
| 77 | 901D~917D | 122 | — | ○ | ○ | ○ | 173 |
| 78 | 1001D~1005D | 126 | — | ○ | ○ | ○ | 174A |
| 79 | 1011D~1015D | 129 | — | ○ | ○ | ○ | 175A |
| 80 | 1101D~1117D | 133 | — | ○ | ○ | ○ | 176 |
| 81 | 101E~118E | 4 | — | ○ | ○ | ○ | 177 |
| 82 | 201E~218E | 7 | — | ○ | ○ | ○ | 178 |
| 83 | 301E~318E | 100 | — | ○ | ○ | ○ | 179 |
| 84 | 401E~418E | 43 | — | ○ | ○ | ○ | 180 |
| 85 | 501E~518E | 16 | — | ○ | ○ | ○ | 181 |
| 86 | 601E~618E | 19 | — | ○ | ○ | ○ | 182 |
| 87 | 701E~718E | 22 | — | ○ | ○ | ○ | 183 |
| 88 | 801E~818E | 25 | — | ○ | ○ | ○ | 184 |
| 89 | 901E~918E | 28 | — | ○ | ○ | ○ | 185 |
| 90 | 1001E~1018E | 31 | — | ○ | ○ | ○ | 186 |
| 91 | 1301E~1318E | 18 | — | ○ | ○ | ○ | 188 |
| 92 | 1401E~1418E | 73 | — | ○ | ○ | ○ | 189 |
| 93 | 1501E~1518E | 76 | — | ○ | ○ | ○ | 190 |
| 94 | 1601E~1618E | 79 | — | ○ | ○ | ○ | 191 |
| 95 | 1701E~1718E | 97 | — | ○ | ○ | ○ | 192 |
| 96 | 1901E~1918E | 193 | — | ○ | ○ | ○ | 194 |
| 97 | 2001E~2018E | 106 | — | ○ | ○ | ○ | 195 |

TABLE 137-continued

| Example No. | Sample No. | Corresponding Table No. | Layer formed: IR absorption layer | Charge injection inhibition layer | CGL/CTL | Surface layer | Evaluation Table No. |
|---|---|---|---|---|---|---|---|
| 98 | 2101E~2118E | 109 | — | ○ | ○ | ○ | 196 |
| 99 | 2201E~2218E | 112 | — | ○ | ○ | ○ | 196A |
| 100 | 2301E~2318E | 117 | — | ○ | ○ | ○ | 197 |
| 101 | 2401E~2419E | 122 | — | ○ | ○ | ○ | 198 |
| 102 | 2501E~2505E | 126 | — | ○ | ○ | ○ | 199A |
| 103 | 2511E~2515E | 129 | — | ○ | ○ | ○ | 200A |
| 104 | 2601E~2617E | 133 | — | ○ | ○ | ○ | 201 |
| 105 | 101F~118F | 4 | ○ | ○ | ○ | — | 202 |
| 106 | 201F~218F | 7 | ○ | ○ | ○ | — | 203 |
| 107 | 301F~318F | 103 | ○ | ○ | ○ | — | 204 |
| 108 | 401F~418F | 37 | ○ | ○ | ○ | — | 205 |
| 109 | 501F~518F | 64 | ○ | ○ | ○ | — | 206 |
| 110 | 601F~618F | 67 | ○ | ○ | ○ | — | 207 |
| 111 | 701F~718F | 208 | ○ | ○ | ○ | — | 209 |
| 112 | 801F~818F | 112 | ○ | ○ | ○ | — | 210 |
| 113 | 901F~918F | 117 | ○ | ○ | ○ | — | 211 |
| 114 | 1001F~1017F | 122 | ○ | ○ | ○ | — | 212 |
| 115 | 1101F~1105F | 126 | ○ | ○ | ○ | — | 213A |
| 116 | 1111F~1115F | 129 | ○ | ○ | ○ | — | 214A |
| 117 | 1201F~1218F | 133 | ○ | ○ | ○ | — | 215 |
| 118 | 101G~118G | 4 | ○ | — | ○ | ○ | 216 |
| 119 | 201G~218G | 217 | ○ | — | ○ | ○ | 218 |
| 120 | 301G~318G | 10 | ○ | — | ○ | ○ | 219 |
| 121 | 401G~418G | 22 | ○ | — | ○ | ○ | 220 |
| 122 | 501G~518G | 16 | ○ | — | ○ | ○ | 221 |
| 123 | 601G~618G | 222 | ○ | — | ○ | ○ | 223 |
| 124 | 701G~718G | 40 | ○ | — | ○ | ○ | 224 |
| 125 | 801G~818G | 46 | ○ | — | ○ | ○ | 225 |
| 126 | 901G~918G | 52 | ○ | — | ○ | ○ | 226 |
| 127 | 1001G~1018G | 58 | ○ | — | ○ | ○ | 227 |
| 128 | 1101G~1118G | 228 | ○ | — | ○ | ○ | 229 |
| 129 | 1201G~1218G | 230 | ○ | — | ○ | ○ | 231 |
| 130 | 1301G~1318G | 70 | ○ | — | ○ | ○ | 232 |
| 131 | 1401G~1418G | 73 | ○ | — | ○ | ○ | 233 |
| 132 | 1501G~1518G | 76 | ○ | — | ○ | ○ | 234 |
| 133 | 1601G~1618G | 79 | ○ | — | ○ | ○ | 235 |
| 134 | 1701G~1718G | 236 | ○ | — | ○ | ○ | 237 |
| 135 | 1801G~1818G | 112 | ○ | — | ○ | ○ | 238 |
| 136 | 1901G~1918G | 117 | ○ | — | ○ | ○ | 239 |
| 137 | 2001G~2017G | 122 | ○ | — | ○ | ○ | 240 |
| 138 | 2101G~2105G | 126 | ○ | — | ○ | ○ | 241A |
| 139 | 2111G~2115G | 129 | ○ | — | ○ | ○ | 242A |
| 140 | 2201G~2218G | 133 | ○ | — | ○ | ○ | 243 |

TABLE 138

| Drum No. | initial charge-retentivity | photo-senitivity | residual potential | ghost | durability |
|---|---|---|---|---|---|
| 101A | ○ | ○ | ○ | ○ | ○ |
| 102A | ○ | ○ | ○ | ○ | ○ |
| 103A | ○ | ○ | ○ | ○ | ○ |
| 104A | ○ | ○ | ○ | ○ | ○ |
| 105A | ○ | ○ | ○ | ○ | ○ |
| 106A | ○ | ○ | ○ | ○ | ○ |
| 107A | ○ | ○ | ○ | ○ | ○ |
| 108A | ○ | ○ | ○ | ○ | ○ |
| 109A | ○ | ○ | ○ | ○ | ○ |
| 110A | ○ | ○ | ○ | ○ | ○ |
| 111A | ○ | ○ | ○ | ○ | ○ |
| 112A | ○ | ○ | ○ | ○ | ○ |
| 113A | ○ | ○ | ○ | ○ | ○ |
| 114A | ○ | ○ | ○ | ○ | ○ |
| 115A | ○ | ○ | ○ | ○ | ○ |
| 116A | ○ | ○ | ○ | ○ | ○ |
| 117A | ○ | ○ | ○ | ○ | ○ |
| 118A | ○ | ○ | ○ | ○ | ○ |

◎: Excellent
○: good
Δ: practically applicable
X: practically not applicable

TABLE 139

| Drum No. | initial charge-retentivity | photo-senitivity | residual potential | ghost | durability |
|---|---|---|---|---|---|
| 201A | ○ | ○ | ○ | ○ | ○ |
| 202A | ○ | ○ | ○ | ○ | ○ |
| 203A | ○ | ○ | ○ | ○ | ○ |
| 204A | ○ | ○ | ○ | ○ | ○ |
| 205A | ○ | ○ | ○ | ○ | ○ |
| 206A | ○ | ○ | ○ | ○ | ○ |
| 207A | ○ | ○ | ○ | ○ | ○ |
| 208A | ○ | ○ | ○ | ○ | ○ |
| 209A | ○ | ○ | ○ | ○ | ○ |
| 210A | ○ | ○ | ○ | ○ | ○ |
| 211A | ○ | ○ | ○ | ○ | ○ |
| 212A | ○ | ○ | ○ | ○ | ○ |
| 213A | ○ | ○ | ○ | ○ | ○ |
| 214A | ○ | ○ | ○ | ○ | ○ |
| 215A | ○ | ○ | ○ | ○ | ○ |
| 216A | ○ | ○ | ○ | ○ | ○ |
| 217A | ○ | ○ | ○ | ○ | ○ |
| 218A | ○ | ○ | ○ | ○ | ○ |

◎: Excellent
○: good
Δ: practically applicable
X : practically not applicable

TABLE 140

| Drum No. | initial charge-retentivity | photo-senitivity | residual potential | ghost | durability |
|---|---|---|---|---|---|
| 301A | ○ | ○ | ○ | ○ | ○ |
| 302A | ○ | ○ | ○ | ○ | ○ |
| 303A | ○ | ○ | ○ | ○ | ○ |
| 304A | ○ | ○ | ○ | ○ | ○ |
| 305A | ○ | ○ | ○ | ○ | ○ |
| 306A | ○ | ○ | ○ | ○ | ○ |
| 307A | ○ | ○ | ○ | ○ | ○ |
| 308A | ○ | ○ | ○ | ○ | ○ |
| 309A | ○ | ○ | ○ | ○ | ○ |
| 310A | ○ | ○ | ○ | ○ | ○ |
| 311A | ○ | ○ | ○ | ○ | ○ |
| 312A | ○ | ○ | ○ | ○ | ○ |
| 313A | ○ | ○ | ○ | ○ | ○ |
| 314A | ○ | ○ | ○ | ○ | ○ |
| 315A | ○ | ○ | ○ | ○ | ○ |
| 316A | ○ | ○ | ○ | ○ | ○ |
| 317A | ○ | ○ | ○ | ○ | ○ |
| 318A | ○ | ○ | ○ | ○ | ○ |

◎: Excellent
○: good
Δ: practically applicable
X: practically not applicable

TABLE 141

| Drum No. | initial charge-retentivity | photo-senitivity | residual potential | ghost | durability |
|---|---|---|---|---|---|
| 401A | ○ | ○ | ○ | ○ | ○ |
| 402A | ○ | ○ | ○ | ○ | ○ |
| 403A | ○ | ○ | ○ | ○ | ○ |
| 404A | ○ | ○ | ○ | ○ | ○ |
| 405A | ○ | ○ | ○ | ○ | ○ |
| 406A | ○ | ○ | ○ | ○ | ○ |
| 407A | ○ | ○ | ○ | ○ | ○ |
| 408A | ○ | ○ | ○ | ○ | ○ |
| 409A | ○ | ○ | ○ | ○ | ○ |
| 410A | ○ | ○ | ○ | ○ | ○ |
| 411A | ○ | ○ | ○ | ○ | ○ |
| 412A | ○ | ○ | ○ | ○ | ○ |
| 413A | ○ | ○ | ○ | ○ | ○ |
| 414A | ○ | ○ | ○ | ○ | ○ |
| 415A | ○ | ○ | ○ | ○ | ○ |
| 416A | ○ | ○ | ○ | ○ | ○ |
| 417A | ○ | ○ | ○ | ○ | ○ |

◎: Excellent
○: good
Δ: practically applicable
X: practically not applicable

TABLE 142

| Drum No. | 501A | 502A | 503A | 504A | 505A |
|---|---|---|---|---|---|
| a [μm] | 25 | 50 | 50 | 12 | 12 |
| b [μm] | 0.8 | 2.5 | 0.8 | 1.5 | 0.3 |

TABLE 142 A

| Drum No. | initial charge-reten-tivity | photo-sensi-tivity | residual potential | ghost | dura-bility | defec-tive image | inter-ference fringe |
|---|---|---|---|---|---|---|---|
| 501A | ○ | ○ | ○ | ○ | ○ | ○ | ◎ |
| 502A | ○ | ○ | ○ | ○ | ○ | ○ | ◎ |
| 503A | ○ | ○ | ○ | ○ | ○ | ○ | ○ |
| 504A | ○ | ○ | ○ | ○ | ○ | ○ | ◎ |
| 505A | ○ | ○ | ○ | ○ | ○ | ○ | ○ |

◎: Excellent
○: good
Δ: practically applicable
X: practically not applicable

TABLE 143

| Drum No. | 511A | 512A | 513A | 514A | 515A |
|---|---|---|---|---|---|
| a [μm] | 30 | 40 | 50 | 70 | 100 |
| b [μm] | 0.7 | 1.0 | 1.2 | 2 | 5 |

TABLE 143 A

| Drum No. | initial charge-reten-tivity | photo-sensi-tivity | residual potential | ghost | dura-bility | defec-tive image | inter-ference fringe |
|---|---|---|---|---|---|---|---|
| 511A | ○ | ○ | ○ | ○ | ○ | ◎ | ○ |
| 512A | ○ | ○ | ○ | ○ | ○ | ◎ | ◎ |
| 513A | ○ | ○ | ○ | ○ | ○ | ◎ | ◎ |
| 514A | ○ | ○ | ○ | ○ | ○ | ◎ | ○ |
| 515A | ○ | ○ | ○ | ○ | ○ | ◎ | ○ |

◎: Excellent
○: good
Δ: practically applicable
X: practically not applicable

TABLE 144

| Drum No. | initial charge-retentivity | photo-sensitivity | residual potential | ghost | durability |
|---|---|---|---|---|---|
| 601 | ○ | ○ | ○ | ○ | ○ |
| 602 | ○ | ○ | ○ | ○ | ○ |
| 603 | ○ | ○ | ○ | ○ | ○ |
| 604 | ○ | ○ | ○ | ○ | ○ |
| 605 | ○ | ○ | ○ | ○ | ○ |
| 606 | ○ | ○ | ○ | ○ | ○ |
| 607 | ○ | ○ | ○ | ○ | ○ |
| 608 | ○ | ○ | ○ | ○ | ○ |
| 609 | ○ | ○ | ○ | ○ | ○ |
| 610 | ○ | ○ | ○ | ○ | ○ |
| 611 | ○ | ○ | ○ | ○ | ○ |
| 612 | ○ | ○ | ○ | ○ | ○ |
| 613 | ○ | ○ | ○ | ○ | ○ |
| 614 | ○ | ○ | ○ | ○ | ○ |
| 615 | ○ | ○ | ○ | ○ | ○ |
| 616 | ○ | ○ | ○ | ○ | ○ |
| 617 | ○ | ○ | ○ | ○ | ○ |

◎: Excellent
○: good
Δ: practically applicable
X : practically not applicable

TABLE 145

| Drum No. | initial charge-retentivity | photo-sensitivity | residual potential | ghost | durability |
|---|---|---|---|---|---|
| 101B | ◎ | ○ | ○ | ○ | ○ |
| 102B | ◎ | ○ | ○ | ○ | ○ |
| 103B | ◎ | ○ | ○ | ○ | ○ |
| 104B | ◎ | ○ | ○ | ○ | ○ |
| 105B | ◎ | ○ | ○ | ○ | ○ |
| 106B | ◎ | ○ | ○ | ○ | ○ |
| 107B | ◎ | ○ | ○ | ○ | ○ |
| 108B | ◎ | ○ | ○ | ○ | ○ |
| 109B | ◎ | ○ | ○ | ○ | ○ |
| 110B | ◎ | ○ | ○ | ○ | ○ |
| 111B | ◎ | ○ | ○ | ○ | ○ |
| 112B | ◎ | ○ | ○ | ○ | ○ |
| 113B | ◎ | ○ | ○ | ○ | ○ |
| 114B | ◎ | ○ | ○ | ○ | ○ |
| 115B | ◎ | ○ | ○ | ○ | ○ |
| 116B | ◎ | ○ | ○ | ○ | ○ |
| 117B | ◎ | ○ | ○ | ○ | ○ |
| 118B | ◎ | ○ | ○ | ○ | ○ |

◎: Excellent
○: good
Δ: practically applicable
X : practically not applicable

TABLE 146

| Drum No. | initial charge-retentivity | photo-sensitivity | residual potential | ghost | durability |
|---|---|---|---|---|---|
| 201B | ◎ | ○ | ○ | ○ | ○ |
| 202B | ◎ | ○ | ○ | ○ | ○ |
| 203B | ◎ | ○ | ○ | ○ | ○ |
| 204B | ◎ | ○ | ○ | ○ | ○ |
| 205B | ◎ | ○ | ○ | ○ | ○ |
| 206B | ◎ | ○ | ○ | ○ | ○ |
| 207B | ◎ | ○ | ○ | ○ | ○ |
| 208B | ◎ | ○ | ○ | ○ | ○ |
| 209B | ◎ | ○ | ○ | ○ | ○ |
| 210B | ◎ | ○ | ○ | ○ | ○ |
| 211B | ◎ | ○ | ○ | ○ | ○ |
| 212B | ◎ | ○ | ○ | ○ | ○ |
| 213B | ◎ | ○ | ○ | ○ | ○ |
| 214B | ◎ | ○ | ○ | ○ | ○ |
| 215B | ◎ | ○ | ○ | ○ | ○ |
| 216B | ◎ | ○ | ○ | ○ | ○ |
| 217B | ◎ | ○ | ○ | ○ | ○ |
| 218B | ◎ | ○ | ○ | ○ | ○ |

◎: Excellent
Δ: practically applicable
○: good
X: practically not applicable

TABLE 147

| Drum No. | initial charge-retentivity | photo-sensitivity | residual potential | ghost | durability |
|---|---|---|---|---|---|
| 301B | ◎ | ○ | ○ | ○ | ○ |
| 302B | ◎ | ○ | ○ | ○ | ○ |
| 303B | ◎ | ○ | ○ | ○ | ○ |
| 304B | ◎ | ○ | ○ | ○ | ○ |
| 305B | ◎ | ○ | ○ | ○ | ○ |
| 306B | ◎ | ○ | ○ | ○ | ○ |
| 307B | ◎ | ○ | ○ | ○ | ○ |
| 308B | ◎ | ○ | ○ | ○ | ○ |
| 309B | ◎ | ○ | ○ | ○ | ○ |
| 310B | ◎ | ○ | ○ | ○ | ○ |
| 311B | ◎ | ○ | ○ | ○ | ○ |
| 312B | ◎ | ○ | ○ | ○ | ○ |
| 313B | ◎ | ○ | ○ | ○ | ○ |
| 314B | ◎ | ○ | ○ | ○ | ○ |
| 315B | ◎ | ○ | ○ | ○ | ○ |
| 316B | ◎ | ○ | ○ | ○ | ○ |
| 317B | ◎ | ○ | ○ | ○ | ○ |
| 318B | ◎ | ○ | ○ | ○ | ○ |

◎: Excellent
Δ: practically applicable
○: good
X: practically not applicable

TABLE 148

| Drum No. | initial charge-retentivity | photo-sensitivity | residual potential | ghost | durability |
|---|---|---|---|---|---|
| 401B | ◎ | ○ | ○ | ◎ | ○ |
| 402B | ◎ | ○ | ○ | ◎ | ○ |
| 403B | ◎ | ○ | ○ | ◎ | ○ |
| 404B | ◎ | ○ | ○ | ◎ | ○ |
| 405B | ◎ | ○ | ○ | ◎ | ○ |
| 406B | ◎ | ○ | ○ | ◎ | ○ |
| 407B | ◎ | ○ | ○ | ◎ | ○ |
| 408B | ◎ | ○ | ○ | ◎ | ○ |
| 409B | ◎ | ○ | ○ | ◎ | ○ |
| 410B | ◎ | ○ | ○ | ◎ | ○ |
| 411B | ◎ | ○ | ○ | ◎ | ○ |
| 412B | ◎ | ○ | ○ | ◎ | ○ |
| 413B | ◎ | ○ | ○ | ◎ | ○ |
| 414B | ◎ | ○ | ○ | ◎ | ○ |
| 415B | ◎ | ○ | ○ | ◎ | ○ |
| 416B | ◎ | ○ | ○ | ◎ | ○ |
| 417B | ◎ | ○ | ○ | ◎ | ○ |

TABLE 148-continued

| Drum No. | initial charge-retentivity | photo-sensitivity | residual potential | ghost | durability |
|---|---|---|---|---|---|
| 418B | ◎ | ○ | ○ | ◎ | ○ |

◎: Excellent
Δ: practically applicable
○: good
X: practically not applicable

TABLE 149

| Drum No. | initial charge-retentivity | photo-sensitivity | residual potential | ghost | durability |
|---|---|---|---|---|---|
| 501B | ◎ | ○ | ○ | ○ | ○ |
| 502B | ◎ | ○ | ○ | ○ | ○ |
| 503B | ◎ | ○ | ○ | ○ | ○ |
| 504B | ◎ | ○ | ○ | ○ | ○ |
| 505B | ◎ | ○ | ○ | ○ | ○ |
| 506B | ◎ | ○ | ○ | ○ | ○ |
| 507B | ◎ | ○ | ○ | ○ | ○ |
| 508B | ◎ | ○ | ○ | ○ | ○ |
| 509B | ◎ | ○ | ○ | ○ | ○ |
| 510B | ◎ | ○ | ○ | ○ | ○ |
| 511B | ◎ | ○ | ○ | ○ | ○ |
| 512B | ◎ | ○ | ○ | ○ | ○ |
| 513B | ◎ | ○ | ○ | ○ | ○ |
| 514B | ◎ | ○ | ○ | ○ | ○ |
| 515B | ◎ | ○ | ○ | ○ | ○ |
| 516B | ◎ | ○ | ○ | ○ | ○ |
| 517B | ◎ | ○ | ○ | ○ | ○ |
| 518B | ◎ | ○ | ○ | ○ | ○ |

: Excellent
: good
Δ: practically applicable
X : practically not applicable

TABLE 150

| Drum No. | initial charge-retentivity | photo-sensitivity | residual potential | ghost | durability |
|---|---|---|---|---|---|
| 601B | ◎ | ○ | ○ | ○ | ○ |
| 602B | ◎ | ○ | ○ | ○ | ○ |
| 603B | ◎ | ○ | ○ | ○ | ○ |
| 604B | ◎ | ○ | ○ | ○ | ○ |
| 605B | ◎ | ○ | ○ | ○ | ○ |
| 606B | ◎ | ○ | ○ | ○ | ○ |
| 607B | ◎ | ○ | ○ | ○ | ○ |
| 608B | ◎ | ○ | ○ | ○ | ○ |
| 609B | ◎ | ○ | ○ | ○ | ○ |
| 610B | ◎ | ○ | ○ | ○ | ○ |
| 611B | ◎ | ○ | ○ | ○ | ○ |
| 612B | ◎ | ○ | ○ | ○ | ○ |
| 613B | ◎ | ○ | ○ | ○ | ○ |
| 614B | ◎ | ○ | ○ | ○ | ○ |
| 615B | ◎ | ○ | ○ | ○ | ○ |
| 616B | ◎ | ○ | ○ | ○ | ○ |
| 617B | ◎ | ○ | ○ | ○ | ○ |
| 618B | ◎ | ○ | ○ | ○ | ○ |

: Excellent
: good
Δ: practically applicable
X : practically not applicable

TABLE 151

| Drum No. | initial charge-retentivity | photo-sensitivity | residual potential | ghost | durability |
|---|---|---|---|---|---|
| 701B | ◎ | ○ | ○ | ○ | ○ |
| 702B | ◎ | ○ | ○ | ○ | ○ |
| 703B | ◎ | ○ | ○ | ○ | ○ |
| 704B | ◎ | ○ | ○ | ○ | ○ |
| 705B | ◎ | ○ | ○ | ○ | ○ |
| 706B | ◎ | ○ | ○ | ○ | ○ |
| 707B | ◎ | ○ | ○ | ○ | ○ |
| 708B | ◎ | ○ | ○ | ○ | ○ |
| 709B | ◎ | ○ | ○ | ○ | ○ |

TABLE 151-continued

| Drum No. | initial charge-retentivity | photo-sensitivity | residual potential | ghost | durability |
|---|---|---|---|---|---|
| 710B | ◎ | ○ | ○ | ○ | ○ |
| 711B | ◎ | ○ | ○ | ○ | ○ |
| 712B | ◎ | ○ | ○ | ○ | ○ |
| 713B | ◎ | ○ | ○ | ○ | ○ |
| 714B | ◎ | ○ | ○ | ○ | ○ |
| 715B | ◎ | ○ | ○ | ○ | ○ |
| 716B | ◎ | ○ | ○ | ○ | ○ |
| 717B | ◎ | ○ | ○ | ○ | ○ |

◎: Excellent
○: good
Δ: practically applicable
X: practically not applicable

TABLE 152

| Drum No. | 801B | 802B | 803B | 804B | 805B |
|---|---|---|---|---|---|
| a [μm] | 25 | 50 | 50 | 12 | 12 |
| b [μm] | 0.8 | 2.5 | 0.8 | 1.5 | 0.3 |

TABLE 152 A

| Drum No. | initial charge reten-tivity | photo-sensi-tivity | residual potential | ghost | dura-bility | defec-tive image | inter-ference fringe |
|---|---|---|---|---|---|---|---|
| 801B | ○ | ○ | ○ | ○ | ◎ | ○ | ◎ |
| 802B | ○ | ○ | ○ | ○ | ◎ | ○ | ◎ |
| 803B | ○ | ○ | ○ | ○ | ◎ | ○ | ○ |
| 804B | ○ | ○ | ○ | ○ | ◎ | ○ | ◎ |
| 805B | ○ | ○ | ○ | ○ | ◎ | ○ | ○ |

◎: Excellent
○: good
Δ: practically applicable
X: practically not applicable

TABLE 153

| Drum No. | 811B | 812B | 813B | 814B | 815B |
|---|---|---|---|---|---|
| a [μm] | 30 | 40 | 50 | 70 | 100 |
| b [μm] | 0.7 | 1.0 | 1.2 | 2 | 5 |

TABLE 153 A

| Drum No. | initial charge retent-tivity | photo-sensi tivity | residual potential | ghost | dura-bility | defec-tive image | inter-ference fringe |
|---|---|---|---|---|---|---|---|
| 811B | ○ | ○ | ○ | ○ | ◎ | ◎ | ○ |
| 812B | ○ | ○ | ○ | ○ | ◎ | ◎ | ○ |
| 813B | ○ | ○ | ○ | ○ | ◎ | ◎ | ○ |
| 814B | ○ | ○ | ○ | ○ | ◎ | ◎ | ○ |
| 815B | ○ | ○ | ○ | ○ | ◎ | ◎ | ○ |

◎: Excellent
○: good
Δ: practically applicable
X : practically not applicable

TABLE 154

| Drum No. | initial charge-retentivity | photo-sensitivity | residual potential | ghost | durability |
|---|---|---|---|---|---|
| 901B | ◎ | ○ | ○ | ○ | ○ |
| 902B | ◎ | ○ | ○ | ○ | ○ |
| 903B | ◎ | ○ | ○ | ○ | ○ |
| 904B | ◎ | ○ | ○ | ○ | ○ |
| 905B | ◎ | ○ | ○ | ○ | ○ |
| 906B | ◎ | ○ | ○ | ○ | ○ |
| 907B | ◎ | ○ | ○ | ○ | ○ |
| 908B | ◎ | ○ | ○ | ○ | ○ |
| 909B | ◎ | ○ | ○ | ○ | ○ |
| 910B | ◎ | ○ | ○ | ○ | ○ |
| 911B | ◎ | ○ | ○ | ○ | ○ |

TABLE 154-continued

| Drum No. | initial charge-retentivity | photo-sensitivity | residual potential | ghost | durability |
|---|---|---|---|---|---|
| 912B | ◎ | ○ | ○ | ○ | ○ |
| 913B | ◎ | ○ | ○ | ○ | ○ |
| 914B | ◎ | ○ | ○ | ○ | ○ |
| 915B | ◎ | ○ | ○ | ○ | ○ |
| 916B | ◎ | ○ | ○ | ○ | ○ |
| 917B | ◎ | ○ | ○ | ○ | ○ |

◎: Excellent
○: good
Δ: practically applicable
X: practically not applicable

TABLE 155

| Drum No. | initial charge-retentivity | photo-sensitivity | residual potential | ghost | durability |
|---|---|---|---|---|---|
| 101C | ◎ | ○ | ○ | ○ | ○ |
| 102C | ◎ | ○ | ○ | ○ | ○ |
| 103C | ◎ | ○ | ○ | ○ | ○ |
| 104C | ◎ | ○ | ○ | ○ | ○ |
| 105C | ◎ | ○ | ○ | ○ | ○ |
| 106C | ◎ | ○ | ○ | ○ | ○ |
| 107C | ◎ | ○ | ○ | ○ | ○ |
| 108C | ◎ | ○ | ○ | ○ | ○ |
| 109C | ◎ | ○ | ○ | ○ | ○ |
| 110C | ◎ | ○ | ○ | ○ | ○ |
| 111C | ◎ | ○ | ○ | ○ | ○ |
| 112C | ◎ | ○ | ○ | ○ | ○ |
| 113C | ◎ | ○ | ○ | ○ | ○ |
| 114C | ◎ | ○ | ○ | ○ | ○ |
| 115C | ◎ | ○ | ○ | ○ | ○ |
| 116C | ◎ | ○ | ○ | ○ | ○ |
| 117C | ◎ | ○ | ○ | ○ | ○ |
| 118C | ◎ | ○ | ○ | ○ | ○ |

◎: Excellent
○: good
Δ: practically applicable
X: practically not applicable

TABLE 156

| Drum No. | initial charge-retentivity | photo-sensitivity | residual potential | ghost | durability |
|---|---|---|---|---|---|
| 201C | ○ | ○ | ○ | ○ | ○ |
| 202C | ○ | ○ | ○ | ○ | ○ |
| 203C | ○ | ○ | ○ | ○ | ○ |
| 204C | ○ | ○ | ○ | ○ | ○ |
| 205C | ○ | ○ | ○ | ○ | ○ |
| 206C | ○ | ○ | ○ | ○ | ○ |
| 207C | ○ | ○ | ○ | ○ | ○ |
| 208C | ○ | ○ | ○ | ○ | ○ |
| 209C | ○ | ○ | ○ | ○ | ○ |
| 210C | ○ | ○ | ○ | ○ | ○ |
| 211C | ○ | ○ | ○ | ○ | ○ |
| 212C | ○ | ○ | ○ | ○ | ○ |
| 213C | ○ | ○ | ○ | ○ | ○ |
| 214C | ○ | ○ | ○ | ○ | ○ |
| 215C | ○ | ○ | ○ | ○ | ○ |
| 216C | ○ | ○ | ○ | ○ | ○ |
| 217C | ○ | ○ | ○ | ○ | ○ |
| 218C | ○ | ○ | ○ | ○ | ○ |

◎: Excellent
○: good
Δ: practically applicable
X : practically not applicable

TABLE 157

| Drum No. | initial charge-retentivity | photo-sensitivity | residual potential | ghost | durability |
|---|---|---|---|---|---|
| 301C | ○ | ○ | ○ | ◎ | ○ |
| 302C | ○ | ○ | ○ | ◎ | ○ |
| 303C | ○ | ○ | ○ | ◎ | ○ |
| 304C | ○ | ○ | ○ | ◎ | ○ |

TABLE 157-continued

| Drum No. | initial charge-retentivity | photo-sensitivity | residual potential | ghost | durability |
|---|---|---|---|---|---|
| 305C | ○ | ○ | ○ | ◎ | ○ |
| 306C | ○ | ○ | ○ | ◎ | ○ |
| 307C | ○ | ○ | ○ | ◎ | ○ |
| 308C | ○ | ○ | ○ | ◎ | ○ |
| 309C | ○ | ○ | ○ | ◎ | ○ |
| 310C | ○ | ○ | ○ | ◎ | ○ |
| 311C | ○ | ○ | ○ | ◎ | ○ |
| 312C | ○ | ○ | ○ | ◎ | ○ |
| 313C | ○ | ○ | ○ | ◎ | ○ |
| 314C | ○ | ○ | ○ | ◎ | ○ |
| 315C | ○ | ○ | ○ | ◎ | ○ |
| 316C | ○ | ○ | ○ | ◎ | ○ |
| 317C | ○ | ○ | ○ | ◎ | ○ |
| 318C | ○ | ○ | ○ | ◎ | ○ |

◎: Excellent
○: good
Δ: practically applicable
X: practically not applicable

TABLE 158

| Drum No. | initial charge-retentivity | photo-sensitivity | residual potential | ghost | durability |
|---|---|---|---|---|---|
| 401C | ○ | ○ | ○ | ○ | ○ |
| 402C | ○ | ○ | ○ | ○ | ○ |
| 403C | ○ | ○ | ○ | ○ | ○ |
| 404C | ○ | ○ | ○ | ○ | ○ |
| 405C | ○ | ○ | ○ | ○ | ○ |
| 406C | ○ | ○ | ○ | ○ | ○ |
| 407C | ○ | ○ | ○ | ○ | ○ |
| 408C | ○ | ○ | ○ | ○ | ○ |
| 409C | ○ | ○ | ○ | ○ | ○ |
| 410C | ○ | ○ | ○ | ○ | ○ |
| 411C | ○ | ○ | ○ | ○ | ○ |
| 412C | ○ | ○ | ○ | ○ | ○ |
| 413C | ○ | ○ | ○ | ○ | ○ |
| 414C | ○ | ○ | ○ | ○ | ○ |
| 415C | ○ | ○ | ○ | ○ | ○ |
| 416C | ○ | ○ | ○ | ○ | ○ |
| 417C | ○ | ○ | ○ | ○ | ○ |
| 418C | ○ | ○ | ○ | ○ | ○ |

◎: Excellent
○: good
Δ: practically applicable
X: practically not applicable

TABLE 159

| Drum No. | initial charge-retentivity | photo-sensitivity | residual potential | ghost | durability |
|---|---|---|---|---|---|
| 501C | ◎ | ○ | ○ | ○ | ○ |
| 502C | ◎ | ○ | ○ | ○ | ○ |
| 503C | ◎ | ○ | ○ | ○ | ○ |
| 504C | ◎ | ○ | ○ | ○ | ○ |
| 505C | ◎ | ○ | ○ | ○ | ○ |
| 506C | ◎ | ○ | ○ | ○ | ○ |
| 507C | ◎ | ○ | ○ | ○ | ○ |
| 508C | ◎ | ○ | ○ | ○ | ○ |
| 509C | ◎ | ○ | ○ | ○ | ○ |
| 510C | ◎ | ○ | ○ | ○ | ○ |
| 511C | ◎ | ○ | ○ | ○ | ○ |
| 512C | ◎ | ○ | ○ | ○ | ○ |
| 513C | ◎ | ○ | ○ | ○ | ○ |
| 514C | ◎ | ○ | ○ | ○ | ○ |
| 515C | ◎ | ○ | ○ | ○ | ○ |
| 516C | ◎ | ○ | ○ | ○ | ○ |
| 517C | ◎ | ○ | ○ | ○ | ○ |
| 518C | ◎ | ○ | ○ | ○ | ○ |

◎: Excellent
○: good
Δ: practically applicable
X : practically not applicable

TABLE 160

| Drum No. | initial charge-retentivity | photo-sensitivity | residual potential | ghost | durability |
|---|---|---|---|---|---|
| 601C | ○ | ○ | ○ | ○ | ○ |
| 602C | ○ | ○ | ○ | ○ | ○ |
| 603C | ○ | ○ | ○ | ○ | ○ |
| 604C | ○ | ○ | ○ | ○ | ○ |
| 605C | ○ | ○ | ○ | ○ | ○ |
| 606C | ○ | ○ | ○ | ○ | ○ |
| 607C | ○ | ○ | ○ | ○ | ○ |
| 608C | ○ | ○ | ○ | ○ | ○ |
| 609C | ○ | ○ | ○ | ○ | ○ |
| 610C | ○ | ○ | ○ | ○ | ○ |
| 611C | ○ | ○ | ○ | ○ | ○ |
| 612C | ○ | ○ | ○ | ○ | ○ |
| 613C | ○ | ○ | ○ | ○ | ○ |
| 614C | ○ | ○ | ○ | ○ | ○ |
| 615C | ○ | ○ | ○ | ○ | ○ |
| 616C | ○ | ○ | ○ | ○ | ○ |
| 617C | ○ | ○ | ○ | ○ | ○ |

◎: Excellent
○: good
Δ: practically applicable
X: practically not applicable

TABLE 161

| Drum No. | 701C | 702C | 703C | 704C | 705C |
|---|---|---|---|---|---|
| a [μm] | 25 | 50 | 50 | 12 | 12 |
| b [μm] | 0.8 | 2.5 | 0.8 | 1.5 | 0.3 |

TABLE 161 A

| Drum No. | initial charge-reten-tivity | photo sensi-tivity | residual potential | ghost | dura-bility | defec-tive image | inter-ference fringe |
|---|---|---|---|---|---|---|---|
| 701C | ○ | ○ | ○ | ○ | ⊙ | ○ | ◎ |
| 702C | ○ | ○ | ○ | ○ | ⊙ | ○ | ◎ |
| 703C | ○ | ○ | ○ | ○ | ○ | ○ | ○ |
| 704C | ○ | ○ | ○ | ○ | ⊙ | ○ | ◎ |
| 705C | ○ | ○ | ○ | ○ | ⊙ | ○ | ○ |

◎: Excellent
○: good
Δ: practically applicable
X: practically not applicable

TABLE 162

| Drum No. | 711C | 712C | 713C | 714C | 715C |
|---|---|---|---|---|---|
| a [μm] | 30 | 40 | 50 | 70 | 100 |
| b [μm] | 0.7 | 1.0 | 1.2 | 2 | 5 |

TABLE 162 A

| Drum No. | initial charge-reten-tivity | photo sensi-tivity | residual potential | ghost | dura-bility | defec-tive image | inter-ference fringe |
|---|---|---|---|---|---|---|---|
| 711C | ○ | ○ | ○ | ○ | ⊙ | ◎ | ⊙ |
| 712C | ○ | ○ | ○ | ○ | ○ | ◎ | ◎ |
| 713C | ○ | ○ | ○ | ○ | ○ | ◎ | ◎ |
| 714C | ○ | ○ | ○ | ○ | ○ | ◎ | ⊙ |
| 715C | ○ | ○ | ○ | ○ | ⊙ | ◎ | ○ |

◎: Excellent
○: good
Δ: practically applicable
X : practically not applicable

TABLE 163

| Drum No. | initial charge-retentivity | photo-sensitivity | residual potential | ghost | durability |
|---|---|---|---|---|---|
| 801C | ⊙ | ○ | ○ | ○ | ○ |
| 802C | ⊙ | ○ | ○ | ○ | ○ |

TABLE 163-continued

| Drum No. | initial charge-retentivity | photo-sensitivity | residual potential | ghost | durability |
|---|---|---|---|---|---|
| 803C | ○ | ○ | ○ | ○ | ○ |
| 804C | ○ | ○ | ○ | ○ | ○ |
| 805C | ○ | ○ | ○ | ○ | ○ |
| 806C | ○ | ○ | ○ | ○ | ○ |
| 807C | ○ | ○ | ○ | ○ | ○ |
| 808C | ○ | ○ | ○ | ○ | ○ |
| 809C | ○ | ○ | ○ | ○ | ○ |
| 810C | ○ | ○ | ○ | ○ | ○ |
| 811C | ○ | ○ | ○ | ○ | ○ |
| 812C | ○ | ○ | ○ | ○ | ○ |
| 813C | ○ | ○ | ○ | ○ | ○ |
| 814C | ○ | ○ | ○ | ○ | ○ |
| 815C | ○ | ○ | ○ | ○ | ○ |
| 816C | ○ | ○ | ○ | ○ | ○ |
| 817C | ○ | ○ | ○ | ○ | ○ |

◎: Excellent
○: good
Δ: practically applicable
X : practically not applicable

TABLE 164

| Drum No. | initial charge-retentivity | photo-sensitivity | residual potential | ghost | durability |
|---|---|---|---|---|---|
| 101D | ○ | ○ | Δ | ○ | ◎ |
| 102D | ○ | ○ | Δ | ○ | ◎ |
| 103D | ○ | ○ | Δ | ○ | ◎ |
| 104D | ○ | ○ | Δ | ○ | ◎ |
| 105D | ○ | ○ | Δ | ○ | ◎ |
| 106D | ○ | ○ | Δ | ○ | ◎ |
| 107D | ○ | ○ | Δ | ○ | ◎ |
| 108D | ○ | ○ | Δ | ○ | ◎ |
| 109D | ○ | ○ | Δ | ○ | ◎ |
| 110D | ○ | ○ | Δ | ○ | ◎ |
| 111D | ○ | ○ | Δ | ○ | ◎ |
| 112D | ○ | ○ | Δ | ○ | ◎ |
| 113D | ○ | ○ | Δ | ○ | ◎ |
| 114D | ○ | ○ | Δ | ○ | ◎ |
| 115D | ○ | ○ | Δ | ○ | ◎ |
| 116D | ○ | ○ | Δ | ○ | ◎ |
| 117D | ○ | ○ | Δ | ○ | ◎ |
| 118D | ○ | ○ | Δ | ○ | ◎ |

◎: Excellent
○: good
Δ: practically applicable
X: practically not applicable

TABLE 165

| Drum No. | initial charge-retentivity | photo-sensitivity | residual potential | ghost | durability |
|---|---|---|---|---|---|
| 201D | ○ | ○ | ○ | ○ | ◎ |
| 202D | ○ | ○ | ○ | ○ | ◎ |
| 203D | ○ | ○ | ○ | ○ | ◎ |
| 204D | ○ | ○ | ○ | ○ | ◎ |
| 205D | ○ | ○ | ○ | ○ | ◎ |
| 206D | ○ | ○ | ○ | ○ | ◎ |
| 207D | ○ | ○ | ○ | ○ | ◎ |
| 208D | ○ | ○ | ○ | ○ | ◎ |
| 209D | ○ | ○ | ○ | ○ | ◎ |
| 210D | ○ | ○ | ○ | ○ | ◎ |
| 211D | ○ | ○ | ○ | ○ | ◎ |
| 212D | ○ | ○ | ○ | ○ | ◎ |
| 213D | ○ | ○ | ○ | ○ | ◎ |
| 214D | ○ | ○ | ○ | ○ | ◎ |
| 215D | ○ | ○ | ○ | ○ | ◎ |
| 216D | ○ | ○ | ○ | ○ | ◎ |
| 217D | ○ | ○ | ○ | ○ | ◎ |
| 218D | ○ | ○ | ○ | ○ | ◎ |

◎: Excellent
○: good
Δ: practically applicable
X : practically not applicable

TABLE 166

| Drum No. | initial charge-retentivity | photo-sensitivity | residual potential | ghost | durability |
|---|---|---|---|---|---|
| 301D | ○ | ○ | ○ | ○ | ◎ |
| 302D | ○ | ○ | ○ | ○ | ◎ |
| 303D | ○ | ○ | ○ | ○ | ◎ |
| 304D | ○ | ○ | ○ | ○ | ◎ |
| 305D | ○ | ○ | ○ | ○ | ◎ |
| 306D | ○ | ○ | ○ | ○ | ◎ |
| 307D | ○ | ○ | ○ | ○ | ◎ |
| 308D | ○ | ○ | ○ | ○ | ◎ |
| 309D | ○ | ○ | ○ | ○ | ◎ |
| 310D | ○ | ○ | ○ | ○ | ◎ |
| 311D | ○ | ○ | ○ | ○ | ◎ |
| 312D | ○ | ○ | ○ | ○ | ◎ |
| 313D | ○ | ○ | ○ | ○ | ◎ |
| 314D | ○ | ○ | ○ | ○ | ◎ |
| 315D | ○ | ○ | ○ | ○ | ◎ |
| 316D | ○ | ○ | ○ | ○ | ◎ |
| 317D | ○ | ○ | ○ | ○ | ◎ |
| 318D | ○ | ○ | ○ | ○ | ◎ |

◎: Excellent
○: good
Δ: practically applicable
X: practically not applicable

TABLE 167

| Drum No. | initial charge-retentivity | photo-sensitivity | residual potential | ghost | durability |
|---|---|---|---|---|---|
| 401D | ○ | ○ | ○ | ○ | ◎ |
| 402D | ○ | ○ | ○ | ○ | ◎ |
| 403D | ○ | ○ | ○ | ○ | ◎ |
| 404D | ○ | ○ | ○ | ○ | ◎ |
| 405D | ○ | ○ | ○ | ○ | ◎ |
| 406D | ○ | ○ | ○ | ○ | ◎ |
| 407D | ○ | ○ | ○ | ○ | ◎ |
| 408D | ○ | ○ | ○ | ○ | ◎ |
| 409D | ○ | ○ | ○ | ○ | ◎ |
| 410D | ○ | ○ | ○ | ○ | ◎ |
| 411D | ○ | ○ | ○ | ○ | ◎ |
| 412D | ○ | ○ | ○ | ○ | ◎ |
| 413D | ○ | ○ | ○ | ○ | ◎ |
| 414D | ○ | ○ | ○ | ○ | ◎ |
| 415D | ○ | ○ | ○ | ○ | ◎ |
| 416D | ○ | ○ | ○ | ○ | ◎ |
| 417D | ○ | ○ | ○ | ○ | ◎ |
| 418D | ○ | ○ | ○ | ○ | ◎ |

◎: Excellent
○: good
Δ: practically applicable
X: practically not applicable

TABLE 168

| Drum No. | initial charge-retentivity | photo-sensitivity | residual potential | ghost | durability |
|---|---|---|---|---|---|
| 501D | ○ | ○ | ○ | ○ | ◎ |
| 502D | ○ | ○ | ○ | ○ | ◎ |
| 503D | ○ | ○ | ○ | ○ | ◎ |
| 504D | ○ | ○ | ○ | ○ | ◎ |
| 505D | ○ | ○ | ○ | ○ | ◎ |
| 506D | ○ | ○ | ○ | ○ | ◎ |
| 507D | ○ | ○ | ○ | ○ | ◎ |
| 508D | ○ | ○ | ○ | ○ | ◎ |
| 509D | ○ | ○ | ○ | ○ | ◎ |
| 510D | ○ | ○ | ○ | ○ | ◎ |
| 511D | ○ | ○ | ○ | ○ | ◎ |
| 512D | ○ | ○ | ○ | ○ | ◎ |
| 513D | ○ | ○ | ○ | ○ | ◎ |
| 514D | ○ | ○ | ○ | ○ | ◎ |
| 515D | ○ | ○ | ○ | ○ | ◎ |
| 516D | ○ | ○ | ○ | ○ | ◎ |
| 517D | ○ | ○ | ○ | ○ | ◎ |

TABLE 168-continued

| Drum No. | initial charge-retentivity | photo-sensitivity | residual potential | ghost | durability |
|---|---|---|---|---|---|
| 518D | ○ | ○ | ○ | ○ | ◎ |

◎: Excellent
○: good
Δ: practically applicable
X: practically not applicable

TABLE 169

| Name of layer | Gas used & its flowrate (SCCM) | | Substrate temperature (°C.) | RF power (W) | Internal pressure (Torr) | Layer thickness (μm) |
|---|---|---|---|---|---|---|
| CGL/CTL | Combination as shown in Table 57 | | | | | |
| Surface layer | $SiH_4$ | 10 | 250 | 200 | 0.4 | 2 |
| | $N_2$ | 500 | | | | |
| | $C_2H_2$ | 20 | | | | |

TABLE 170

| Drum No. | initial charge-retentivity | photo-sensitivity | residual potential | ghost | durability |
|---|---|---|---|---|---|
| 601D | ○ | ○ | ○ | ○ | ◎ |
| 602D | ○ | ○ | ○ | ○ | ◎ |
| 603D | ○ | ○ | ○ | ○ | ◎ |
| 604D | ○ | ○ | ○ | ○ | ◎ |
| 605D | ○ | ○ | ○ | ○ | ◎ |
| 606D | ○ | ○ | ○ | ○ | ◎ |
| 607D | ○ | ○ | ○ | ○ | ◎ |
| 608D | ○ | ○ | ○ | ○ | ◎ |
| 609D | ○ | ○ | ○ | ○ | ◎ |
| 610D | ○ | ○ | ○ | ○ | ◎ |
| 611D | ○ | ○ | ○ | ○ | ◎ |
| 612D | ○ | ○ | ○ | ○ | ◎ |
| 613D | ○ | ○ | ○ | ○ | ◎ |
| 614D | ○ | ○ | ○ | ○ | ◎ |
| 615D | ○ | ○ | ○ | ○ | ◎ |
| 616D | ○ | ○ | ○ | ○ | ◎ |
| 617D | ○ | ○ | ○ | ○ | ◎ |
| 618D | ○ | ○ | ○ | ○ | ◎ |

◎: Excellent
○: good
Δ: practically applicable
X : practically not applicable

TABLE 171

| Drum No. | initial charge-retentivity | photo-sensitivity | residual potential | ghost | durability |
|---|---|---|---|---|---|
| 701D | ○ | ○ | ○ | ◎ | ◎ |
| 702D | ○ | ○ | ○ | ◎ | ◎ |
| 703D | ○ | ○ | ○ | ◎ | ◎ |
| 704D | ○ | ○ | ○ | ◎ | ◎ |
| 705D | ○ | ○ | ○ | ◎ | ◎ |
| 706D | ○ | ○ | ○ | ◎ | ◎ |
| 707D | ○ | ○ | ○ | ◎ | ◎ |
| 708D | ○ | ○ | ○ | ◎ | ◎ |
| 709D | ○ | ○ | ○ | ◎ | ◎ |
| 710D | ○ | ○ | ○ | ◎ | ◎ |
| 711D | ○ | ○ | ○ | ◎ | ◎ |
| 712D | ○ | ○ | ○ | ◎ | ◎ |
| 713D | ○ | ○ | ○ | ◎ | ◎ |
| 714D | ○ | ○ | ○ | ◎ | ◎ |
| 715D | ○ | ○ | ○ | ◎ | ◎ |
| 716D | ○ | ○ | ○ | ◎ | ◎ |
| 717D | ○ | ○ | ○ | ◎ | ◎ |

TABLE 171-continued

| Drum No. | initial charge-retentivity | photo-sensitivity | residual potential | ghost | durability |
|---|---|---|---|---|---|
| 718D | ○ | ○ | ○ | ◎ | ◎ |

◎: Excellent
○: good
Δ: practically applicable
X: practically not applicable

TABLE 172

| Drum No. | initial charge-retentivity | photo-sensitivity | residual potential | ghost | durability |
|---|---|---|---|---|---|
| 801D | ○ | ○ | ○ | ○ | ◎ |
| 802D | ○ | ○ | ○ | ○ | ◎ |
| 803D | ○ | ○ | ○ | ○ | ◎ |
| 804D | ○ | ○ | ○ | ○ | ◎ |
| 805D | ○ | ○ | ○ | ○ | ◎ |
| 806D | ○ | ○ | ○ | ○ | ◎ |
| 807D | ○ | ○ | ○ | ○ | ◎ |
| 808D | ○ | ○ | ○ | ○ | ◎ |
| 809D | ○ | ○ | ○ | ○ | ◎ |
| 810D | ○ | ○ | ○ | ○ | ◎ |
| 811D | ○ | ○ | ○ | ○ | ◎ |
| 812D | ○ | ○ | ○ | ○ | ◎ |
| 813D | ○ | ○ | ○ | ○ | ◎ |
| 814D | ○ | ○ | ○ | ○ | ◎ |
| 815D | ○ | ○ | ○ | ○ | ◎ |
| 816D | ○ | ○ | ○ | ○ | ◎ |
| 817D | ○ | ○ | ○ | ○ | ◎ |
| 818D | ○ | ○ | ○ | ○ | ◎ |

◎: Excellent
○: good
Δ: practically applicable
X: practically not applicable

TABLE 173

| Drum No. | initial charge-retentivity | photo-sensitivity | residual potential | ghost | durability |
|---|---|---|---|---|---|
| 901D | ○ | ○ | ○ | ○ | ◎ |
| 902D | ○ | ○ | ○ | ○ | ◎ |
| 903D | ○ | ○ | ○ | ○ | ◎ |
| 904D | ○ | ○ | ○ | ○ | ◎ |
| 905D | ○ | ○ | ○ | ○ | ◎ |
| 906D | ○ | ○ | ○ | ○ | ◎ |
| 907D | ○ | ○ | ○ | ○ | ◎ |
| 908D | ○ | ○ | ○ | ○ | ◎ |
| 909D | ○ | ○ | ○ | ○ | ◎ |
| 910D | ○ | ○ | ○ | ○ | ◎ |
| 911D | ○ | ○ | ○ | ○ | ◎ |
| 912D | ○ | ○ | ○ | ○ | ◎ |
| 913D | ○ | ○ | ○ | ○ | ◎ |
| 914D | ○ | ○ | ○ | ○ | ◎ |
| 915D | ○ | ○ | ○ | ○ | ◎ |
| 916D | ○ | ○ | ○ | ○ | ◎ |
| 917D | ○ | ○ | ○ | ○ | ◎ |
| 918D | ○ | ○ | ○ | ○ | ◎ |

◎: Excellent
○: good
Δ: practically applicable
X: practically not applicable

TABLE 174

| Drum No. | 1001D | 1002D | 1003D | 1004D | 1005D |
|---|---|---|---|---|---|
| a [μm] | 25 | 50 | 50 | 12 | 12 |
| b [μm] | 0.8 | 2.5 | 0.8 | 1.5 | 0.3 |

TABLE 174 A

| Drum No. | initial charge-reten-tivity | photo-sensi-tivity | residual potential | ghost | dura-bility | defec-tive image | inter-ference fringe |
|---|---|---|---|---|---|---|---|
| 1001D | ○ | ○ | ○ | ○ | ◎ | ○ | ◎ |
| 1002D | ○ | ○ | ○ | ○ | ◎ | ○ | ◎ |
| 1003D | ○ | ○ | ○ | ○ | ◎ | ○ | ○ |
| 1004D | ○ | ○ | ○ | ○ | ◎ | ○ | ◎ |
| 1005D | ○ | ○ | ○ | ○ | ◎ | ○ | ○ |

◎: Excellent
○: good
Δ: practically applicable
X: practically not applicable

TABLE 175

| Drum No. | 1011D | 1012D | 1013D | 1014D | 1015D |
|---|---|---|---|---|---|
| a [μm] | 30 | 40 | 50 | 70 | 100 |
| b [μm] | 0.7 | 1.0 | 1.2 | 2 | 5 |

TABLE 175 A

| Drum No. | initial charge-reten-tivity | photo-sensi-tivity | residual potential | ghost | dura-bility | defec-tive image | inter-ference fringe |
|---|---|---|---|---|---|---|---|
| 1011D | ○ | ○ | ○ | ○ | ◎ | ◎ | ○ |
| 1012D | ○ | ○ | ○ | ○ | ◎ | ◎ | ◎ |
| 1013D | ○ | ○ | ○ | ○ | ◎ | ◎ | ◎ |
| 1014D | ○ | ○ | ○ | ○ | ◎ | ◎ | ○ |
| 1015D | ○ | ○ | ○ | ○ | ◎ | ◎ | ○ |

◎: Excellent
○: good
Δ: practically applicable
X: practically not applicable

TABLE 176

| Drum No. | initial charge-retentivity | photo-sensitivity | residual potential | ghost | durability |
|---|---|---|---|---|---|
| 1101D | ○ | ○ | ○ | ○ | ◎ |
| 1102D | ○ | ○ | ○ | ○ | ◎ |
| 1103D | ○ | ○ | ○ | ○ | ◎ |
| 1104D | ○ | ○ | ○ | ○ | ◎ |
| 1105D | ○ | ○ | ○ | ○ | ◎ |
| 1106D | ○ | ○ | ○ | ○ | ◎ |
| 1107D | ○ | ○ | ○ | ○ | ◎ |
| 1108D | ○ | ○ | ○ | ○ | ◎ |
| 1109D | ○ | ○ | ○ | ○ | ◎ |
| 1110D | ○ | ○ | ○ | ○ | ◎ |
| 1111D | ○ | ○ | ○ | ○ | ◎ |
| 1112D | ○ | ○ | ○ | ○ | ◎ |
| 1113D | ○ | ○ | ○ | ○ | ◎ |
| 1114D | ○ | ○ | ○ | ○ | ◎ |
| 1115D | ○ | ○ | ○ | ○ | ◎ |
| 1116D | ○ | ○ | ○ | ○ | ◎ |
| 1117D | ○ | ○ | ○ | ○ | ◎ |

◎: Excellent
○: good
Δ: practically applicable
X : practically not applicable

TABLE 177

| Drum No. | initial charge-retentivity | photo-sensitivity | residual potential | ghost | durability |
|---|---|---|---|---|---|
| 101E | ◎ | ○ | Δ | ○ | ◎ |
| 102E | ◎ | ○ | Δ | ○ | ◎ |
| 103E | ◎ | ○ | Δ | ○ | ◎ |
| 104E | ◎ | ○ | Δ | ○ | ◎ |
| 105E | ◎ | ○ | Δ | ○ | ◎ |
| 106E | ◎ | ○ | Δ | ○ | ◎ |
| 107E | ◎ | ○ | Δ | ○ | ◎ |
| 108E | ◎ | ○ | Δ | ○ | ◎ |
| 109E | ◎ | ○ | Δ | ○ | ◎ |

TABLE 177-continued

| Drum No. | initial charge-retentivity | photo-sensitivity | residual potential | ghost | durability |
|---|---|---|---|---|---|
| 110E | ◎ | ○ | Δ | ○ | ◎ |
| 111E | ◎ | ○ | Δ | ○ | ◎ |
| 112E | ◎ | ○ | Δ | ○ | ◎ |
| 113E | ◎ | ○ | Δ | ○ | ◎ |
| 114E | ◎ | ○ | Δ | ○ | ◎ |
| 115E | ◎ | ○ | Δ | ○ | ◎ |
| 116E | ◎ | ○ | Δ | ○ | ◎ |
| 117E | ◎ | ○ | Δ | ○ | ◎ |
| 118E | ◎ | ○ | Δ | ○ | ◎ |

◎: Excellent
○: good
Δ: practically applicable
X: practically not applicable

TABLE 178

| Drum No. | initial charge-retentivity | photo-sensitivity | residual potential | ghost | durability |
|---|---|---|---|---|---|
| 201E | ◎ | ○ | Δ | ○ | ◎ |
| 202E | ◎ | ○ | Δ | ○ | ◎ |
| 203E | ◎ | ○ | Δ | ○ | ◎ |
| 204E | ◎ | ○ | Δ | ○ | ◎ |
| 205E | ◎ | ○ | Δ | ○ | ◎ |
| 206E | ◎ | ○ | Δ | ○ | ◎ |
| 207E | ◎ | ○ | Δ | ○ | ◎ |
| 208E | ◎ | ○ | Δ | ○ | ◎ |
| 209E | ◎ | ○ | Δ | ○ | ◎ |
| 210E | ◎ | ○ | Δ | ○ | ◎ |
| 211E | ◎ | ○ | Δ | ○ | ◎ |
| 212E | ◎ | ○ | Δ | ○ | ◎ |
| 213E | ◎ | ○ | Δ | ○ | ◎ |
| 214E | ◎ | ○ | Δ | ○ | ◎ |
| 215E | ◎ | ○ | Δ | ○ | ◎ |
| 216E | ◎ | ○ | Δ | ○ | ◎ |
| 217E | ◎ | ○ | Δ | ○ | ◎ |
| 218E | ◎ | ○ | Δ | ○ | ◎ |

◎: Excellent
○: good
Δ: practically applicable
X: practically not applicable

TABLE 179

| Drum No. | initial charge-retentivity | photo-sensitivity | residual potential | ghost | durability |
|---|---|---|---|---|---|
| 301E | ◎ | ○ | Δ | ○ | ◎ |
| 302E | ◎ | ○ | Δ | ○ | ◎ |
| 303E | ◎ | ○ | Δ | ○ | ◎ |
| 304E | ◎ | ○ | Δ | ○ | ◎ |
| 305E | ◎ | ○ | Δ | ○ | ◎ |
| 306E | ◎ | ○ | Δ | ○ | ◎ |
| 307E | ◎ | ○ | Δ | ○ | ◎ |
| 308E | ◎ | ○ | Δ | ○ | ◎ |
| 309E | ◎ | ○ | Δ | ○ | ◎ |
| 310E | ◎ | ○ | Δ | ○ | ◎ |
| 311E | ◎ | ○ | Δ | ○ | ◎ |
| 312E | ◎ | ○ | Δ | ○ | ◎ |
| 313E | ◎ | ○ | Δ | ○ | ◎ |
| 314E | ◎ | ○ | Δ | ○ | ◎ |
| 315E | ◎ | ○ | Δ | ○ | ◎ |
| 316E | ◎ | ○ | Δ | ○ | ◎ |
| 317E | ◎ | ○ | Δ | ○ | ◎ |
| 318E | ◎ | ○ | Δ | ○ | ◎ |

◎: Excellent
○: good
Δ: practically applicable
X : practically not applicable

TABLE 180

| Drum No. | initial charge-retentivity | photo-sensitivity | residual potential | ghost | durability |
|---|---|---|---|---|---|
| 401E | ◎ | ○ | ○ | ○ | ◎ |

TABLE 180-continued

| Drum No. | initial charge-retentivity | photo-sensitivity | residual potential | ghost | durability |
|---|---|---|---|---|---|
| 402E | ◎ | ○ | ○ | ○ | ◎ |
| 403E | ◎ | ○ | ○ | ○ | ◎ |
| 404E | ◎ | ○ | ○ | ○ | ◎ |
| 405E | ◎ | ○ | ○ | ○ | ◎ |
| 406E | ◎ | ○ | ○ | ○ | ◎ |
| 407E | ◎ | ○ | ○ | ○ | ◎ |
| 408E | ◎ | ○ | ○ | ○ | ◎ |
| 409E | ◎ | ○ | ○ | ○ | ◎ |
| 410E | ◎ | ○ | ○ | ○ | ◎ |
| 411E | ◎ | ○ | ○ | ○ | ◎ |
| 412E | ◎ | ○ | ○ | ○ | ◎ |
| 413E | ◎ | ○ | ○ | ○ | ◎ |
| 414E | ◎ | ○ | ○ | ○ | ◎ |
| 415E | ◎ | ○ | ○ | ○ | ◎ |
| 416E | ◎ | ○ | ○ | ○ | ◎ |
| 417E | ◎ | ○ | ○ | ○ | ◎ |
| 418E | ◎ | ○ | ○ | ○ | ◎ |

◎: Excellent
○: goed
Δ: practically applicable
X: practically not applicable

TABLE 181

| Drum No. | initial charge-retentivity | photo-sensitivity | residual potential | ghost | durability |
|---|---|---|---|---|---|
| 501E | ◎ | ○ | ○ | ○ | ◎ |
| 502E | ◎ | ○ | ○ | ○ | ◎ |
| 503E | ◎ | ○ | ○ | ○ | ◎ |
| 504E | ◎ | ○ | ○ | ○ | ◎ |
| 505E | ◎ | ○ | ○ | ○ | ◎ |
| 506E | ◎ | ○ | ○ | ○ | ◎ |
| 507E | ◎ | ○ | ○ | ○ | ◎ |
| 508E | ◎ | ○ | ○ | ○ | ◎ |
| 509E | ◎ | ○ | ○ | ○ | ◎ |
| 510E | ◎ | ○ | ○ | ○ | ◎ |
| 511E | ◎ | ○ | ○ | ○ | ◎ |
| 512E | ◎ | ○ | ○ | ○ | ◎ |
| 513E | ◎ | ○ | ○ | ○ | ◎ |
| 514E | ◎ | ○ | ○ | ○ | ◎ |
| 515E | ◎ | ○ | ○ | ○ | ◎ |
| 516E | ◎ | ○ | ○ | ○ | ◎ |
| 517E | ◎ | ○ | ○ | ○ | ◎ |
| 518E | ◎ | ○ | ○ | ○ | ◎ |

◎: Excellent
○: good
Δ: practically applicable
X: practically not applicable

TABLE 182

| Drum No. | initial charge-retentivity | photo-sensitivity | residual potential | ghost | durability |
|---|---|---|---|---|---|
| 601E | ◎ | ○ | ○ | ○ | ◎ |
| 602E | ◎ | ○ | ○ | ○ | ◎ |
| 603E | ◎ | ○ | ○ | ○ | ◎ |
| 604E | ◎ | ○ | ○ | ○ | ◎ |
| 605E | ◎ | ○ | ○ | ○ | ◎ |
| 606E | ◎ | ○ | ○ | ○ | ◎ |
| 607E | ◎ | ○ | ○ | ○ | ◎ |
| 608E | ◎ | ○ | ○ | ○ | ◎ |
| 609E | ◎ | ○ | ○ | ○ | ◎ |
| 610E | ◎ | ○ | ○ | ○ | ◎ |
| 611E | ◎ | ○ | ○ | ○ | ◎ |
| 612E | ◎ | ○ | ○ | ○ | ◎ |
| 613E | ◎ | ○ | ○ | ○ | ◎ |
| 614E | ◎ | ○ | ○ | ○ | ◎ |
| 615E | ◎ | ○ | ○ | ○ | ◎ |
| 616E | ◎ | ○ | ○ | ○ | ◎ |
| 617E | ◎ | ○ | ○ | ○ | ◎ |

TABLE 182-continued

| Drum No. | initial charge-retentivity | photo-sensitivity | residual potential | ghost | durability |
|---|---|---|---|---|---|
| 618E | ◎ | ○ | ○ | ○ | ◎ |

◎: Excellent
○: good
Δ: practically applicable
X : practically not applicable

TABLE 183

| Drum No. | initial charge-retentivity | photo-sensitivity | residual potential | ghost | durability |
|---|---|---|---|---|---|
| 701E | ◎ | ○ | ○ | ○ | ◎ |
| 702E | ◎ | ○ | ○ | ○ | ◎ |
| 703E | ◎ | ○ | ○ | ○ | ◎ |
| 704E | ◎ | ○ | ○ | ○ | ◎ |
| 705E | ◎ | ○ | ○ | ○ | ◎ |
| 706E | ◎ | ○ | ○ | ○ | ◎ |
| 707E | ◎ | ○ | ○ | ○ | ◎ |
| 708E | ◎ | ○ | ○ | ○ | ◎ |
| 709E | ◎ | ○ | ○ | ○ | ◎ |
| 710E | ◎ | ○ | ○ | ○ | ◎ |
| 711E | ◎ | ○ | ○ | ○ | ◎ |
| 712E | ◎ | ○ | ○ | ○ | ◎ |
| 713E | ◎ | ○ | ○ | ○ | ◎ |
| 714E | ◎ | ○ | ○ | ○ | ◎ |
| 715E | ◎ | ○ | ○ | ○ | ◎ |
| 716E | ◎ | ○ | ○ | ○ | ◎ |
| 717E | ◎ | ○ | ○ | ○ | ◎ |
| 718E | ◎ | ○ | ○ | ○ | ◎ |

◎: Excellent
○: good
Δ: practically applicable
X : practically not applicable

TABLE 184

| Drum No. | initial charge-retentivity | photo sensitivity | residual potential | ghost | durability |
|---|---|---|---|---|---|
| 801E | ◎ | ○ | ○ | ○ | ◎ |
| 802E | ◎ | ○ | ○ | ○ | ◎ |
| 803E | ◎ | ○ | ○ | ○ | ◎ |
| 804E | ◎ | ○ | ○ | ○ | ◎ |
| 805E | ◎ | ○ | ○ | ○ | ◎ |
| 806E | ◎ | ○ | ○ | ○ | ◎ |
| 807E | ◎ | ○ | ○ | ○ | ◎ |
| 808E | ◎ | ○ | ○ | ○ | ◎ |
| 809E | ◎ | ○ | ○ | ○ | ◎ |
| 810E | ◎ | ○ | ○ | ○ | ◎ |
| 811E | ◎ | ○ | ○ | ○ | ◎ |
| 812E | ◎ | ○ | ○ | ○ | ◎ |
| 813E | ◎ | ○ | ○ | ○ | ◎ |
| 814E | ◎ | ○ | ○ | ○ | ◎ |
| 815E | ◎ | ○ | ○ | ○ | ◎ |
| 816E | ◎ | ○ | ○ | ○ | ◎ |
| 817E | ◎ | ○ | ○ | ○ | ◎ |
| 818E | ◎ | ○ | ○ | ○ | ◎ |

◎: Excellent
○: good
Δ: practically applicable
X: practically not applicable

TABLE 185

| Drum No. | initial charge-retentivity | photo-sensitivity | residual potential | ghost | durability |
|---|---|---|---|---|---|
| 901E | ◎ | ○ | ○ | ○ | ◎ |
| 902E | ◎ | ○ | ○ | ○ | ◎ |
| 903E | ◎ | ○ | ○ | ○ | ◎ |
| 904E | ◎ | ○ | ○ | ○ | ◎ |
| 905E | ◎ | ○ | ○ | ○ | ◎ |
| 906E | ◎ | ○ | ○ | ○ | ◎ |
| 907E | ◎ | ○ | ○ | ○ | ◎ |
| 908E | ◎ | ○ | ○ | ○ | ◎ |
| 909E | ◎ | ○ | ○ | ○ | ◎ |

TABLE 185-continued

| Drum No. | initial charge-retentivity | photo-sensitivity | residual potential | ghost | durability |
|---|---|---|---|---|---|
| 910E | ◎ | ○ | ○ | ○ | ◎ |
| 911E | ◎ | ○ | ○ | ○ | ◎ |
| 912E | ◎ | ○ | ○ | ○ | ◎ |
| 913E | ◎ | ○ | ○ | ○ | ◎ |
| 914E | ◎ | ○ | ○ | ○ | ◎ |
| 915E | ◎ | ○ | ○ | ○ | ◎ |
| 916E | ◎ | ○ | ○ | ○ | ◎ |
| 917E | ◎ | ○ | ○ | ○ | ◎ |
| 918E | ◎ | ○ | ○ | ○ | ◎ |

◎: Excellent
○: good
Δ: practically applicable
X: practically not applicable

TABLE 186

| Drum No. | initial charge-retentivity | photo-sensitivity | residual potential | ghost | durability |
|---|---|---|---|---|---|
| 1001E | ◎ | ○ | ◎ | ○ | ◎ |
| 1002E | ◎ | ○ | ◎ | ○ | ◎ |
| 1003E | ◎ | ○ | ◎ | ○ | ◎ |
| 1004E | ◎ | ○ | ◎ | ○ | ◎ |
| 1005E | ◎ | ○ | ◎ | ○ | ◎ |
| 1006E | ◎ | ○ | ◎ | ○ | ◎ |
| 1007E | ◎ | ○ | ◎ | ○ | ◎ |
| 1008E | ◎ | ○ | ◎ | ○ | ◎ |
| 1009E | ◎ | ○ | ◎ | ○ | ◎ |
| 1010E | ◎ | ○ | ◎ | ○ | ◎ |
| 1011E | ◎ | ○ | ◎ | ○ | ◎ |
| 1012E | ◎ | ○ | ◎ | ○ | ◎ |
| 1013E | ◎ | ○ | ◎ | ○ | ◎ |
| 1014E | ◎ | ○ | ◎ | ○ | ◎ |
| 1015E | ◎ | ○ | ◎ | ○ | ◎ |
| 1016E | ◎ | ○ | ◎ | ○ | ◎ |
| 1017E | ◎ | ○ | ◎ | ○ | ◎ |
| 1018E | ◎ | ○ | ◎ | ○ | ◎ |

◎: Excellent
○: good
Δ: practically applicable
X: practically not applicable

TABLE 188-continued

| Drum No. | initial charge-retentivity | photo-sensitivity | residual potential | ghost | durability |
|---|---|---|---|---|---|
| 1307E | ◎ | ○ | ◎ | ○ | ◎ |
| 1308E | ◎ | ○ | ◎ | ○ | ◎ |
| 1309E | ◎ | ○ | ◎ | ○ | ◎ |
| 1310E | ◎ | ○ | ◎ | ○ | ◎ |
| 1311E | ◎ | ○ | ◎ | ○ | ◎ |
| 1312E | ◎ | ○ | ◎ | ○ | ◎ |
| 1313E | ◎ | ○ | ◎ | ○ | ◎ |
| 1314E | ◎ | ○ | ◎ | ○ | ◎ |
| 1315E | ◎ | ○ | ◎ | ○ | ◎ |
| 1316E | ◎ | ○ | ◎ | ○ | ◎ |
| 1317E | ◎ | ○ | ◎ | ○ | ◎ |
| 1318E | ◎ | ○ | ◎ | ○ | ◎ |

◎: Excellent
○: good
Δ: practically applicable
X: practically not applicable

TABLE 189

| Drum No. | initial charge-retentivity | photo-sensitivity | residual potential | ghost | durability |
|---|---|---|---|---|---|
| 1401E | ◎ | ○ | ◎ | ○ | ◎ |
| 1402E | ◎ | ○ | ◎ | ○ | ◎ |
| 1403E | ◎ | ○ | ◎ | ○ | ◎ |
| 1404E | ◎ | ○ | ◎ | ○ | ◎ |
| 1405E | ◎ | ○ | ◎ | ○ | ◎ |
| 1406E | ◎ | ○ | ◎ | ○ | ◎ |
| 1407E | ◎ | ○ | ◎ | ○ | ◎ |
| 1408E | ◎ | ○ | ◎ | ○ | ◎ |
| 1409E | ◎ | ○ | ◎ | ○ | ◎ |
| 1410E | ◎ | ○ | ◎ | ○ | ◎ |
| 1411E | ◎ | ○ | ◎ | ○ | ◎ |
| 1412E | ◎ | ○ | ◎ | ○ | ◎ |
| 1413E | ◎ | ○ | ◎ | ○ | ◎ |
| 1414E | ◎ | ○ | ◎ | ○ | ◎ |
| 1415E | ◎ | ○ | ◎ | ○ | ◎ |
| 1416E | ◎ | ○ | ◎ | ○ | ◎ |
| 1417E | ◎ | ○ | ◎ | ○ | ◎ |
| 1418E | ◎ | ○ | ◎ | ○ | ◎ |

◎: Excellent
○: good

TABLE 187

| Name of layer | Gas used & its flow rate (SCCM) | | Substrate temperature (°C.) | RF power (W) | Internal pressure (Torr) | Layer thickness (μm) |
|---|---|---|---|---|---|---|
| Charge injection inhibition layer | $SiH_4$ | 100 | 250 | 150 | 0.35 | 3 |
| | $SiF_4$ | 50 | | | | |
| | $PH_3$ (against $SiH_4$) | | | | | |
| | (substrate side 2 μm) | 800 ppm | | | | |
| | (surface side 1 μm) | 800 → 0 ppm | | | | |
| | (constantly decrease) | | | | | |
| | NO (substrate side 2 μm) | 10 | | | | |
| | (surface side 1 μm) | 10 → 0 | | | | |
| | (constantly decrease) | | | | | |
| | $CH_4$ (substrate side 2 μm) | 20 | | | | |
| | (surface side 1 μm) | 20 → 0 | | | | |
| | (constantly decrease) | | | | | |
| CGL/CTL | Combination as shown in TABLE | 30 | | | | |
| Surface layer | $SiH_4$ | 20 | 250 | 150 | 0.4 | 1 |
| | $CH_4$ | 500 | | | | |

TABLE 188

| Drum No. | initial charge-retentivity | photo-sensitivity | residual potential | ghost | durability |
|---|---|---|---|---|---|
| 1301E | ◎ | ○ | ◎ | ○ | ◎ |
| 1302E | ◎ | ○ | ◎ | ○ | ◎ |
| 1303E | ◎ | ○ | ◎ | ○ | ◎ |
| 1304E | ◎ | ○ | ◎ | ○ | ◎ |
| 1305E | ◎ | ○ | ◎ | ○ | ◎ |
| 1306E | ◎ | ○ | ◎ | ○ | ◎ |

Δ: practically applicable
X : practically not applicable

TABLE 190

| Drum No. | initial charge-retentivity | photo-sensitivity | residual potential | ghost | durability |
|---|---|---|---|---|---|
| 1501E | ◎ | ○ | ○ | ◎ | ◎ |
| 1502E | ◎ | ○ | ○ | ◎ | ◎ |
| 1503E | ◎ | ○ | ○ | ◎ | ◎ |

TABLE 190-continued

| Drum No. | initial charge-retentivity | photo-sensitivity | residual potential | ghost | durability |
|---|---|---|---|---|---|
| 1504E | ◎ | ○ | ○ | ○ | ◎ |
| 1505E | ◎ | ○ | ○ | ○ | ◎ |
| 1506E | ◎ | ○ | ○ | ○ | ◎ |
| 1507E | ◎ | ○ | ○ | ○ | ◎ |
| 1508E | ◎ | ○ | ○ | ○ | ◎ |
| 1509E | ◎ | ○ | ○ | ○ | ◎ |
| 1510E | ◎ | ○ | ○ | ○ | ◎ |
| 1511E | ◎ | ○ | ○ | ○ | ◎ |
| 1512E | ◎ | ○ | ○ | ○ | ◎ |
| 1513E | ◎ | ○ | ○ | ○ | ◎ |
| 1514E | ◎ | ○ | ○ | ○ | ◎ |
| 1515E | ◎ | ○ | ○ | ○ | ◎ |
| 1516E | ◎ | ○ | ○ | ○ | ◎ |
| 1517E | ◎ | ○ | ○ | ○ | ◎ |
| 1518E | ◎ | ○ | ○ | ○ | ◎ |

◎: Excellent
○: good
Δ: practically applicable
X : practically not applicable

TABLE 192-continued

| Drum No. | initial charge-retentivity | photo-sensitivity | residual potential | ghost | durability |
|---|---|---|---|---|---|
| 1703E | ◎ | ◎ | ○ | ◎ | ◎ |
| 1704E | ◎ | ◎ | ○ | ◎ | ◎ |
| 1705E | ◎ | ◎ | ○ | ◎ | ◎ |
| 1706E | ◎ | ◎ | ○ | ◎ | ◎ |
| 1707E | ◎ | ◎ | ○ | ◎ | ◎ |
| 1708E | ◎ | ◎ | ○ | ◎ | ◎ |
| 1709E | ◎ | ◎ | ○ | ◎ | ◎ |
| 1710E | ◎ | ◎ | ○ | ◎ | ◎ |
| 1711E | ◎ | ◎ | ○ | ◎ | ◎ |
| 1712E | ◎ | ◎ | ○ | ◎ | ◎ |
| 1713E | ◎ | ◎ | ○ | ◎ | ◎ |
| 1714E | ◎ | ◎ | ○ | ◎ | ◎ |
| 1715E | ◎ | ◎ | ○ | ◎ | ◎ |
| 1716E | ◎ | ◎ | ○ | ◎ | ◎ |
| 1717E | ◎ | ◎ | ○ | ◎ | ◎ |
| 1718E | ◎ | ◎ | ○ | ◎ | ◎ |

◎: Excellent
○: good
Δ: practically applicable
X: practically not applicable

TABLE 193

| Name of layer | Gas used & its flow rate (SCCM) | | Substrate temperature (°C.) | RF power (W) | Internal pressure (Torr) | Layer thickness (μm) |
|---|---|---|---|---|---|---|
| Charge injection inhibition layer | $SiH_4$ | 100 | 250 | 300 | 0.35 | 3 |
| | $H_2$ | 100 | | | | |
| | NO (substrate side 2 μm) | 10 | | | | |
| | (surface side 1 μm) (constantly decrease) | 10 → 0 | | | | |
| | $CH_4$ (substrate side 2 μm) | 100 | | | | |
| | (surface side 1 μm) (constantly decrease) | 100 → 0 | | | | |
| CGL/CTL | Combination as shown in Table 97 | | | | | |
| Surface layer | $SiH_4$ (substrate side) (surface side) | 350 → 10 | 250 | 150 | 0.4 | 1 |
| | $CH_4$ (substrate side) (surface side) (constantly diversify) | 350 → 10 | | | | |

TABLE 191

| Drum No. | initial charge-retentivity | photo-sensitivity | residual potential | ghost | durability |
|---|---|---|---|---|---|
| 1601E | ◎ | ○ | ○ | ○ | ◎ |
| 1602E | ◎ | ○ | ○ | ○ | ◎ |
| 1603E | ◎ | ○ | ○ | ○ | ◎ |
| 1604E | ◎ | ○ | ○ | ○ | ◎ |
| 1605E | ◎ | ○ | ○ | ○ | ◎ |
| 1606E | ◎ | ○ | ○ | ○ | ◎ |
| 1607E | ◎ | ○ | ○ | ○ | ◎ |
| 1608E | ◎ | ○ | ○ | ○ | ◎ |
| 1609E | ◎ | ○ | ○ | ○ | ◎ |
| 1610E | ◎ | ○ | ○ | ○ | ◎ |
| 1611E | ◎ | ○ | ○ | ○ | ◎ |
| 1612E | ◎ | ○ | ○ | ○ | ◎ |
| 1613E | ◎ | ○ | ○ | ○ | ◎ |
| 1614E | ◎ | ○ | ○ | ○ | ◎ |
| 1615E | ◎ | ○ | ○ | ○ | ◎ |
| 1616E | ◎ | ○ | ○ | ○ | ◎ |
| 1617E | ◎ | ○ | ○ | ○ | ◎ |
| 1618E | ◎ | ○ | ○ | ○ | ◎ |

◎: Excellent
○: good
Δ: practically applicable
X : practically not applicable

TABLE 194

| Drum No. | initial charge-retentivity | photo-sensitivity | residual potential | ghost | durability |
|---|---|---|---|---|---|
| 1901E | ◎ | ○ | ◎ | ◎ | ◎ |
| 1902E | ◎ | ○ | ◎ | ◎ | ◎ |
| 1903E | ◎ | ○ | ◎ | ◎ | ◎ |
| 1904E | ◎ | ○ | ◎ | ◎ | ◎ |
| 1905E | ◎ | ○ | ◎ | ◎ | ◎ |
| 1906E | ◎ | ○ | ◎ | ◎ | ◎ |
| 1907E | ◎ | ○ | ◎ | ◎ | ◎ |
| 1908E | ◎ | ○ | ◎ | ◎ | ◎ |
| 1909E | ◎ | ○ | ◎ | ◎ | ◎ |
| 1910E | ◎ | ○ | ◎ | ◎ | ◎ |
| 1911E | ◎ | ○ | ◎ | ◎ | ◎ |
| 1912E | ◎ | ○ | ◎ | ◎ | ◎ |
| 1913E | ◎ | ○ | ◎ | ◎ | ◎ |
| 1914E | ◎ | ○ | ◎ | ◎ | ◎ |
| 1915E | ◎ | ○ | ◎ | ◎ | ◎ |
| 1916E | ◎ | ○ | ◎ | ◎ | ◎ |
| 1917E | ◎ | ○ | ◎ | ◎ | ◎ |
| 1918E | ◎ | ○ | ◎ | ◎ | ◎ |

◎: Excellent
○: good
Δ: practically applicable
X: practically not applicable

TABLE 192

| Drum No. | initial charge-retentivity | photo-sensitivity | residual potential | ghost | durability |
|---|---|---|---|---|---|
| 1701E | ◎ | ◎ | ○ | ◎ | ◎ |
| 1702E | ◎ | ◎ | ○ | ◎ | ◎ |

TABLE 195

| Drum No. | initial charge-retentivity | photo-sensitivity | residual potential | ghost | durability |
|---|---|---|---|---|---|
| 2001E | ◎ | ○ | ○ | ◎ | ◎ |

TABLE 195-continued

| Drum No. | initial charge-retentivity | photo-sensitivity | residual potential | ghost | durability |
|---|---|---|---|---|---|
| 2002E | ◎ | ○ | ○ | ◎ | ◎ |
| 2003E | ◎ | ○ | ○ | ◎ | ◎ |
| 2004E | ◎ | ○ | ○ | ◎ | ◎ |
| 2005E | ◎ | ○ | ○ | ◎ | ◎ |
| 2006E | ◎ | ○ | ○ | ◎ | ◎ |
| 2007E | ◎ | ○ | ○ | ◎ | ◎ |
| 2008E | ◎ | ○ | ○ | ◎ | ◎ |
| 2009E | ◎ | ○ | ○ | ◎ | ◎ |
| 2010E | ◎ | ○ | ○ | ◎ | ◎ |
| 2011E | ◎ | ○ | ○ | ◎ | ◎ |
| 2012E | ◎ | ○ | ○ | ◎ | ◎ |
| 2013E | ◎ | ○ | ○ | ◎ | ◎ |
| 2014E | ◎ | ○ | ○ | ◎ | ◎ |
| 2015E | ◎ | ○ | ○ | ◎ | ◎ |
| 2016E | ◎ | ○ | ○ | ◎ | ◎ |
| 2017E | ◎ | ○ | ○ | ◎ | ◎ |
| 2018E | ◎ | ○ | ○ | ◎ | ◎ |

◎: Excellent
○: good
Δ: practically applicable
X: practically not applicable

TABLE 196

| Drum No. | initial charge-retentivity | photo-sensitivity | residual potential | ghost | durability |
|---|---|---|---|---|---|
| 2101E | ◎ | ○ | ○ | ○ | ◎ |
| 2102E | ◎ | ○ | ○ | ○ | ◎ |
| 2103E | ◎ | ○ | ○ | ○ | ◎ |
| 2104E | ◎ | ○ | ○ | ○ | ◎ |
| 2105E | ◎ | ○ | ○ | ○ | ◎ |
| 2106E | ◎ | ○ | ○ | ○ | ◎ |
| 2107E | ◎ | ○ | ○ | ○ | ◎ |
| 2108E | ◎ | ○ | ○ | ○ | ◎ |
| 2109E | ◎ | ○ | ○ | ○ | ◎ |
| 2110E | ◎ | ○ | ○ | ○ | ◎ |
| 2111E | ◎ | ○ | ○ | ○ | ◎ |
| 2112E | ◎ | ○ | ○ | ○ | ◎ |
| 2113E | ◎ | ○ | ○ | ○ | ◎ |
| 2114E | ◎ | ○ | ○ | ○ | ◎ |
| 2115E | ◎ | ○ | ○ | ○ | ◎ |
| 2116E | ◎ | ○ | ○ | ○ | ◎ |
| 2117E | ◎ | ○ | ○ | ○ | ◎ |
| 2118E | ◎ | ○ | ○ | ○ | ◎ |

◎: Excellent
○: good
Δ: practically applicable
X: practically not applicable

TABLE 196A

| Drum No. | initial charge-retentivity | photo-sensitivity | residual potential | ghost | durability |
|---|---|---|---|---|---|
| 2201E | ◎ | ○ | ○ | ○ | ◎ |
| 2202E | ◎ | ○ | ○ | ○ | ◎ |
| 2203E | ◎ | ○ | ○ | ○ | ◎ |
| 2204E | ◎ | ○ | ○ | ○ | ◎ |
| 2205E | ◎ | ○ | ○ | ○ | ◎ |
| 2206E | ◎ | ○ | ○ | ○ | ◎ |
| 2207E | ◎ | ○ | ○ | ○ | ◎ |
| 2208E | ◎ | ○ | ○ | ○ | ◎ |
| 2209E | ◎ | ○ | ○ | ○ | ◎ |
| 2210E | ◎ | ○ | ○ | ○ | ◎ |
| 2211E | ◎ | ○ | ○ | ○ | ◎ |
| 2212E | ◎ | ○ | ○ | ○ | ◎ |
| 2213E | ◎ | ○ | ○ | ○ | ◎ |
| 2214E | ◎ | ○ | ○ | ○ | ◎ |
| 2215E | ◎ | ○ | ○ | ○ | ◎ |
| 2216E | ◎ | ○ | ○ | ○ | ◎ |
| 2217E | ◎ | ○ | ○ | ○ | ◎ |

TABLE 196A-continued

| Drum No. | initial charge-retentivity | photo-sensitivity | residual potential | ghost | durability |
|---|---|---|---|---|---|
| 2218E | ◎ | ○ | ○ | ○ | ◎ |

◎: Excellent
○: good
Δ: practically applicable
X : practically not applicable

TABLE 197

| Drum No. | initial charge-retentivity | photo-sensitivity | residual potential | ghost | durability |
|---|---|---|---|---|---|
| 2301E | ◎ | ○ | ○ | ○ | ◎ |
| 2302E | ◎ | ○ | ○ | ○ | ◎ |
| 2303E | ◎ | ○ | ○ | ○ | ◎ |
| 2304E | ◎ | ○ | ○ | ○ | ◎ |
| 2305E | ◎ | ○ | ○ | ○ | ◎ |
| 2306E | ◎ | ○ | ○ | ○ | ◎ |
| 2307E | ◎ | ○ | ○ | ○ | ◎ |
| 2308E | ◎ | ○ | ○ | ○ | ◎ |
| 2309E | ◎ | ○ | ○ | ○ | ◎ |
| 2310E | ◎ | ○ | ○ | ○ | ◎ |
| 2311E | ◎ | ○ | ○ | ○ | ◎ |
| 2312E | ◎ | ○ | ○ | ○ | ◎ |
| 2313E | ◎ | ○ | ○ | ○ | ◎ |
| 2314E | ◎ | ○ | ○ | ○ | ◎ |
| 2315E | ◎ | ○ | ○ | ○ | ◎ |
| 2316E | ◎ | ○ | ○ | ○ | ◎ |
| 2317E | ◎ | ○ | ○ | ○ | ◎ |
| 2318E | ◎ | ○ | ○ | ○ | ◎ |

◎: Excellent
○: good
Δ: practically applicable
X: practically not applicable

TABLE 198

| Drum No. | initial charge-retentivity | photo sensitivity | residual potential | ghost | durability |
|---|---|---|---|---|---|
| 2401E | ◎ | ○ | ○ | ○ | ◎ |
| 2402E | ◎ | ○ | ○ | ○ | ◎ |
| 2403E | ◎ | ○ | ○ | ○ | ◎ |
| 2404E | ◎ | ○ | ○ | ○ | ◎ |
| 2405E | ◎ | ○ | ○ | ○ | ◎ |
| 2406E | ◎ | ○ | ○ | ○ | ◎ |
| 2407E | ◎ | ○ | ○ | ○ | ◎ |
| 2408E | ◎ | ○ | ○ | ○ | ◎ |
| 2409E | ◎ | ○ | ○ | ○ | ◎ |
| 2410E | ◎ | ○ | ○ | ○ | ◎ |
| 2411E | ◎ | ○ | ○ | ○ | ◎ |
| 2412E | ◎ | ○ | ○ | ○ | ◎ |
| 2413E | ◎ | ○ | ○ | ○ | ◎ |
| 2414E | ◎ | ○ | ○ | ○ | ◎ |
| 2415E | ◎ | ○ | ○ | ○ | ◎ |
| 2416E | ◎ | ○ | ○ | ○ | ◎ |
| 2417E | ◎ | ○ | ○ | ○ | ◎ |

◎: Excellent
○: good
Δ: practically applicable
X: practically not applicable

TABLE 199

| Drum No. | 2501 | 2502 | 2503 | 2504 | 2505 |
|---|---|---|---|---|---|
| a [μm] | 25 | 50 | 50 | 12 | 12 |
| b [μm] | 0.8 | 2.5 | 0.8 | 1.5 | 0.3 |

TABLE 199 A

| Drum No. | initial charge-reten-tivity | photo-sensi-tivity | residual potential | ghost | dura-bility | defec-tive image | inter-ference fringe |
|---|---|---|---|---|---|---|---|
| 2501E | ○ | ○ | ○ | ○ | ◎ | ○ | ◎ |

TABLE 199 A-continued

| Drum No. | initial charge-reten-tivity | photo-sensi-tivity | residual potential | ghost | dura-bility | defec-tive image | inter-ference fringe |
|---|---|---|---|---|---|---|---|
| 2502E | ○ | ○ | ○ | ○ | ◎ | ○ | ◎ |
| 2503E | ○ | ○ | ○ | ○ | ◎ | ○ | ○ |
| 2504E | ○ | ○ | ○ | ○ | ◎ | ○ | ◎ |
| 2505E | ○ | ○ | ○ | ○ | ◎ | ○ | ○ |

◎: Excellent
○: good
Δ: practically applicable
X : practically not applicable

TABLE 200

| Drum No. | 2511 | 2512 | 2513 | 2514 | 2515 |
|---|---|---|---|---|---|
| a [μm] | 30 | 40 | 50 | 70 | 100 |
| b [μm] | 0.7 | 1.0 | 1.2 | 2 | 5 |

TABLE 200 A

| Drum No. | initial charge-reten-tivity | photo-sensi-tivity | residual potential | ghost | dura-bility | defec-tive image | inter-ference fringe |
|---|---|---|---|---|---|---|---|
| 2511 | ○ | ○ | ○ | ○ | ◎ | ◎ | ○ |
| 2512 | ○ | ○ | ○ | ○ | ◎ | ◎ | ◎ |
| 2513 | ○ | ○ | ○ | ○ | ◎ | ◎ | ◎ |
| 2514 | ○ | ○ | ○ | ○ | ◎ | ◎ | ○ |
| 2515 | ○ | ○ | ○ | ○ | ◎ | ◎ | ○ |

◎: Excellent
○: good
Δ: practically applicable
X: practically not applicable

TABLE 201

| Drum No. | initial charge-retentivity | photo-sensitivity | residual potential | ghost | durability |
|---|---|---|---|---|---|
| 2601E | ◎ | ○ | ○ | ○ | ◎ |
| 2602E | ◎ | ○ | ○ | ○ | ◎ |
| 2603E | ◎ | ○ | ○ | ○ | ◎ |
| 2604E | ◎ | ○ | ○ | ○ | ◎ |
| 2605E | ◎ | ○ | ○ | ○ | ◎ |
| 2606E | ◎ | ○ | ○ | ○ | ◎ |
| 2607E | ◎ | ○ | ○ | ○ | ◎ |
| 2608E | ◎ | ○ | ○ | ○ | ◎ |
| 2609E | ◎ | ○ | ○ | ○ | ◎ |
| 2610E | ◎ | ○ | ○ | ○ | ◎ |
| 2611E | ◎ | ○ | ○ | ○ | ◎ |
| 2612E | ◎ | ○ | ○ | ○ | ◎ |
| 2613E | ◎ | ○ | ○ | ○ | ◎ |
| 2614E | ◎ | ○ | ○ | ○ | ◎ |
| 2615E | ◎ | ○ | ○ | ○ | ◎ |
| 2616E | ◎ | ○ | ○ | ○ | ◎ |
| 2617E | ◎ | ○ | ○ | ○ | ◎ |

◎: Excellent
○: good
Δ: practically applicable
X: practically not applicable

TABLE 202

| Drum No. | initial charge-retentivity | photo-sensitivity | residual potential | ghost | durability |
|---|---|---|---|---|---|
| 101F | ◎ | ○ | ○ | ○ | ○ |
| 102F | ◎ | ○ | ○ | ○ | ○ |
| 103F | ◎ | ○ | ○ | ○ | ○ |
| 104F | ◎ | ○ | ○ | ○ | ○ |
| 105F | ◎ | ○ | ○ | ○ | ○ |
| 106F | ◎ | ○ | ○ | ○ | ○ |
| 107F | ◎ | ○ | ○ | ○ | ○ |
| 108F | ◎ | ○ | ○ | ○ | ○ |
| 109F | ◎ | ○ | ○ | ○ | ○ |
| 110F | ◎ | ○ | ○ | ○ | ○ |

TABLE 202-continued

| Drum No. | initial charge-retentivity | photo-sensitivity | residual potential | ghost | durability |
|---|---|---|---|---|---|
| 111F | ◎ | ○ | ○ | ○ | ○ |
| 112F | ◎ | ○ | ○ | ○ | ○ |
| 113F | ◎ | ○ | ○ | ○ | ○ |
| 114F | ◎ | ○ | ○ | ○ | ○ |
| 115F | ◎ | ○ | ○ | ○ | ○ |
| 116F | ◎ | ○ | ○ | ○ | ○ |
| 117F | ◎ | ○ | ○ | ○ | ○ |
| 118F | ◎ | ○ | ○ | ○ | ○ |

◎: Excellent
○: good
Δ: practically applicable
X: practically not applicable

TABLE 203

| Drum No. | initial charge-retentivity | photo-sensitivity | residual potential | ghost | durability |
|---|---|---|---|---|---|
| 201F | ◎ | ○ | ○ | ○ | ○ |
| 202F | ◎ | ○ | ○ | ○ | ○ |
| 203F | ◎ | ○ | ○ | ○ | ○ |
| 204F | ◎ | ○ | ○ | ○ | ○ |
| 205F | ◎ | ○ | ○ | ○ | ○ |
| 206F | ◎ | ○ | ○ | ○ | ○ |
| 207F | ◎ | ○ | ○ | ○ | ○ |
| 208F | ◎ | ○ | ○ | ○ | ○ |
| 209F | ◎ | ○ | ○ | ○ | ○ |
| 210F | ◎ | ○ | ○ | ○ | ○ |
| 211F | ◎ | ○ | ○ | ○ | ○ |
| 212F | ◎ | ○ | ○ | ○ | ○ |
| 213F | ◎ | ○ | ○ | ○ | ○ |
| 214F | ◎ | ○ | ○ | ○ | ○ |
| 215F | ◎ | ○ | ○ | ○ | ○ |
| 216F | ◎ | ○ | ○ | ○ | ○ |
| 217F | ◎ | ○ | ○ | ○ | ○ |
| 218F | ◎ | ○ | ○ | ○ | ○ |

◎: Excellent
○: good
Δ: practically applicable
X: practically not applicable

TABLE 204

| Drum No. | initial charge-retentivity | photo-sensitivity | residual potential | ghost | durability |
|---|---|---|---|---|---|
| 301F | ◎ | ○ | ○ | ○ | ○ |
| 302F | ◎ | ○ | ○ | ○ | ○ |
| 303F | ◎ | ○ | ○ | ○ | ○ |
| 304F | ◎ | ○ | ○ | ○ | ○ |
| 305F | ◎ | ○ | ○ | ○ | ○ |
| 306F | ◎ | ○ | ○ | ○ | ○ |
| 307F | ◎ | ○ | ○ | ○ | ○ |
| 308F | ◎ | ○ | ○ | ○ | ○ |
| 309F | ◎ | ○ | ○ | ○ | ○ |
| 310F | ◎ | ○ | ○ | ○ | ○ |
| 311F | ◎ | ○ | ○ | ○ | ○ |
| 312F | ◎ | ○ | ○ | ○ | ○ |
| 313F | ◎ | ○ | ○ | ○ | ○ |
| 314F | ◎ | ○ | ○ | ○ | ○ |
| 315F | ◎ | ○ | ○ | ○ | ○ |
| 316F | ◎ | ○ | ○ | ○ | ○ |
| 317F | ◎ | ○ | ○ | ○ | ○ |
| 318F | ◎ | ○ | ○ | ○ | ○ |

◎: Excellent
○: good
Δ: practically applicable
X : practically not applicable

TABLE 205

| Drum No. | initial charge-retentivity | photo sensitivity | residual potential | ghost | durability |
|---|---|---|---|---|---|
| 401F | ◎ | ○ | ○ | ○ | ○ |
| 402F | ◎ | ○ | ○ | ○ | ○ |

TABLE 205-continued

| Drum No. | initial charge-retentivity | photo sensitivity | residual potential | ghost | durability |
|---|---|---|---|---|---|
| 403F | ◎ | ○ | ○ | ○ | ○ |
| 404F | ◎ | ○ | ○ | ○ | ○ |
| 405F | ◎ | ○ | ○ | ○ | ○ |
| 406F | ◎ | ○ | ○ | ○ | ○ |
| 407F | ◎ | ○ | ○ | ○ | ○ |
| 408F | ◎ | ○ | ○ | ○ | ○ |
| 409F | ◎ | ○ | ○ | ○ | ○ |
| 410F | ◎ | ○ | ○ | ○ | ○ |
| 411F | ◎ | ○ | ○ | ○ | ○ |
| 412F | ◎ | ○ | ○ | ○ | ○ |
| 413F | ◎ | ○ | ○ | ○ | ○ |
| 414F | ◎ | ○ | ○ | ○ | ○ |
| 415F | ◎ | ○ | ○ | ○ | ○ |
| 416F | ◎ | ○ | ○ | ○ | ○ |
| 417F | ◎ | ○ | ○ | ○ | ○ |
| 418F | ◎ | ○ | ○ | ○ | ○ |

: Excellent
Δ: practically applicable
: good
X: practically not applicable

TABLE 206

| Drum No. | initial charge-retentivity | photo-sensitivity | residual potential | ghost | durability |
|---|---|---|---|---|---|
| 501F | ◎ | ○ | ○ | ○ | ○ |
| 502F | ◎ | ○ | ○ | ○ | ○ |
| 503F | ◎ | ○ | ○ | ○ | ○ |
| 504F | ◎ | ○ | ○ | ○ | ○ |
| 505F | ◎ | ○ | ○ | ○ | ○ |
| 506F | ◎ | ○ | ○ | ○ | ○ |
| 507F | ◎ | ○ | ○ | ○ | ○ |
| 508F | ◎ | ○ | ○ | ○ | ○ |

TABLE 206-continued

| Drum No. | initial charge-retentivity | photo-sensitivity | residual potential | ghost | durability |
|---|---|---|---|---|---|
| 518F | ◎ | ○ | ○ | ○ | ○ |

: Excellent
Δ: practically applicable
: good
X: practically not applicable

TABLE 207

| Drum No. | initial charge-retentivity | photo-sensitivity | residual potential | ghost | durability |
|---|---|---|---|---|---|
| 601F | ◎ | ○ | ○ | ◎ | ○ |
| 602F | ◎ | ○ | ○ | ◎ | ○ |
| 603F | ◎ | ○ | ○ | ◎ | ○ |
| 604F | ◎ | ○ | ○ | ◎ | ○ |
| 605F | ◎ | ○ | ○ | ◎ | ○ |
| 606F | ◎ | ○ | ○ | ◎ | ○ |
| 607F | ◎ | ○ | ○ | ◎ | ○ |
| 608F | ◎ | ○ | ○ | ◎ | ○ |
| 609F | ◎ | ○ | ○ | ◎ | ○ |
| 610F | ◎ | ○ | ○ | ◎ | ○ |
| 611F | ◎ | ○ | ○ | ◎ | ○ |
| 612F | ◎ | ○ | ○ | ◎ | ○ |
| 613F | ◎ | ○ | ○ | ◎ | ○ |
| 614F | ◎ | ○ | ○ | ◎ | ○ |
| 615F | ◎ | ○ | ○ | ◎ | ○ |
| 616F | ◎ | ○ | ○ | ◎ | ○ |
| 617F | ◎ | ○ | ○ | ◎ | ○ |
| 618F | ◎ | ○ | ○ | ◎ | ○ |

: Excellent
Δ: practically applicable
: good
X: practically not applicable

TABLE 208

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 10 | | | | |
| | $N_2$ (substrate side 0.7 μm) | 30 | | | | |
| | (surface side 0.3 μm) (constantly decrease) | 30 → 0 | | | | |
| | $CH_4$ (substrate side 0.7 μm) | 25 | | | | |
| | (surface side 0.3 μm) (constantly decrease) | 25 → 20 | | | | |
| | NO | 10 | | | | |
| Charge injection inhibition layer | $SiH_4$ | 150 | 250 | 150 | 0.35 | 3 |
| | $SiF_4$ | 50 | | | | |
| | $GeH_4$ | 10 | | | | |
| | $PH_3$ (against $SiH_4$) | | | | | |
| | (substrate side 2 μm) | 800 ppm | | | | |
| | (surface side 1 μm) (constantly decrease) | 800 → 0 ppm | | | | |
| | NO (substrate side 2 μm) | 10 | | | | |
| | (surface side 1 μm) (constantly decrease) | 10 → 0 | | | | |
| | $CH_4$ (substrate side 2 μm) | 20 | | | | |
| | (surface side 1 μm) (constantly decrease) | 20 → 0 | | | | |
| CGL/CTL | Combination as shown in Table 66 | | | | | |

| | | | | | |
|---|---|---|---|---|---|
| 509F | ◎ | ○ | ○ | ○ | ○ |
| 510F | ◎ | ○ | ○ | ○ | ○ |
| 511F | ◎ | ○ | ○ | ○ | ○ |
| 512F | ◎ | ○ | ○ | ○ | ○ |
| 513F | ◎ | ○ | ○ | ○ | ○ |
| 514F | ◎ | ○ | ○ | ○ | ○ |
| 515F | ◎ | ○ | ○ | ○ | ○ |
| 516F | ◎ | ○ | ○ | ○ | ○ |
| 517F | ◎ | ○ | ○ | ○ | ○ |

TABLE 209

| Drum No. | initial charge-retentivity | photo-sensitivity | residual potential | ghost | durability |
|---|---|---|---|---|---|
| 701F | ◎ | ○ | ○ | ◎ | ○ |
| 702F | ◎ | ○ | ○ | ◎ | ○ |
| 703F | ◎ | ○ | ○ | ◎ | ○ |
| 704F | ◎ | ○ | ○ | ◎ | ○ |
| 705F | ◎ | ○ | ○ | ◎ | ○ |
| 706F | ◎ | ○ | ○ | ◎ | ○ |
| 707F | ◎ | ○ | ○ | ◎ | ○ |

TABLE 209-continued

| Drum No. | initial charge-retentivity | photo-sensitivity | residual potential | ghost | durability |
|---|---|---|---|---|---|
| 708F | ◎ | ○ | ○ | ◎ | ○ |
| 709F | ◎ | ○ | ○ | ◎ | ○ |
| 710F | ◎ | ○ | ○ | ◎ | ○ |
| 711F | ◎ | ○ | ○ | ◎ | ○ |
| 712F | ◎ | ○ | ○ | ◎ | ○ |
| 713F | ◎ | ○ | ○ | ◎ | ○ |
| 714F | ◎ | ○ | ○ | ◎ | ○ |
| 715F | ◎ | ○ | ○ | ◎ | ○ |
| 716F | ◎ | ○ | ○ | ◎ | ○ |
| 717F | ◎ | ○ | ○ | ◎ | ○ |
| 718F | ◎ | ○ | ○ | ◎ | ○ |

◎: Excellent
○: good
Δ: practically applicable
X : practically not applicable

TABLE 210

| Drum No. | initial charge-retentivity | photo-sensitivity | residual potential | ghost | durability |
|---|---|---|---|---|---|
| 801F | ◎ | ○ | ○ | ○ | ○ |
| 802F | ◎ | ○ | ○ | ○ | ○ |
| 803F | ◎ | ○ | ○ | ○ | ○ |
| 804F | ◎ | ○ | ○ | ○ | ○ |
| 805F | ◎ | ○ | ○ | ○ | ○ |
| 806F | ◎ | ○ | ○ | ○ | ○ |
| 807F | ◎ | ○ | ○ | ○ | ○ |
| 808F | ◎ | ○ | ○ | ○ | ○ |
| 809F | ◎ | ○ | ○ | ○ | ○ |
| 810F | ◎ | ○ | ○ | ○ | ○ |
| 811F | ◎ | ○ | ○ | ○ | ○ |
| 812F | ◎ | ○ | ○ | ○ | ○ |
| 813F | ◎ | ○ | ○ | ○ | ○ |
| 814F | ◎ | ○ | ○ | ○ | ○ |
| 815F | ◎ | ○ | ○ | ○ | ○ |
| 816F | ◎ | ○ | ○ | ○ | ○ |
| 817F | ◎ | ○ | ○ | ○ | ○ |
| 818F | ◎ | ○ | ○ | ○ | ○ |

◎: Excellent
○: good
Δ: practically applicable
X : practically not applicable

TABLE 211

| Drum No. | initial charge-retentivity | photo-sensitivity | residual potential | ghost | durability |
|---|---|---|---|---|---|
| 901F | ◎ | ○ | ○ | ○ | ○ |
| 902F | ◎ | ○ | ○ | ○ | ○ |
| 903F | ◎ | ○ | ○ | ○ | ○ |
| 904F | ◎ | ○ | ○ | ○ | ○ |
| 905F | ◎ | ○ | ○ | ○ | ○ |
| 906F | ◎ | ○ | ○ | ○ | ○ |
| 907F | ◎ | ○ | ○ | ○ | ○ |
| 908F | ◎ | ○ | ○ | ○ | ○ |
| 909F | ◎ | ○ | ○ | ○ | ○ |
| 910F | ◎ | ○ | ○ | ○ | ○ |
| 911F | ◎ | ○ | ○ | ○ | ○ |
| 912F | ◎ | ○ | ○ | ○ | ○ |
| 913F | ◎ | ○ | ○ | ○ | ○ |
| 914F | ◎ | ○ | ○ | ○ | ○ |
| 915F | ◎ | ○ | ○ | ○ | ○ |
| 916F | ◎ | ○ | ○ | ○ | ○ |
| 917F | ◎ | ○ | ○ | ○ | ○ |
| 918F | ◎ | ○ | ○ | ○ | ○ |

◎: Excellent
○: good
Δ: practically applicable
X: practically not applicable

TABLE 212

| Drum No. | initial charge-retentivity | photo-sensitivity | residual potential | ghost | durability |
|---|---|---|---|---|---|
| 1001 | ◎ | ○ | ○ | ○ | ○ |
| 1002 | ◎ | ○ | ○ | ○ | ○ |
| 1003 | ◎ | ○ | ○ | ○ | ○ |
| 1004 | ◎ | ○ | ○ | ○ | ○ |
| 1005 | ◎ | ○ | ○ | ○ | ○ |
| 1006 | ◎ | ○ | ○ | ○ | ○ |
| 1007 | ◎ | ○ | ○ | ○ | ○ |
| 1008 | ◎ | ○ | ○ | ○ | ○ |
| 1009 | ◎ | ○ | ○ | ○ | ○ |
| 1010 | ◎ | ○ | ○ | ○ | ○ |
| 1011 | ◎ | ○ | ○ | ○ | ○ |
| 1012 | ◎ | ○ | ○ | ○ | ○ |
| 1013 | ◎ | ○ | ○ | ○ | ○ |
| 1014 | ◎ | ○ | ○ | ○ | ○ |
| 1015 | ◎ | ○ | ○ | ○ | ○ |
| 1016 | ◎ | ○ | ○ | ○ | ○ |
| 1017 | ◎ | ○ | ○ | ○ | ○ |

◎: Excellent
○: good
Δ: practically applicable
X: practically not applicable

TABLE 213

| Drum No. | 1101F | 1102F | 1103F | 1104F | 1105F |
|---|---|---|---|---|---|
| a [μm] | 25 | 50 | 50 | 12 | 12 |
| b [μm] | 0.8 | 2.5 | 0.8 | 1.5 | 0.3 |

TABLE 213 A

| Drum No. | initial charge-reten-tivity | photo-sensi-tivity | residual potential | ghost | dura-bility | defec-tive image | inter-ference fringe |
|---|---|---|---|---|---|---|---|
| 1101F | ◎ | ○ | ○ | ○ | ○ | ◎ | ○ |
| 1102F | ◎ | ○ | ○ | ○ | ○ | ◎ | ◎ |
| 1103F | ◎ | ○ | ○ | ○ | ○ | ○ | ◎ |
| 1104F | ◎ | ○ | ○ | ○ | ○ | ◎ | ○ |
| 1105F | ◎ | ○ | ○ | ○ | ○ | ○ | ○ |

◎: Excellent
○: good
Δ: practically applicable
X: practically not applicable

TABLE 214

| Drum No. | 1111F | 1112F | 1113F | 1114F | 1115F |
|---|---|---|---|---|---|
| a [μm] | 30 | 40 | 50 | 70 | 100 |
| b [μm] | 0.7 | 1.0 | 1.2 | 2 | 5 |

TABLE 214 A

| Drum No. | initial charge-reten-tivity | photo-sensi-tivity | residual potential | ghost | dura-bility | defec-tive image | inter-ference fringe |
|---|---|---|---|---|---|---|---|
| 1111F | ◎ | ○ | ○ | ○ | ○ | ◎ | ○ |
| 1112F | ◎ | ○ | ○ | ○ | ○ | ◎ | ◎ |
| 1113F | ◎ | ○ | ○ | ○ | ○ | ◎ | ◎ |
| 1114F | ◎ | ○ | ○ | ○ | ○ | ◎ | ○ |
| 1115F | ◎ | ○ | ○ | ○ | ○ | ◎ | ○ |

◎: Excellent
○: good
Δ: practically applicable
X: practically not applicable

TABLE 215

| Drum No. | initial charge-retentivity | photo-sensitivity | residual potential | ghost | durability |
|---|---|---|---|---|---|
| 1201 | | | | | |
| 1202 | | | | | |

TABLE 215-continued

| Drum No. | initial charge-retentivity | photo-sensitivity | residual potential | ghost | durability |
|---|---|---|---|---|---|
| 1203 | ◎ | ○ | ○ | ○ | ○ |
| 1204 | ◎ | ○ | ○ | ○ | ○ |
| 1205 | ◎ | ○ | ○ | ○ | ○ |
| 1206 | ◎ | ○ | ○ | ○ | ○ |
| 1207 | ◎ | ○ | ○ | ○ | ○ |
| 1208 | ◎ | ○ | ○ | ○ | ○ |
| 1209 | ◎ | ○ | ○ | ○ | ○ |
| 1210 | ◎ | ○ | ○ | ○ | ○ |
| 1211 | ◎ | ○ | ○ | ○ | ○ |
| 1212 | ◎ | ○ | ○ | ○ | ○ |
| 1213 | ◎ | ○ | ○ | ○ | ○ |
| 1214 | ◎ | ○ | ○ | ○ | ○ |
| 1215 | ◎ | ○ | ○ | ○ | ○ |
| 1216 | ◎ | ○ | ○ | ○ | ○ |
| 1217 | ◎ | ○ | ○ | ○ | ○ |
| 1218 | ◎ | ○ | ○ | ○ | ○ |

◎: Excellent
○: good
Δ: practically applicable
X: practically not applicable

TABLE 216

| Drum No. | initial charge-retentivity | photo-sensitivity | residual potential | ghost | durability |
|---|---|---|---|---|---|
| 101G | ○ | ○ | Δ | ○ | ◎ |
| 102G | ○ | ○ | Δ | ○ | ◎ |
| 103G | ○ | ○ | Δ | ○ | ◎ |
| 104G | ○ | ○ | Δ | ○ | ◎ |
| 105G | ○ | ○ | Δ | ○ | ◎ |
| 106G | ○ | ○ | Δ | ○ | ◎ |
| 107G | ○ | ○ | Δ | ○ | ◎ |
| 108G | ○ | ○ | Δ | ○ | ◎ |
| 109G | ○ | ○ | Δ | ○ | ◎ |
| 110G | ○ | ○ | Δ | ○ | ◎ |
| 111G | ○ | ○ | Δ | ○ | ◎ |
| 112G | ○ | ○ | Δ | ○ | ◎ |
| 113G | ○ | ○ | Δ | ○ | ◎ |
| 114G | ○ | ○ | Δ | ○ | ◎ |
| 115G | ○ | ○ | Δ | ○ | ◎ |
| 116G | ○ | ○ | Δ | ○ | ◎ |
| 117G | ○ | ○ | Δ | ○ | ◎ |
| 118G | ○ | ○ | Δ | ○ | ◎ |

◎: Excellent
○: good
Δ: practically applicable
X: practically not applicable

TABLE 217

| Name of layer | Gas used & its flow rate (SCCM) | Substrate temperature (°C.) | RF power (W) | Internal pressure (Torr) | Layer thickness (μm) |
|---|---|---|---|---|---|
| IR absorption layer | $SiH_4$ 100<br>$GeH_4$ (substrate side 0.7 μm) 50<br>(surface side 0.3 μm) 50→0<br>(constantly decrease)<br>$B_2H_6$ (against $SiH_4$) 1000 ppm<br>NO 10 | 250 | 150 | 0.35 | 1 |
| CGL/CTL | Combination as shown in Table 3 | | | | |
| Surface layer | $SiH_4$ 20<br>$CH_4$ 500 | 250 | 150 | 0.4 | 1 |

TABLE 218

| Drum No. | initial charge-retentivity | photo-sensitivity | residual potential | ghost | durability |
|---|---|---|---|---|---|
| 201G | ○ | ○ | ○ | ○ | ◎ |
| 202G | ○ | ○ | ○ | ○ | ◎ |
| 203G | ○ | ○ | ○ | ○ | ◎ |
| 204G | ○ | ○ | ○ | ○ | ◎ |
| 205G | ○ | ○ | ○ | ○ | ◎ |
| 206G | ○ | ○ | ○ | ○ | ◎ |
| 207G | ○ | ○ | ○ | ○ | ◎ |
| 208G | ○ | ○ | ○ | ○ | ◎ |
| 209G | ○ | ○ | ○ | ○ | ◎ |
| 210G | ○ | ○ | ○ | ○ | ◎ |
| 211G | ○ | ○ | ○ | ○ | ◎ |
| 212G | ○ | ○ | ○ | ○ | ◎ |
| 213G | ○ | ○ | ○ | ○ | ◎ |
| 214G | ○ | ○ | ○ | ○ | ◎ |
| 215G | ○ | ○ | ○ | ○ | ◎ |
| 216G | ○ | ○ | ○ | ○ | ◎ |
| 217G | ○ | ○ | ○ | ○ | ◎ |
| 218G | ○ | ○ | ○ | ○ | ◎ |

◎: Excellent
○: good
Δ: practically applicable
X: practically not applicable

TABLE 219

| Drum No. | initial charge-retentivity | photo-sensitivity | residual potential | ghost | durability |
|---|---|---|---|---|---|
| 301G | ○ | ○ | ○ | ○ | ◎ |
| 302G | ○ | ○ | ○ | ○ | ◎ |
| 303G | ○ | ○ | ○ | ○ | ◎ |
| 304G | ○ | ○ | ○ | ○ | ◎ |
| 305G | ○ | ○ | ○ | ○ | ◎ |
| 306G | ○ | ○ | ○ | ○ | ◎ |
| 307G | ○ | ○ | ○ | ○ | ◎ |
| 308G | ○ | ○ | ○ | ○ | ◎ |
| 309G | ○ | ○ | ○ | ○ | ◎ |
| 310G | ○ | ○ | ○ | ○ | ◎ |
| 311G | ○ | ○ | ○ | ○ | ◎ |
| 312G | ○ | ○ | ○ | ○ | ◎ |
| 313G | ○ | ○ | ○ | ○ | ◎ |
| 314G | ○ | ○ | ○ | ○ | ◎ |
| 315G | ○ | ○ | ○ | ○ | ◎ |
| 316G | ○ | ○ | ○ | ○ | ◎ |
| 317G | ○ | ○ | ○ | ○ | ◎ |
| 318G | ○ | ○ | ○ | ○ | ◎ |

◎: Excellent
○: good
Δ: practically applicable
X : practically not applicable

TABLE 220

| Drum No. | initial charge-retentivity | photo-sensitivity | residual potential | ghost | durability |
|---|---|---|---|---|---|
| 401G | ◎ | ○ | ○ | ○ | ○ |
| 402G | ◎ | ○ | ○ | ○ | ○ |
| 403G | ◎ | ○ | ○ | ○ | ○ |
| 404G | ◎ | ○ | ○ | ○ | ○ |
| 405G | ◎ | ○ | ○ | ○ | ○ |
| 406G | ◎ | ○ | ○ | ○ | ○ |
| 407G | ◎ | ○ | ○ | ○ | ○ |
| 408G | ◎ | ○ | ○ | ○ | ○ |
| 409G | ◎ | ○ | ○ | ○ | ○ |
| 410G | ◎ | ○ | ○ | ○ | ○ |
| 411G | ◎ | ○ | ○ | ○ | ○ |
| 412G | ◎ | ○ | ○ | ○ | ○ |
| 413G | ◎ | ○ | ○ | ○ | ○ |
| 414G | ◎ | ○ | ○ | ○ | ○ |
| 415G | ◎ | ○ | ○ | ○ | ○ |
| 416G | ◎ | ○ | ○ | ○ | ○ |
| 417G | ◎ | ○ | ○ | ○ | ○ |

TABLE 220-continued

| Drum No. | initial charge-retentivity | photo-sensitivity | residual potential | ghost | durability |
|---|---|---|---|---|---|
| 418G | ○ | ○ | ○ | ○ | ◎ |

◎: Excellent
○: good
Δ: practically applicable
X : practically not applicable

TABLE 221

| Drum No. | initial charge-retentivity | photo-sensitivity | residual potential | ghost | durability |
|---|---|---|---|---|---|
| 501G | ○ | ○ | ○ | ○ | ◎ |
| 502G | ○ | ○ | ○ | ○ | ◎ |
| 503G | ○ | ○ | ○ | ○ | ◎ |
| 504G | ○ | ○ | ○ | ○ | ◎ |
| 505G | ○ | ○ | ○ | ○ | ◎ |
| 506G | ○ | ○ | ○ | ○ | ◎ |
| 507G | ○ | ○ | ○ | ○ | ◎ |
| 508G | ○ | ○ | ○ | ○ | ◎ |
| 509G | ○ | ○ | ○ | ○ | ◎ |
| 510G | ○ | ○ | ○ | ○ | ◎ |
| 511G | ○ | ○ | ○ | ○ | ◎ |
| 512G | ○ | ○ | ○ | ○ | ◎ |
| 513G | ○ | ○ | ○ | ○ | ◎ |
| 514G | ○ | ○ | ○ | ○ | ◎ |
| 515G | ○ | ○ | ○ | ○ | ◎ |
| 516G | ○ | ○ | ○ | ○ | ◎ |
| 517G | ○ | ○ | ○ | ○ | ◎ |
| 518G | ○ | ○ | ○ | ○ | ◎ |

◎: Excellent
○: good
Δ: practically applicable
X : practically not applicable

TABLE 222

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $CH_4$ (substrate side 0.7 μm) | 10 | | | | |
| | (surface side 0.3 μm) (constantly decrease) | 10 → 0 | | | | |
| | NO (substrate side 0.7 μm) | 5 | | | | |
| | (surface side 0.3 μm) (constantly decrease) | 5 → 0 | | | | |
| | $N_2$ (substrate side 0.7 μm) | 30 | | | | |
| | (surface side 0.3 μm) (constantly decrease) | 30 → 0 | | | | |
| CGL/CTL | Combination as shown in Table 18 | | | | | |
| Surface layer | $SiH_4$ | 10 | 250 | 200 | 0.4 | 2 |
| | $N_2$ | 500 | | | | |
| | $C_2H_2$ | 20 | | | | |

X: practically not applicable

TABLE 223

| Drum No. | initial charge-retentivity | photo-sensitivity | residual potential | ghost | durability |
|---|---|---|---|---|---|
| 601G | ○ | ○ | ○ | ◎ | ◎ |
| 602G | ○ | ○ | ○ | ◎ | ◎ |
| 603G | ○ | ○ | ○ | ◎ | ◎ |
| 604G | ○ | ○ | ○ | ◎ | ◎ |
| 605G | ○ | ○ | ○ | ◎ | ◎ |
| 606G | ○ | ○ | ○ | ◎ | ◎ |
| 607G | ○ | ○ | ○ | ◎ | ◎ |
| 608G | ○ | ○ | ○ | ◎ | ◎ |
| 609G | ○ | ○ | ○ | ◎ | ◎ |
| 610G | ○ | ○ | ○ | ◎ | ◎ |
| 611G | ○ | ○ | ○ | ◎ | ◎ |
| 612G | ○ | ○ | ○ | ◎ | ◎ |
| 613G | ○ | ○ | ○ | ◎ | ◎ |
| 614G | ○ | ○ | ○ | ◎ | ◎ |
| 615G | ○ | ○ | ○ | ◎ | ◎ |

TABLE 223-continued

| Drum No. | initial charge-retentivity | photo-sensitivity | residual potential | ghost | durability |
|---|---|---|---|---|---|
| 616G | ○ | ○ | ○ | ◎ | |
| 617G | ○ | ○ | ○ | ◎ | |
| 618G | ○ | ○ | ○ | ◎ | |

◎: Excellent
○: good
Δ: practically applicable
X: practically not applicable

TABLE 224

| Drum No. | initial charge-retentivity | photo-sensitivity | residual potential | ghost | durability |
|---|---|---|---|---|---|
| 701G | ○ | ○ | ○ | ○ | ◎ |
| 702G | ○ | ○ | ○ | ○ | ◎ |
| 703G | ○ | ○ | ○ | ○ | ◎ |
| 704G | ○ | ○ | ○ | ○ | ◎ |
| 705G | ○ | ○ | ○ | ○ | ◎ |
| 706G | ○ | ○ | ○ | ○ | ◎ |
| 707G | ○ | ○ | ○ | ○ | ◎ |
| 708G | ○ | ○ | ○ | ○ | ◎ |
| 709G | ○ | ○ | ○ | ○ | ◎ |
| 710G | ○ | ○ | ○ | ○ | ◎ |
| 711G | ○ | ○ | ○ | ○ | ◎ |
| 712G | ○ | ○ | ○ | ○ | ◎ |
| 713G | ○ | ○ | ○ | ○ | ◎ |
| 714G | ○ | ○ | ○ | ○ | ◎ |
| 715G | ○ | ○ | ○ | ○ | ◎ |
| 716G | ○ | ○ | ○ | ○ | ◎ |
| 717G | ○ | ○ | ○ | ○ | ◎ |
| 718G | ○ | ○ | ○ | ○ | ◎ |

◎: Excellent
○: good
Δ: practically applicable
X: practically not applicable

TABLE 225

| Drum No. | initial charge-retentivity | photo-sensitivity | residual potential | ghost | durability |
|---|---|---|---|---|---|
| 801G | ○ | ○ | ◎ | ◎ | ◎ |
| 802G | ○ | ○ | ◎ | ◎ | ◎ |
| 803G | ○ | ○ | ◎ | ◎ | ◎ |
| 804G | ○ | ○ | ◎ | ◎ | ◎ |
| 805G | ○ | ○ | ◎ | ◎ | ◎ |
| 806G | ○ | ○ | ◎ | ◎ | ◎ |
| 807G | ○ | ○ | ◎ | ◎ | ◎ |
| 808G | ○ | ○ | ◎ | ◎ | ◎ |
| 809G | ○ | ○ | ◎ | ◎ | ◎ |
| 810G | ○ | ○ | ◎ | ◎ | ◎ |
| 811G | ○ | ○ | ◎ | ◎ | ◎ |
| 812G | ○ | ○ | ◎ | ◎ | ◎ |
| 813G | ○ | ○ | ◎ | ◎ | ◎ |

TABLE 225-continued

| Drum No. | initial charge-retentivity | photo-sensitivity | residual potential | ghost | durability |
|---|---|---|---|---|---|
| 814G | ○ | ○ | ◎ | ◎ | ◎ |
| 815G | ○ | ○ | ◎ | ◎ | ◎ |
| 816G | ○ | ○ | ◎ | ◎ | ◎ |
| 817G | ○ | ○ | ◎ | ◎ | ◎ |
| 818G | ○ | ○ | ◎ | ◎ | ◎ |

◎: Excellent
○: good
Δ: practically applicable
X: practically not applicable

TABLE 226

| Drum No. | initial charge-retentivity | photo-sensitivity | residual potential | ghost | durability |
|---|---|---|---|---|---|
| 901G | ○ | ○ | ○ | ○ | ◎ |
| 902G | ○ | ○ | ○ | ○ | ◎ |
| 903G | ○ | ○ | ○ | ○ | ◎ |
| 904G | ○ | ○ | ○ | ○ | ◎ |
| 905G | ○ | ○ | ○ | ○ | ◎ |
| 906G | ○ | ○ | ○ | ○ | ◎ |
| 907G | ○ | ○ | ○ | ○ | ◎ |
| 908G | ○ | ○ | ○ | ○ | ◎ |
| 909G | ○ | ○ | ○ | ○ | ◎ |
| 910G | ○ | ○ | ○ | ○ | ◎ |
| 911G | ○ | ○ | ○ | ○ | ◎ |
| 912G | ○ | ○ | ○ | ○ | ◎ |
| 913G | ○ | ○ | ○ | ○ | ◎ |
| 914G | ○ | ○ | ○ | ○ | ◎ |
| 915G | ○ | ○ | ○ | ○ | ◎ |
| 916G | ○ | ○ | ○ | ○ | ◎ |
| 917G | ○ | ○ | ○ | ○ | ◎ |
| 918G | ○ | ○ | ○ | ○ | ◎ |

: Excellent
: good
Δ: practically applicable
X: practically not applicable

TABLE 227

| Drum No. | initial charge-retentivity | photo-sensitivity | residual potential | ghost | durability |
|---|---|---|---|---|---|
| 1001 | ○ | ◎ | ○ | ◎ | ◎ |
| 1002 | ○ | ◎ | ○ | ◎ | ◎ |
| 1003 | ○ | ◎ | ○ | ◎ | ◎ |

TABLE 227-continued

| Drum No. | initial charge-retentivity | photo-sensitivity | residual potential | ghost | durability |
|---|---|---|---|---|---|
| 1004 | ○ | ◎ | ○ | ◎ | ◎ |
| 1005 | ○ | ◎ | ○ | ◎ | ◎ |
| 1006 | ○ | ◎ | ○ | ◎ | ◎ |
| 1007 | ○ | ◎ | ○ | ◎ | ◎ |
| 1008 | ○ | ◎ | ○ | ◎ | ◎ |
| 1009 | ○ | ◎ | ○ | ◎ | ◎ |
| 1010 | ○ | ◎ | ○ | ◎ | ◎ |
| 1011 | ○ | ◎ | ○ | ◎ | ◎ |
| 1012 | ○ | ◎ | ○ | ◎ | ◎ |
| 1013 | ○ | ◎ | ○ | ◎ | ◎ |
| 1014 | ○ | ◎ | ○ | ◎ | ◎ |
| 1015 | ○ | ◎ | ○ | ◎ | ◎ |
| 1016 | ○ | ◎ | ○ | ◎ | ◎ |
| 1017 | ○ | ◎ | ○ | ◎ | ◎ |
| 1018 | ○ | ◎ | ○ | ◎ | ◎ |

◎: Excellent
○: good
Δ: practically applicable
X: practically not applicable

TABLE 228

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | 250 | 150 | 0.35 | 1 |
| | $GeH_4$ | | 50 | | | | |
| | $CH_4$ | (substrate side 0.7 μm) | 10 | | | | |
| | | (surface side 0.3 μm) (constantly decrease) | 10 → 0 | | | | |
| | NO | (substrate side 0.7 μm) | 5 | | | | |
| | | (surface side 0.3 μm) (constantly decrease) | 5 → 0 | | | | |
| | $N_2$ | (substrate side 0.7 μm) | 30 | | | | |
| | | (surface side 0.3 μm) (constantly decrease) | 30 → 0 | | | | |
| CGL/CTL | Combination as shown in Table 57 | | | | | | |
| Surface layer | $SiH_4$ | | 50 | 250 | 150 | 0.4 | 5 |
| | $CH_4$ | | 600 | | | | |

TABLE 229

| Drum No. | initial charge-retentivity | photo-sensitivity | residual potential | ghost | durability |
|---|---|---|---|---|---|
| 1101G | ○ | ○ | Δ | ○ | ◎ |
| 1102G | ○ | ○ | Δ | ○ | ◎ |
| 1103G | ○ | ○ | Δ | ○ | ◎ |
| 1104G | ○ | ○ | Δ | ○ | ◎ |
| 1105G | ○ | ○ | Δ | ○ | ◎ |
| 1106G | ○ | ○ | Δ | ○ | ◎ |
| 1107G | ○ | ○ | Δ | ○ | ◎ |
| 1108G | ○ | ○ | Δ | ○ | ◎ |
| 1109G | ○ | ○ | Δ | ○ | ◎ |
| 1110G | ○ | ○ | Δ | ○ | ◎ |
| 1111G | ○ | ○ | Δ | ○ | ◎ |
| 1112G | ○ | ○ | Δ | ○ | ◎ |
| 1113G | ○ | ○ | Δ | ○ | ◎ |
| 1114G | ○ | ○ | Δ | ○ | ◎ |
| 1115G | ○ | ○ | Δ | ○ | ◎ |
| 1116G | ○ | ○ | Δ | ○ | ◎ |
| 1117G | ○ | ○ | Δ | ○ | ◎ |
| 1118G | ○ | ○ | Δ | ○ | ◎ |

◎: Excellent
○: good
Δ: practically applicable
X : practically not applicable

TABLE 230

| Name of layer | Gas used & its flow rate (SCCM) | | Substrate temperature (°C.) | RF power (W) | Internal pressure (Torr) | Layer thickness (μm) |
|---|---|---|---|---|---|---|
| IR absorption layer | $SiH_4$ | 100 | 250 | 150 | 0.35 | 1 |
| | $GeH_4$ | 50 | | | | |
| | $PH_3$ (against $SiH_4$) | 800 ppm | | | | |
| | NO | 5 | | | | |
| | $N_2$ | 30 | | | | |
| | $H_2$ | 100 | | | | |
| | $GeH_4$ | 10 | | | | |
| CGL/CTL | Combination as shown in Table 57 | | | | | |
| Surface layer | $SiH_4$ | 10 | 250 | 150 | 0.4 | 2 |
| | $N_2$ | 500 | | | | |
| | $CH_4$ | 20 | | | | |

TABLE 231

| Drum No. | initial charge-retentivity | photo-sensitivity | residual potential | ghost | durability |
|---|---|---|---|---|---|
| 1201G | ○ | ○ | ○ | ◎ | ◎ |
| 1202G | ○ | ○ | ○ | ◎ | ◎ |
| 1203G | ○ | ○ | ○ | ◎ | ◎ |
| 1204G | ○ | ○ | ○ | ◎ | ◎ |
| 1205G | ○ | ○ | ○ | ◎ | ◎ |
| 1206G | ○ | ○ | ○ | ◎ | ◎ |
| 1207G | ○ | ○ | ○ | ◎ | ◎ |
| 1208G | ○ | ○ | ○ | ◎ | ◎ |
| 1209G | ○ | ○ | ○ | ◎ | ◎ |
| 1210G | ○ | ○ | ○ | ◎ | ◎ |
| 1211G | ○ | ○ | ○ | ◎ | ◎ |
| 1212G | ○ | ○ | ○ | ◎ | ◎ |
| 1213G | ○ | ○ | ○ | ◎ | ◎ |
| 1214G | ○ | ○ | ○ | ◎ | ◎ |
| 1215G | ○ | ○ | ○ | ◎ | ◎ |
| 1216G | ○ | ○ | ○ | ◎ | ◎ |
| 1217G | ○ | ○ | ○ | ◎ | ◎ |
| 1218G | ○ | ○ | ○ | ◎ | ◎ |

◎: Excellent
○: good
Δ: practically applicable
X : practically not applicable

TABLE 232

| Drum No. | initial charge-retentivity | photo-sensitivity | residual potential | ghost | durability |
|---|---|---|---|---|---|
| 1301G | ○ | ○ | ◎ | ○ | ◎ |
| 1302G | ○ | ○ | ◎ | ○ | ◎ |
| 1303G | ○ | ○ | ◎ | ○ | ◎ |
| 1304G | ○ | ○ | ◎ | ○ | ◎ |
| 1305G | ○ | ○ | ◎ | ○ | ◎ |
| 1306G | ○ | ○ | ◎ | ○ | ◎ |
| 1307G | ○ | ○ | ◎ | ○ | ◎ |
| 1308G | ○ | ○ | ◎ | ○ | ◎ |
| 1309G | ○ | ○ | ◎ | ○ | ◎ |
| 1310G | ○ | ○ | ◎ | ○ | ◎ |
| 1311G | ○ | ○ | ◎ | ○ | ◎ |
| 1312G | ○ | ○ | ◎ | ○ | ◎ |
| 1313G | ○ | ○ | ◎ | ○ | ◎ |
| 1314G | ○ | ○ | ◎ | ○ | ◎ |
| 1315G | ○ | ○ | ◎ | ○ | ◎ |
| 1316G | ○ | ○ | ◎ | ○ | ◎ |
| 1317G | ○ | ○ | ◎ | ○ | ◎ |
| 1318G | ○ | ○ | ◎ | ○ | ◎ |

◎: Excellent
○: good
Δ: practically applicable
X : practically not applicable

TABLE 233

| Drum No. | initial charge-retentivity | photo-sensitivity | residual potential | ghost | durability |
|---|---|---|---|---|---|
| 1401G | ○ | ○ | ◎ | ○ | ◎ |
| 1402G | ○ | ○ | ◎ | ○ | ◎ |
| 1403G | ○ | ○ | ◎ | ○ | ◎ |
| 1404G | ○ | ○ | ◎ | ○ | ◎ |
| 1405G | ○ | ○ | ◎ | ○ | ◎ |
| 1406G | ○ | ○ | ◎ | ○ | ◎ |
| 1407G | ○ | ○ | ◎ | ○ | ◎ |
| 1408G | ○ | ○ | ◎ | ○ | ◎ |
| 1409G | ○ | ○ | ◎ | ○ | ◎ |
| 1410G | ○ | ○ | ◎ | ○ | ◎ |
| 1411G | ○ | ○ | ◎ | ○ | ◎ |
| 1412G | ○ | ○ | ◎ | ○ | ◎ |
| 1413G | ○ | ○ | ◎ | ○ | ◎ |
| 1414G | ○ | ○ | ◎ | ○ | ◎ |
| 1415G | ○ | ○ | ◎ | ○ | ◎ |
| 1416G | ○ | ○ | ◎ | ○ | ◎ |
| 1417G | ○ | ○ | ◎ | ○ | ◎ |
| 1418G | ○ | ○ | ◎ | ○ | ◎ |

◎: Excellent
○: good
Δ: practically applicable
X: practically not applicable

TABLE 234

| Drum No. | initial charge-retentivity | photo-sensitivity | residual potential | ghost | durability |
|---|---|---|---|---|---|
| 1501G | ○ | ○ | ○ | ◎ | ◎ |
| 1502G | ○ | ○ | ○ | ◎ | ◎ |
| 1503G | ○ | ○ | ○ | ◎ | ◎ |
| 1504G | ○ | ○ | ○ | ◎ | ◎ |
| 1505G | ○ | ○ | ○ | ◎ | ◎ |
| 1506G | ○ | ○ | ○ | ◎ | ◎ |
| 1507G | ○ | ○ | ○ | ◎ | ◎ |
| 1508G | ○ | ○ | ○ | ◎ | ◎ |
| 1509G | ○ | ○ | ○ | ◎ | ◎ |
| 1510G | ○ | ○ | ○ | ◎ | ◎ |
| 1511G | ○ | ○ | ○ | ◎ | ◎ |
| 1512G | ○ | ○ | ○ | ◎ | ◎ |
| 1513G | ○ | ○ | ○ | ◎ | ◎ |
| 1514G | ○ | ○ | ○ | ◎ | ◎ |
| 1515G | ○ | ○ | ○ | ◎ | ◎ |
| 1516G | ○ | ○ | ○ | ◎ | ◎ |
| 1517G | ○ | ○ | ○ | ◎ | ◎ |
| 1518G | ○ | ○ | ○ | ◎ | ◎ |

◎: Excellent
○: good
Δ: practically applicable
X: practically not applicable

TABLE 235

| Drum No. | initial charge-retentivity | photo-sensitivity | residual potential | ghost | durability |
|---|---|---|---|---|---|
| 1601G | ○ | ○ | ○ | ○ | ◎ |
| 1602G | ○ | ○ | ○ | ○ | ◎ |
| 1603G | ○ | ○ | ○ | ○ | ◎ |
| 1604G | ○ | ○ | ○ | ○ | ◎ |
| 1605G | ○ | ○ | ○ | ○ | ◎ |
| 1606G | ○ | ○ | ○ | ○ | ◎ |
| 1607G | ○ | ○ | ○ | ○ | ◎ |
| 1608G | ○ | ○ | ○ | ○ | ◎ |
| 1609G | ○ | ○ | ○ | ○ | ◎ |
| 1610G | ○ | ○ | ○ | ○ | ◎ |
| 1611G | ○ | ○ | ○ | ○ | ◎ |
| 1612G | ○ | ○ | ○ | ○ | ◎ |
| 1613G | ○ | ○ | ○ | ○ | ◎ |
| 1614G | ○ | ○ | ○ | ○ | ◎ |
| 1615G | ○ | ○ | ○ | ○ | ◎ |
| 1616G | ○ | ○ | ○ | ○ | ◎ |
| 1617G | ○ | ○ | ○ | ○ | ◎ |
| 1618G | ○ | ○ | ○ | ○ | ◎ |

◎: Excellent
○: good
Δ: practically applicable
X: practically not applicable

TABLE 236

| Name of layer | Gas used & its flow rate (SCCM) | | | Substrate temperature (°C.) | RF power (W) | Internal pressure (Torr) | Layer thickness (μm) |
|---|---|---|---|---|---|---|---|
| IR absorption layer | $SiH_4$ | | 100 | | | | |
| | $GeH_4$ | | 10 | | | | |
| | $CH_4$ | (substrate side 0.7 μm) | 25 | | | | |
| | | (surface side 0.3 μm) | 25 → 20 | | | | |
| | | (constantly decrease) | | 250 | 150 | 0.35 | 1 |
| | NO | | 10 | | | | |
| | $N_2$ | (substrate side 0.7 μm) | 30 | | | | |
| | | (surface side 0.3 μm) | 30 → 0 | | | | |
| | | (constantly decrease) | | | | | |
| CGL/ | Combination as shown in Table 78 | | | | | | |
| CTL Surface layer | $SiH_4$ | | 10 | 250 | 200 | 0.4 | 2 |
| | $N_2$ | | 500 | | | | |
| | $CH_4$ | | 20 | | | | |

TABLE 237

| Drum No. | initial charge-retentivity | photo-sensitivity | residual potential | ghost | durability |
|---|---|---|---|---|---|
| 1701G | ○ | ○ | ○ | ◎ | ◎ |
| 1702G | ○ | ○ | ○ | ◎ | ◎ |
| 1703G | ○ | ○ | ○ | ◎ | ◎ |
| 1704G | ○ | ○ | ○ | ◎ | ◎ |
| 1705G | ○ | ○ | ○ | ◎ | ◎ |
| 1706G | ○ | ○ | ○ | ◎ | ◎ |
| 1707G | ○ | ○ | ○ | ◎ | ◎ |
| 1708G | ○ | ○ | ○ | ◎ | ◎ |
| 1709G | ○ | ○ | ○ | ◎ | ◎ |
| 1710G | ○ | ○ | ○ | ◎ | ◎ |
| 1711G | ○ | ○ | ○ | ◎ | ◎ |
| 1712G | ○ | ○ | ○ | ◎ | ◎ |
| 1713G | ○ | ○ | ○ | ◎ | ◎ |
| 1714G | ○ | ○ | ○ | ◎ | ◎ |
| 1715G | ○ | ○ | ○ | ◎ | ◎ |
| 1716G | ○ | ○ | ○ | ◎ | ◎ |
| 1717G | ○ | ○ | ○ | ◎ | ◎ |

TABLE 237-continued

| Drum No. | initial charge-retentivity | photo-sensitivity | residual potential | ghost | durability |
|---|---|---|---|---|---|
| 1718G | ○ | ○ | ○ | ◎ | ◎ |

◎: Excellent
○: good
Δ: practically applicable
X: practically not applicable

TABLE 238

| Drum No. | initial charge-retentivity | photo-sensitivity | residual potential | ghost | durability |
|---|---|---|---|---|---|
| 1801G | ○ | ○ | ○ | ○ | ◎ |
| 1802G | ○ | ○ | ○ | ○ | ◎ |
| 1803G | ○ | ○ | ○ | ○ | ◎ |
| 1804G | ○ | ○ | ○ | ○ | ◎ |
| 1805G | ○ | ○ | ○ | ○ | ◎ |
| 1806G | ○ | ○ | ○ | ○ | ◎ |
| 1807G | ○ | ○ | ○ | ○ | ◎ |
| 1808G | ○ | ○ | ○ | ○ | ◎ |
| 1809G | ○ | ○ | ○ | ○ | ◎ |
| 1810G | ○ | ○ | ○ | ○ | ◎ |
| 1811G | ○ | ○ | ○ | ○ | ◎ |
| 1812G | ○ | ○ | ○ | ○ | ◎ |
| 1813G | ○ | ○ | ○ | ○ | ◎ |
| 1814G | ○ | ○ | ○ | ○ | ◎ |
| 1815G | ○ | ○ | ○ | ○ | ◎ |
| 1816G | ○ | ○ | ○ | ○ | ◎ |
| 1817G | ○ | ○ | ○ | ○ | ◎ |
| 1818G | ○ | ○ | ○ | ○ | ◎ |

◎: Excellent
○: good
Δ: practically applicable
X: practically not applicable

TABLE 239

| Drum No. | initial charge-retentivity | photo-sensitivity | residual potential | ghost | durability |
|---|---|---|---|---|---|
| 1901G | ○ | ○ | ○ | ○ | ◎ |
| 1902G | ○ | ○ | ○ | ○ | ◎ |
| 1903G | ○ | ○ | ○ | ○ | ◎ |
| 1904G | ○ | ○ | ○ | ○ | ◎ |
| 1905G | ○ | ○ | ○ | ○ | ◎ |
| 1906G | ○ | ○ | ○ | ○ | ◎ |
| 1907G | ○ | ○ | ○ | ○ | ◎ |
| 1908G | ○ | ○ | ○ | ○ | ◎ |
| 1909G | ○ | ○ | ○ | ○ | ◎ |
| 1910G | ○ | ○ | ○ | ○ | ◎ |

TABLE 239-continued

| Drum No. | initial charge-retentivity | photo-sensitivity | residual potential | ghost | durability |
|---|---|---|---|---|---|
| 1911G | ◎ | ○ | ○ | ○ | ○ |
| 1912G | ◎ | ○ | ○ | ○ | ○ |
| 1913G | ◎ | ○ | ○ | ○ | ○ |
| 1914G | ◎ | ○ | ○ | ○ | ○ |
| 1915G | ◎ | ○ | ○ | ○ | ○ |
| 1916G | ◎ | ○ | ○ | ○ | ○ |
| 1917G | ◎ | ○ | ○ | ○ | ○ |
| 1918G | ◎ | ○ | ○ | ○ | ○ |

◎: Excellent
○: good
Δ: practically applicable
X: practically not applicable

TABLE 240

| Drum No. | initial charge-retentivity | photo-sensitivity | residual potential | ghost | durability |
|---|---|---|---|---|---|
| 2001 | ○ | ○ | ○ | ○ | ◎ |
| 2002 | ○ | ○ | ○ | ○ | ◎ |
| 2003 | ○ | ○ | ○ | ○ | ◎ |
| 2004 | ○ | ○ | ○ | ○ | ◎ |
| 2005 | ○ | ○ | ○ | ○ | ◎ |
| 2006 | ○ | ○ | ○ | ○ | ◎ |
| 2007 | ○ | ○ | ○ | ○ | ◎ |
| 2008 | ○ | ○ | ○ | ○ | ◎ |
| 2009 | ○ | ○ | ○ | ○ | ◎ |
| 2010 | ○ | ○ | ○ | ○ | ◎ |
| 2011 | ○ | ○ | ○ | ○ | ◎ |
| 2012 | ○ | ○ | ○ | ○ | ◎ |
| 2013 | ○ | ○ | ○ | ○ | ◎ |
| 2014 | ○ | ○ | ○ | ○ | ◎ |
| 2015 | ○ | ○ | ○ | ○ | ◎ |
| 2016 | ○ | ○ | ○ | ○ | ◎ |
| 2017 | ○ | ○ | ○ | ○ | ◎ |

◎: Excellent
○: good
Δ: practically applicable
X: practically not applicable

TABLE 241

| Drum No. | 2101G | 2102G | 2103G | 2104G | 2105G |
|---|---|---|---|---|---|
| a [μm] | 25 | 50 | 50 | 12 | 12 |
| b [μm] | 0.8 | 2.5 | 0.8 | 1.5 | 0.3 |

TABLE 241 A

| Drum No. | initial charge-reten-tivity | photo-sensi-tivity | residual potential | ghost | dura-bility | defec-tive image | inter-ference fringe |
|---|---|---|---|---|---|---|---|
| 2101G | ○ | ○ | ○ | ○ | ◎ | ○ | ◎ |
| 2102G | ○ | ○ | ○ | ○ | ◎ | ○ | ◎ |
| 2103G | ○ | ○ | ○ | ○ | ◎ | ○ | ○ |
| 2104G | ○ | ○ | ○ | ○ | ◎ | ○ | ◎ |
| 2105G | ○ | ○ | ○ | ○ | ◎ | ○ | ○ |

◎: Excellent
○: good
Δ: practically applicable
X : practically not applicable

TABLE 242

| Drum No. | 2111G | 2112G | 2113G | 2114G | 2115G |
|---|---|---|---|---|---|
| a [μm] | 30 | 40 | 50 | 70 | 100 |
| b [μm] | 0.7 | 1.0 | 1.2 | 2 | 5 |

TABLE 242G

| Drum No. | initial charge-reten-tivity | photo-sensi-tivity | residual potential | ghost | dura-bility | defec-tive image | inter-ference fringe |
|---|---|---|---|---|---|---|---|
| 2111G | ○ | ○ | ○ | ○ | ◎ | ◎ | ○ |
| 2112G | ○ | ○ | ○ | ○ | ◎ | ◎ | ◎ |
| 2113G | ○ | ○ | ○ | ○ | ◎ | ◎ | ◎ |
| 2114G | ○ | ○ | ○ | ○ | ◎ | ◎ | ○ |
| 2115G | ○ | ○ | ○ | ○ | ◎ | ◎ | ○ |

◎: Excellent
○: good
Δ: practically applicable
X: practically not applicable

TABLE 243

| Drum No. | initial charge-retentivity | photo-sensitivity | residual potential | ghost | durability |
|---|---|---|---|---|---|
| 2201G | ○ | ○ | ○ | ○ | ◎ |
| 2202G | ○ | ○ | ○ | ○ | ◎ |
| 2203G | ○ | ○ | ○ | ○ | ◎ |
| 2204G | ○ | ○ | ○ | ○ | ◎ |
| 2205G | ○ | ○ | ○ | ○ | ◎ |
| 2206G | ○ | ○ | ○ | ○ | ◎ |
| 2207G | ○ | ○ | ○ | ○ | ◎ |
| 2208G | ○ | ○ | ○ | ○ | ◎ |
| 2209G | ○ | ○ | ○ | ○ | ◎ |
| 2210G | ○ | ○ | ○ | ○ | ◎ |
| 2211G | ○ | ○ | ○ | ○ | ◎ |
| 2212G | ○ | ○ | ○ | ○ | ◎ |
| 2213G | ○ | ○ | ○ | ○ | ◎ |
| 2214G | ○ | ○ | ○ | ○ | ◎ |
| 2215G | ○ | ○ | ○ | ○ | ◎ |
| 2216G | ○ | ○ | ○ | ○ | ◎ |
| 2217G | ○ | ○ | ○ | ○ | ◎ |
| 2218G | ○ | ○ | ○ | ○ | ◎ |

◎: Excellent
○: good
Δ: practically applicable
X : practically not applicable

What is claimed is:

1. A light receiving member for use in electrophotography comprising a substrate for electrophotography and a light receiving layer having, in sequence, (i) a charge carrier generation layer and (ii) a charge carrier transport layer on said substrate, said charge carrier generation layer (i) being formed of a non-single-crystal material substantially consisting of silicon atoms as the main constituent atoms and at least one kind selected from the group consisting of hydrogen atoms and halogen atoms in a total amount of 1 to 40 atomic percent and said charge carrier transport layer (ii) being formed of a non-single-crystal material containing silicon atoms as the main constituent atoms, carbon atoms, a conductivity controlling element capable of providing p-type conductivity or n-type conductivity in an unevenly distributed state in the thickness direction and at least one kind selected from the group consisting of hydrogen atoms and halogen atoms.

2. A light receiving member for use in electrophotography according to claim 1, wherein the charge carrier generation layer is 0.01 to 30 μm thick and the charge carrier transport layer is 5 to 50 μm thick.

3. A light receiving member for use in electrophotography according to claim 1, the substrate is electroconductive.

4. A light receiving member for use in electrophotography according to claim 1, wherein the substrate is electrically insulative.

5. A light receiving member for use in electrophotography according to claim 1, wherein the substrate is cylindrical in form.

6. A light receiving member for use in electrophotography according to claim 1, wherein the substrate has an uneven surface.

7. A light receiving member for use in electrophotography according to claim 1, wherein the substrate has an irregular surface.

8. A light receiving member for use in electrophotography according to claim 1, wherein said conductivity controlling element capable of providing p-type conductivity contained in the charge carrier transport layer is an element selected from the group consisting of boron, aluminum, gallium, indium and thallium.

9. A light receiving member for use in electrophotography according to claim 1, wherein the amount of said element in the charge carrier transport layer is in the range of from 0.001 to 3000 atomic ppm.

10. A light receiving member for use in electrophotography according to claim 1, wherein said conductivity controlling element capable of providing n-type conductivity contained in the charge carrier transport layer is an element selected from the group consisting of phosphorous, arsenic, antimony and bismuth.

11. A light receiving member for use in electrophotography according to claim 1, wherein the amount of said element in the charge carrier transport layer is in the range of from 0.001 to 3000 atomic ppm.

12. A light receiving member for use in electrophotography according to claim 1, wherein the amount of said carbon atoms in the charge carrier transport layer is in the range of from 0.01 to 50 atomic percent.

13. A light receiving member for use in electrophotography according to claim 1, wherein the charge carrier transport layer contains said carbon atoms in a uniformly distributed state in the thickness direction.

14. A light receiving member for use in electrophotography according to claim 1, wherein the charge carrier transport layer contains said carbon atoms in an unevenly distributed state in the thickness direction.

15. A light receiving member for use in electrophotography according to claim 1, wherein the charge carrier transport layer contains at least one kind selected from the group consisting of nitrogen atoms and oxygen atoms in addition to said carbon atoms.

16. A light receiving member for use in electrophotography according to claim 1, wherein the total amount of the carbon atoms and said at least one kind selected from the group consisting of nitrogen atoms and oxygen atoms in the charge carrier transport layer is in the range of from 0.01 to 50 atomic percent.

17. A light receiving member for use in electrophotography according to claim 1, wherein the charge carrier transport layer contains said at least one kind selected from the group consisting of hydrogen atoms and halogen atoms in a total amount of 1 to 70 atomic percent.

18. A light receiving member for use in electrophotography according to claim 1, wherein the light receiving layer contains a charge injection inhibition layer under the charge carrier generation layer.

19. A light receiving member for use in electrophotography according to claim 18, wherein the charge injection inhibition layer is 0.01 to 10 μm thick and comprises a member selected from the group consisting of (a) a non-single-crystal silicon-containing material containing a conductivity controlling element and at least one kind selected from the group consisting of hydrogen atoms and halogen atoms, (b) a non-single-crystal silicon-containing material at least one kind selected from the group consisting of carbon atoms, oxygen atoms and nitrogen atoms and (c) a non-single-crystal silicon-containing material containing at least one kind selected from the group consisting of carbon atoms, oxygen atoms and nitrogen atoms and at least one kind selected from the group consisting of hydrogen atoms, halogen atoms and a conductivity controlling element capable of providing p-type conductivity or n-type conductivity.

20. A light receiving member for use in electrophotography according to claim 1, wherein the light receiving layer contains an infrared absorptive layer under the charge carrier generation layer.

21. A light receiving member for use in electrophotography according to claim 20, wherein the infrared absorption layer is 0.05 to 25 μm thick and comprises a non-single-crystal material containing at least one kind selected from the group consisting of germanium atoms and tin atoms and at least one kind selected from the group consisting of hydrogen atoms and halogen atoms.

22. A light receiving member for use in electrophotography according to claim 21, wherein the infrared absorption layer further contains silicon atoms.

23. A light receiving member for use in electrophotography according to claim 21, wherein the infrared absorption layer further contains a conductivity controlling element capable of providing p-type conductivity or n-type conductivity.

24. A light receiving member for use in electrophotography according to claim 21, wherein the infrared absorption layer further contains at least one kind selected from the group consisting of carbon atoms, oxygen atoms and nitrogen atoms.

25. A light receiving member for use in electrophotography according to claim 1, wherein the light receiving layer contains a surface layer on the charge carrier transport layer.

26. A light receiving member for use in electrophotography according to claim 25, wherein the surface layer is 0.003 to 30 μm thick and comprises a non-single-crystal material substantially composed of silicon atoms as the main constituent atoms, at least one kind selected from the group consisting of carbon atoms, oxygen atoms and nitrogen atoms and at least one kind selected from the group consisting of hydrogen atoms and halogen atoms.

27. A light receiving member for use in electrophotography according to claim 18, wherein an infrared absorption layer is disposed between the substrate and the charge injection inhibition layer.

28. A light receiving member for use in electrophotography according to claim 27, wherein the charge injection inhibition layer is 0.01 to 10 μm thick and comprises a member selected from the group consisting of (a) a non-single-crystal silicon-containing material containing a conductivity controlling element and at least one kind selected from the group consisting of hydrogen atoms and halogen atoms, (b) a non-single-crystal silicon-containing material containing at least one kind selected from the group consisting of carbon atoms, oxygen atoms and nitrogen atoms, and (c) a non-single-crystal silicon-containing material containing at least one kind selected from the group consisting of carbon atoms, oxygen atoms and nitrogen atoms and at least one kind selected from the group consisting of hydrogen atoms, halogen atoms and a conductivity controlling element capable of providing p-type conductivity or n-type conductivity and wherein the infrared absorption layer is 0.05 to 25 μm thick and comprises a non-single-crystal material containing at least one kind selected from the group consisting of germanium atoms and tin atoms and at least one kind selected from the group consisting of hydrogen atoms and halogen atoms.

29. A light receiving member for use in electrophotography according to claim 28, wherein the infrared absorption layer further contains silicon atoms.

30. A light receiving member for use in electrophotography according to claim 28, wherein the infrared absorption layer further contains a conductivity controlling element capable of providing p-type conductivity or n-type conductivity.

31. A light receiving member for use in electrophotography according to claim 28, wherein the infrared absorption layer further contains at least one kind selected from the group consisting of carbon atoms, oxygen atoms and nitrogen atoms.

32. A light receiving member for use in electrophotography according to claim 18, wherein a surface layer is disposed on the charge carrier transport layer.

33. A light receiving member for use in electrophotography according to claim 32, wherein the charge injection inhibition layer is 0.01 to 10 μm thick and comprises a member selected from the group consisting of (a) a non-single-crystal silicon-containing material containing a conductivity controlling element and at least one kind selected from the group consisting of hydrogen atoms and halogen atoms, (b) a non-single-crystal silicon-containing material containing at least one kind selected from the group consisting of carbon atoms, oxygen atoms and nitrogen atoms and (c) a non-single-crystal silicon-containing material containing at least one kind selected from the group consisting of carbon atoms, oxygen atoms and nitrogen atoms and at least one kind selected from the group consisting of hydrogen atoms, halogen atoms and a conductivity controlling element capable of providing p-type conductivity or n-type conductivity and wherein the surface layer is 0.003 to 30 μm thick and comprises a non-single-crystal material substantially composed of silicon atoms as the main constituent atoms, at least one kind selected from the group consisting of carbon atoms, oxygen atoms and nitrogen atoms and at least one kind selected from the group consisting of hydrogen atoms and halogen atoms.

34. A light receiving member for use in electrophotography according to claim 20, wherein a surface layer is disposed on the charge carrier transport layer.

35. A light receiving member for use in electrophotography according to claim 35, wherein the infrared absorption layer is 0.05 to 25 μm thick and comprises a non-single-crystal material containing at least one kind selected from the group consisting of germanium atoms and tin atoms and at least one kind selected from the group consisting of hydrogen atoms and halogen atoms and wherein the surface layer is 0.003 to 30 μm thick and comprises a non-single-crystal material substantially composed of silicon atoms as the main constituent atoms, at least one kind selected from the group consisting of carbon atoms, oxygen atoms and nitrogen atoms and at least one kind selected from the group consisting of hydrogen atoms and halogen atoms.

36. A light receiving member for use in electrophotography according to claim 35, wherein the infrared absorption layer further contains silicon atoms.

37. A light receiving member for use in electrophotography according to claim 35, wherein the infrared absorption layer further contains a conductivity controlling element capable of providing p-type conductivity or n-type conductivity.

38. A light receiving member for use in electrophotography according to claim 35, wherein the infrared absorption layer further contains at least one kind selected from the group consisting of carbon atoms, oxygen atoms and nitrogen atoms.

39. A light receiving member for use in electrophotography according to claim 27, wherein a surface layer is disposed on the charge carrier transport layer.

40. A light receiving member for use in electrophotography according to claim 39, wherein the infrared absorption layer is 0.05 to 25 μm thick and comprises a non-single-crystal material containing at least one kind selected from the group consisting of germanium atoms and tin atoms and at least one kind selected from the group consisting of hydrogen atoms and halogen atoms, the charge injection inhibition layer is 0.01 to 10 μm thick and comprises a member selected from the group consisting of (a) a non-single-crystal silicon-containing material containing a conductivity controlling element and at least one kind selected from the group consisting of hydrogen atoms and halogen atoms, (b) a non-single-crystal silicon-containing material containing at least one kind selected from the group consisting of carbon atoms, oxygen atoms and nitrogen atoms and (c) a non-single-crystal silicon-containing material containing at least one kind selected from the group consisting of carbon atoms, oxygen atoms and nitrogen atoms and at least one kind selected from the group consisting of hydrogen atoms, halogen atoms and a conductivity controlling element capable of providing p-type conductivity or n-type conductivity and wherein the surface layer is 0.003 to 30 μm thick and comprises a non-single-crystal material substantially composed of silicon atoms as the main constituent atoms, at least one kind selected from the group consisting of carbon atoms, oxygen atoms and nitrogen atoms and at least one kind selected from the group consisting of hydrogen atoms and halogen atoms.

41. A light receiving member for use in electrophotography according to claim 40, wherein the infrared absorption layer further contains silicon atoms.

42. A light receiving member for use in electrophotography according to claim 40, wherein the infrared absorption layer further contains a conductivity controlling element capable of providing p-type conductivity or n-type conductivity.

43. A light receiving member for use in electrophotography according to claim 40, wherein the infrared absorption layer further contains at least one kind selected from the group consisting of carbon atoms, oxygen atoms and nitrogen atoms.

44. An electrophotographic process comprising:

(a) applying a charge to the light receiving member of claim 1; and (b) applying an electromagnetic wave to said light receiving member thereby forming an electrostatic image.

* * * * *

UNITED STATES PATENT AND TRADEMARK OFFICE

CERTIFICATE OF CORRECTION

PATENT NO. : 4,954,397

DATED : September 4, 1990

INVENTOR(S) : HIROSHI AMANDA ET AL.

It is certified that error appears in the above-identified patent and that said Letters Patent is hereby corrected as shown below:

IN [57] ABSTRACT

Line 20, "is" should read --is characterized--.
Line 24, "degreadation" should read --degradation--.
Line 26, "scarce" should read --little--.

COLUMN 2

Line 12, "to" should be deleted.

COLUMN 3

Line 50, "hereinafter" should read --(hereinafter,--.

COLUMN 4

Line 61, "of" should read --on--.

COLUMN 5

Line 49, "during" should read --during illumination--.

COLUMN 8

Line 5, "material. Illustrated" should read --material. ¶ Illustrated--.
Line 17, "CTL" should read --CTL 106--.

COLUMN 9

Line 57, "sirably" should read --sirable--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 11

Line 26, "or" should read --of--.
Line 44, "graviationally" should read --gravitationally--.

COLUMN 12

Line 34, " "atoms (Ge,Sn)", " should read --atoms (Ge,Sn),"],--.
Line 37, "hereinafter" should read [hereinafter--.
Line 38, " "Non-(Ge,Sn)(Si)(H,X)". " should read --"Non-(Ge,Sn)(Si)(H,X)"].--.

Column 13

Line 20, "during" should read --during illumination--.
Line 56, "position B" should read --position $t_B$--.

COLUMN 14

Line 49, "oxygen atoms (O)" should read --oxygen atoms (O)--.

COLUMN 18

Line 26, "atomic %" (first occurrence) should be deleted.

COLUMN 19

Line 29, "uniformely" should read --uniformly--.
Line 60, "representative" should read --represents--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 23

Line 42, "hydrogen atom" should read --hydrogen atoms--.

COLUMN 26

Line 67, "abovementioned" should read --above-mentioned--.

COLUMN 28

Line 8, "copable" should read --capable--.

COLUMN 29

Line 38, "halogen atoms (H)" should read --halogen atoms (X)--.

COLUMN 31

Line 34, "copable" should read --capable--.
Line 37, "In" should read --¶ In--.

COLUMN 32

Line 58, "silution" should read --dilution--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 33

Line 34, "raw" should read --raw material--.
Line 50, "sputtered" should read --sputtering--.

COLUMN 34

Line 41, "ammonium azide ($NH_3N_3$)." should read --ammonium azide ($NH_4N_3$).--.

COLUMN 35

Line 57, "$1X10^{-3}$ Torr," should read --$1X10^{-3}$ Torr to 1 Torr.

COLUMN 36

Line 10, "anealed" should read --annealing--.
Line 11, "anealing" should read --annealing--.
Line 42, "member," should read --member--.

COLUMN 37

Line 5, "2 $kg/cm_2$." should read -- 2 $kg/cm^2$.--.
Line 27, "The," should read --Then,--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 39

Line 14, "2014, 2016" should read --2014, 2015, 2016--.
Line 18, close up right margin.
Line 19, close up left margin.
Line 46, "exit valves 2041 through 2046" should read --exit valves 2041 through 2047--.
Line 52, "2012 through 2027" should read --2021 through 2027--.

COLUMN 41

Line 11, "1047," should read --2047,--.
Line 31, "1041 and 1042" should read --2041 and 2042--.
Line 34, "1041 and 1047" should read --2041 and 2047--. and "1070" should read --2070--.
Line 36, "chamber 1001." should read --chamber 2001.--.
Line 37, "1041 and 1047" should read --2041 and 2047--.
Line 41, "valve 1002" should read --valve 2002--.
Line 42, "gauge 1004" should read --gauge 2004--.
Line 44, "chamber 1001" should read --chamber 2001--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 43

Line 42, "1012," should read --4012,--.
Line 55, "$H_2$in" should read --$H_2$ in--.

COLUMN 44

Line 18, "aneal" should read --anneal--.

COLUMN 46

Line 25, "EXAMPLE 17" should read --EXAMPLE 7--.

COLUMN 50

Line 65, Example 33" should read --EXAMPLE 33--.

COLUMN 52

Line 31, "patters" should read --patterns--.
Line 49, "bearing balls" should read --ball bearings--.
Line 52, "crosssectional" should read --cross-sectional--.
Line 53, "Rf" should read --RF--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 53

Line 1, "Rf" should read --RF--.

COLUMN 59

Line 18,
Table 16(cont'd), "diversity" should read --diversify--.

COLUMN 61

Lines 15 and 16,
Table 21, "CTL 2 CTL 3 CTL 4 CTL 5 CTL 6 CTL 7 CTL 8 CTL "
should read
--CTL 1 CTL 2 CTL 3 CTL 4 CTL 5 CTL 6 CTL 7 CTL 8 --.

COLUMN 65

Lines 53 and 54,
Table 34, "$CH_4$ (substrate side 0.7 μm) 10
(surface side 0.3 μm) "
should read
--$CH_4$ (substrate side 0.7 μm) 10
(surface side 0.3 μm) 10 → 1--.

COLUMN 69

Lines 44-49,
Table 44, "residual potential
should read
--residual potential
"
--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 70

Lines 3-15,

Table 44-continued

| "residual potential | | --residual potential | |
|---|---|---|---|
| ○ | should read | ⊙ | |
| ○ | | ⊙ | |
| ○ | | ⊙ | |
| ○ | | ⊙ | |
| ○ | | ⊙ | |
| ○ | | ⊙ | |
| ○ | | ⊙ | |
| ○ | | ⊙ | |
| ○ | | ⊙ | |
| ○ | | ⊙ | |
| ○ | | ⊙ | |
| ○ | " | ⊙ | --. |
| ○ | | ⊙ | |

COLUMN 71

Lines 13-18 and 44-56,

Table 47

| "residual potential | ghost | | --residual potential | ghost | |
|---|---|---|---|---|---|
| ○ | ○ | should read | ⊙ | ⊙ | |
| ○ | ○ | | ⊙ | ⊙ | |
| ○ | ○ | | ⊙ | ⊙ | |
| ○ | ○ | | ⊙ | ⊙ | |
| ○ | ○ | | ⊙ | ⊙ | |
| ○ | ○ | | ⊙ | ⊙ | |
| ○ | ○ | | ⊙ | ⊙ | |
| ○ | ○ | | ⊙ | ⊙ | |
| ○ | ○ | | ⊙ | ⊙ | |
| ○ | ○ | | ⊙ | ⊙ | |
| ○ | ○ | | ⊙ | ⊙ | |
| ○ | ○ | | ⊙ | ⊙ | |
| ○ | ○ | " | ⊙ | ⊙ | --. |
| ○ | ○ | | ⊙ | ⊙ | |
| ○ | ○ | | ⊙ | ⊙ | |

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 79

LIne 6 and 8,
Table 65-continued, " :Excellent" should read
-- ◎ :Excellent--; and
" :good" should read -- ○ :good--.

COLUMN 81

Table 70-continued, "decreased)" should read
--decrease)--.

COLUMN 83

LIne 35,
Table 76, "150 250 150 0.35 3" should read
--150 250 150 0.35 3--.

COLUMN 85

Lines 36, 37, 51, 53 and 54,
Table 82, "$SiH_4$ 100
$GeH_4$ 10"
should read --$SiH_4$ 100
$GeH_4$ 10--; and "CG/CTL" should read --CGL/CTL--; and "$N_2$ 500 m
$CH_4$ 20"
should read
--$N_2$ 500 m
$CH_4$ 20--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 87

Table 85, "150 250 150 0.35 3" should read
--150 250 150 0.35 3--.

Table 86, "ghost --ghost
should read
"--.

COLUMN 99

Table 112, "$B_2H_6$(against $SiH_4$" should read
--$B_2H_6$(against $SiH_4$)--.

Table 113, "

| | | | | | | | |
|---|---|---|---|---|---|---|---|
| | | $SiH_4$ | 120 | | | | |
| CGL 2 | | $SiF_4$ | 40 | 250 | 300 | 2 | 2" |

should read

| | | | | | | | |
|---|---|---|---|---|---|---|---|
| --CGL 2 | | $SiH_4$ | 120 | 250 | 300 | 2 | 2 |
| | | $SiF_4$ | 40--. | | | | |

COLUMN 100

Table 114, "

| | | | | | | |
|---|---|---|---|---|---|---|
| CTL 7 | $SiH_4$ | 240 | 250 | 3 | 28 | |
| | $C_2H_4$ | | 16" | | | |

should read

| | | | | | | |
|---|---|---|---|---|---|---|
| --CTL 7 | $SiH_4$ | 240 | 250 | 3 | 28 | |
| | $C_2H_4$ | 16--. | | | | |

Table 115, "photo- --photo-
senitivity" should read sensitivity--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 106

Lines 10-16,
Table 128, "

| durability | defective image | interference fringe |
|---|---|---|
| ○ | ◎ | ○ |
| ○ | ◎ | ○ |
| ○ | ◎ | ○ |
| ○ | ◎ | ○ |
| ○ | ◎ | ○ |

"

should read

--

| durability | defective image | interference fringe |
|---|---|---|
| ◎ | ○ | ◎ |
| ◎ | ○ | ◎ |
| ◎ | ○ | ○ |
| ◎ | ○ | ◎ |
| ◎ | ○ | ○ |

--.

COLUMN 108

Lines 62 and 63,
Table 136, "photo-senitivity" should read --photo-sensitivity--.

COLUMN 109

Lines 3 and 4,
Table 136-continued, "photo-senitivity" should read --photo-sensitivity--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 111

Table 138, "photo- senitivity" should read --photo- sensitivity--.

COLUMN 112

Table 139, "photo- senitivity" should read --photo- sensitivity--.

COLUMN 113

Table 140, "photo- senitivity" should read --photo- sensitivity--.

Table 141, "photo- senitivity" should read --photo- sensitivity--.

COLUMN 114

Table 144, "601, 602, 603, 604, 605, 606, 607, 608, 609, 610, 611, 612, 613, 614, 615, 616, 617" should read --601A, 602A, 603A, 604A, 605A, 606A, 607A, 608A, 609A, 610A, 611A, 612A, 613A, 614A, 615A, 616A, 617A--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 116

Table 149, "

: Excellent
: good
Δ: practically applicable
X : practically not applicable

" should read

--

●: Excellent
○: good
Δ: practically applicable
X : practically not applicable

--.

Table 150, "

: Excellent
: good
Δ: practically applicable
X : practically not applicable

" should read

--

●: Excellent
○: good
Δ: practically applicable
X: practically not applicable

--.

COLUMN 117

Table 153A, "

| inter-ference fringe |
|---|
| ○ |
| ○ |
| ○ |
| ○ |
| ○ |

" should read --

| inter-ference fringe |
|---|
| ○ |
| ◉ |
| ◉ |
| ○ |
| ○ |

--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 118

Table 155, "initial charge-retentivity ⊙⊙⊙

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 123

Table 170, "ghost

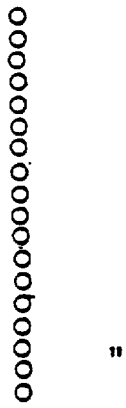

"

should read

--ghost

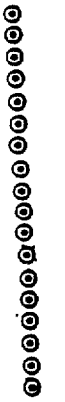

--.

Table 171, "ghost

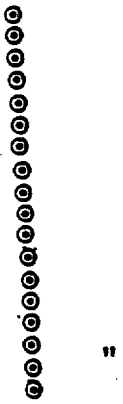

"

should read

--ghost

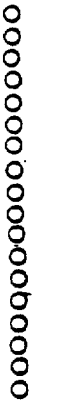

--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 126

Table 179, "residual potential" should read --residual potential--.

COLUMN 128

Table 184, "photo sensitivity" should read --photo-sensitivity--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 129

Table 186, "residual potential" should read --residual potential--.

Table 187, "TABLE 30" should read --Table 30--.

COLUMN 131

Table 190-continued, "ghost" should read --ghost--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 134

Table 198, "photo sensitivity" should read --photo-sensitivity--.

Table 199, "Drum No. 2501, 2502, 2503, 2504, 2505" should read --2501E, 2502E, 2503E, 2504E, 2505E--.

COLUMN 135

Table 200, "Drum No. 2511, 2512, 2513, 2514, 2515" should read --2511E, 2512E, 2513E, 2514E, 2515E--.

Table 200A, "2511, 2512, 2513, 2514, 2515" should read --2511E, 2512E, 1513E, 1514E, 1515E--.

COLUMN 136

Table 205, "photo sensitivity" should read --photo-sensitivity--.

COLUMN 137

Table 205-continued, "photo sensitivity" should read --photo-sensitivity--.

and "

: Excellent
Δ: practically applicable
: good
X: practically not applicable should read

--

●: Excellent
O: good
Δ: practically applicable
X : practically not applicable

"

--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 138

Table 206-continued,

" --

: Excellent
Δ: practically applicable
: good
X: practically not applicable should read ●: Excellent
○: good
Δ: practically applicable
X: practically not applicable

" --.

Table 207, " --

: Excellent
Δ: practically applicable
: good
X: practically not applicable should read ●: Excellent
○: good
Δ: practically applicable
X: practically not applicable

" --.

COLUMN 140

Table 212, "1001, 1002, 1003, 1004, 1005, 1006, 1007, 1008, 1009, 1010, 1011, 1012, 1013, 1014, 1015, 1016 1017" should read --1001F, 1002F, 1003F, 1004F, 1005F, 1006F, 1007F, 1008F, 1009F, 1010F, 1011F, 1012F, 1013F, 1014F, 1015F, 1016F, 1017F--.

Table 213A, "

| inter-ference fringe |
|---|
| ○ |
| ○ |
| ◎ |
| ◎ |
| ○ |

" should read --

| inter-ference fringe |
|---|
| ◎ |
| ○ |
| ◎ |
| ◎ |
| ○ |

--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 140

Table 215, "1201
1202"
should read
--1201F ◉ ○ ○ ○ ○ --.
1202F ◉ ○ ○ ○ ○

COLUMN 141, Table 215-continued,
"1203, 1204, 1205, 1206, 1207, 1208, 1209, 1210,
1211, 1212, 1213, 1214, 1215, 1216, 1217, 1218"
should read --1203F, 1204F, 1205F, 1206F, 1207F,
1208F, 1209F, 1210F, 1211F, 1212F, 1213F, 1214F,
1215F, 1216F, 1217F, 1218F--.

COLUMN 142

Table 220, "

| [illegible] charge-reservoir | |
|---|---|
| ◉ | ○ |
| ◉ | ○ |
| ◉ | ○ |

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 142

Table 220, " 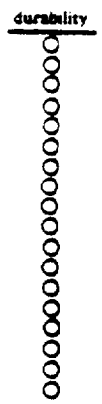 " should read -- 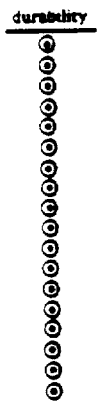 --.

COLUMN 144

Table 223-continued " 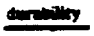 " should read -- 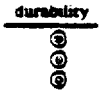 --.

Before Table 225, "X: practically not applicable" should be deleted.

COLUMN 145

Table 226, " 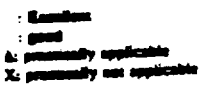 " should read -- 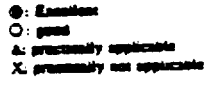 --.

Table 227, 1001, 1002, 1003" should read --1001G, 1002G, 1003G--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 146

Table 227-continued, "1004, 1005, 1006, 1007, 1008, 1009, 1010, 1011, 1012, 1013, 1014, 1015, 1015, 1017, 1018" should read --1004G, 1005G, 1006G, 1007G, 1008G, 1009G, 1010G, 1011G, 1012G, 1013G, 1014G, 1015G, 1016G, 1017G, 1018G--.

COLUMN 151

Table 239-continued, "

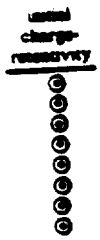

" should read --

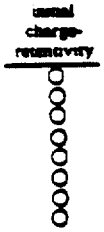

-- and "

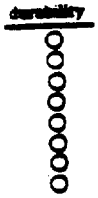

" should read --

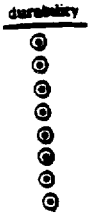

--.

UNITED STATES PATENT AND TRADEMARK OFFICE

CERTIFICATE OF CORRECTION

PATENT NO. : 4,954,397

DATED : September 4, 1990

INVENTOR(S) : HIROSHI AMADA ET AL.

It is certified that error appears in the above-identified patent and that said Letters Patent is hereby corrected as shown below:

COLUMN 151

Table 240, "2001, 2002, 2003, 2004, 2005, 2006, 2007, 2008, 2009. 2010, 2011, 2012, 2013, 2014, 2015, 2016, 2017" should read --2001G, 2002G, 2003G, 2004G, 2005G, 2006G, 2007G,2008G, 2009G, 2010G, 2011G, 2012G, 2013G, 2014G, 2015G, 2016G, 2017G --.

COLUMN 152

Line 66, "claim 1, the" should read --claim 1, wherein the--.

COLUMN 153

Line 31, "phosphorous" should read --phosphorus--.
Line 33, "claim 1" should read --claim 10--.

UNITED STATES PATENT AND TRADEMARK OFFICE

CERTIFICATE OF CORRECTION

PATENT NO. : 4,954,397
DATED : September 4, 1990
INVENTOR(S) : Hiroshi Amada, et al.

It is certified that error appears in the above-indentified patent and that said Letters Patent is hereby corrected as shown below:

COLUMN 154

Line 14, "material at" should read --material containing at--.

Signed and Sealed this

Thirtieth Day of May, 1995

Bruce Lehman

*Attest:*

BRUCE LEHMAN

*Attesting Officer*

*Commissioner of Patents and Trademarks*